US011952206B2

(12) United States Patent
Kendall et al.

(10) Patent No.: US 11,952,206 B2
(45) **Date of Patent: *Apr. 9, 2024**

(54) FOLDING CONTAINER

(71) Applicant: Compact Container Systems, LLC, Boca Raton, FL (US)

(72) Inventors: Norman Kendall, Jensen Beach, FL (US); Joshua J. Kraft, Tequesta, FL (US); Jay Cummings, Cincinnati, OH (US); Rich Reiter, Batavia, OH (US); John O'Brien, Jacksonville, FL (US)

(73) Assignee: Compact Container Systems, LLC, Boca Raton, FL (US)

( * ) Notice: Subject to any disclaimer, the term of this patent is extended or adjusted under 35 U.S.C. 154(b) by 91 days.

This patent is subject to a terminal disclaimer.

(21) Appl. No.: 17/443,224

(22) Filed: Jul. 22, 2021

(65) Prior Publication Data

US 2021/0347563 A1 Nov. 11, 2021

Related U.S. Application Data

(63) Continuation-in-part of application No. 16/740,321, filed on Jan. 10, 2020, now Pat. No. 11,192,713, (Continued)

(51) Int. Cl.

| | |
|---|---|
| ***B65D 88/52*** | (2006.01) |
| ***B65D 90/00*** | (2006.01) |
| ***B65D 90/02*** | (2019.01) |

(52) U.S. Cl.

CPC ..... *B65D 88/522* (2013.01); *B65D 90/008* (2013.01); *B65D 90/027* (2013.01)

(58) Field of Classification Search

CPC .... B65D 88/52; B65D 88/522; B65D 88/526; B65D 7/24; B65D 7/26; B65D 7/28; B65D 9/12; B65D 9/18

(Continued)

(56) References Cited

U.S. PATENT DOCUMENTS

| | | | |
|---|---|---|---|
| 570,272 | A | 10/1896 | Stevens |
| 3,403,806 | A | 10/1968 | Pohl |

(Continued)

FOREIGN PATENT DOCUMENTS

| | | | |
|---|---|---|---|
| CN | 101200238 | A | 6/2008 |
| CN | 201264785 | | 7/2009 |

(Continued)

OTHER PUBLICATIONS

Extended European Search Report, dated Oct. 21, 2016, 7 pages, issued in European Application No. 14773808.2.

(Continued)

*Primary Examiner* — Jeffrey R Allen

(74) *Attorney, Agent, or Firm* — AVEK IP, LLC

(57) ABSTRACT

A foldable container adjustable between an unfolded condition and a folded condition comprises a roof panel and an opposing base panel, a front panel and an opposing door panel which are each hingedly connected to solely the roof panel, a right side panel and an opposing left side panel, a right side roof skirt and an opposing left side roof skirt having disparate heights, a left side compound beam and a right side compound beam extending from the base panel, and a left side hinge-beam structure and a right side hinge-beam structure each having a hinge point and a skirt retaining portion. The right side panel and the left side panel are hingedly coupled to their respective hinge-beam structures at the hinge points. The hinge points lie in different horizontal planes. The hinge points lie within a midline of their respective side panel.

19 Claims, 141 Drawing Sheets

Related U.S. Application Data which is a continuation-in-part of application No. 16/245,739, filed on Jan. 11, 2019, now Pat. No. 10,882,689, which is a continuation-in-part of application No. 15/694,775, filed on Sep. 2, 2017, now Pat. No. 11,046,507, which is a continuation-in-part of application No. 13/815,638, filed on Mar. 13, 2013, now Pat. No. 9,751,688.

(58) Field of Classification Search
USPC ..... 220/1.5, 6, 7, 4.28, 4.29
See application file for complete search history.

(56) References Cited

U.S. PATENT DOCUMENTS

| | | | | |
|---|---|---|---|---|
| 3,612,330 | A | 10/1971 | Baer | |
| 3,752,332 | A | 8/1973 | Theurer | |
| 3,866,365 | A | 2/1975 | Honigman | |
| 4,099,640 | A | 7/1978 | Nessfield et al. | |
| 4,177,907 | A | 12/1979 | Funaioli et al. | |
| 4,240,359 | A | 12/1980 | Howe | |
| 4,726,486 | A | 2/1988 | Masuda | |
| 5,275,301 | A | 1/1994 | Clive-Smith | |
| 5,732,839 | A | 3/1998 | Schimmang et al. | |
| 6,866,160 | B2 | 3/2005 | Wang et al. | |
| 7,874,107 | B1 | 1/2011 | Medley et al. | |
| 7,931,164 | B2 | 4/2011 | Krohn | |
| 7,984,819 | B1 | 7/2011 | Davis | |
| 9,751,688 | B2 | 9/2017 | Churbuck et al. | |
| 10,882,689 | B2 | 1/2021 | Kendall et al. | |
| 11,046,507 | B2 | 6/2021 | Kendall et al. | |
| 2006/0043090 | A1 | 3/2006 | Ferrini | |
| 2007/0163474 | A1 | 7/2007 | Truksa | |
| 2008/0029510 | A1 | 2/2008 | Fisk | |
| 2008/0135545 | A1 | 6/2008 | Sadkin et al. | |
| 2010/0025397 | A1* | 2/2010 | Krohn | B65D 88/522 220/6 |
| 2010/0025398 | A1 | 2/2010 | Krohn | |
| 2010/0102056 | A1 | 4/2010 | Bellehumeur et al. | |
| 2012/0006816 | A1 | 1/2012 | Turnquist | |
| 2012/0048846 | A1 | 3/2012 | Choi | |
| 2012/0248105 | A1 | 10/2012 | Leong | |
| 2012/0318811 | A1 | 12/2012 | Leasure | |
| 2013/0020316 | A1 | 1/2013 | Hong | |
| 2013/0180981 | A1 | 7/2013 | Meijers et al. | |
| 2014/0144907 | A1 | 5/2014 | Giesbers et al. | |
| 2014/0144920 | A1 | 5/2014 | Meijers et al. | |
| 2014/0183186 | A1 | 7/2014 | Buskermolen et al. | |
| 2014/0299596 | A1 | 10/2014 | Kochanowski | |
| 2020/0148464 | A1 | 5/2020 | Kendall et al. | |

FOREIGN PATENT DOCUMENTS

| | | | |
|---|---|---|---|
| CN | 103204330 | A | 7/2013 |
| CN | 103619732 | A | 3/2014 |
| CN | 203473630 | U | 3/2014 |
| DE | 8611553 | U1 | 6/1986 |
| DE | 102013100260 | A1 | 7/2013 |
| GB | 2160851 | A | 1/1986 |
| NL | 2007607 | C2 | 4/2012 |
| NL | 2009992 | A | 7/2013 |
| WO | 0140064 | A1 | 6/2001 |
| WO | 2006020927 | A1 | 2/2006 |
| WO | 2012057616 | A1 | 5/2012 |
| WO | 2012154036 | A1 | 11/2012 |

OTHER PUBLICATIONS

Final Office Action, dated Sep. 6, 2017, 27 pages, issued in U.S. Appl. No. 14/490,992.

First Office Action, dated Nov. 2, 2015, 18 pages, issued in Chinese Application No. 201480001507.7.

International Search Report and Written Opinion, dated Apr. 15, 2015, 11 pages, issued in PCT Application No. PCT/US2014/062001.

International Search Report and Written Opinion, dated Feb. 6, 2015, 10 pages, issued in PCT Application No. PCT/US2014/062092.

International Search Report and Written Opinion, dated Mar. 10, 2020, 7 pages, issued in PCT Application No. PCT/US2020/013208.

International Search Report with Written Opinion, dated Jul. 18, 2014, 11 pages, issued in PCT Application No. PCT/US2014/026191.

Non-Final Office Action, dated Sep. 2, 2020, 7 pages, issued in U.S. Appl. No. 15/694,775.

Notice of Allowance, dated Aug. 31, 2021, 5 pages, issued in U.S. Appl. No. 16/740,321.

Notice of Allowance, dated Dec. 10, 2020, 7 pages, issued in U.S. Appl. No. 15/694,775.

Notice of Allowance, dated Sep. 23, 2020, 8 pages, issued in U.S. Appl. No. 16/245,739.

Notice of Allowanced, dated Nov. 22, 2017, 15 pages, issued in U.S. Appl. No. 14/490,992.

Notice of Grant dated Jan. 2, 2016, 2 pages, issued in Chinese Application No. 201520430322.

Office Action, dated Feb. 1, 2016, 33 pages, issued in U.S. Appl. No. 14/490,992.

Office Action, dated Jun. 29, 2017, 4 pages, issued in European Application No. 14773808.2.

Office Action, dated Nov. 7, 2016, 4 pages, issued in Chinese Application No. 201480001507.7.

U.S. Appl. No. 14/490,992, filed Sep. 19, 2014, 187 pages.

U.S. Appl. No. 14/581,383, filed Dec. 23, 2014, 181 pages.

U.S. Appl. No. 14/587,074, filed Dec. 31, 2014, 186 pages.

U.S. Appl. No. 62/052,614, filed Sep. 19, 2014, 35 pages.

* cited by examiner

FOLDING CONTAINER

CROSS REFERENCE TO RELATED APPLICATIONS

This application is a continuation-in-part of U.S. patent application Ser. No. 16/740,321, filed Jan. 10, 2020, which is a continuation-in-part of U.S. patent application Ser. No. 16/245,739, filed Jan. 11, 2019, now U.S. Pat. No. 10,882,689, which is a continuation-in-part of U.S. patent application Ser. No. 15/694,775, filed Sep. 2, 2017, now U.S. Pat. No. 11,046,507, which is a continuation-in-part of U.S. patent application Ser. No. 13/815,638, filed Mar. 13, 2013, now U.S. Pat. No. 9,751,688. The disclosure of each of these Applications is incorporated by reference herein in its entirety.

FIELD OF THE DISCLOSURE

This disclosure relates to enclosed, general purpose cargo containers, and more specifically, to an improved foldable cargo container.

BACKGROUND

The shipping industry uses large cargo containers to ship cargo from one location to another in domestic and global commerce. Such containers are designed to be conveniently moved from one mode of transport to another across the land by road or on rail or over the sea. Such containers are sometimes referred to as "intermodal shipping containers". The use of such containers has essentially eliminated the need for manually transferring cargo from one vessel to another, or from one vehicle or railcar to another in the effort to deliver the cargo to its final destination.

Today, cargo containers are generally standardized by internationally recognized standards, and by national domestic standards with respect to dimensions and structure. Thus, the standard containers can be securely arranged in vertical stacks in side-by-side and end-to-end relationship with each other, and can be handled most effectively when transferring from one mode of transport to another.

Often, these containers must be transported empty from one delivery point to the next location where cargo is available for shipment. Transport of empty containers costs the shipper money and erodes profits since transport of each such container incurs handling cost and occupies valuable space which could otherwise be used to ship a revenue producing container loaded with cargo. Additionally, the shipping of both loaded and empty containers creates problems such as how to arrange the lighter, empty containers and the heavier, loaded containers aboard ships in such a manner that the safety of the ships is not compromised. Beyond safety issues, the shipment of empty containers causes monetary losses for shippers, losses which result in either substantial financial impact on the shipper, or increased charges to customers for the handling and transport of loaded containers. Similar cost disadvantages apply when shipping empty containers over road or by rail.

Long ago shippers recognized that significant economic savings in shipping could be realized if empty containers could be "folded" so as to occupy a substantially smaller space, so that less space need be sacrificed in the transporting of empty containers. Such an effort presently exists only for the "open frame" or flat rack type containers. To that end, the prior art proposed many foldable or nesting cargo containers of the enclosed types intended to reduce the space required for their shipment when empty. While such prior art foldable containers have been proposed, the market has not embraced the prior art containers as a substitute for the standard, non-foldable cargo containers.

One common shortcoming in most foldable container designs is that structural features are incorporated in them which render the designs nearly incompatible for use in combination with existing, standard cargo containers. Accordingly, if these cargo containers were to become a part of the norm, they could not be used with existing standard containers, making the cost of implementation of these designs impractical, if not prohibitive.

Another shortcoming of foldable containers of the prior art is the lack of structural designs which enable or facilitate the folding and un-folding of such containers in a simple and effective manner with commonly available equipment.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

An embodiment of a foldable container, which is adjustable between an unfolded condition and a folded condition, comprises a roof panel and an opposing base panel. The foldable container also comprises a front panel and an opposing door panel which are each hingedly connected to solely the roof panel. The foldable container also comprises a left side compound beam and a right side compound beam, each of which extend from the base panel. The foldable container further comprises a left side hinge-beam structure extending from the left side compound beam. The left side hinge-beam structure has a left side hinge point and a first skirt retaining portion. The foldable container further comprises a right side hinge-beam structure extending from the right side compound beam. The right side hinge-beam structure has a right side hinge point and a second skirt retaining portion. The foldable container also comprises a right side panel and an opposing left side panel. The right side panel is hingedly coupled to the right side hinge-beam structure at the right side hinge point, and the left side panel is hingedly coupled to the left side hinge-beam structure at the left side hinge point. The foldable container also comprises a right side roof skirt associated with the right side panel and an opposing left side roof skirt associated with the left side panel. A height of the right side roof skirt is disparate from a height of the left side roof skirt. The right side hinge point and the left side hinge point lie in different horizontal planes. The right side hinge point lies within a midline of the right side panel. The left side hinge point lies within a midline of the left side panel.

Another embodiment of a foldable container, which is adjustable between an unfolded condition and a folded condition, comprises a roof panel and an opposing base panel. The foldable container also comprises a front panel and an opposing door panel which are each hingedly connected to solely the roof panel. The foldable container also comprises a first side panel which is offset from an opposing second side panel by a vertical distance. The foldable container further comprises a first skirt retaining portion situated outwardly adjacent the first side panel, and a second skirt retaining portion situated outwardly adjacent the second side panel. The foldable container further comprises a first roof skirt associated with a top of the first side panel and an opposing second roof skirt associated with a top of the second side panel. The first roof skirt and the second roof skirt have a height difference. The foldable container also comprises a set of tracks situated on the first side panel. In the folded condition, the second side panel is situated upwardly adjacent the base panel, the first side panel is situated upwardly adjacent the second side panel, a group comprising the front panel and the door panel is upwardly adjacent the first panel, and the roof panel is upwardly adjacent the group. The first roof skirt is received within the first skirt retaining portion, and the second roof skirt is received within the second skirt retaining portion. The vertical distance equals the height difference.

In another embodiment, a method of converting a folding container from an unfolded condition to a folded condition is disclosed. The folding container comprises a roof panel, a base panel opposing the roof panel, a front panel, a door panel opposing the front panel, a first side panel, a second side panel opposing the first side panel, a first roof skirt associated with a top of the first side panel, a second roof skirt associated with a top of the second side panel and opposing the first roof skirt, and a set of tracks situated on the first side panel. Each of the front panel and the door panel are hingedly connected to solely the roof panel. Each of the first side panel and the second panel have a plurality of side wall locking latches. The foldable container further comprises a first skirt retaining portion situated outwardly adjacent the first side panel, and a second skirt retaining portion situated outwardly adjacent the second side panel, the method comprising. The method comprises the steps of: unlocking each of the plurality of side wall latches from the roof panel; lifting the roof panel from the first side panel and the second side panel; folding the first side panel and the second side panel towards the base panel; folding the door panel and the front panel towards the roof panel; lowering the roof panel, the door panel, and the front panel towards the base panel; slotting the first roof skirt in the first skirt retaining portion and the second roof skirt in the second skirt retaining portion; and locking the roof panel to the base panel.

BRIEF DESCRIPTION OF THE SEVERAL VIEWS OF THE DRAWINGS

Illustrative embodiments of the present disclosure are described in detail below with reference to the attached drawing figures and wherein:

FIG. 123 is a perspective view of an alternate embodiment of the collapsible container of FIG. 1.

FIG. 124 is a detailed perspective view of a portion of the container of FIG. 123.

FIG. 125 is a detailed perspective of a portion of a spring mechanism in accordance with the embodiment of the present disclosure in FIG. 124.

FIG. 126 is an elevation view of the spring mechanism of FIG. 124.

FIG. 127A is a cross section view of the spring mechanism of FIG. 125 in a compressed state.

FIG. 127B is a cross section view of the spring mechanism of FIG. 125 in an uncompressed state.

FIG. 128 is a cross section view of a container incorporating a damper mechanism.

FIG. 129 is an elevation view of a damper mechanism for use with a folding container.

FIG. 130 is a perspective view of yet another embodiment of the collapsible container of FIG. 1.

FIG. 131 is a detail view of a right side damper assembly of the collapsible container of FIG. 130.

FIG. 132 is a side view of a damper chain of the right side damper assembly of FIG. 131.

FIG. 133 is a detail view of a left side damper assembly of the collapsible container of FIG. 130.

Figure 133:
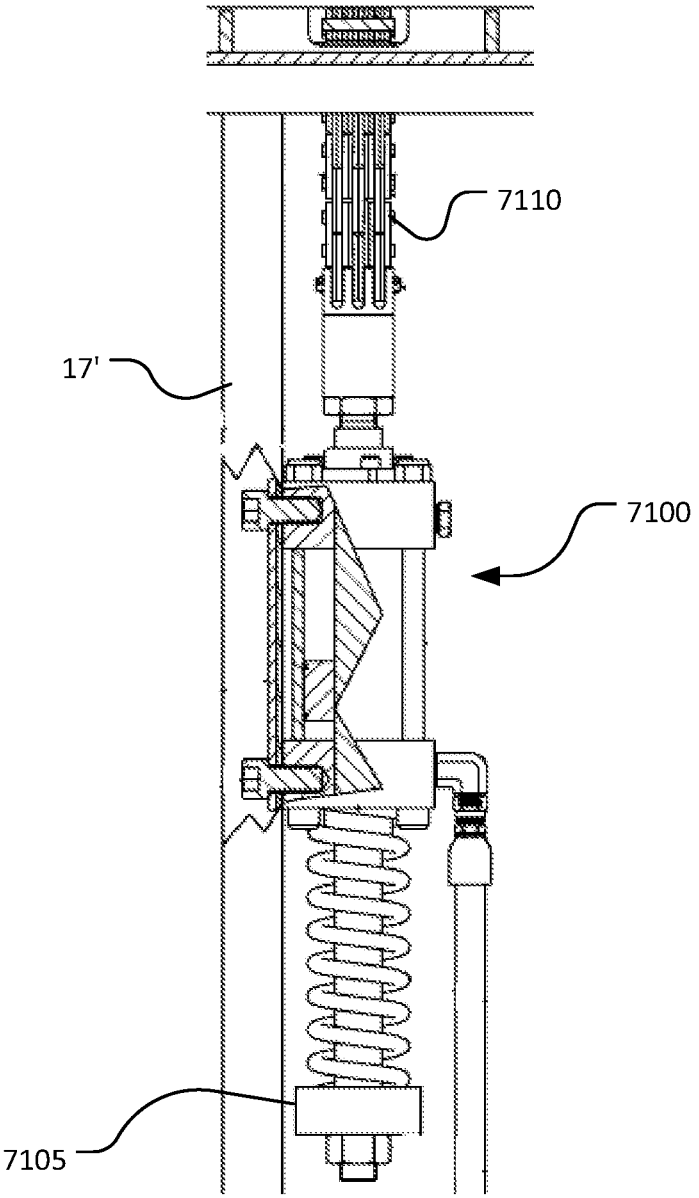
Figure 134:
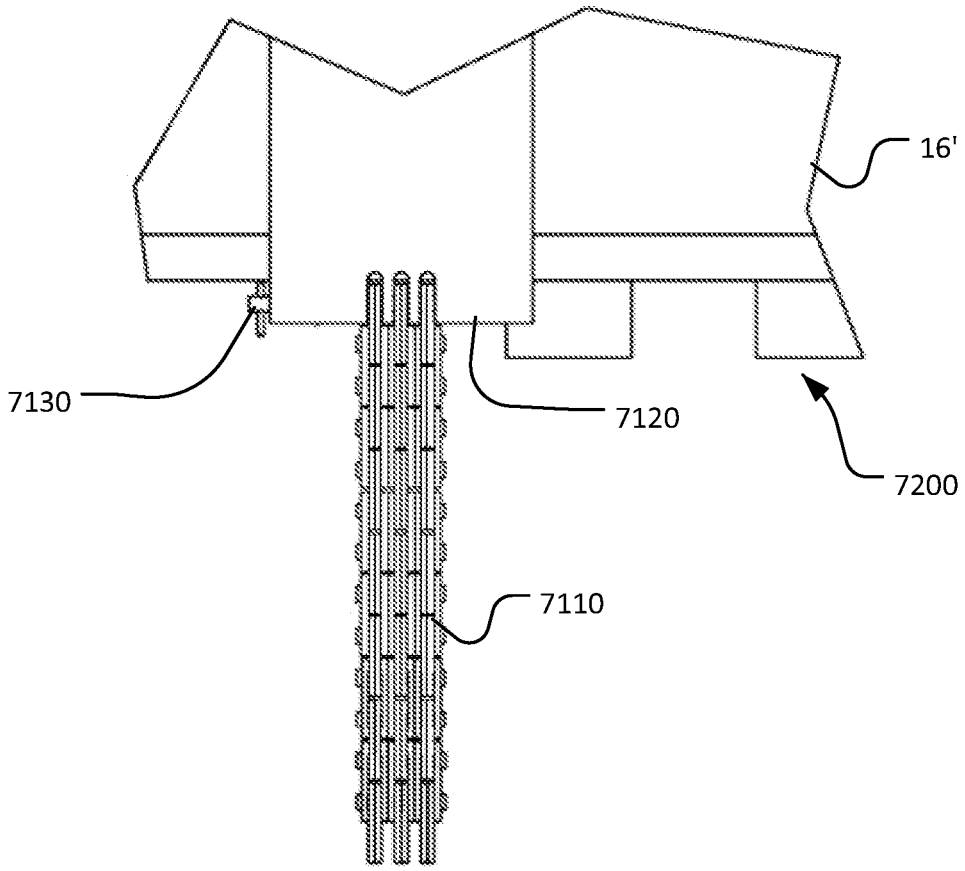

FIG. 134 is a side view of a damper chain of the left side damper assembly of FIG. 133.

Figure 130:
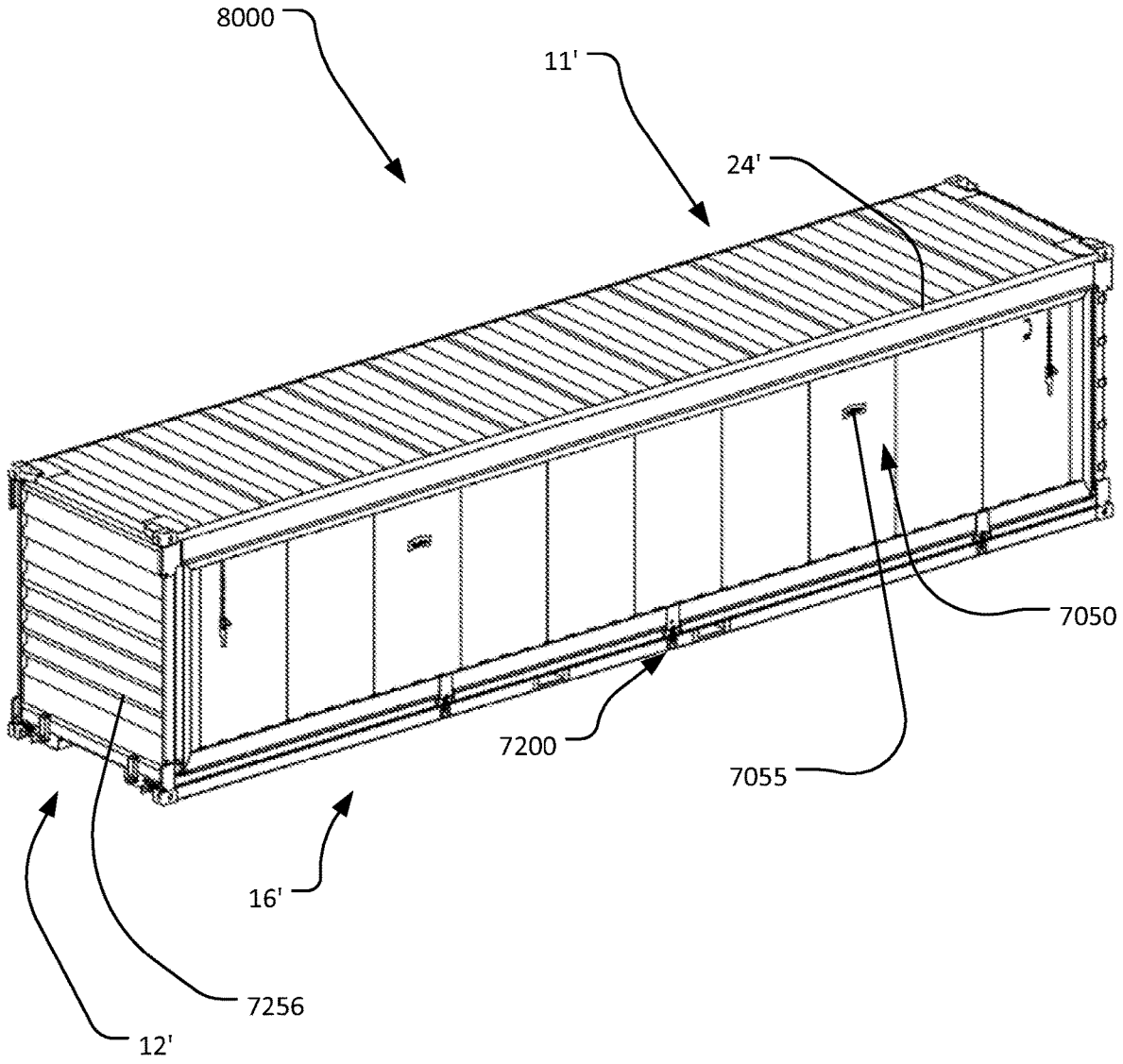
Figure 131:
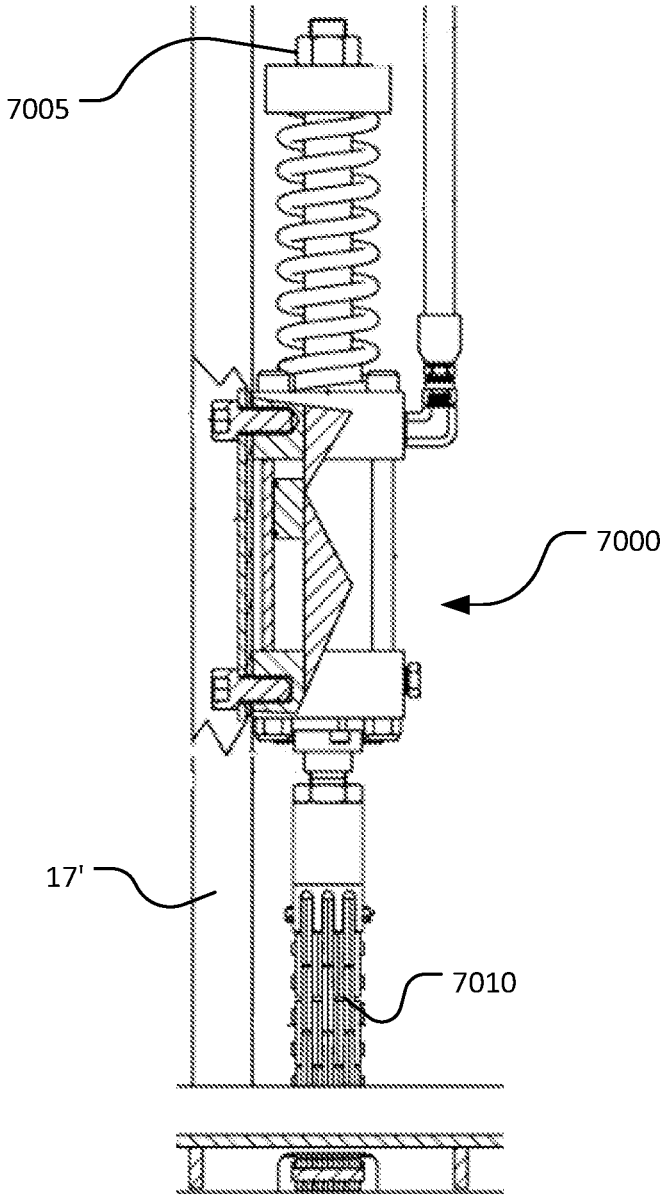
Figure 135:
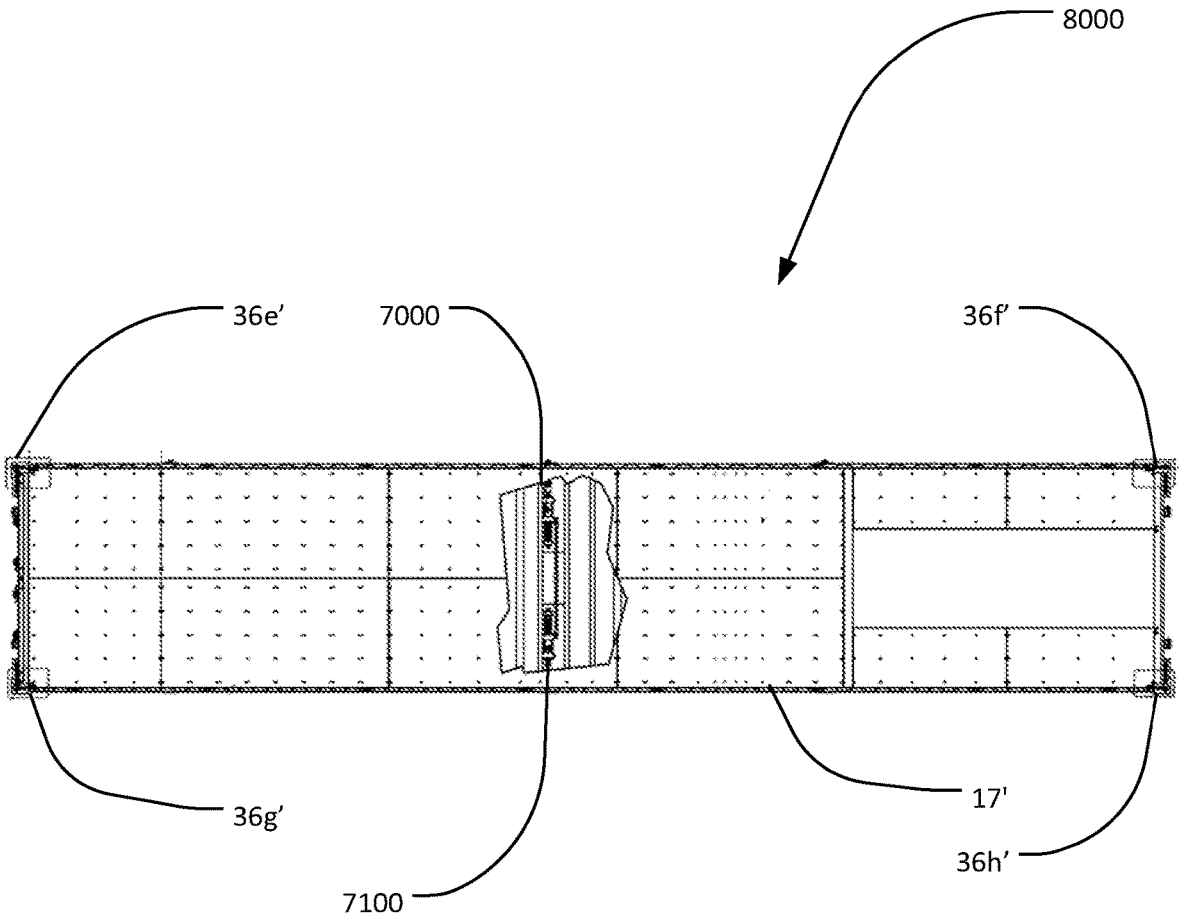

FIG. 135 is a bottom view of a base assembly of the collapsible container of FIG. 130 with a portion thereof cutout for illustration.

Figure 136:
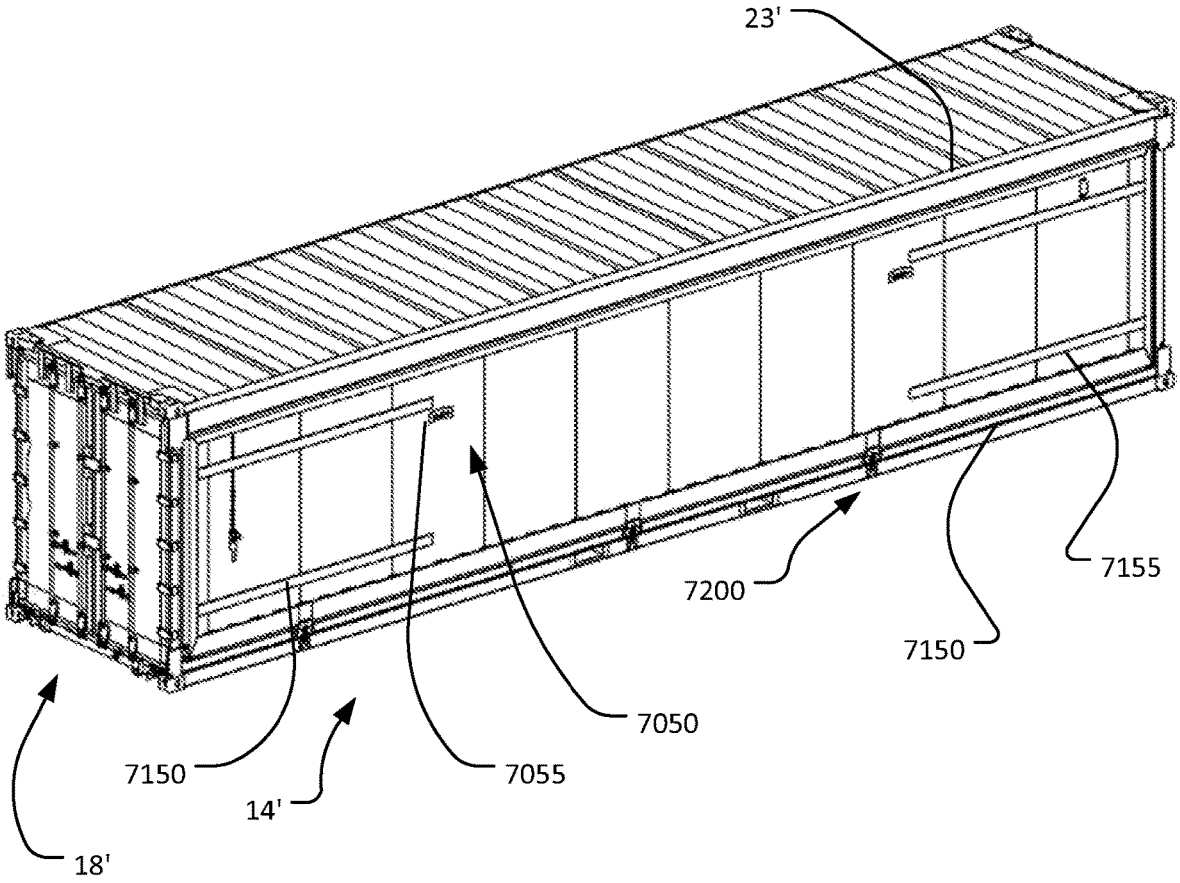

FIG. 136 is another perspective view of the collapsible container of FIG. 130.

Figure 137:
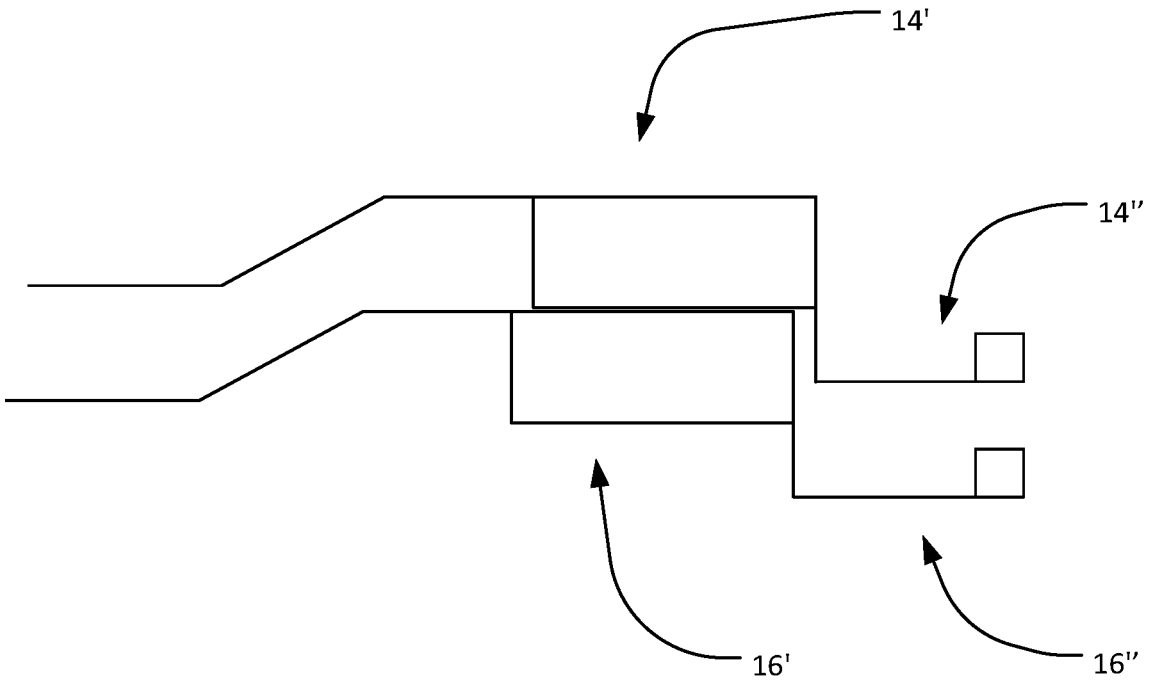

FIG. 137 is a schematic view of side panels of the collapsible container of FIG. 130, in a folded state.

Figure 138:
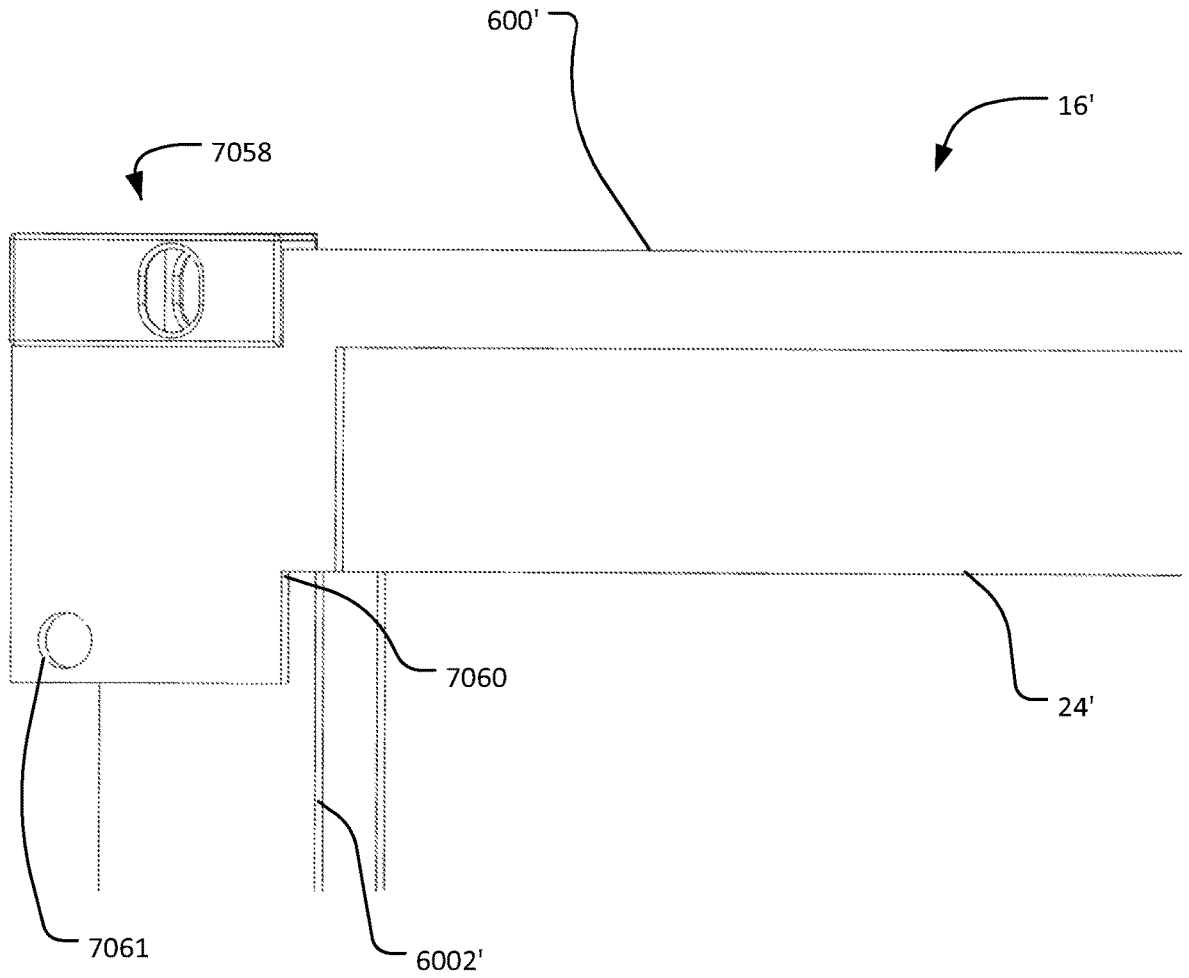

FIG. 138 is a perspective view of a vertical skirt plate of the collapsible container of FIG. 130.

Figure 139:
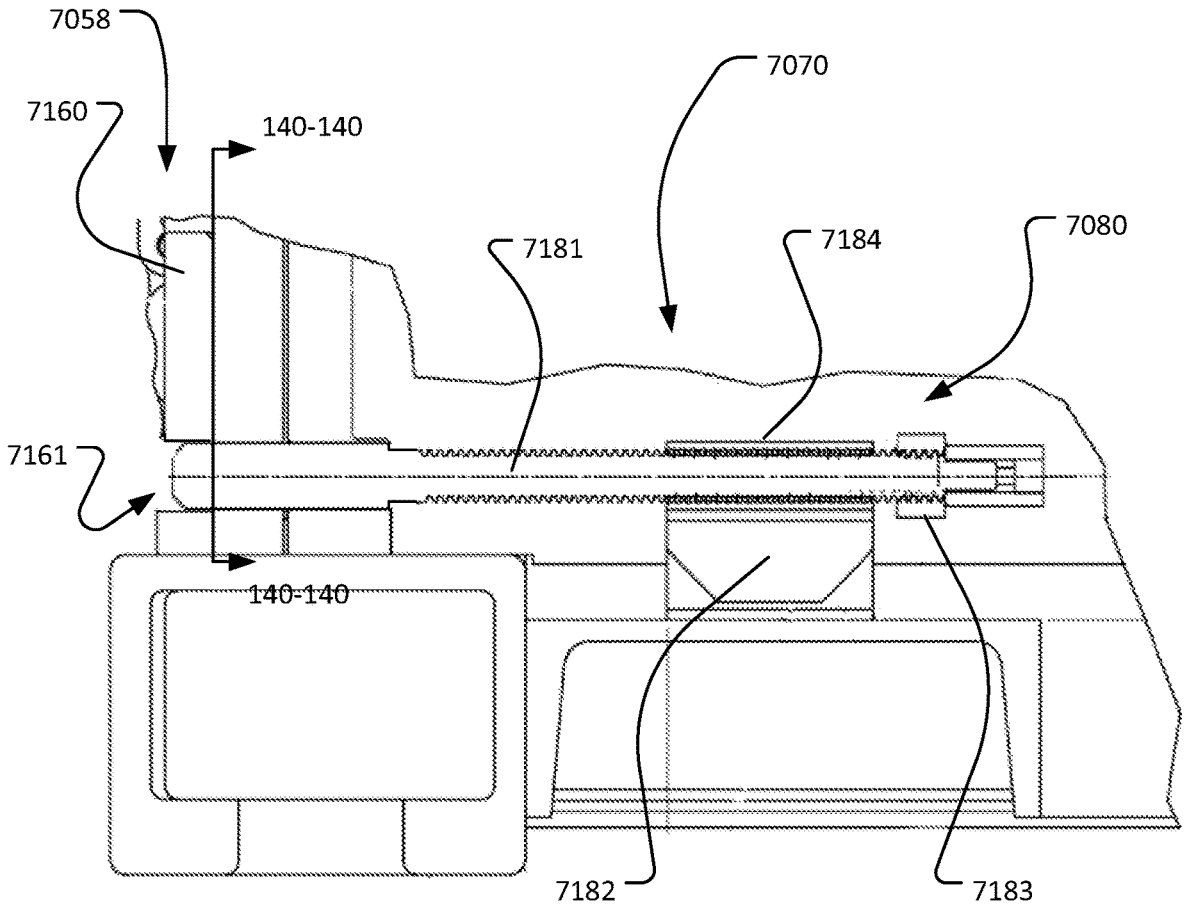

FIG. 139 is a cross sectional view of a ratcheting system of the collapsible container of FIG. 130.

Figure 140:
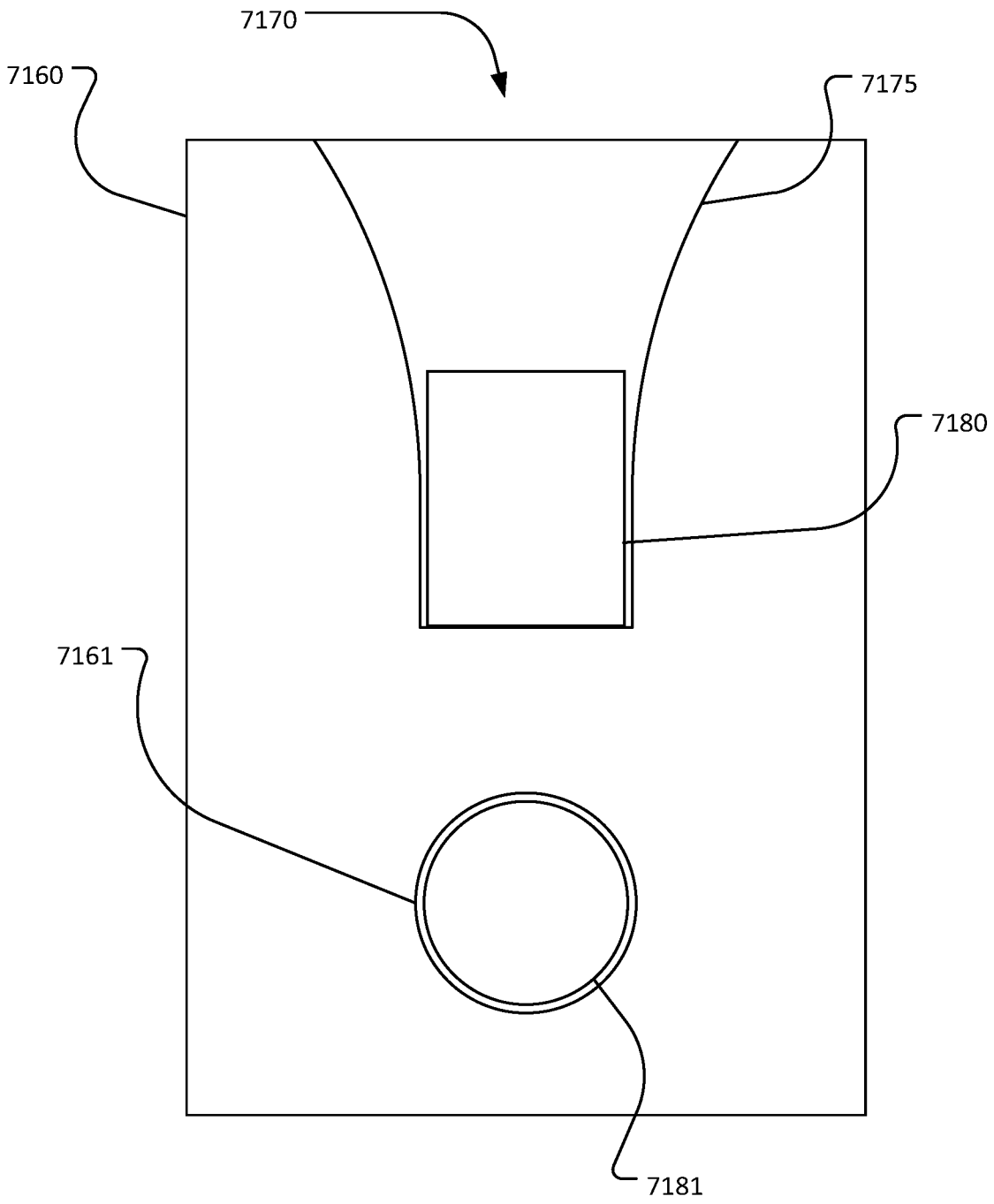

FIG. 140 is a cross sectional view taken along line 140-140 of FIG. 139.

Figure 141:
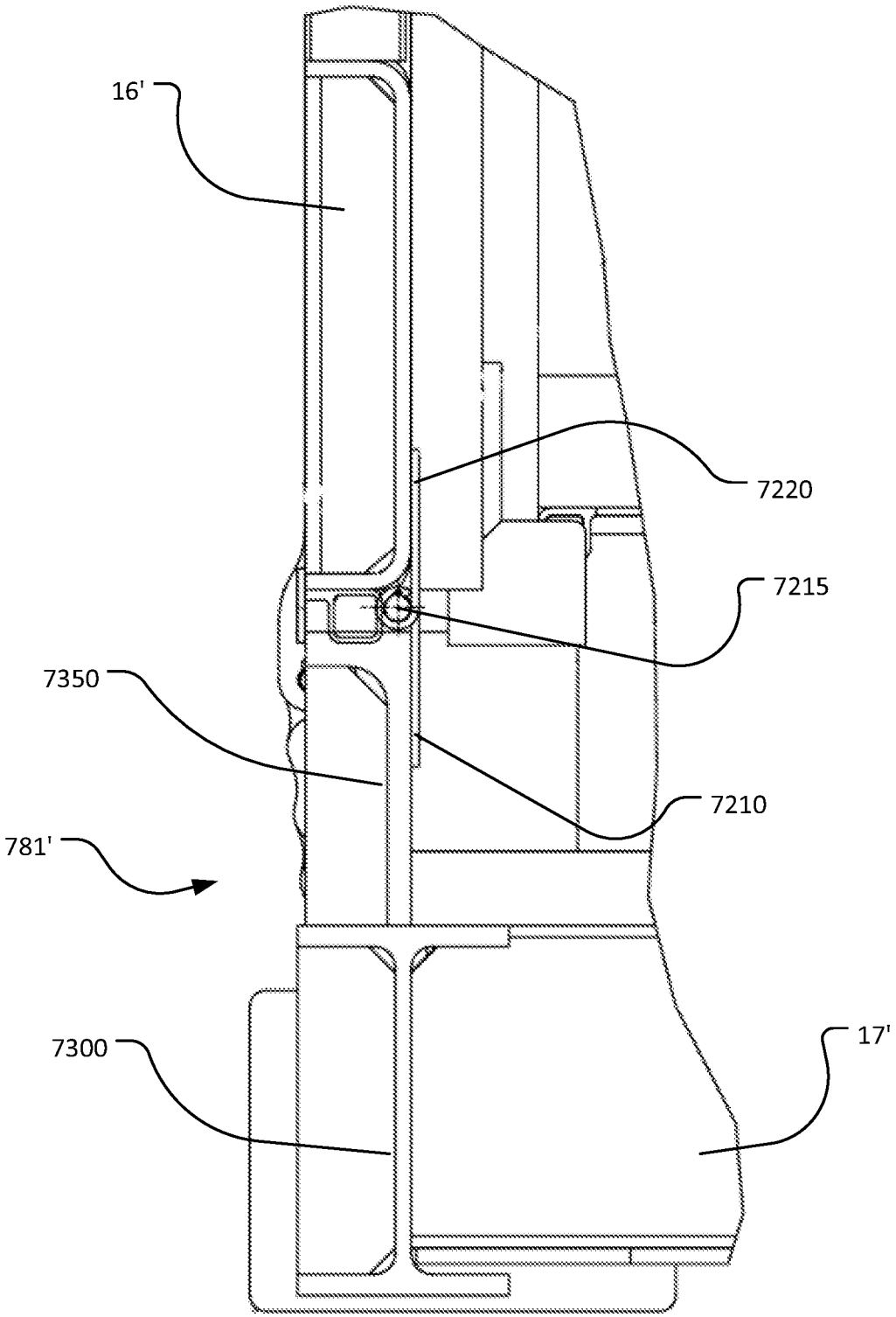

FIG. 141 is a cross sectional view of a multi butt hinge system along a left side of the collapsible container of FIG. 130.

Figure 142:
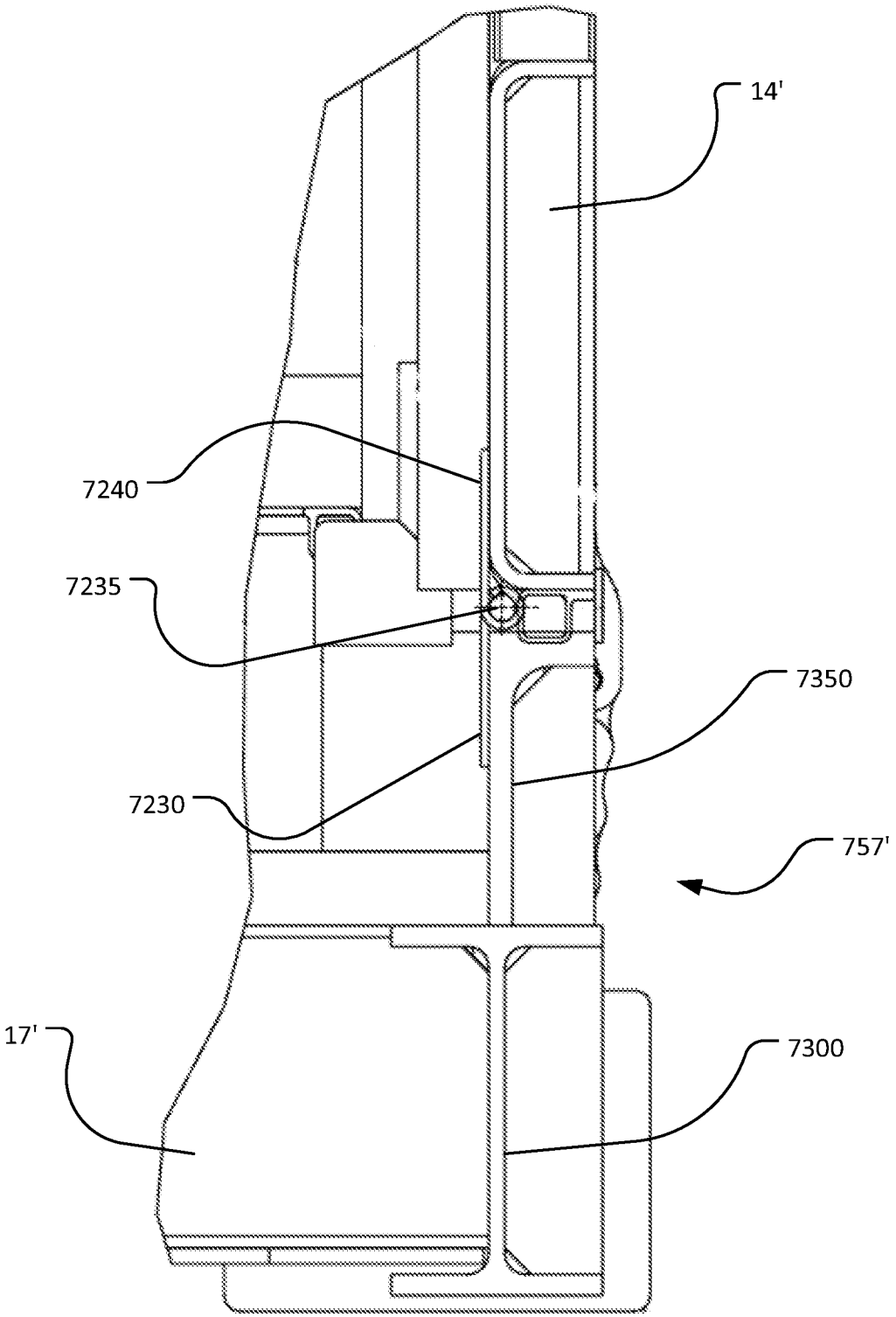

FIG. 142 is a cross sectional view of a multi butt hinge system along a right side of the collapsible container of FIG. 130.

Figure 143:
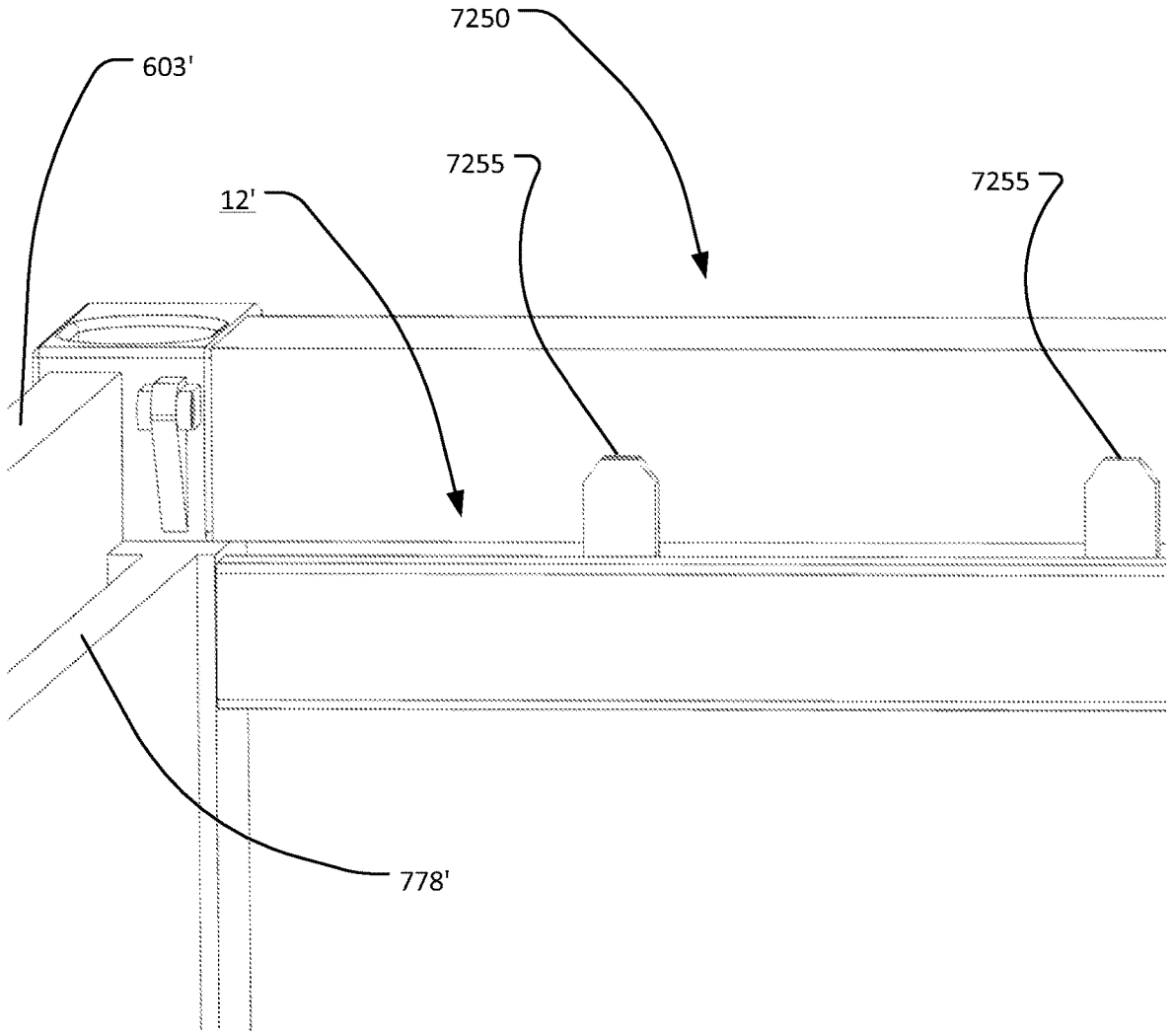

FIG. 143 is an internal perspective view of certain anti-racking features of the collapsible container of FIG. 130.

Figure 144:
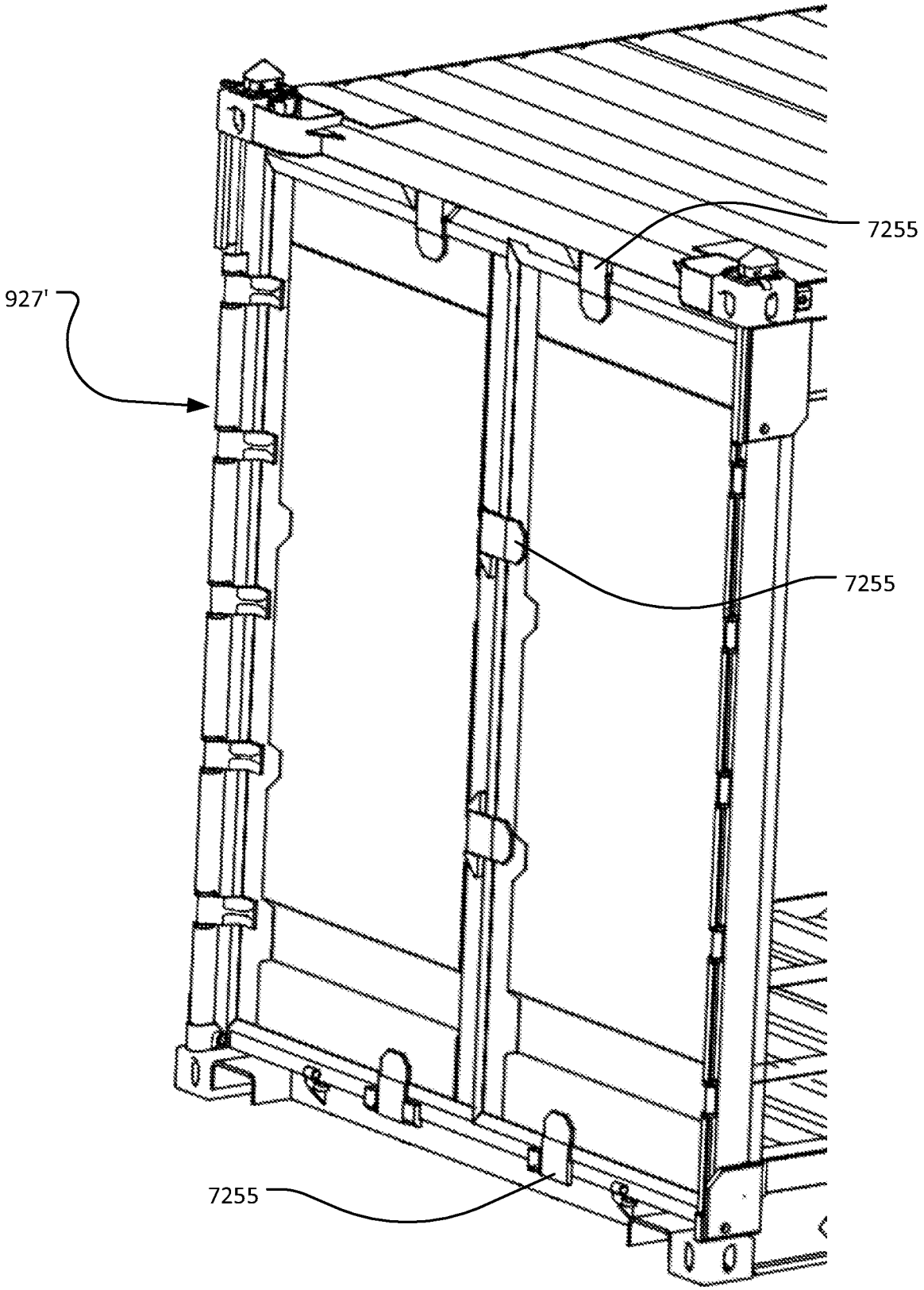

FIG. 144 is another internal perspective view of certain anti-racking features of the collapsible container of FIG. 130.

Figure 145B:
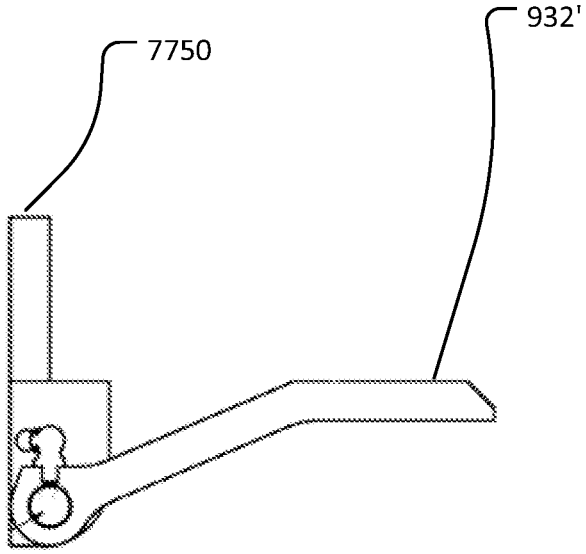
Figure 145A:
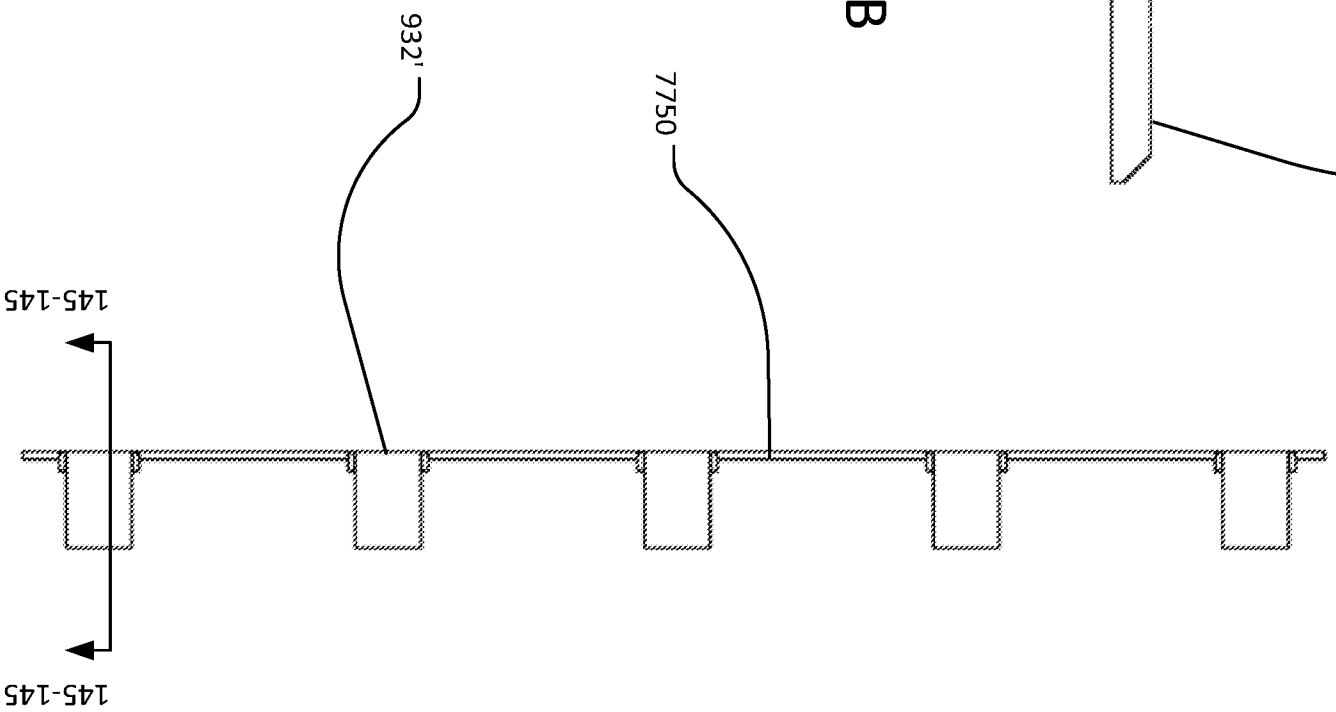

FIG. 145A is a side view of a door hinge bar of the collapsible container of FIG. 130.

FIG. 145B is a cross sectional view taken along line 145-145 of FIG. 145A.

Figure 146:
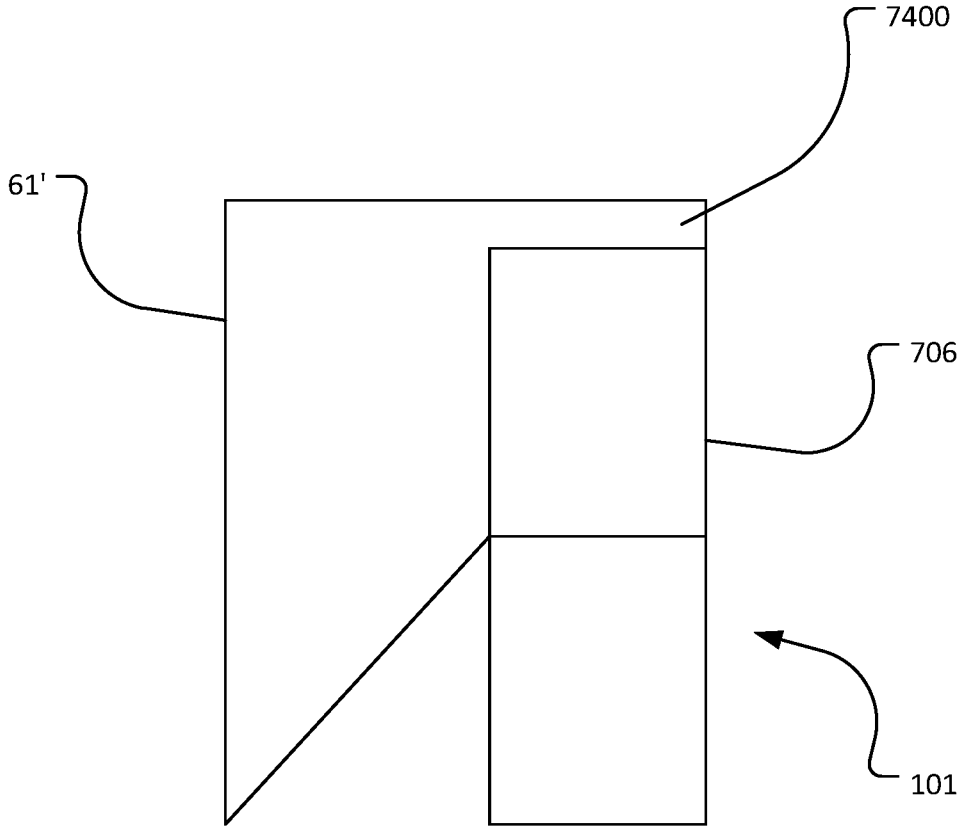

FIG. 146 is a schematic view of a sill plate with an inverted channel of the collapsible container of FIG. 130.

Figure 147:
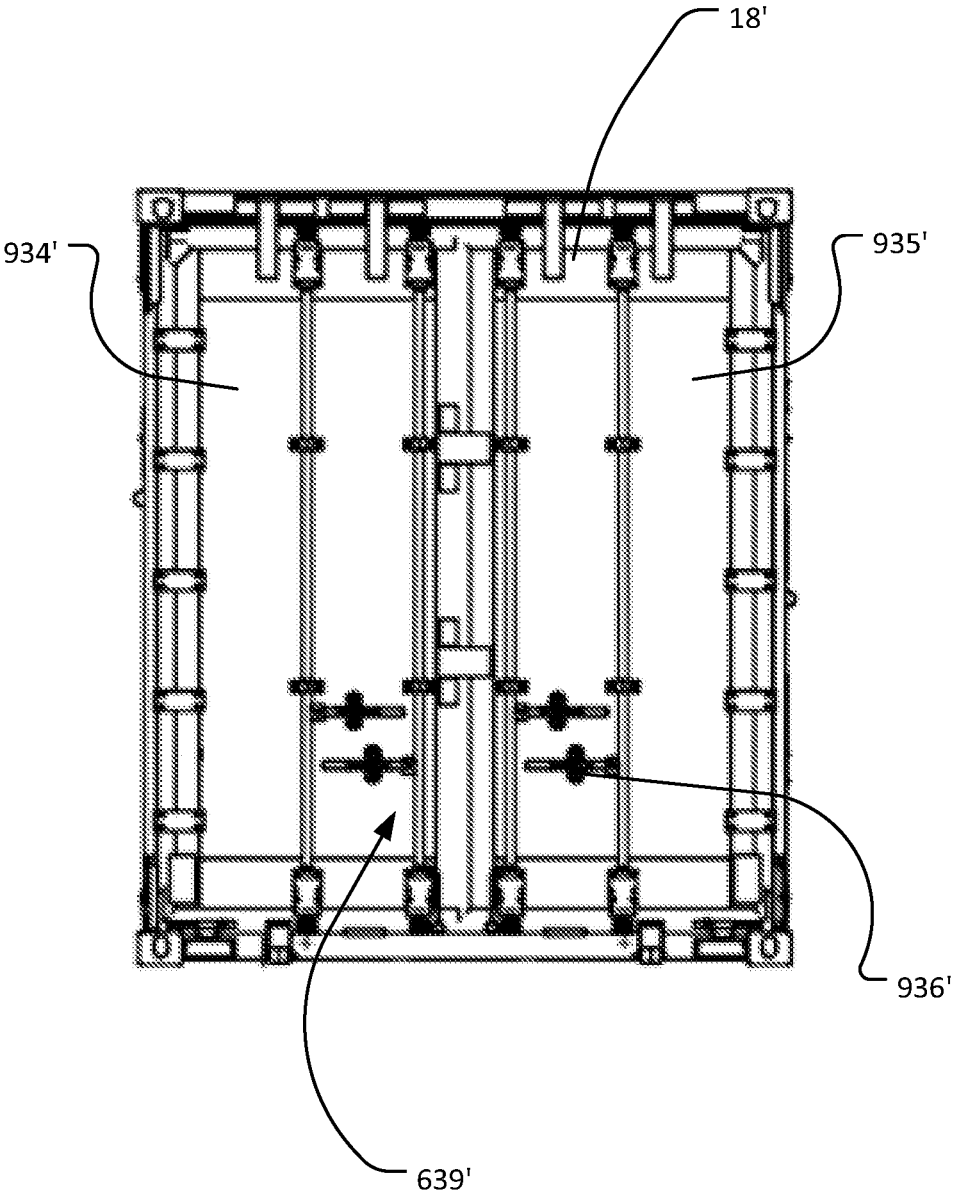

FIG. 147 is a plan view of a configuration of a door latch assembly of the collapsible container of FIG. 130.

Figure 148:
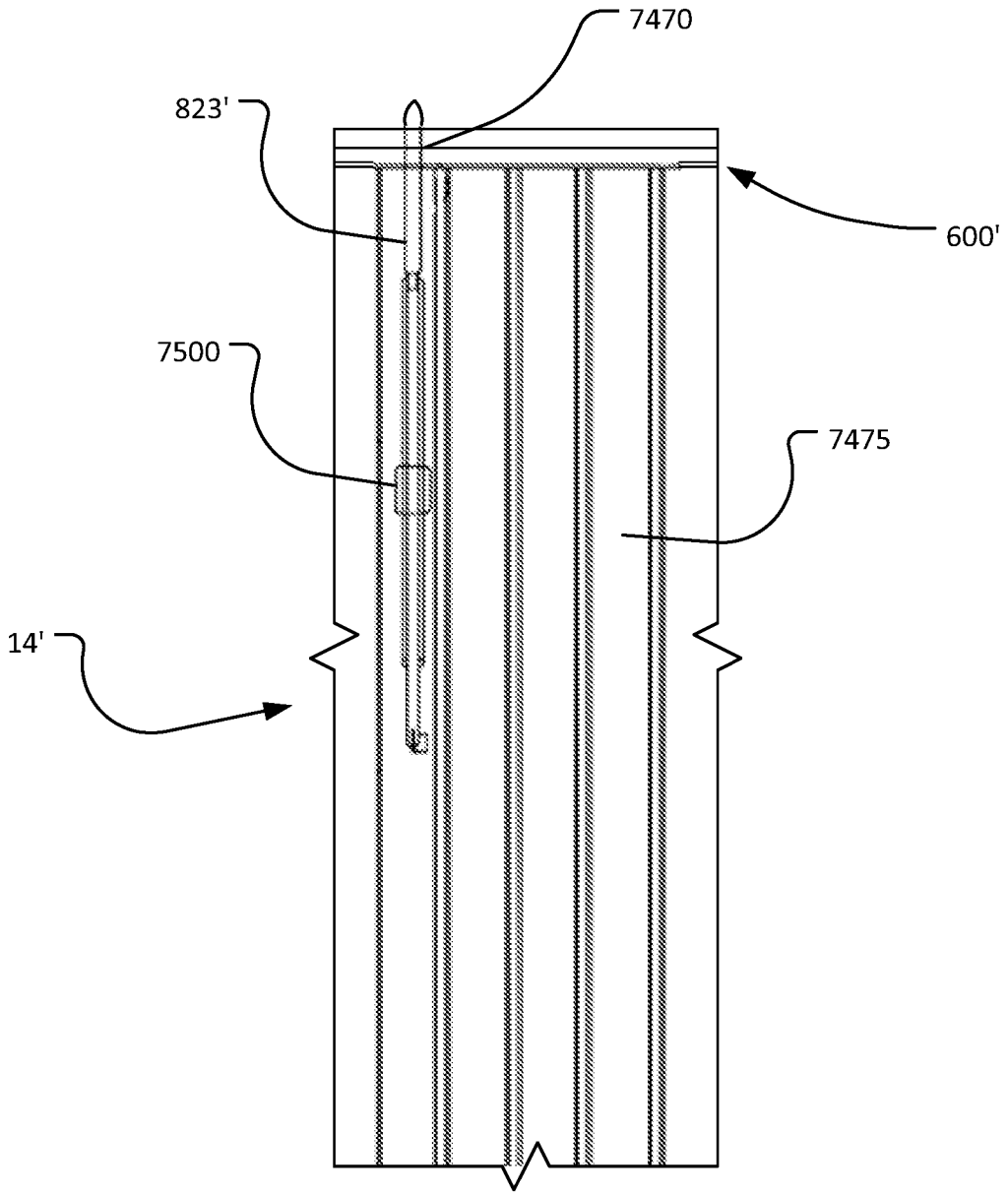

FIG. 148 is an internal view of an interior locking bolt assembly of the collapsible container of FIG. 130.

Figure 149:
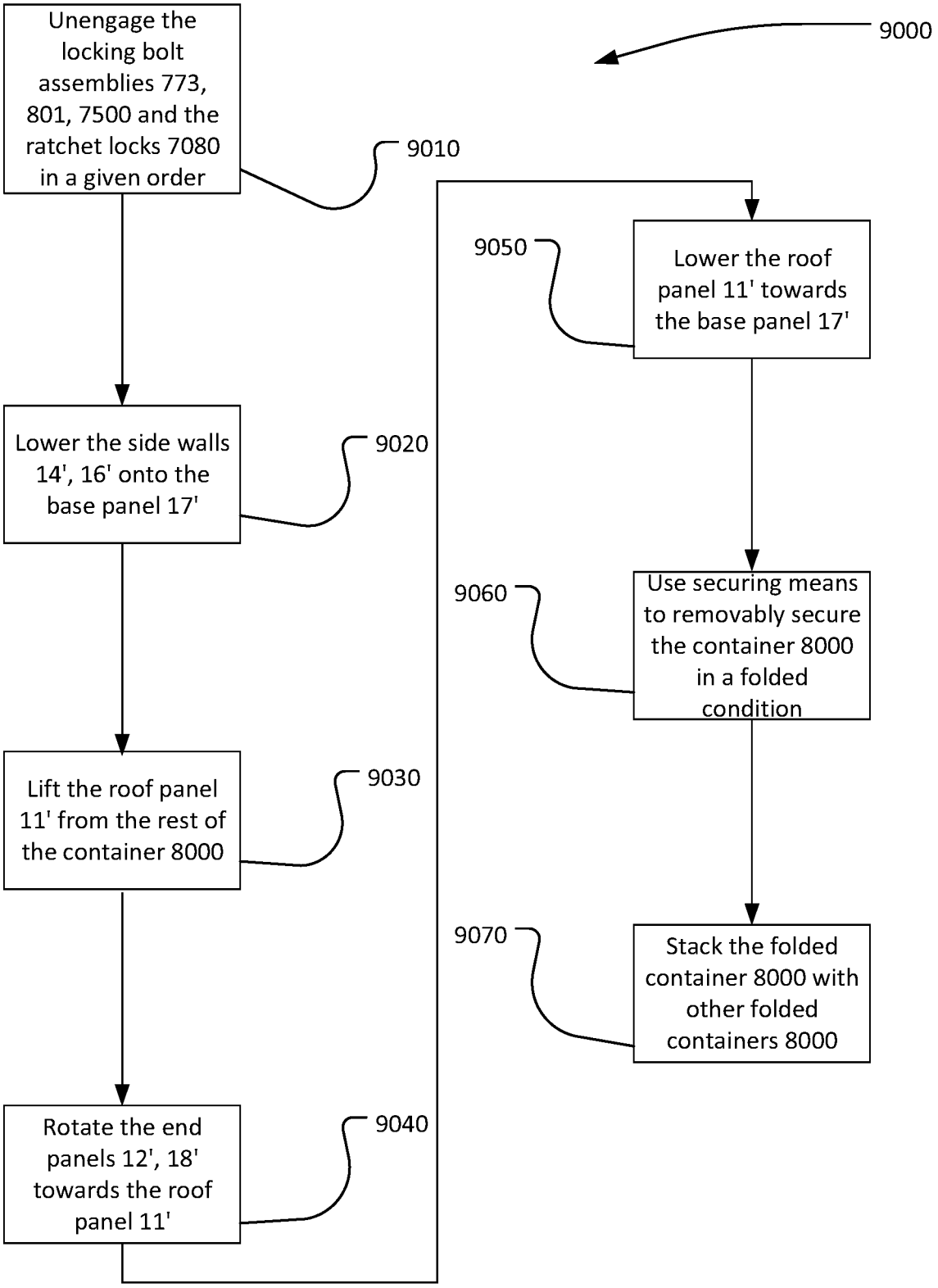

FIG. 149 is a flowchart depicting a method of folding the collapsible container of FIG. 130.

Figure 1:
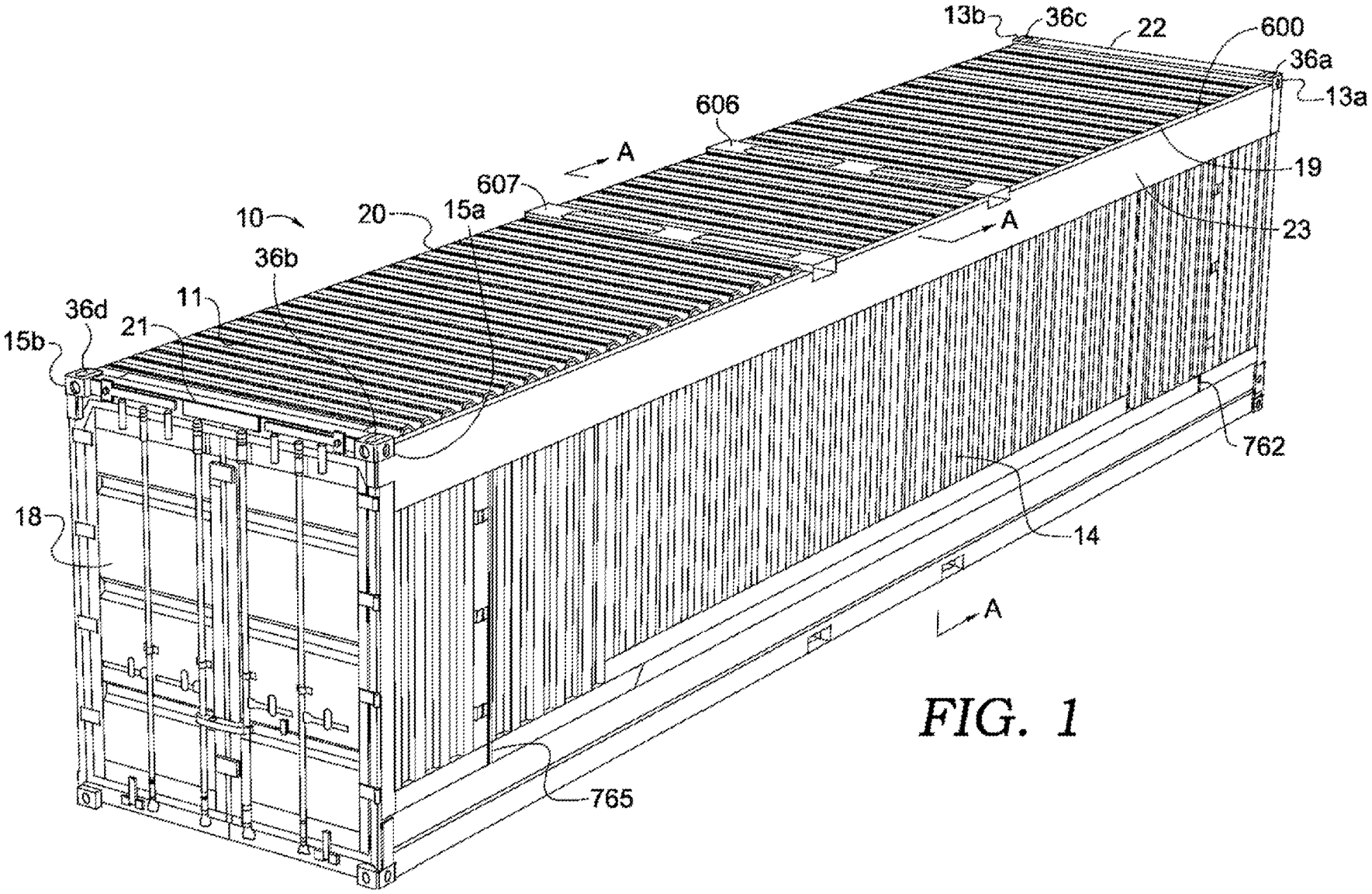
FIG. 1 is a perspective view of a foldable (or collapsible) container showing the door panel and the right side panel, according to an embodiment of the present disclosure.
Figure 150:
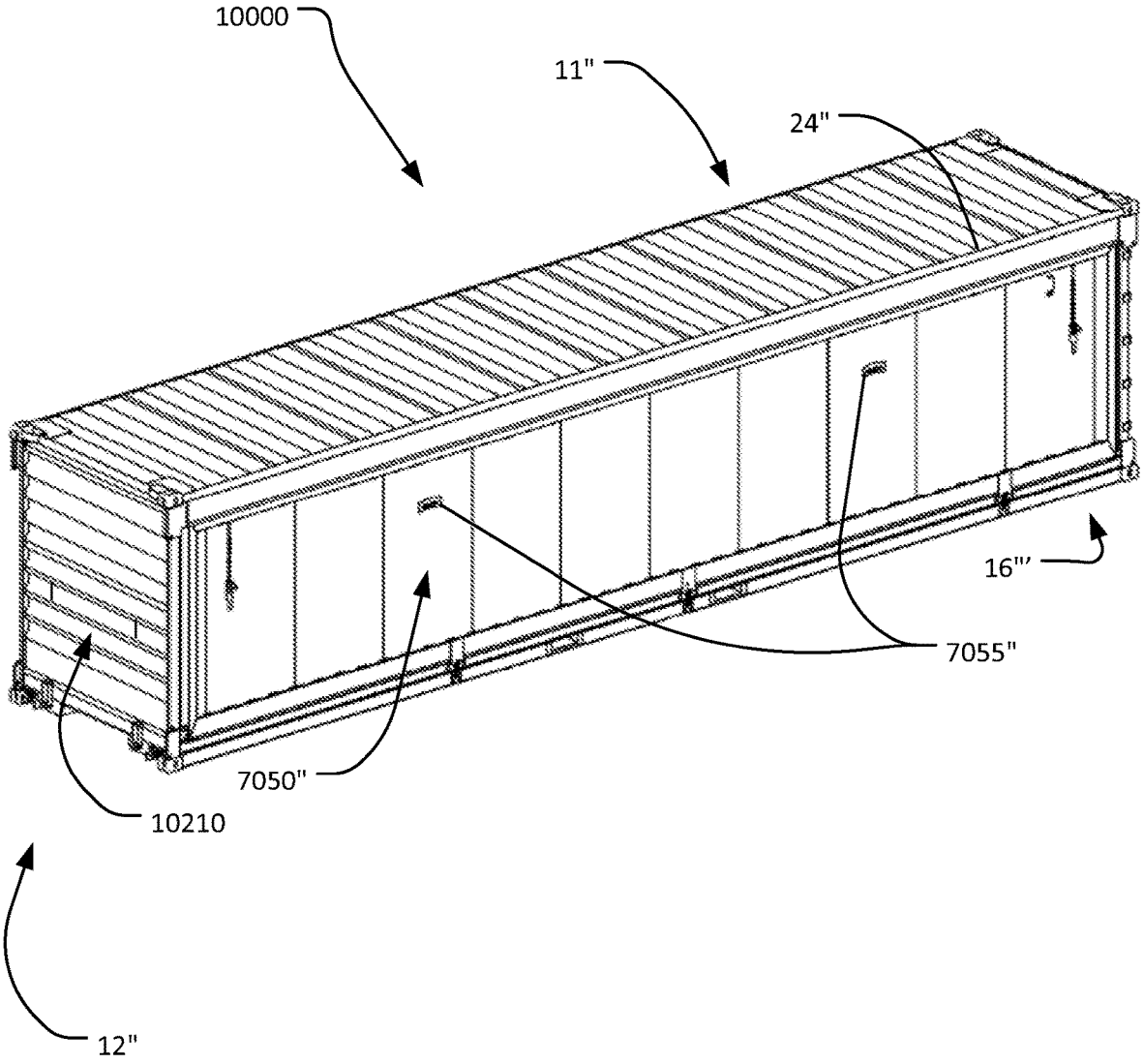

FIG. 150 is a perspective view of yet another embodiment of the collapsible container of FIG. 1

Figure 151:
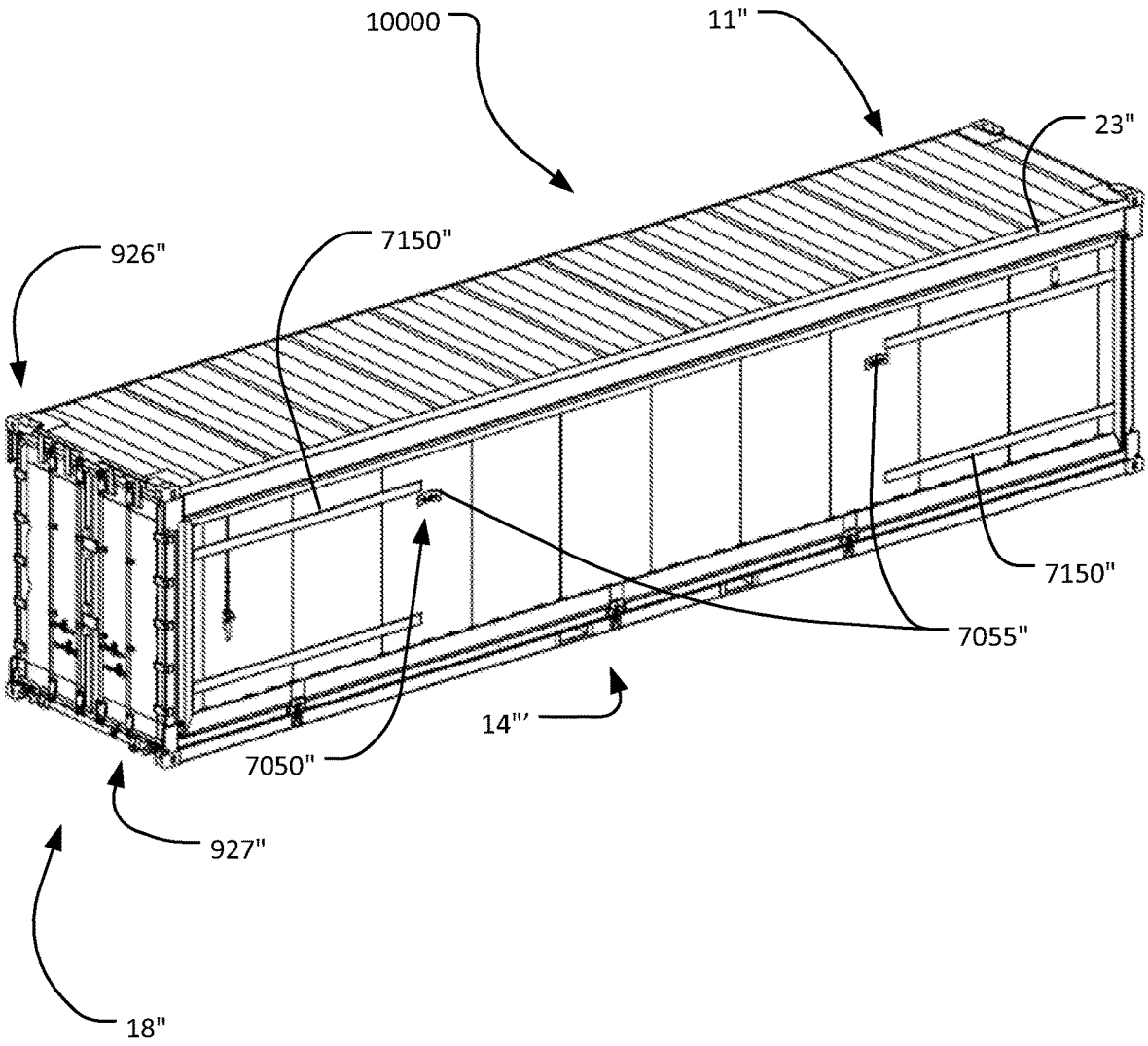

FIG. 151 is a perspective view of the collapsible container of FIG. 150.

Figure 152A:
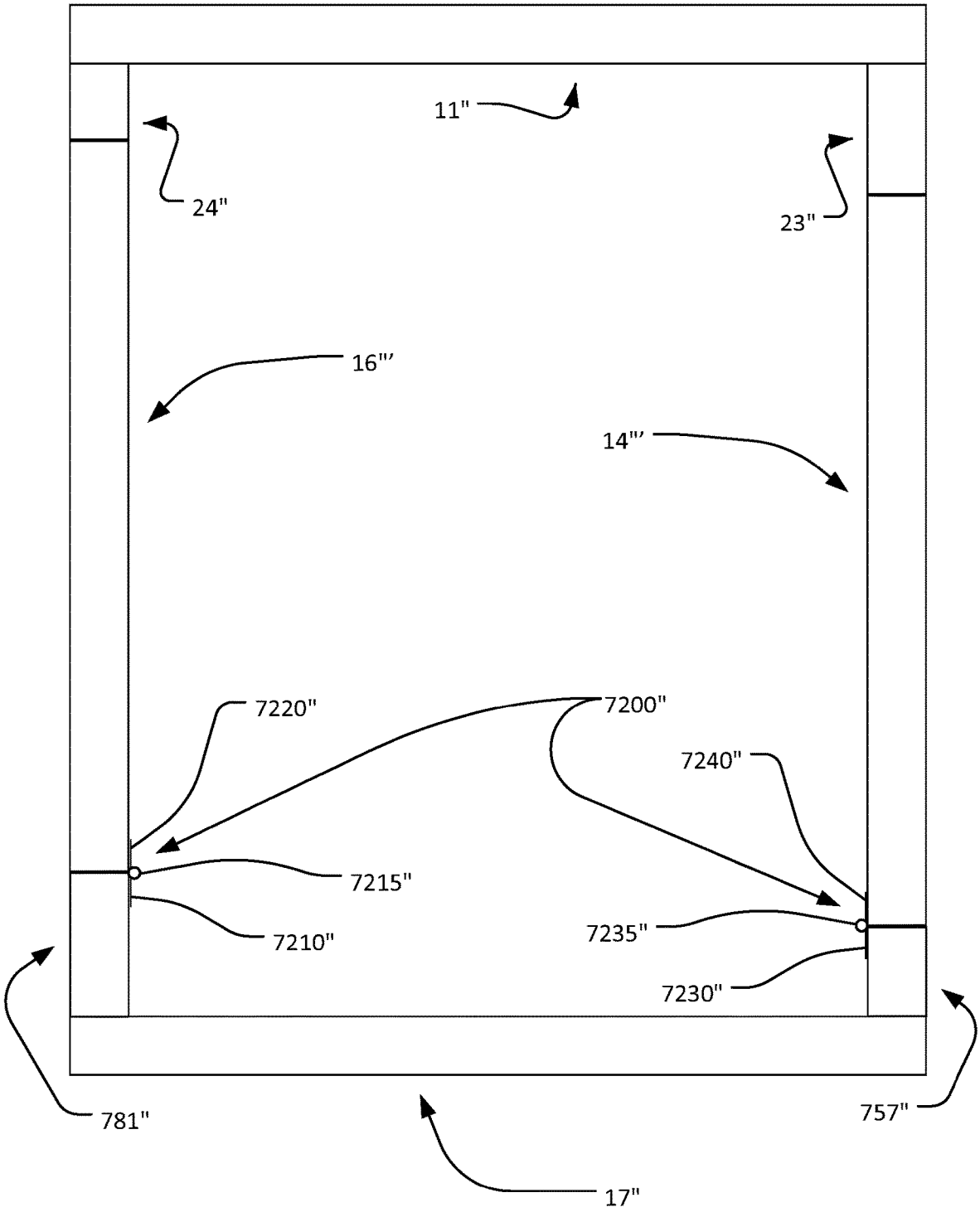

FIG. 152A is a schematic view of the collapsible container of FIG. 150 in an unfolded condition.

Figure 152B:
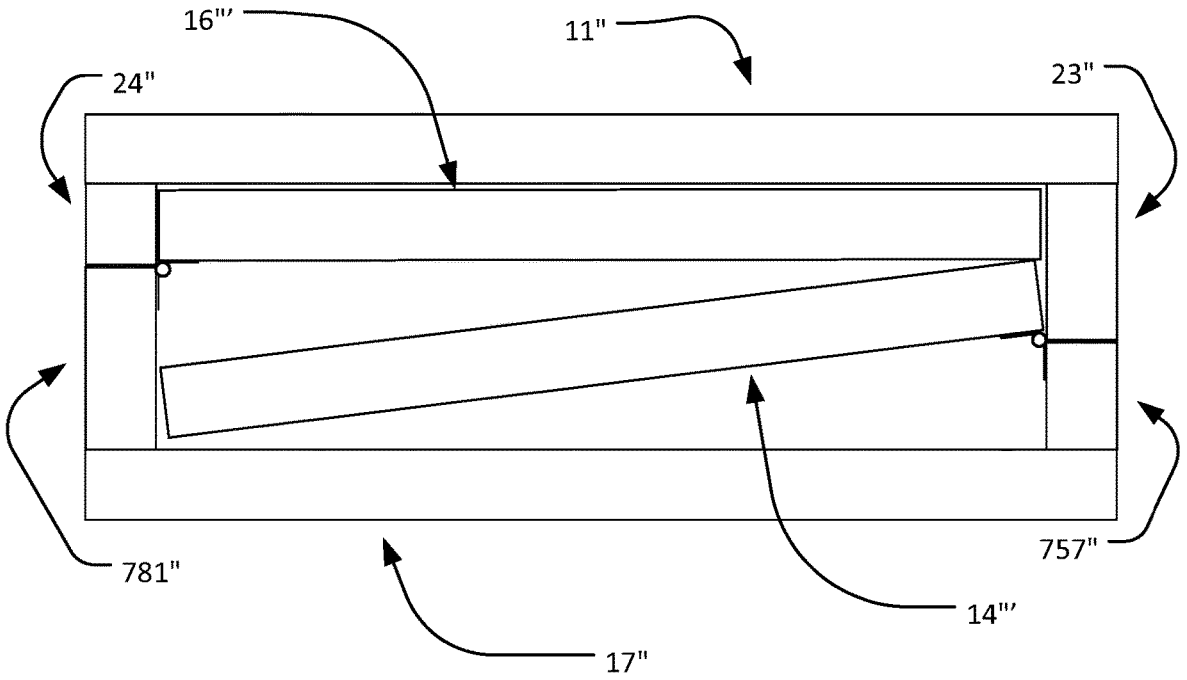

FIG. 152B is a schematic view of the collapsible container of FIG. 150 in a folded condition.

Figure 153:
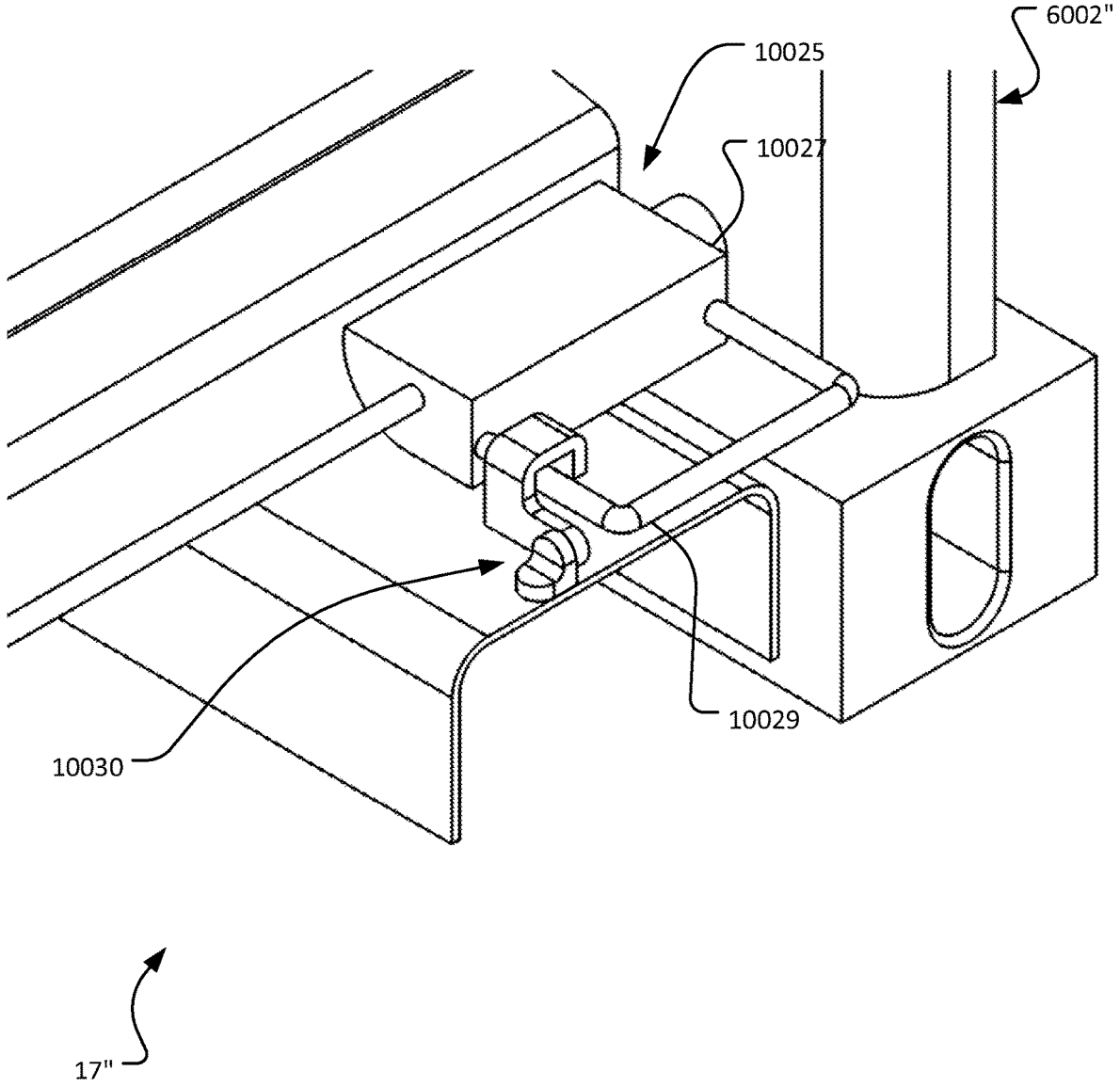

FIG. 153 is a perspective view of a hammer locking mechanism of the collapsible container of FIG. 150.

Figure 154:
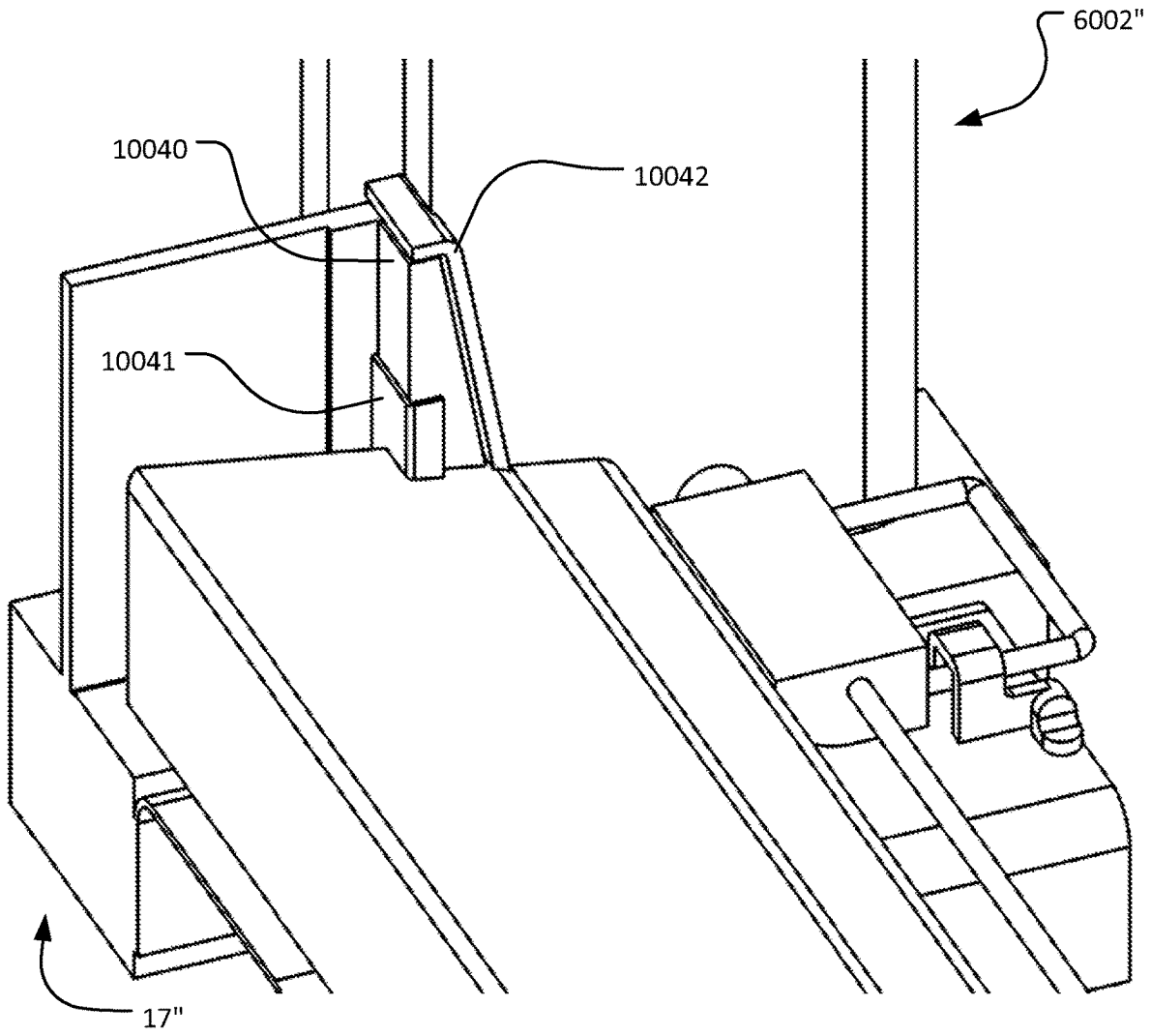

FIG. 154 is a perspective view of a base receiving portion of the collapsible container of FIG. 150.

Figure 155:
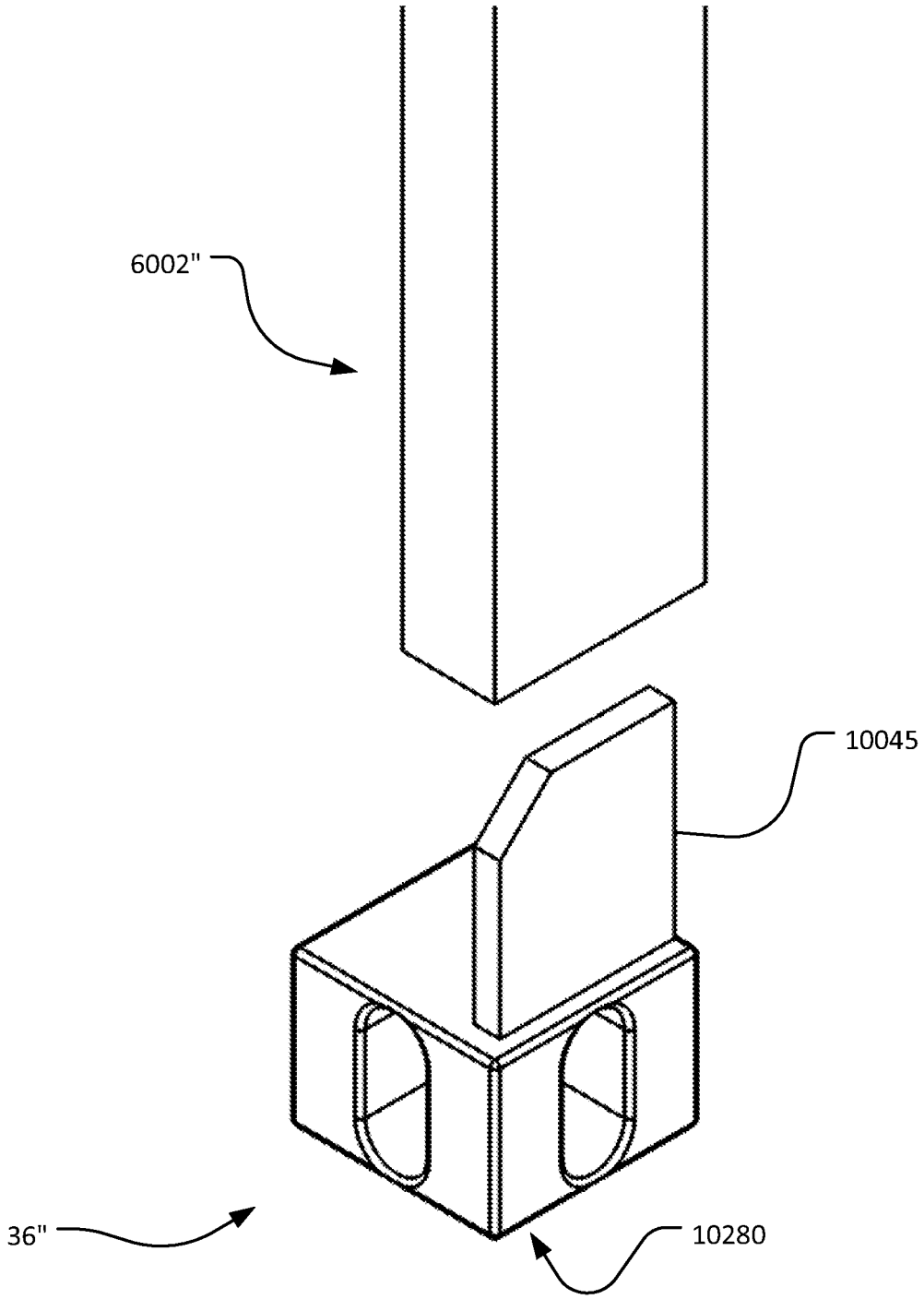

FIG. 155 is a perspective view of a slotting portion of the collapsible container of FIG. 150.

Figure 156:
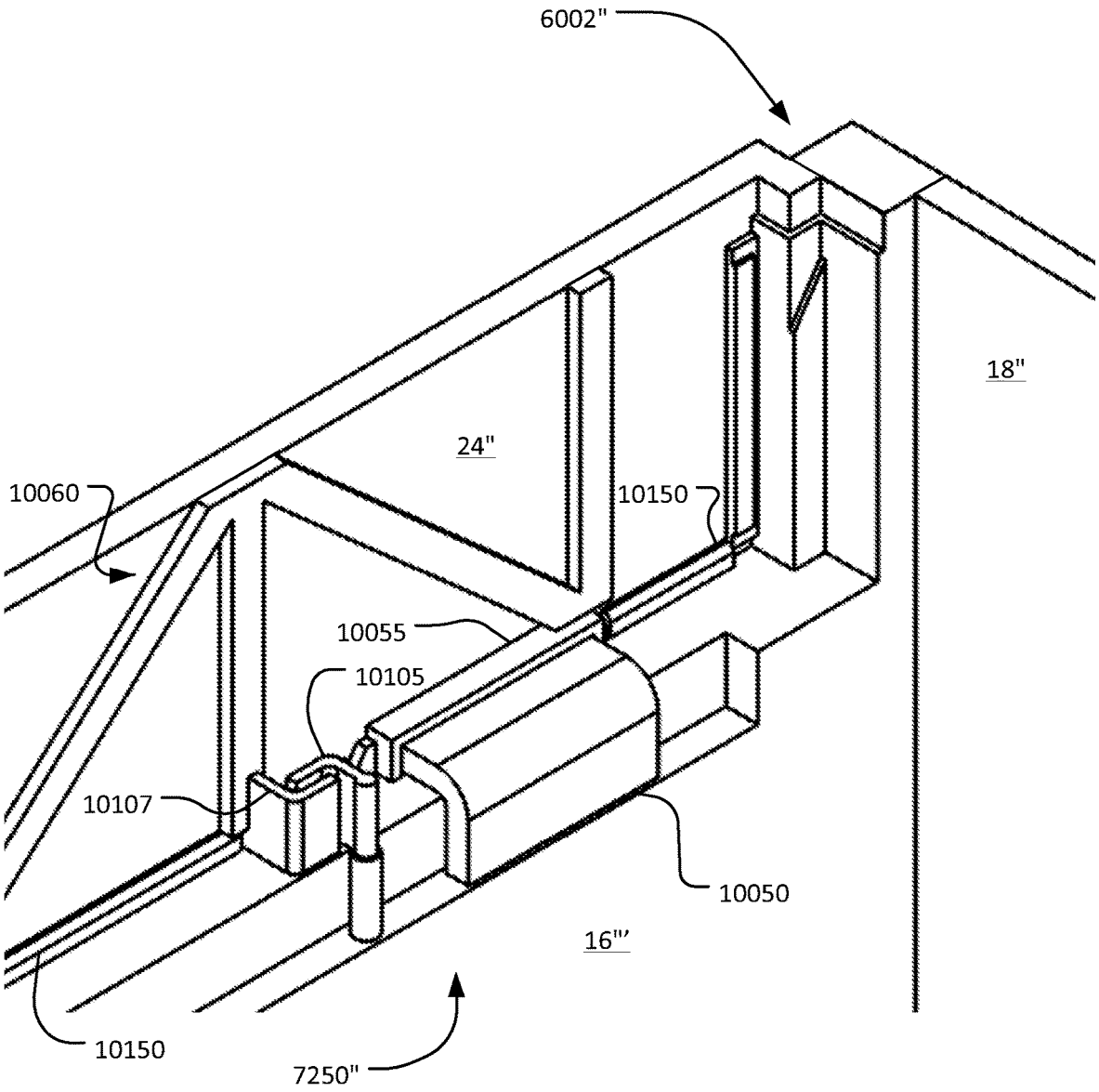

FIG. 156 is a perspective view of certain anti-racking features of the collapsible container of FIG. 150.

Figure 157A:
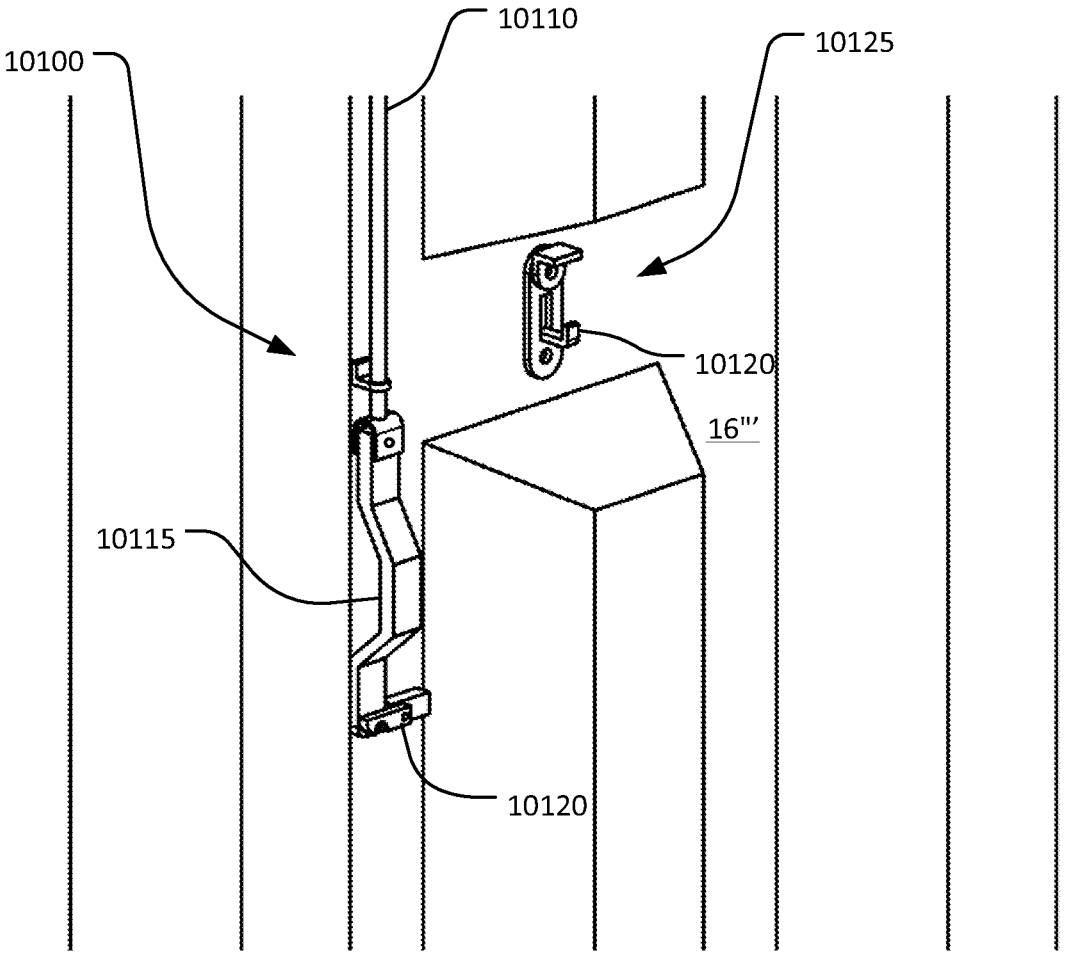

FIG. 157A is a perspective view of a side wall latch system of the collapsible container of FIG. 150, in a first position.

Figure 157B:
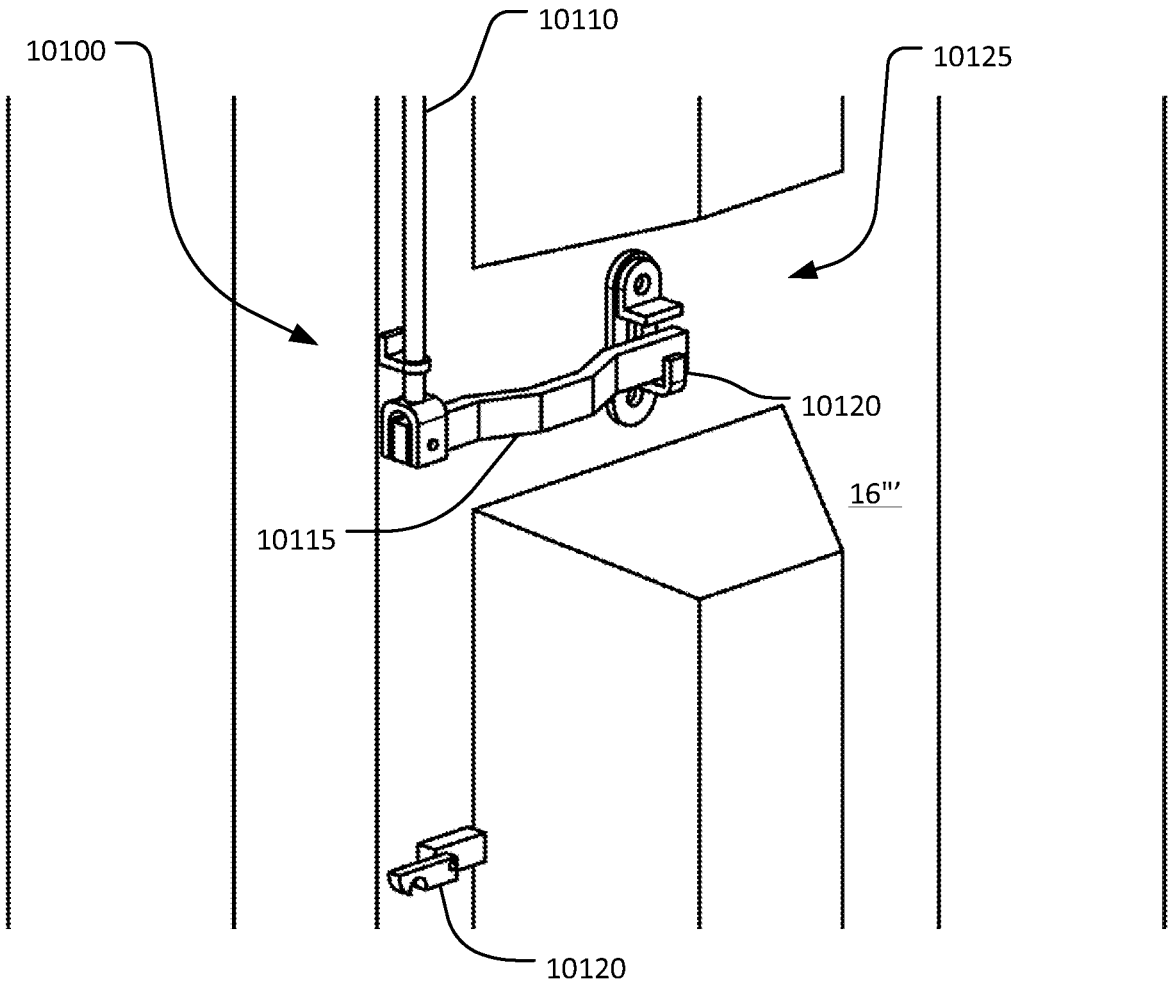

FIG. 157B is a perspective view of the side wall latch system of the collapsible container of FIG. 150, in a second position.

Figure 158:
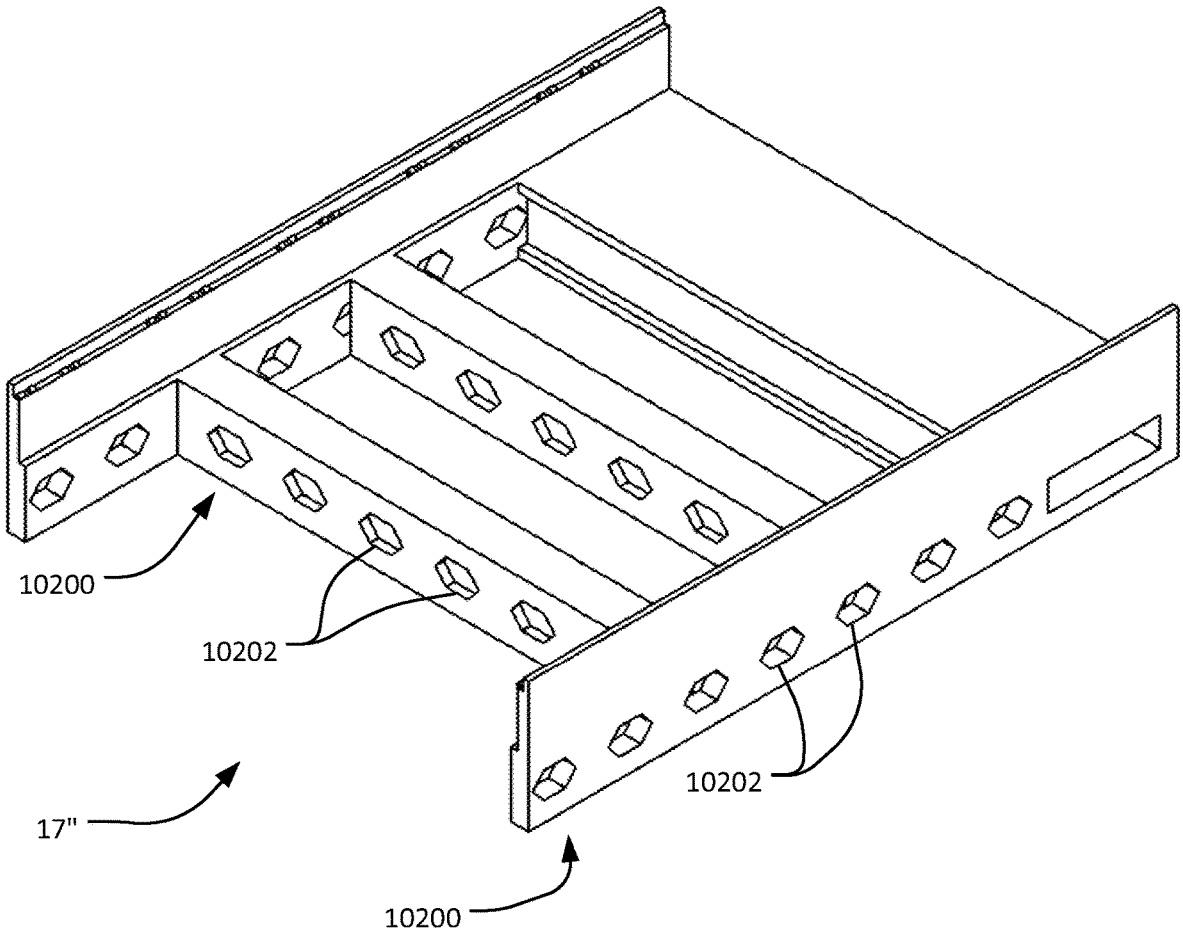

FIG. 158 is a perspective partial view of a base panel of the collapsible container of FIG. 150.

Figure 159A:
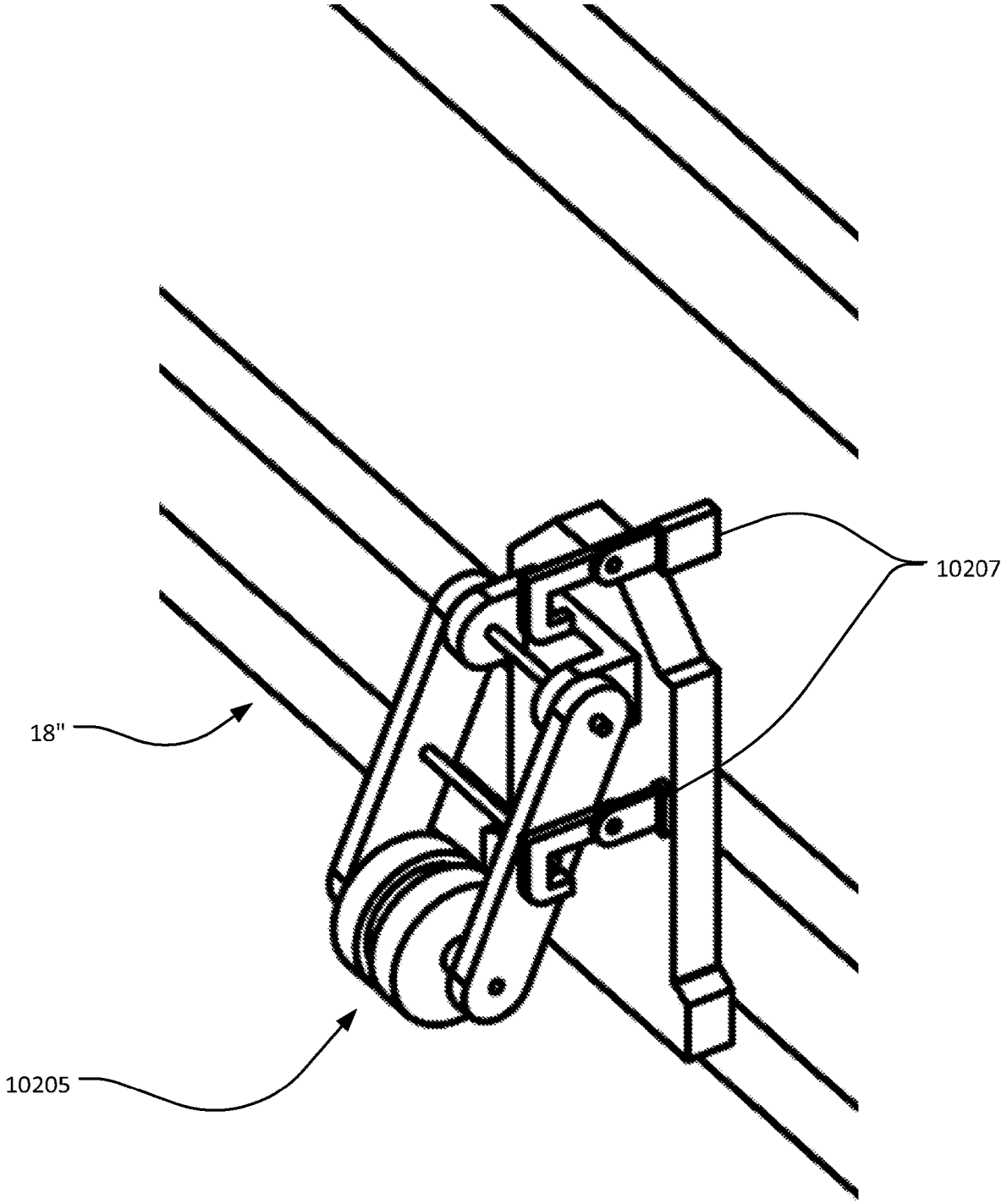

FIG. 159A is a perspective view of a wheel of the collapsible container of FIG. 150, in a first position.

Figure 159B:
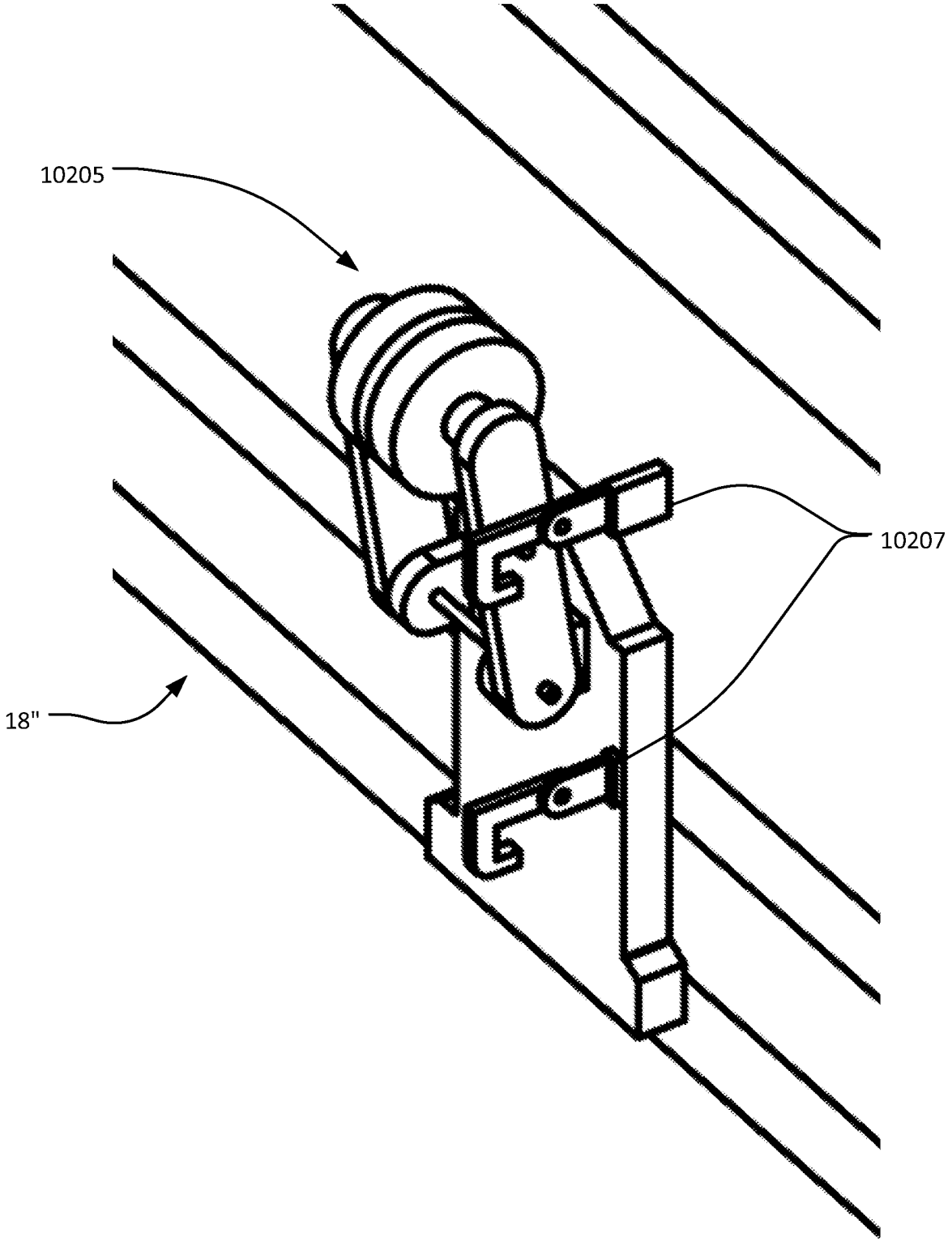

FIG. 159B is a perspective view of the wheel of the collapsible container of FIG. 150, in a second position.

Figure 160:
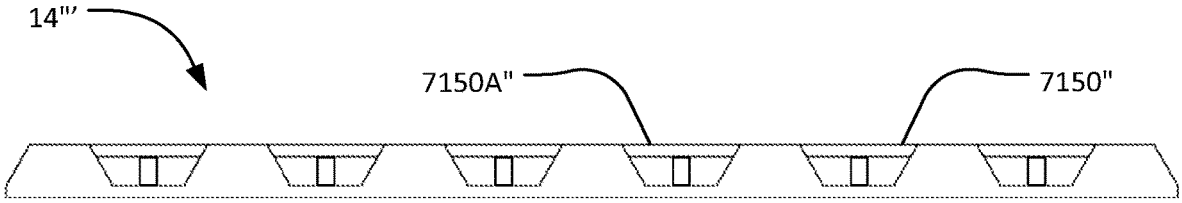

FIG. 160 is a schematic view of tracks of the collapsible container of FIG. 150.

Figure 161:
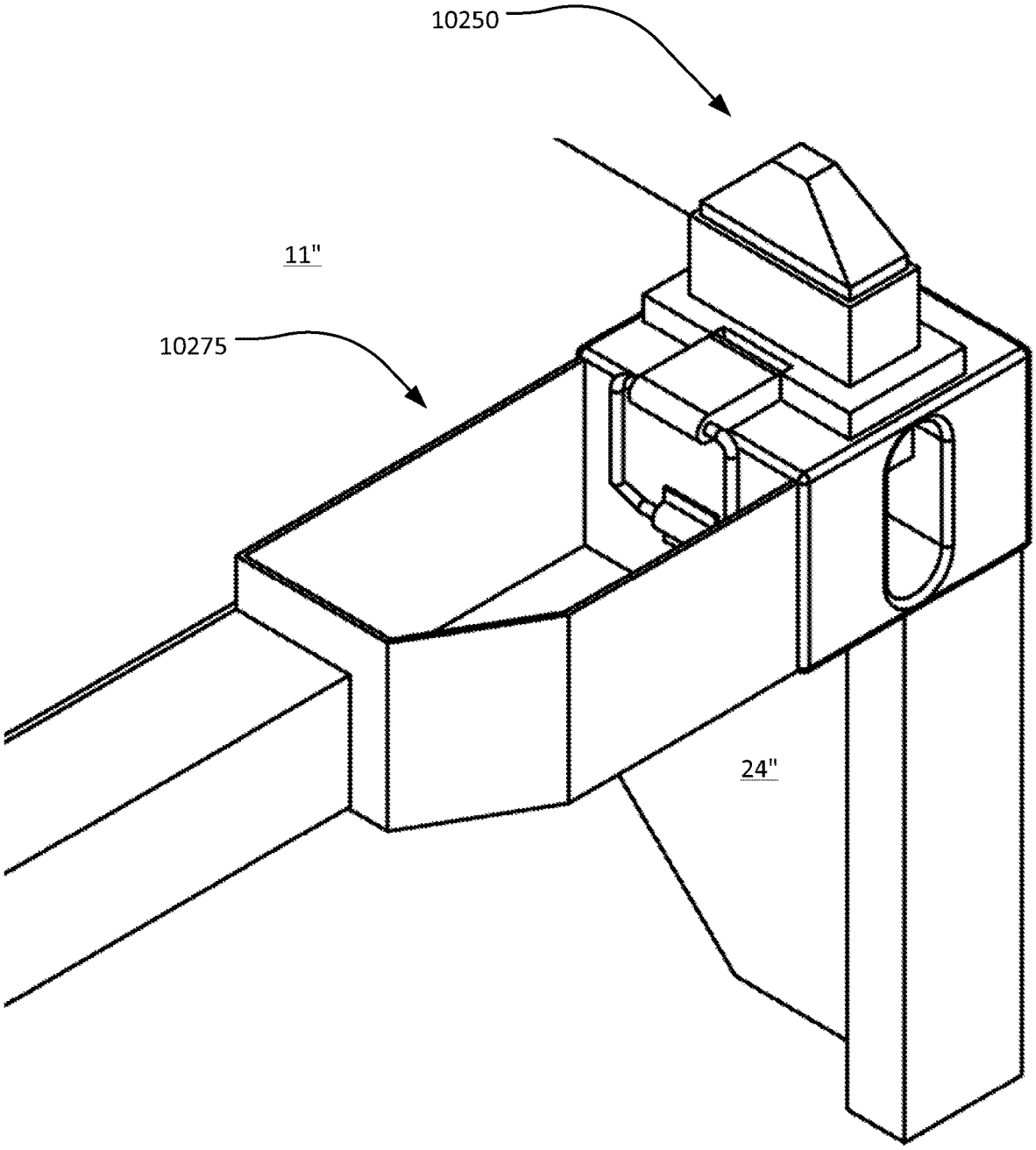

FIG. 161 is a perspective view of a tethered twist lock of the collapsible container of FIG. 150.

Figure 162:
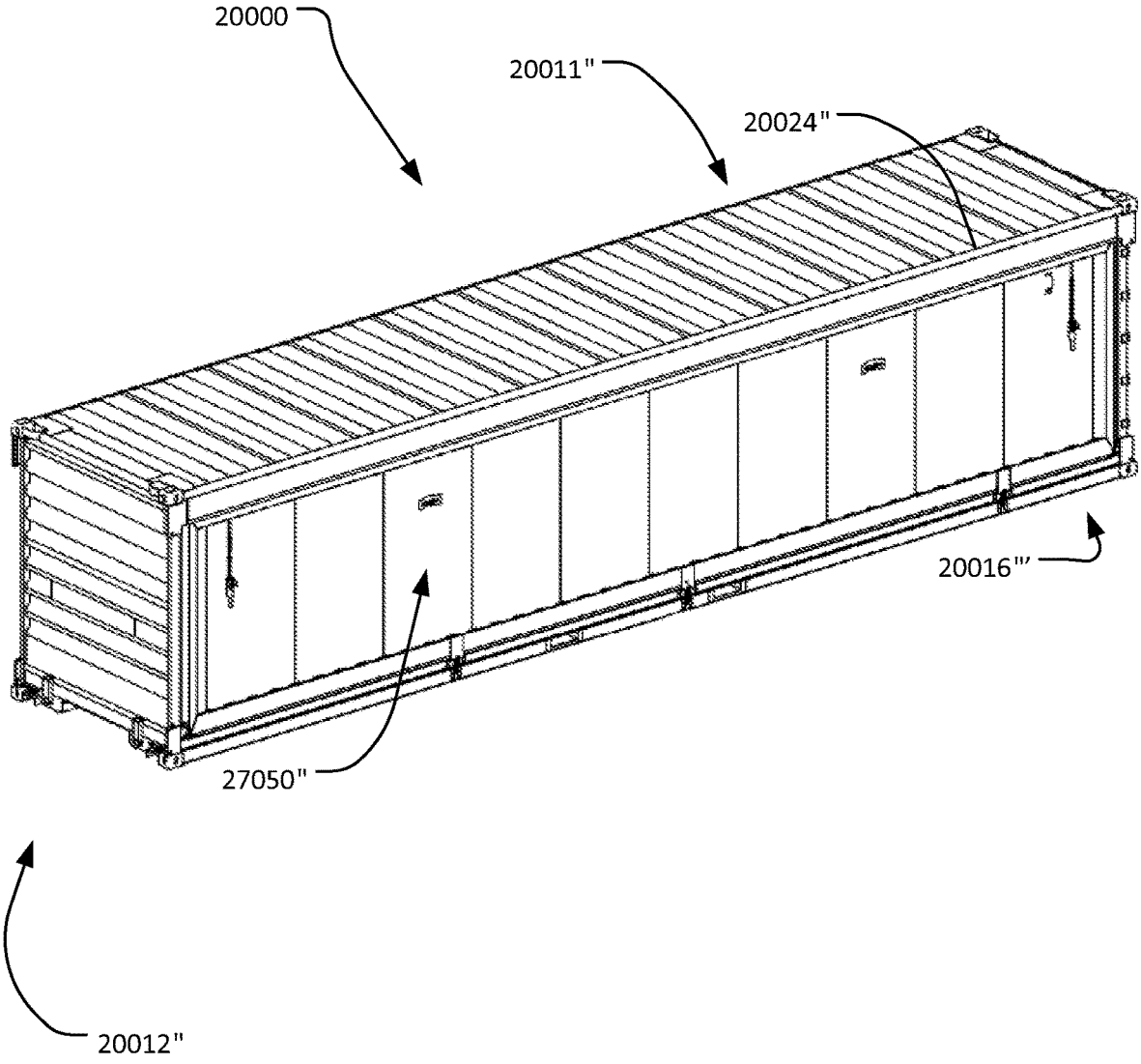

FIG. 162 is a perspective view of yet another embodiment of the collapsible container of FIG. 1.

Figure 163:
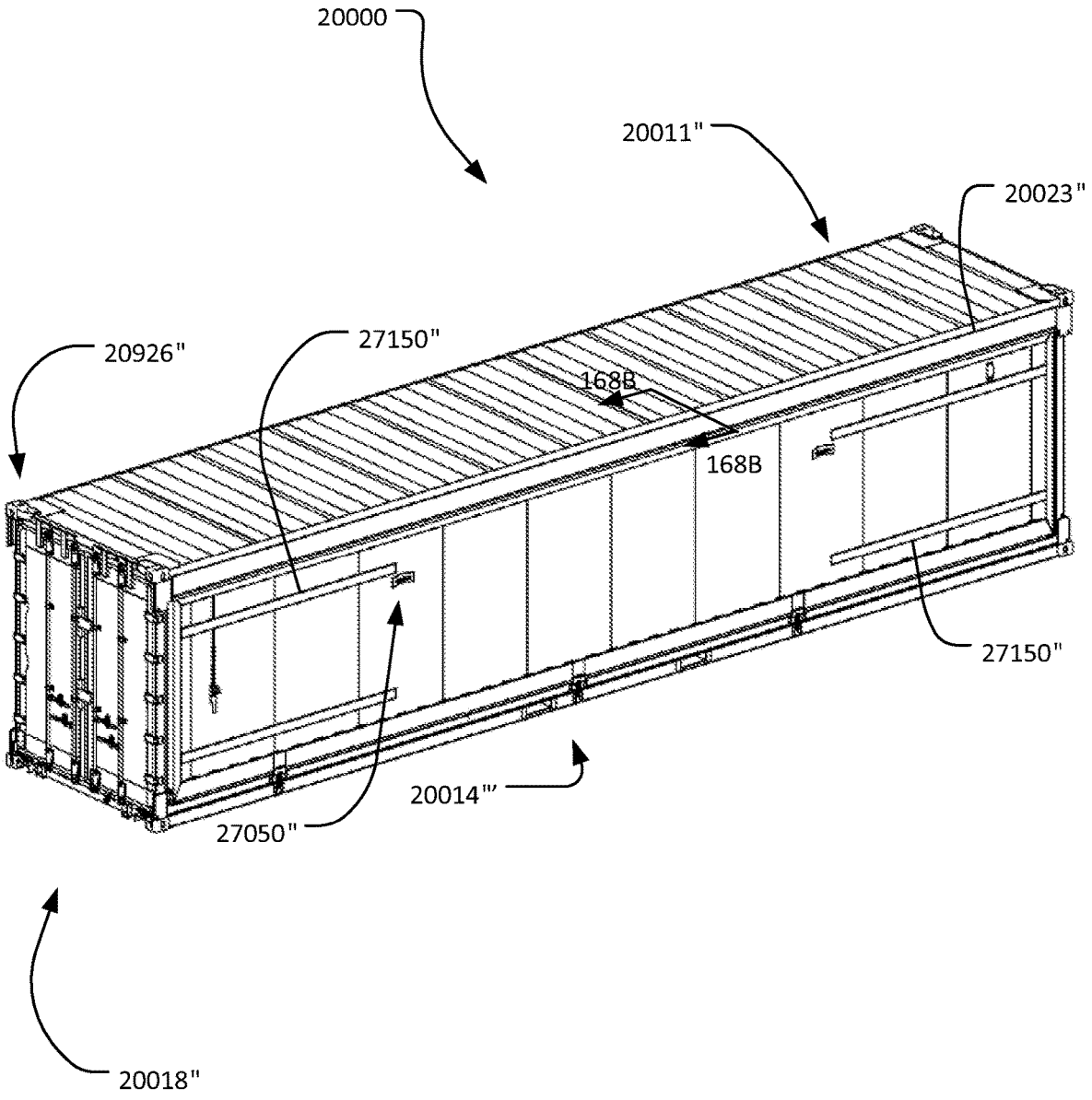

FIG. 163 is a perspective view of the collapsible container of FIG. 162.

Figure 164A:
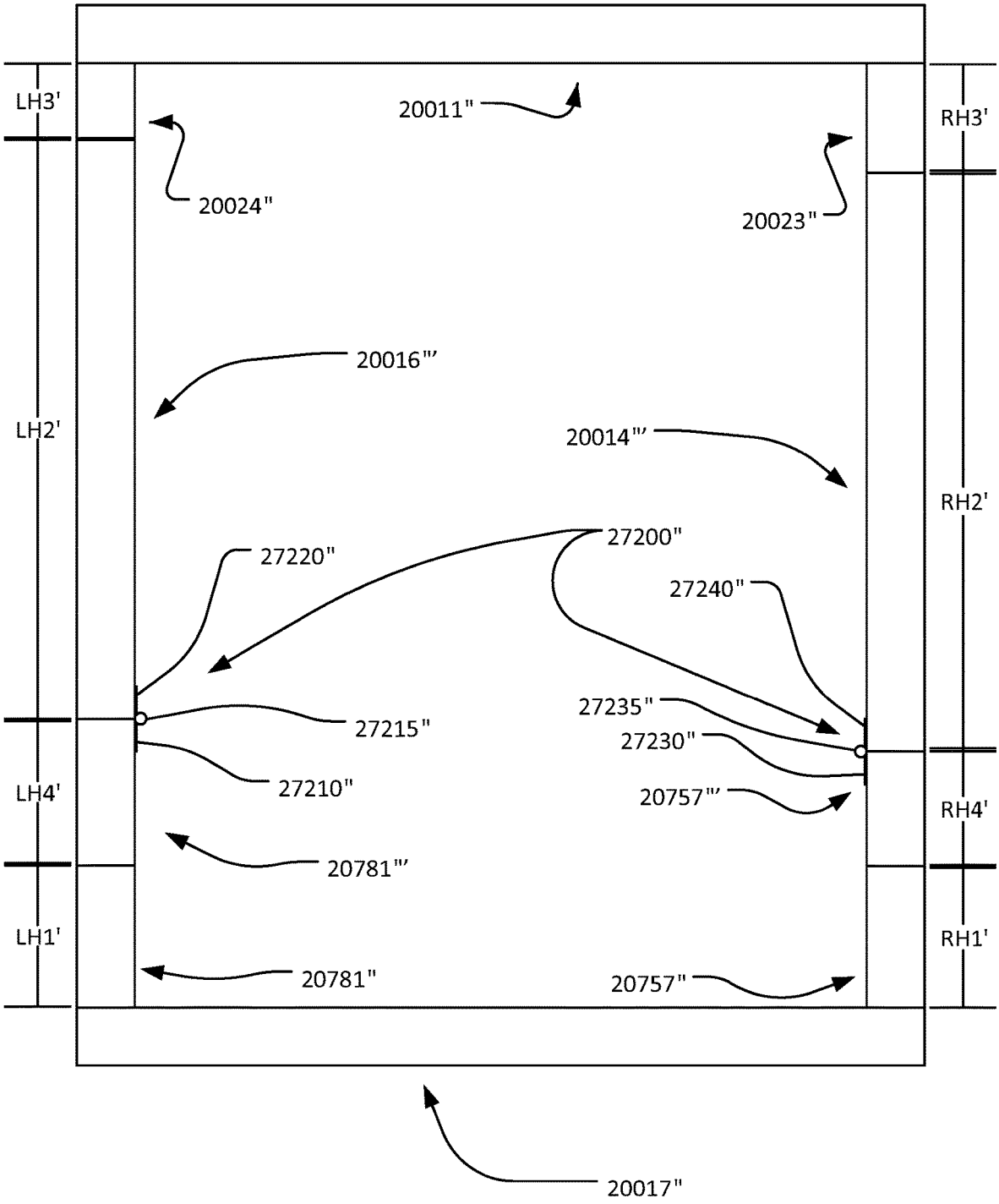

FIG. 164A is a schematic view of the collapsible container of FIG. 162 in an unfolded condition.

Figure 164B:
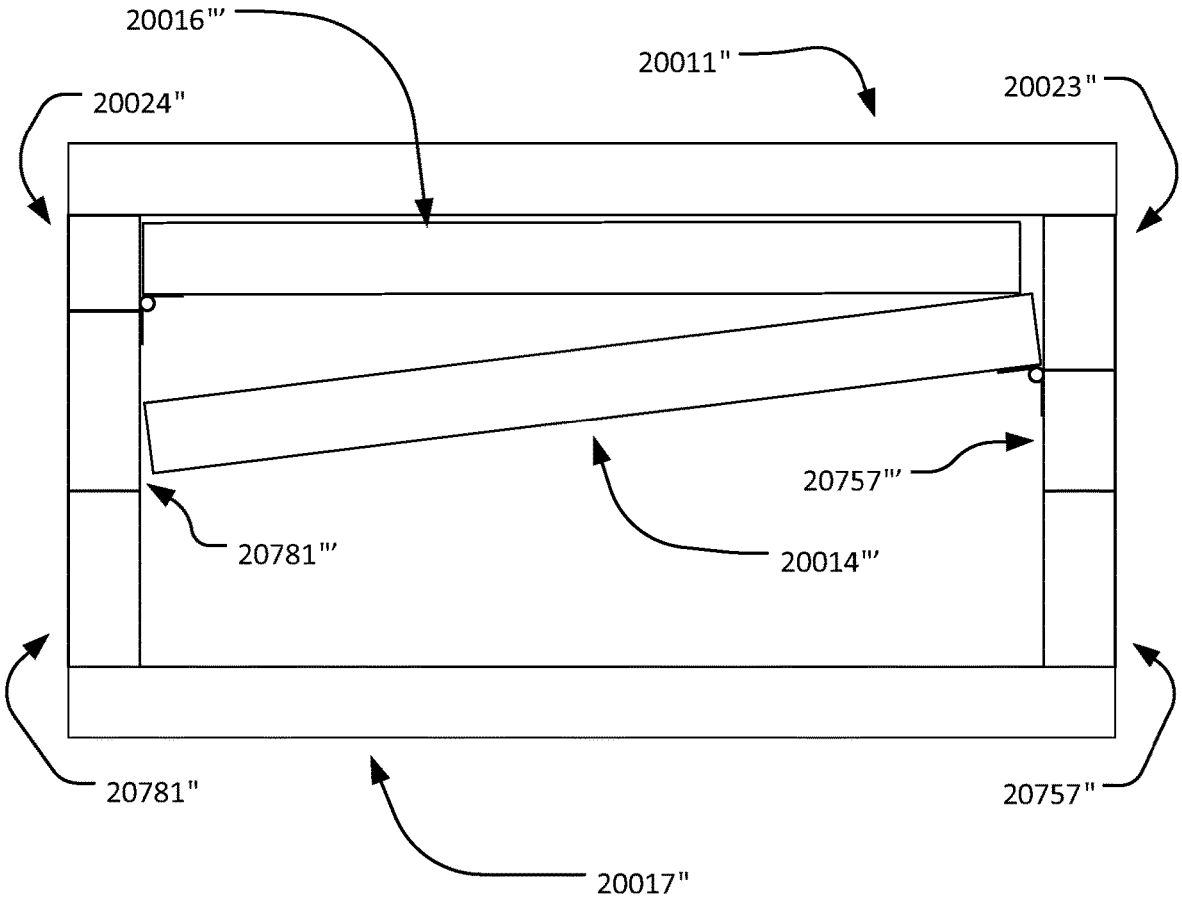

FIG. 164B is a schematic view of the collapsible container of FIG. 162 in a folded condition.

Figure 165:
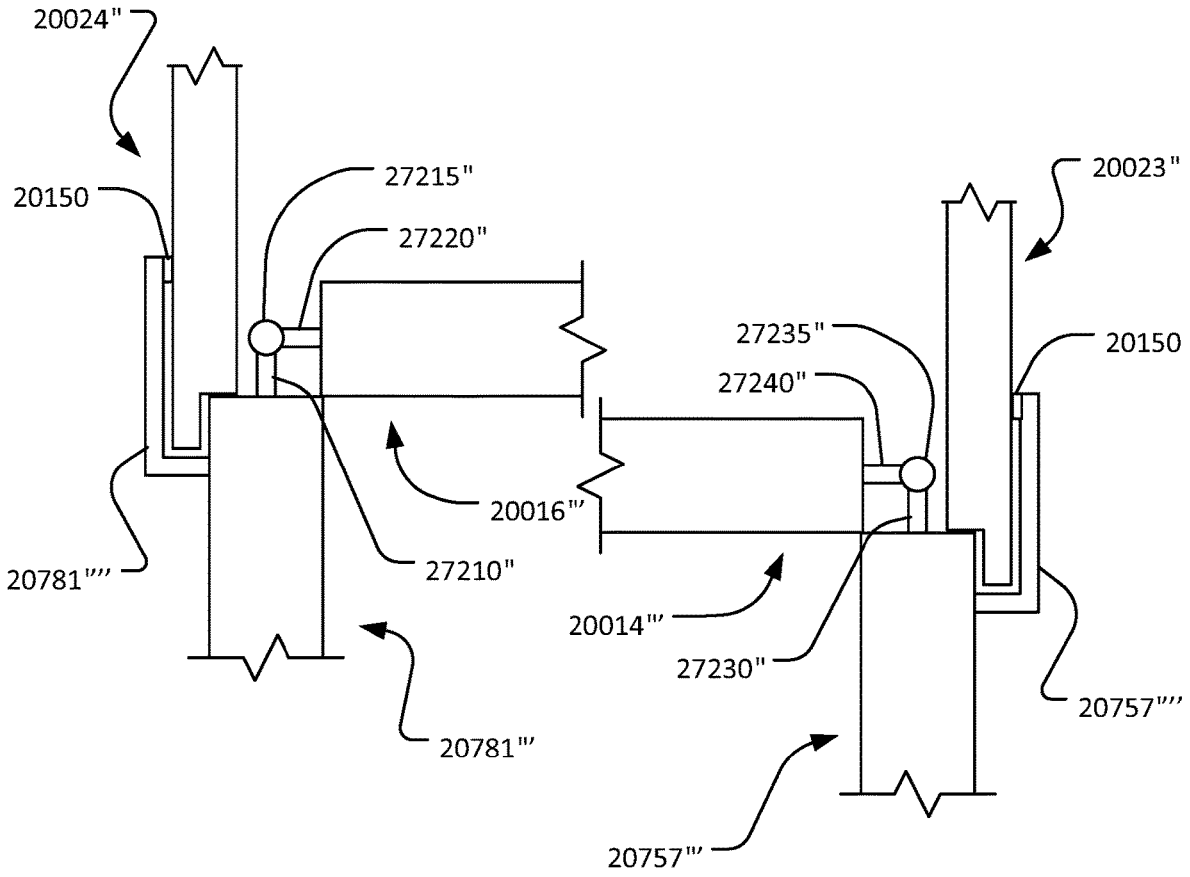

FIG. 165 is a schematic view of another embodiment of the collapsible container of FIG. 162, in the folded condition.

Figure 166:
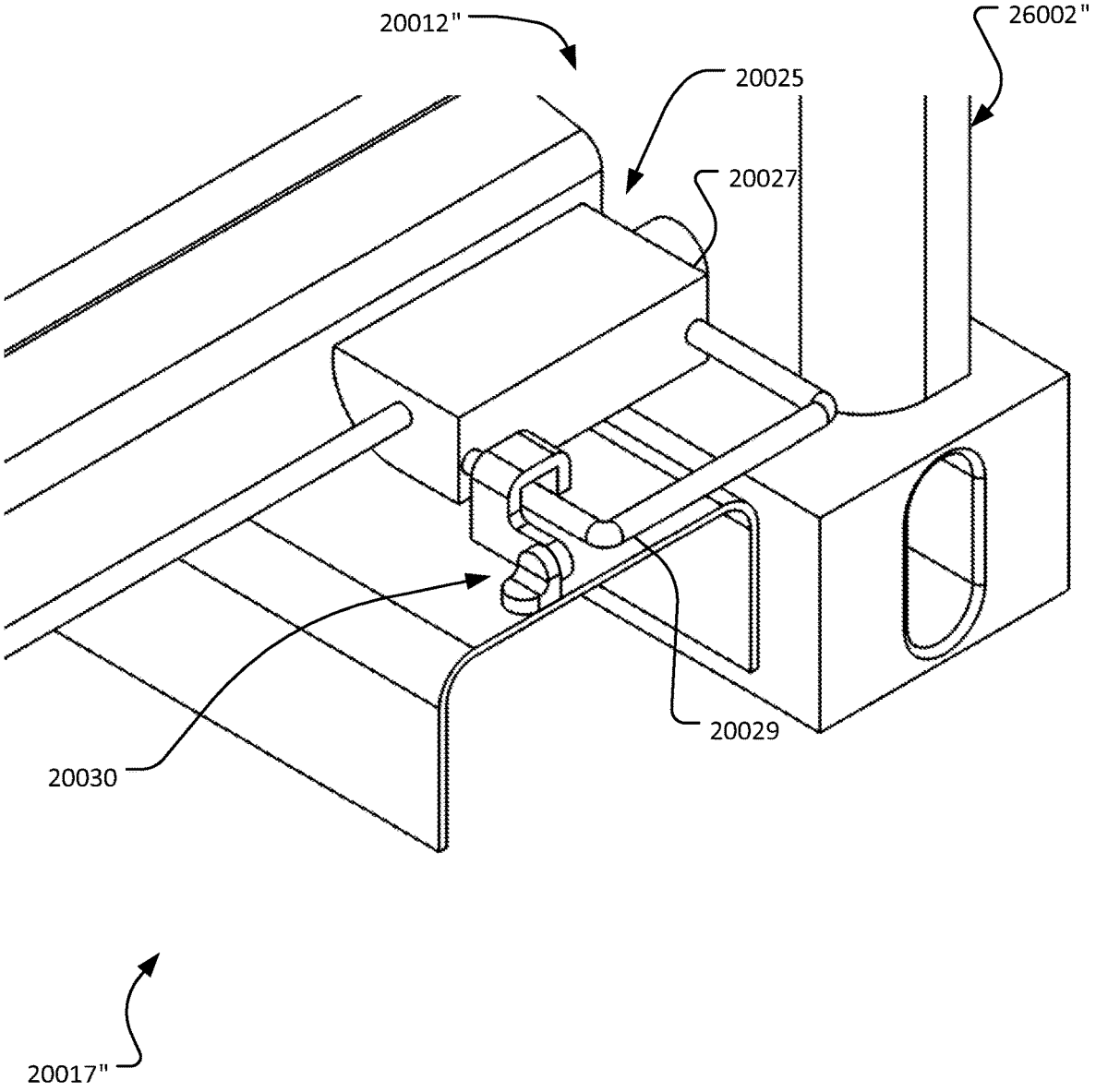

FIG. 166 is a perspective view of a hammer locking mechanism of the collapsible container of FIG. 162.

Figure 167:
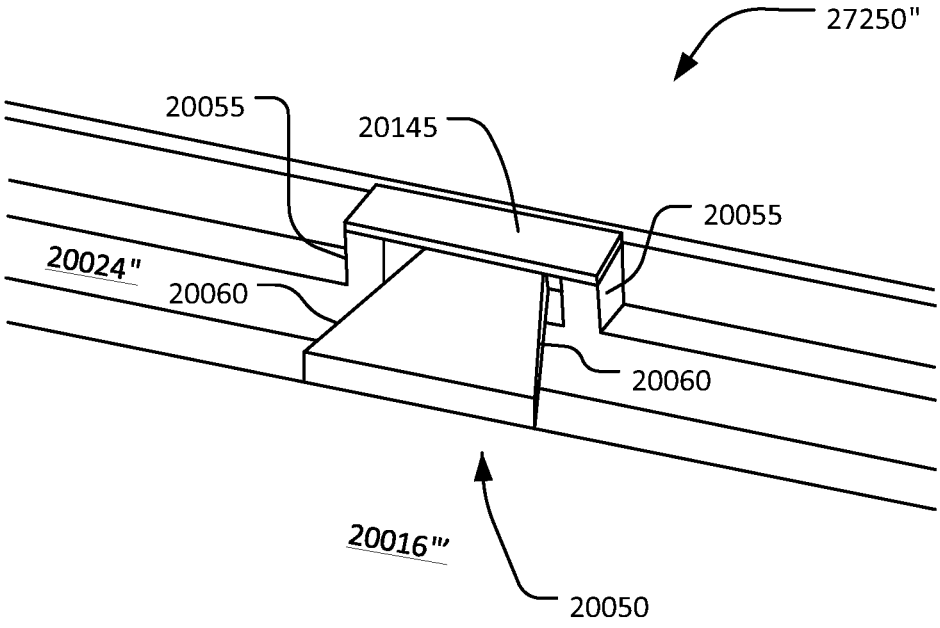

FIG. 167 is a perspective view of certain anti-racking features of the collapsible container of FIG. 162.

Figure 168A:
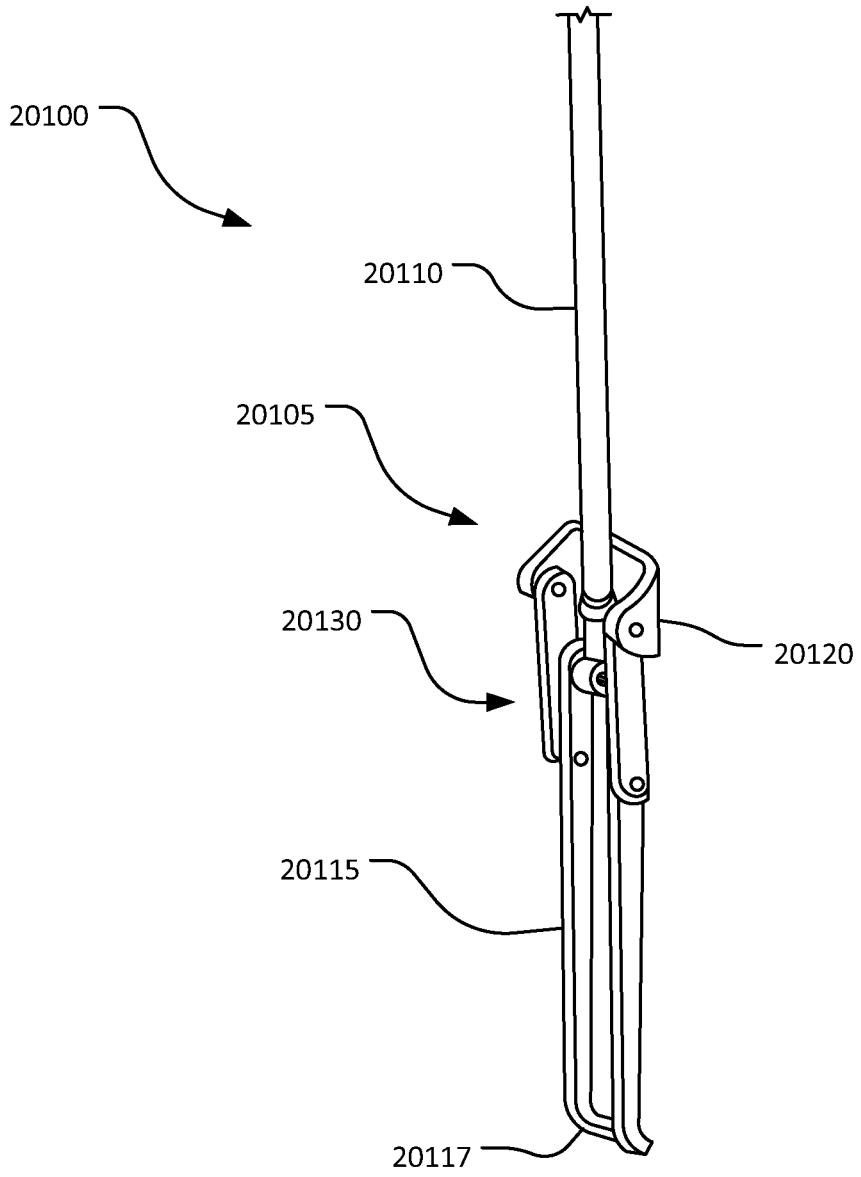

FIG. 168A is a perspective view of a latch handle of a side wall latch system of the collapsible container of FIG. 162.

Figure 168B:
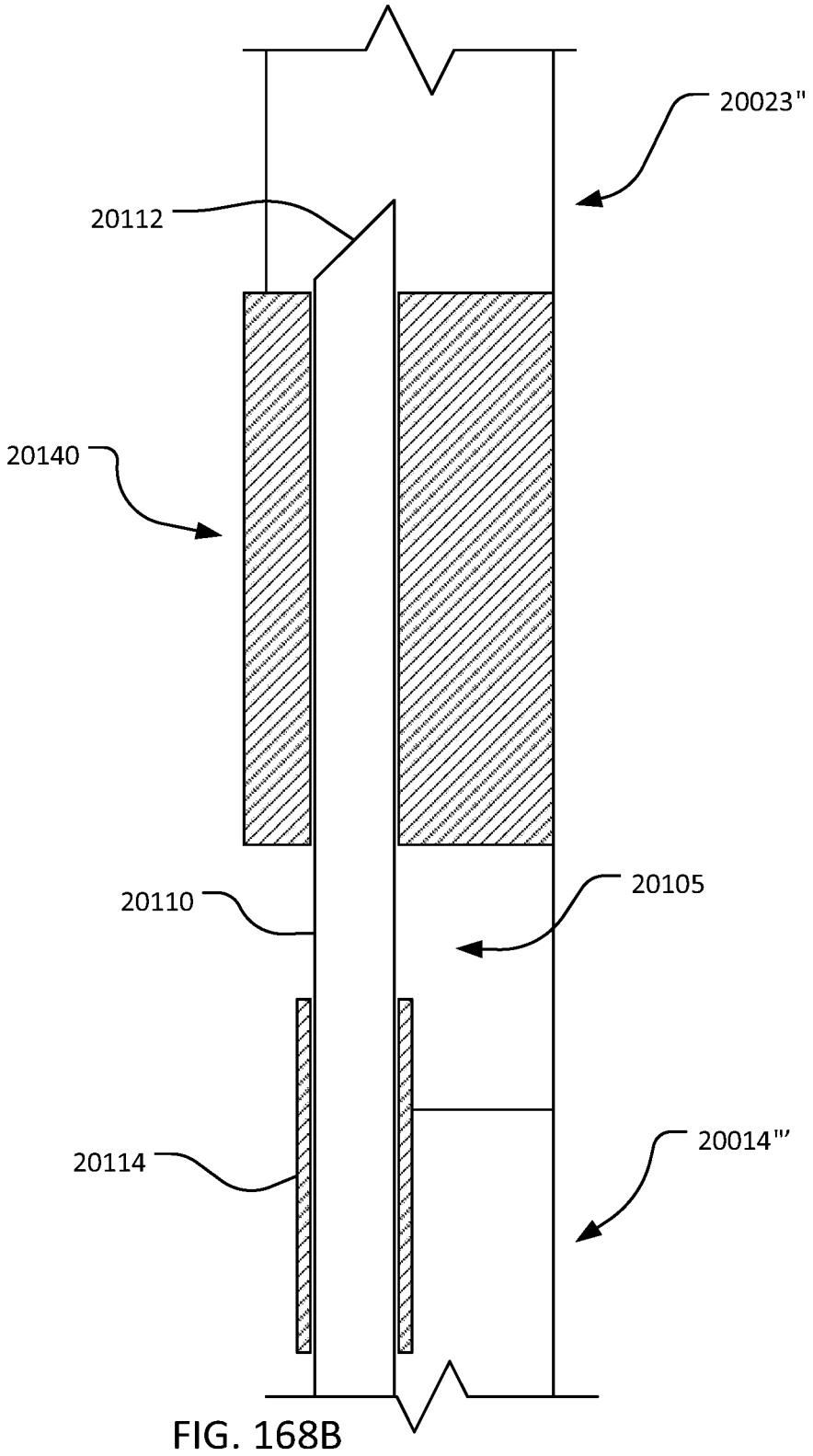

FIG. 168B is a sectional view of a bar-skirt retaining portion of the side wall latch system of the collapsible container of FIG. 163.

Figure 169:
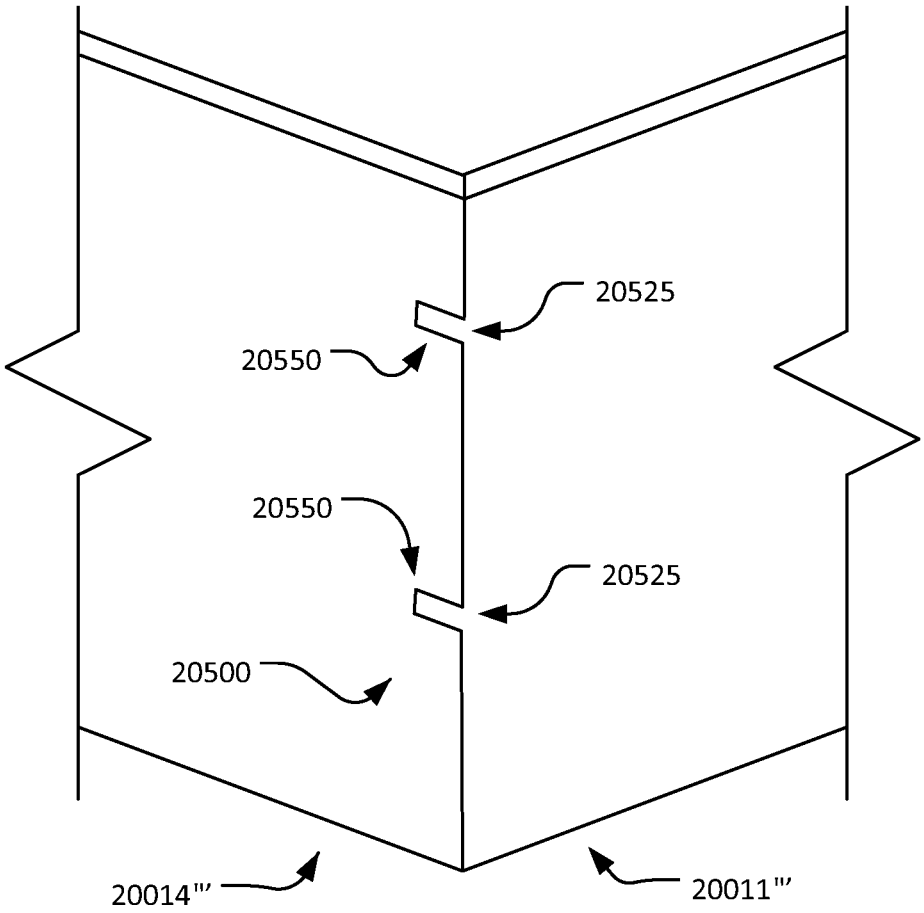

FIG. 169 is a schematic view of an alignment tab system of the collapsible container of FIG. 162.

DETAILED DESCRIPTION

Figure 2:
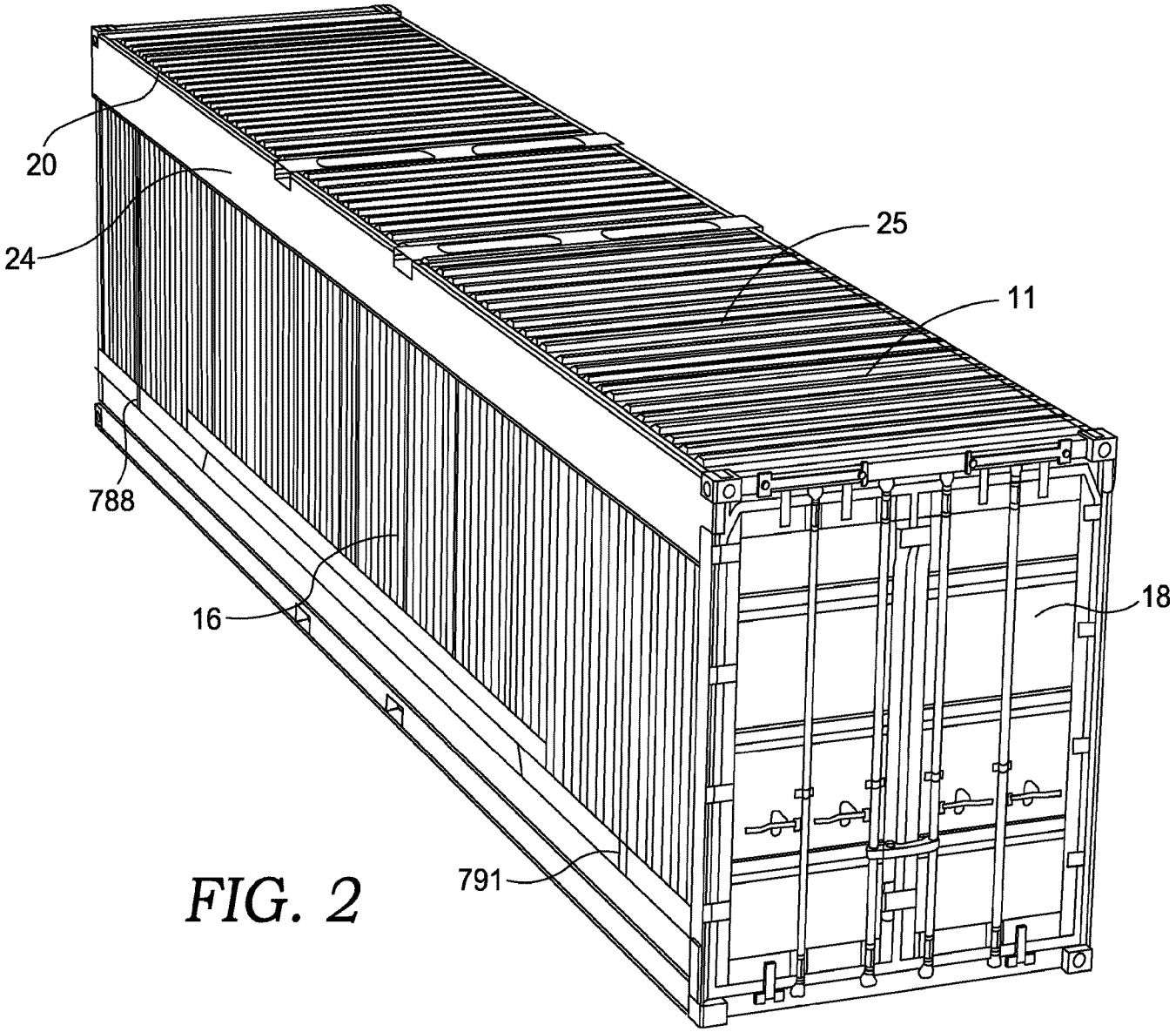
FIG. 2 is another perspective view of the embodiment of FIG. 1 showing the door panel and the left side panel.
Figure 3:
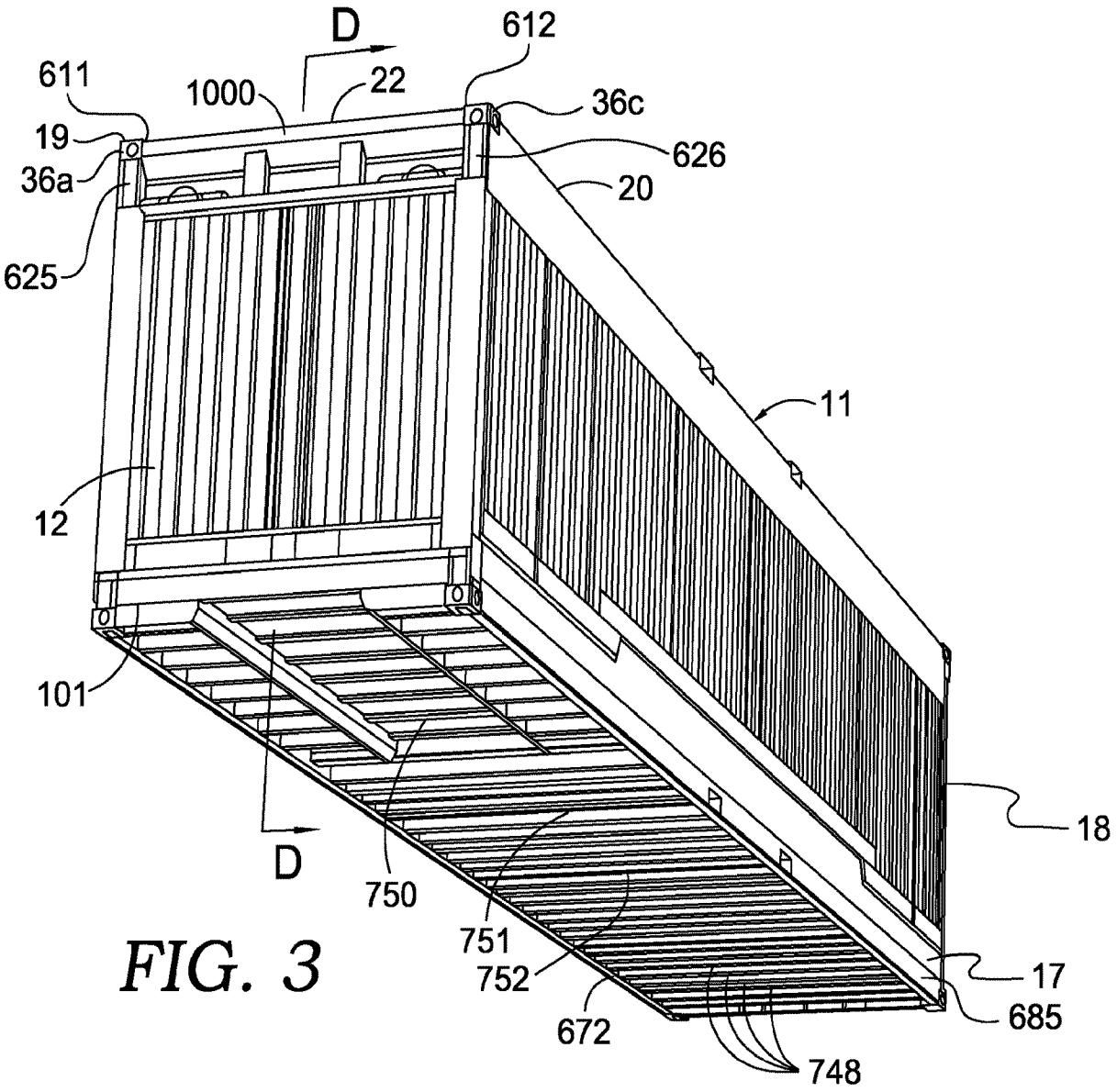
FIG. 3 is another perspective view of the foldable container of FIG. 1 showing the front panel and the left side panel.

As shown in FIG. 1, an embodiment of the foldable container 10 of the present disclosure includes a roof panel 11, a door panel, and a right side panel 14, and as shown in FIG. 2 the foldable container 10 further includes a left side panel 16. Collectively, the right side panel 14 and the left side panel 16 may be referred to herein as the "side panels", or individually either may be referred to as a "side panel". As shown in FIG. 3, the foldable container further includes a base panel 17, and a front panel 12 opposite the door panel 18.

Referring back to FIG. 1, the roof panel 11 includes a roof right edge 19, a roof left edge 20, a roof door edge 21, and a roof front edge 22. As shown in FIGS. 1 and 3, the roof panel 11 includes four standard corner fittings 36*a*, 36*b*, 36*c*, 36*d* of the type known in the art for lifting the foldable container 10 (as with a spreader), or for securing the foldable container 10 to another container which may be stacked on top of it. One corner fitting 36*a*, 36*b*, 36*c*, 36*d* is located on the roof panel 11 adjacent each end 13*a*, 13*b* of the roof front edge 22, and adjacent each end 15*a*, 15*b* of the roof door edge 21 thereof, in accordance with the international standards.

Figure 4:
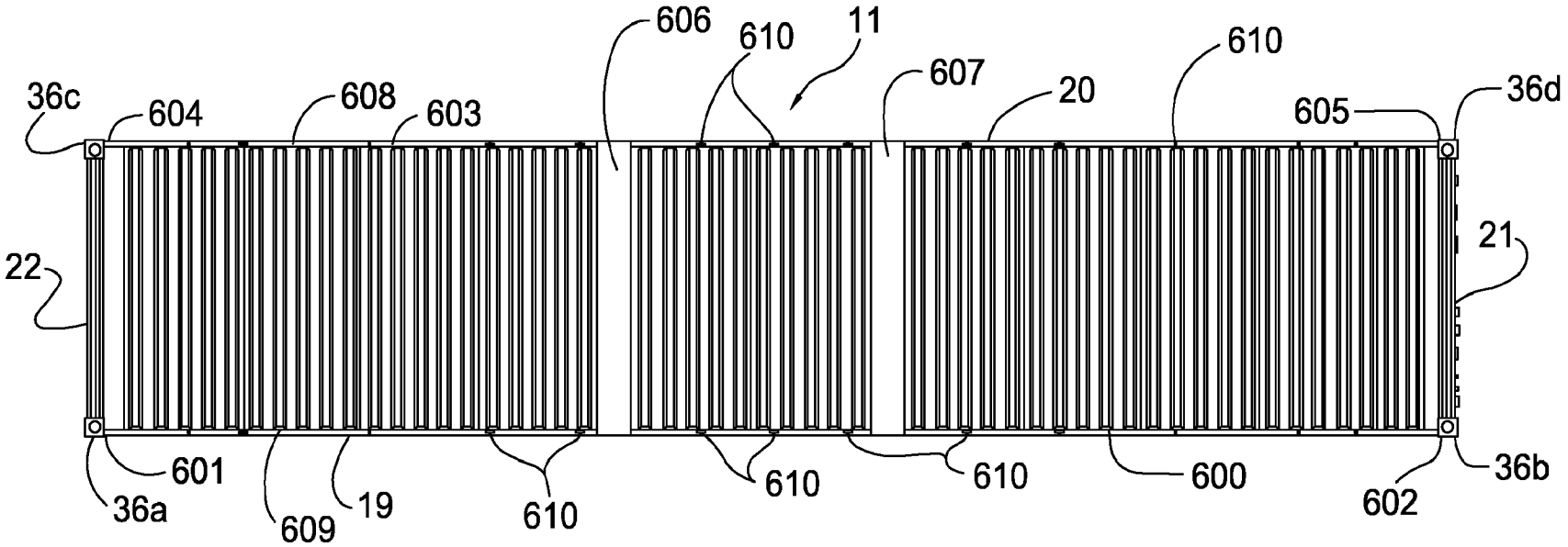
FIG. 4 is a plan view of the top of the roof panel.
Figure 5:
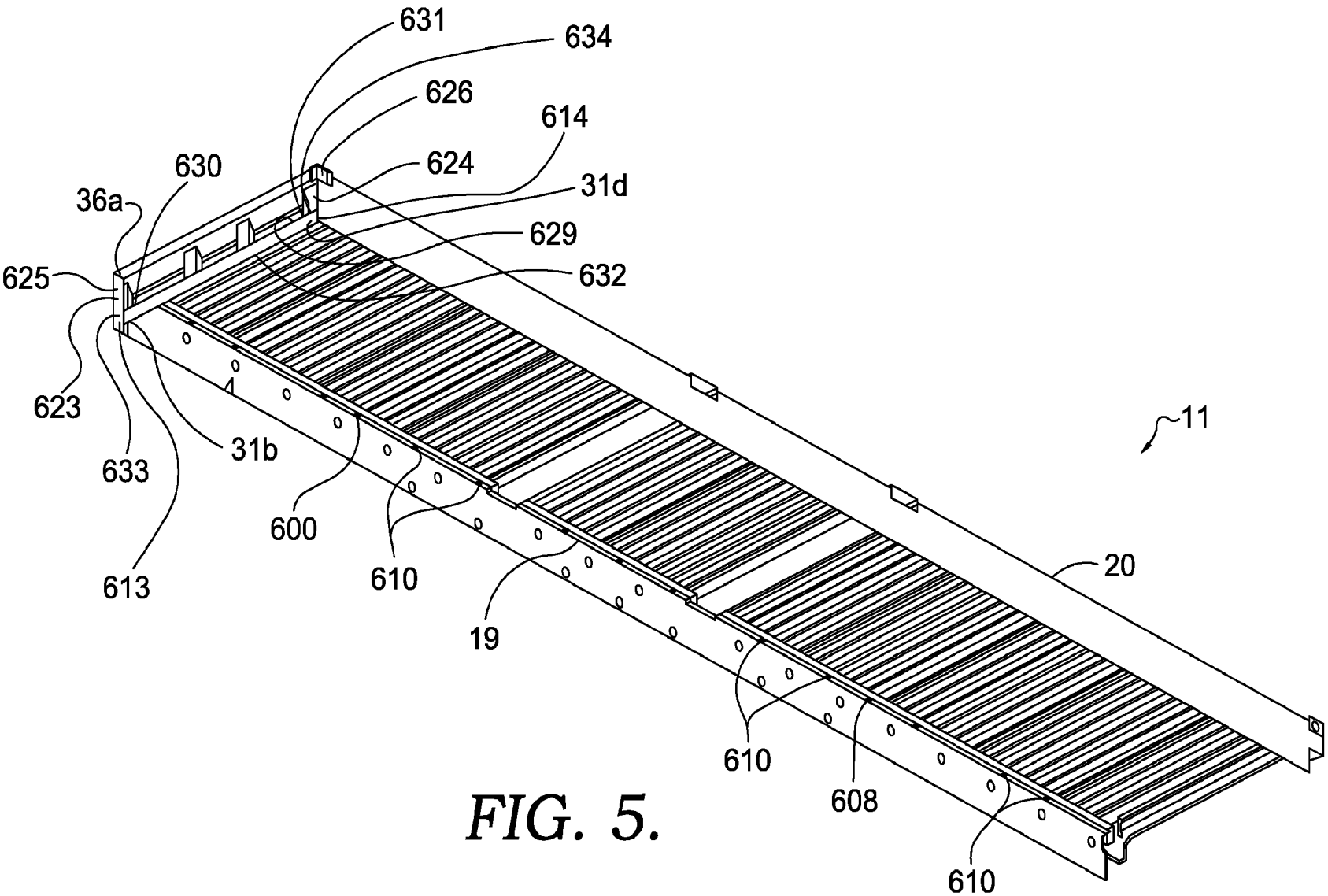
FIG. 5 is a perspective view of the underside of the roof panel.
Figure 6:
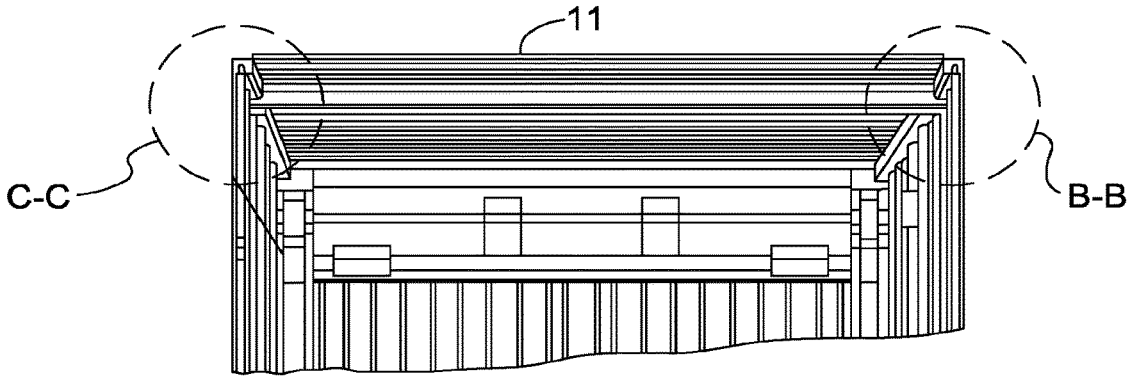
FIG. 6 is a view of the inside of the front panel taken along line A-A of FIG. 1.
Figure 7:
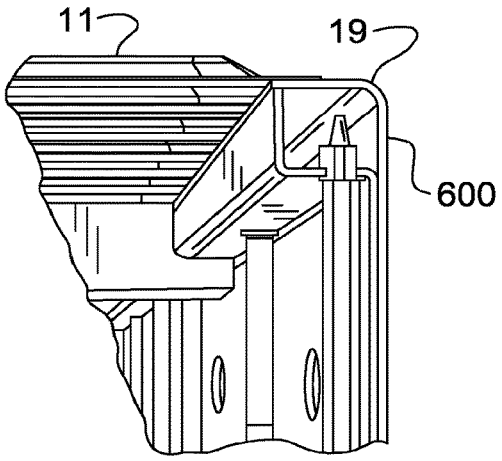
FIG. 7 is an enlarged view of section B-B of FIG. 6.

As shown in FIGS. 4 & 5, a hollow, rectangular roof right beam 600 extends along the right edge 19 of the roof panel 11 from the corner fitting 36*a* on the front edge 22 adjacent the roof right edge 19 of the roof panel 11 to the corner fitting 36*b* on the roof door edge 21 adjacent the roof right edge 19 of the roof panel 11. The roof right beam 600 is continuous except for the interruptions where the roof lifting beams 606, 607 pass through the roof right beam 600. The end 601 of the roof right beam 600 adjacent the roof front edge 22 is rigidly attached to the adjacent corner fitting 36*a*, preferably by welding, and the end 602 of the roof right beam 600 adjacent the roof door edge 21 is rigidly attached to the adjacent corner fitting 36*b*, preferably by welding. Likewise, the roof right beam 600 is preferably welded to the roof lifting beams 606, 607 where they pass through the roof right beam 600. As shown in FIGS. 6&7, the roof right beam 600 is hollow and extends downwardly from the roof right edge 19 a distance of about four inches.

Figure 8:
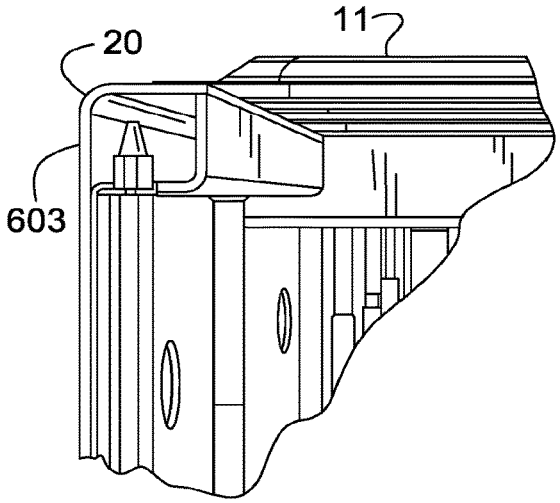
FIG. 8 is an enlarged view of section C-C of FIG. 6.

As shown in FIGS. 4 & 8, a hollow, rectangular roof left beam 603 extends along the roof left edge 20 of the roof panel 11 from the corner fitting 36*c* on the front edge 22 adjacent the roof left edge 20 of the roof panel 11 to the corner fitting 36*d* on the roof door edge 21 adjacent the roof left edge 20 of the roof panel 11. The roof left beam 603 is continuous except for the interruptions where the roof lifting beams 606, 607 pass through the roof left beam 603. The end 604 of the roof left beam 603 adjacent the roof front edge 22 is rigidly attached to the adjacent corner fitting 36*c*, preferably by welding, and the end 605 of the roof left beam 603 adjacent the roof door edge 21 is rigidly attached to the adjacent corner fitting 36*d*, preferably by welding. Likewise, the roof left beam 603 is preferably welded to the roof lifting beams 606, 607 where they pass through the roof left beam 603. The roof left beam 603 is hollow and extends downwardly from the roof left edge 20 a distance of about four inches. The lower face 608 of the roof right beam 600 and the lower face 609 of the roof left beam 603 each contain a plurality of locking bolt holes 610, the purpose of which is described below.

As shown in FIG. 1, along the roof right edge 19 of the roof panel 11, a right skirt 23 extends downwardly therefrom a length of about twelve inches, and as shown in FIG. 2, along the roof left edge 20 of the roof panel 11, a left skirt 24 also extends downwardly therefrom a length of about twelve inches.

Figure 9:
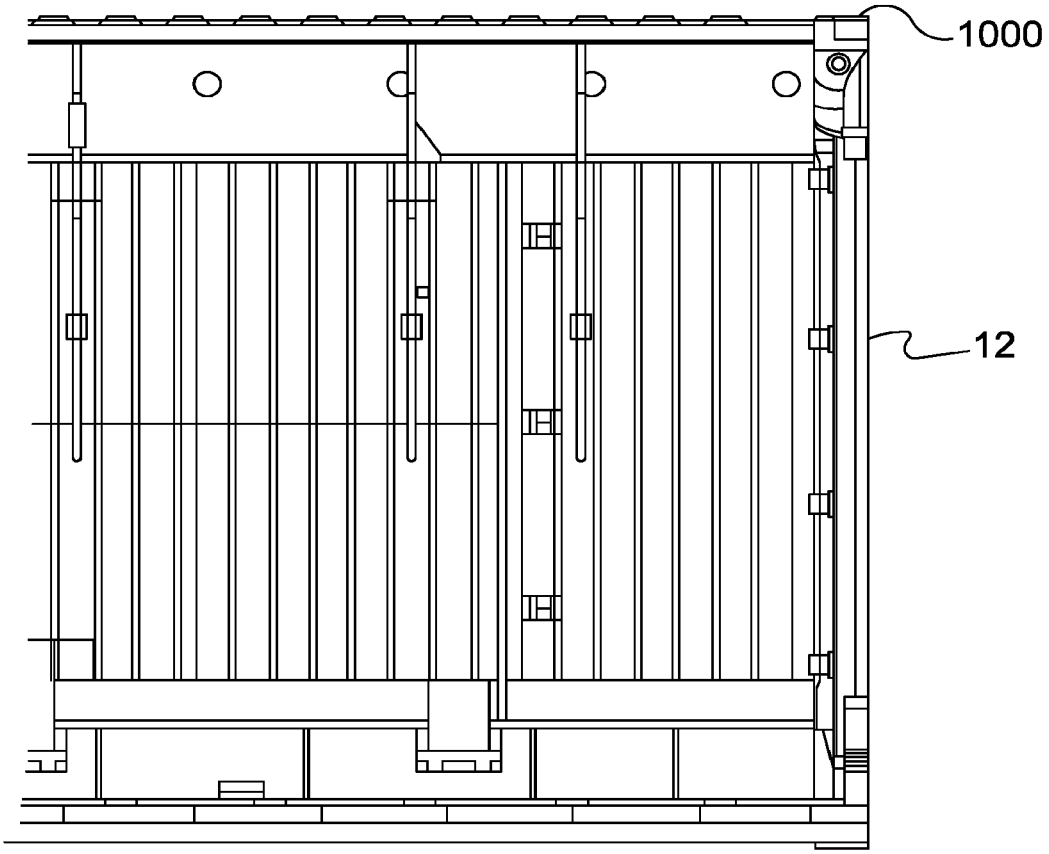
FIG. 9 is a cross sectional view of the front panel taken along line D-D of FIG. 3.
Figure 10:
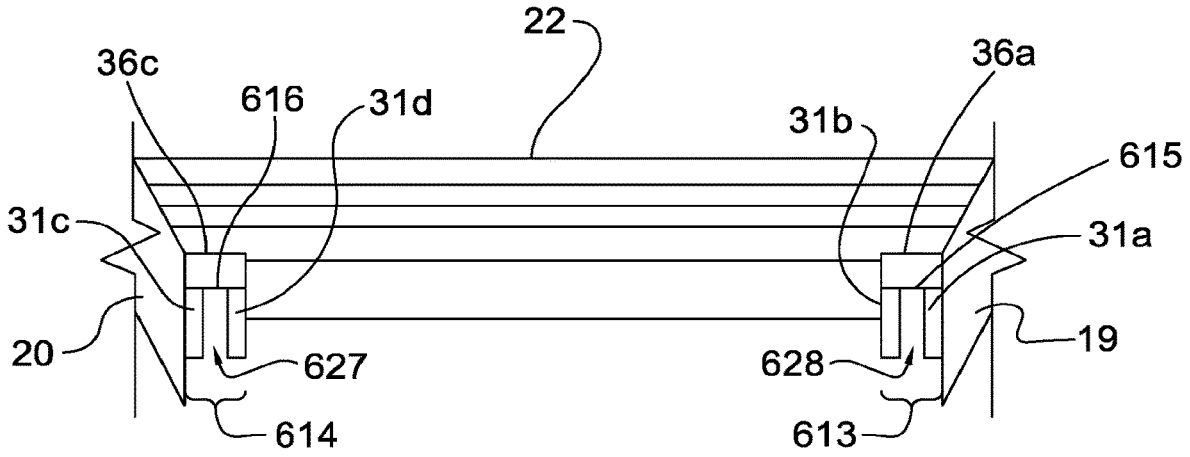
FIG. 10 is a partial view of the underside of the front end of the roof panel.
Figure 11A:
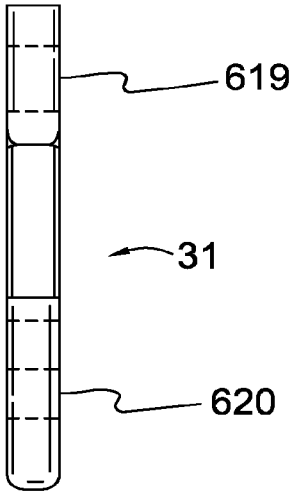
FIGS. 11A and 11B are plan views of the front first hinge members.
Figure 11B:
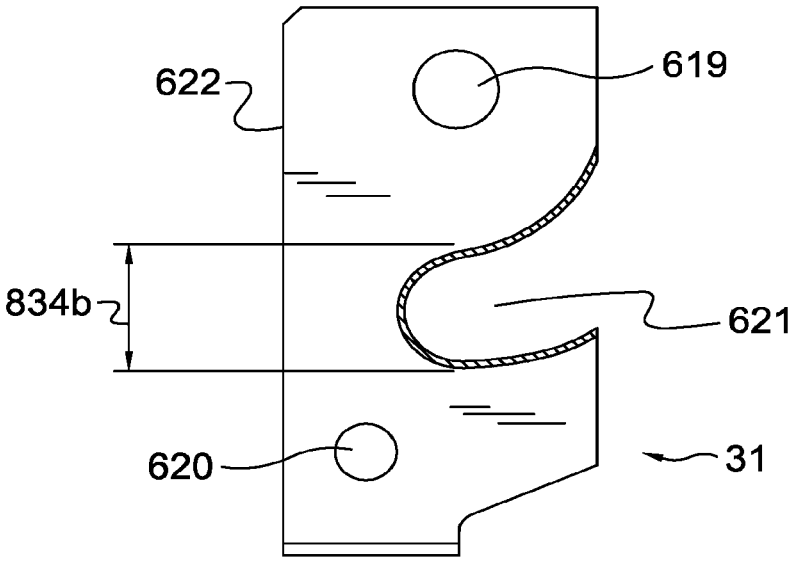

The upper exterior surface 25 of the roof panel 11 is made from corrugated metal, preferably CorTen® steel. As shown in FIGS. 3 & 9, the roof panel 11 includes a hollow, rectangular roof front beam 1000 that has one end 611 adjacent the roof right edge 19 and another end 612 adjacent the roof left edge 20. The roof front beam 1000 extends along the roof front edge 22 of the roof panel 11, and extends downwardly therefrom a distance of about four inches. More specifically, the rectangular roof front beam 1000 extends from the corner fitting 36*a* on the roof front edge 22 to the other corner fitting 36*c* on the roof front edge 22. The end 611 of the front beam 1000 adjacent the corner fitting 36*a* is rigidly attached thereto, preferably by welding, and the end 612 of the roof front beam 1000 adjacent the corner fitting 36*c* is rigidly attached thereto, also preferably by welding. As shown in FIG. 10, the roof panel 11 further includes two front first hinge sets 613, 614. The front first hinge set 613 includes two front first hinge members 31*a*, 31*b*, each rigidly connected to the lower surface 615 of the corner fitting 36*a* adjacent the roof front edge 22 and the roof right edge 19, preferably by welding. The front first hinge set 614 likewise includes two front first hinge members 31*c*, 31*d*, each rigidly connected to the lower surface 616 of the corner fitting 36*c* adjacent the roof front edge 22 and the roof left edge 20, preferably by welding. The front first hinge members 31*a*, 31*b*, of the front first hinge set 613 adjacent the roof right edge 19 are fixed in spaced relation to each other for receiving a front hinge pivot 617, as described in greater detail below, and the front first hinge members 31*c*, 31*d*, of the front first hinge set 614 adjacent the roof left edge 20 are fixed in spaced relation to each other for receiving another front hinge pivot 618, as described in greater detail below. A representative front first hinge member 31 is shown in isolation in FIGS. 11A and 11B. Each front first hinge member has a front hinge edge 622, front pivot hole 619, a front bolt hole 620, and a lug receiving slot 621. The purpose of each of these features is described in greater detail below.

As shown in FIG. 5, a front hinge plate 623, 624, having a length substantially equal to the length of the front hinge edge 622 of the first hinge members 31*a*, 31*b*, 31*c*, 31*d*, is fixedly secured between immediately adjacent first hinge members 31*a*, 31*b*, and 31*c*, 31*d*, preferably by welding along the length of each front hinge edge 622. The combination of front hinge plate 623 and the first front hinge members 31*a*, 31*b* secured to it, form a roof front interlock 625 adjacent the roof right edge 19 of the roof panel 11, and the combination of front hinge plate 624 and the first front hinge members secured to it 31*c*, 31*d*, form a roof front interlock 626 secured to the corner fitting 36*c* adjacent the roof left edge 20 of the roof panel 11. Each front roof interlock 625, 626 has a lower slot 627, 628 for receiving a large tang extending from the base panel 17 when the folding container 10 is in its fully folded condition, as described below.

Figure 12:
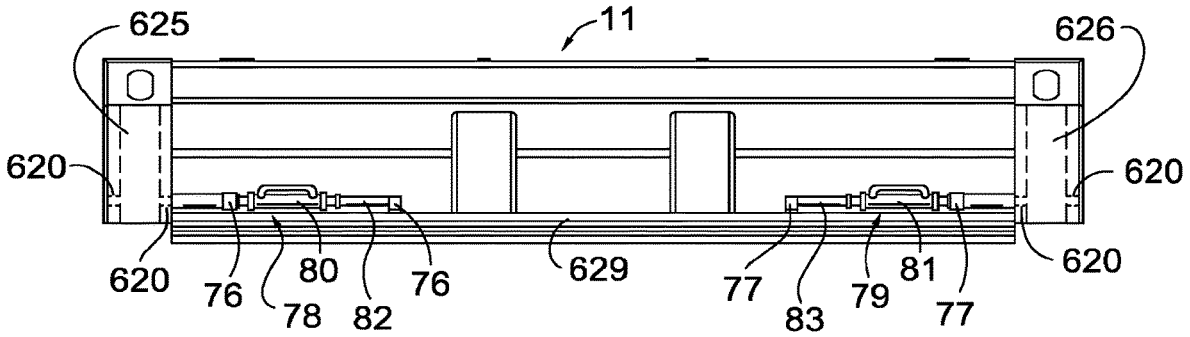
FIG. 12 is a plan view of the front end of the roof panel.

Referring again to FIG. 5, a front shelf beam 629 extends between the front first hinge sets 613, 614, and the end 630 of the front shelf beam 629 adjacent the roof right edge 19 is fixedly secured to the inward front first hinge member 31*b*, preferably by welding, such that the lower edge 632 of the front shelf beam 629 is approximately aligned with the lower edge 633 of the front hinge plate 623. Likewise, the end 631 of the front shelf beam 629 adjacent the roof left edge 20 is fixedly secured to the inward front first hinge member 31*d*, preferably by welding, such that the lower edge 632 of the front shelf beam 629 is approximately aligned with the lower edge 634 of the front hinge plate 624. As shown in FIG. 12, mounted to the front shelf beam 629 adjacent each roof front interlock 625, 626, and aligned with the bolt holes 620 therein, are hammer lock retainers 76, 77. A hammer locking mechanism 78, 79, including a slide hammer 80, 81, and a hammer locking bolt 82, 83 is slideably secured to each of the hammer lock retainers 76, 77, such that each hammer locking mechanism 78, 79 is positionable by use of one of the slide hammers 80, 81, slideably mounted on one of the hammer locking bolts 82, 83, between an unlocked position in which the respective hammer locking bolt 82, 83, is in a retracted position substantially outside of the roof front interlock 625, 626, immediately adjacent thereto, and a locked position in which the respective hammer locking bolt 82, 83 extends through the bolt holes 620 of the roof front interlock 625, 626 immediately adjacent thereto.

Figure 13:
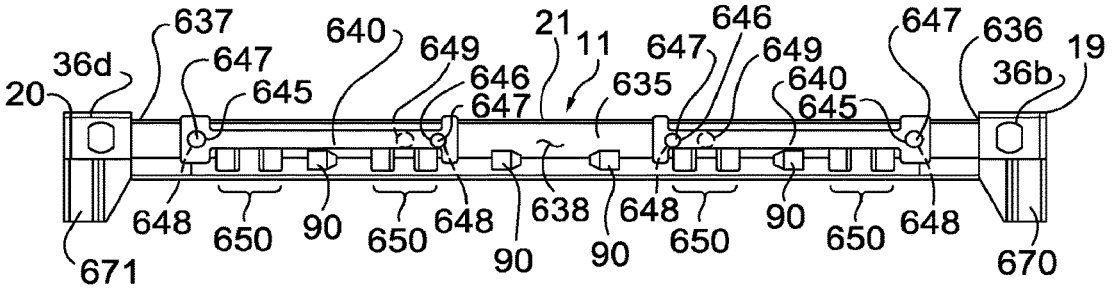
FIG. 13 is a plan view of the door end of the roof panel.

As shown in FIG. 13, the roof panel 11 includes a hollow, rectangular roof door beam 635 that extends along the roof door edge 21 of the roof panel 11, and extends downwardly therefrom a distance of about four inches. The hollow, rectangular roof door beam 635 extends from the corner fitting 36*b* on the roof door edge 21 adjacent the roof right edge 19 to the corner fitting 36*d* on the roof door edge 21 adjacent the roof left edge 20. The end 636 of the roof door beam 635 adjacent the roof right edge 19 is rigidly attached to the corner fitting 36*b* adjacent the roof right edge 19, preferably by welding, and the end 637 of the roof door beam 635 adjacent the roof left edge 20 is rigidly attached to the corner fitting 36*d* adjacent the roof left edge 20, preferably by welding. The exterior vertical face 638 of the rectangular roof door beam 635 includes a plurality of lock hasps 90, preferably four, rigidly secured thereto for receiving the upper ends 91 of each of the locking rods 92 of the door latch assembly 639 as described below. The roof panel 11 further includes a pair of locking straps 640, removably secured thereto adjacent the lock hasps 90. Each locking strap 640 is preferably made of steel, and has a shape of similar to that of an "I". Adjacent each end of each locking strap 640 is a bolt hole 645, 646, for receiving one of the strap bolts 647 that are used to removably secure the locking strap 640 to the container 10 when the container 10 is in its folded, and unfolded, condition, as described below. When the container 10 is in its unfolded condition, the strap bolts 647 are received within stored strap bolt holes 648, not shown, that secure the locking strap 640 to the roof panel 11. The roof panel 11 also includes two upper active strap bolt holes 649, not shown, for use when the container 10 is in its folded condition, as described below. A plurality, and preferably four (4), pairs of upper door stop receivers 650 are welded to the exterior vertical face 638 of the rectangular roof door beam 635 adjacent the lock hasps 90, the upper door stop receivers 650 of each such pair being in spaced relation to each other. Each of the upper active strap bolt holes 649 is aligned with one pair of upper door stop receivers 650. As those skilled in the art will readily appreciate, when a locking strap 640 is secured by a strap bolt 647 to one of the upper active strap bolt holes 649, the "T" at one end 645 of the locking strap 640 rests on one pair of the door stop receivers when the locking strap 640 is supporting a load. Accordingly, the thickness of the each locking strap 640, and the load carrying ability of the upper door stop receivers 650 on which the locking strap 640 rests, must be sufficient to support, at a minimum, a weight equal to that of the entire container 10 when the container 10 is empty, which, in turn, depends on the material from which the container 10, the locking straps 640, and the upper door stop receivers 650 are made, as well as the strength of the welds securing the upper door stop receivers 650 to the roof door beam 635.

Figure 14:
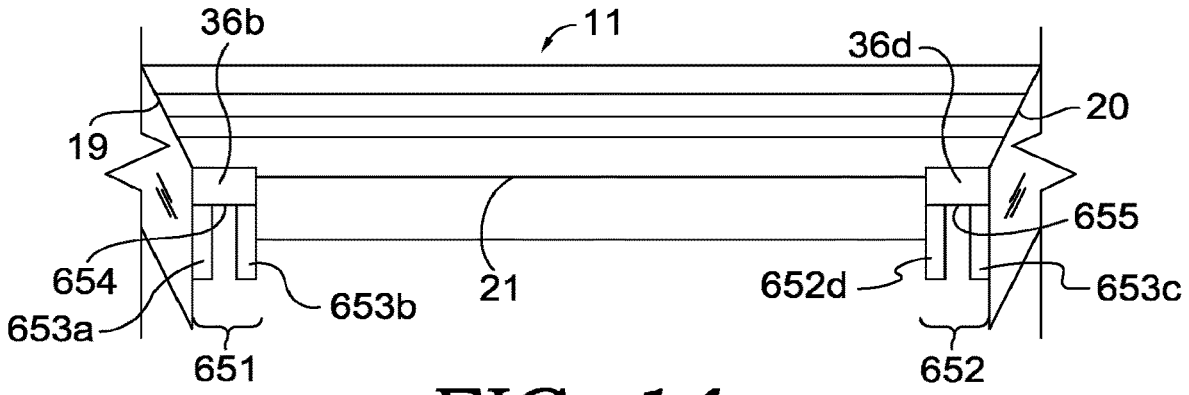
FIG. 14 is a partial view of the underside of the door end of the roof panel.
Figure 15:
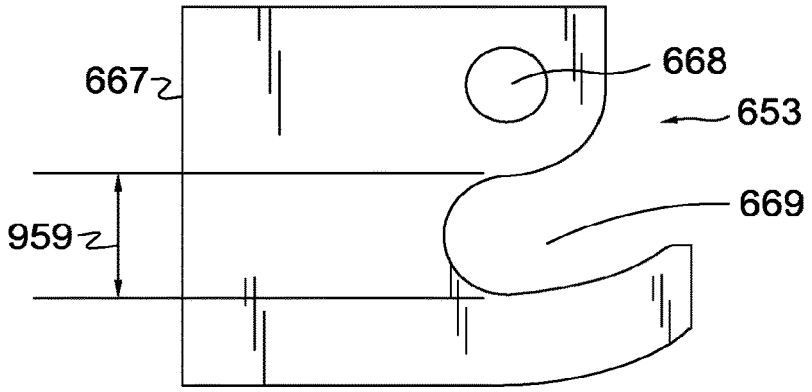
FIG. 15 is a plan view of the door first hinge members.

As shown in FIG. 14, the roof panel 11 further includes two door first hinge sets 651, 652. The door first hinge set 651 includes two door first hinge members 653*a*, 653*b*, each rigidly connected to the lower surface 654 of the corner fitting 36*b* adjacent the roof door edge 21 and the roof right edge 19, preferably by welding. The door first hinge set 652 likewise includes two door first hinge members 653*c*, 653*d*, each rigidly connected to the lower surface 655 of the corner fitting 36*d* adjacent the roof door edge 21 and the roof left edge 20, preferably by welding. The door first hinge members 653*a*, 653*b*, of the door first hinge set 651 adjacent the roof right edge 19 are fixed in spaced relation to each other for receiving a door hinge pivot 656, as described in greater detail below, and the door first hinge members 653*c*, 653*d*, of the door first hinge set 652 adjacent the roof left edge 20 are fixed in spaced relation to each other for receiving a front hinge pivot 666, as described in greater detail below. A representative door first hinge member 653 is shown in isolation in FIG. 15. Each door first hinge member 653 has a door hinge edge 667, door pivot hole 668, and a door lug receiving slot 669. The purpose of each of these features is described in greater detail below.

Referring again to FIG. 13, a door hinge plate 670, 671, having a length substantially equal to the length of the door hinge edge 667 of the door first hinge members 653*a*, 653*b*, 653*c*, 653*d*, is fixedly secured between immediately adjacent door first hinge members 653*a*, 653*b*, 653*c*, 653*d*, preferably by welding along the length of each door hinge edge 667.

Figure 16:
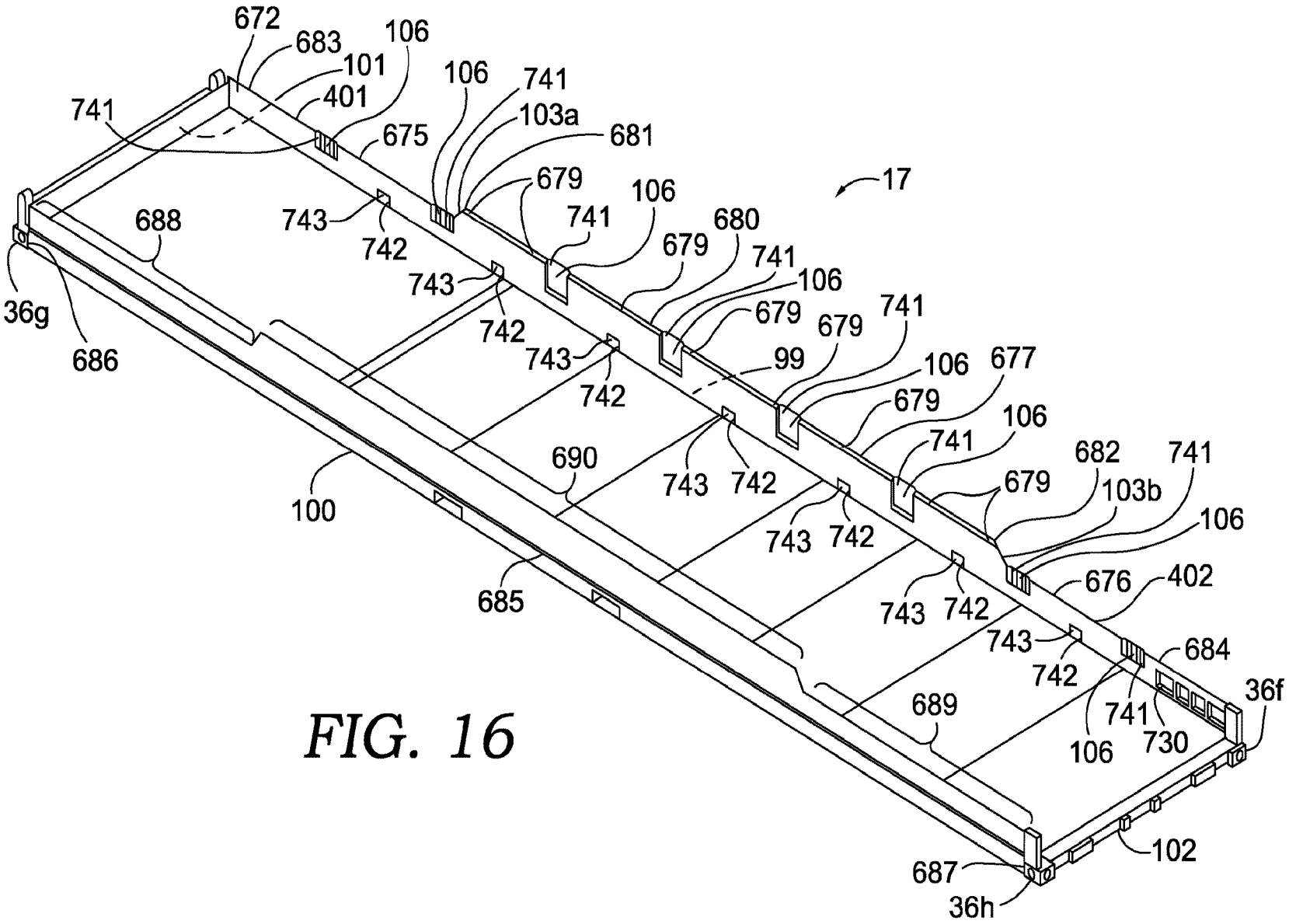
FIG. 16 is a perspective view of the upper side of the left side of the base panel.
Figure 17:
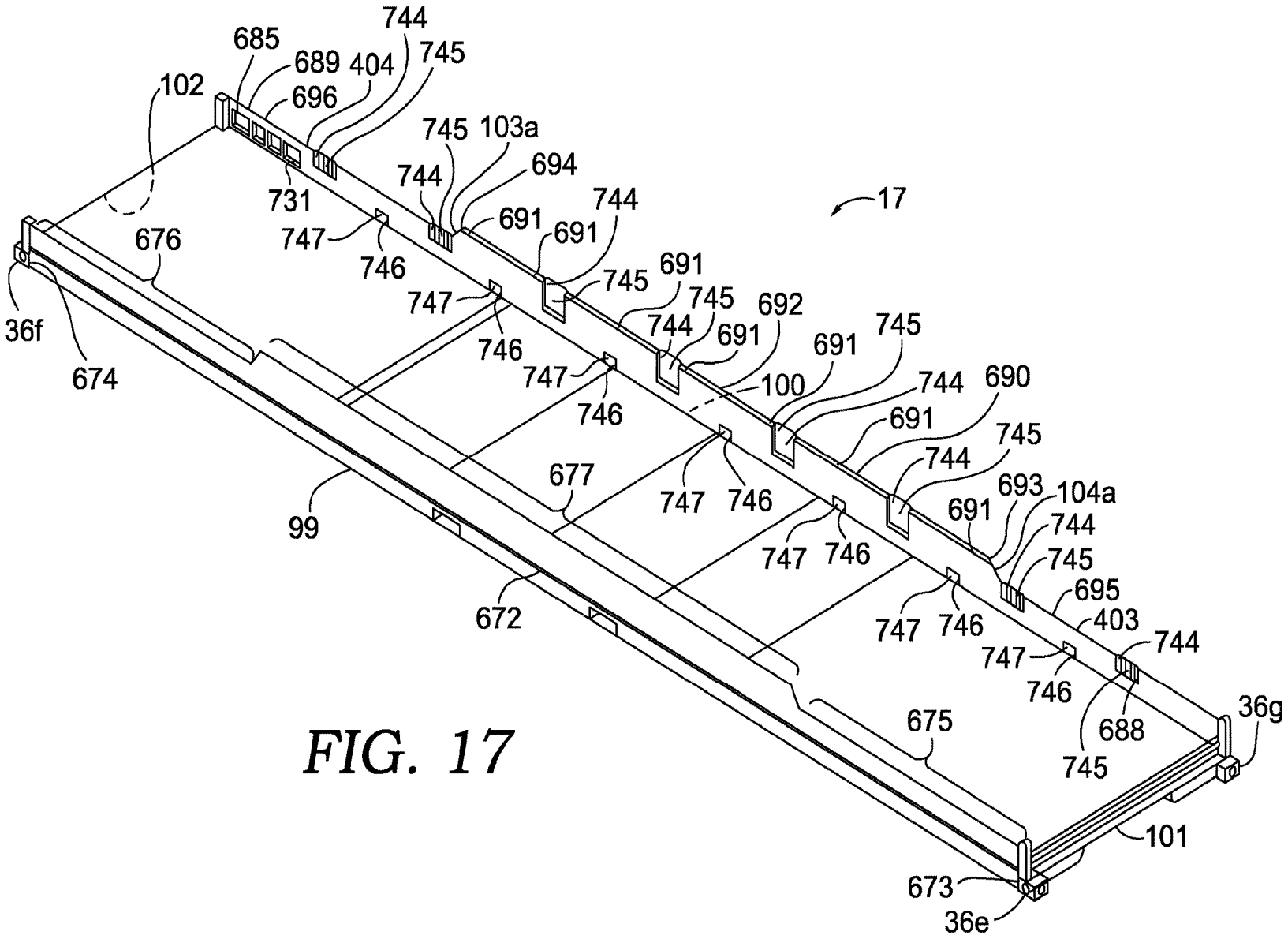
FIG. 17 is a perspective view of the upper side of the right side of the base panel.

As shown in FIGS. 16 & 17, the base panel 17 includes a base right edge 99, a base left edge 100, a base front edge 101, and a base door edge 102. The base panel 17 includes four standard corner fittings 36*e*, 36*f*, 36*g*, 36*h* of the type known in the art for securing the container 10 to another container on which it may be stacked. One corner fitting 36*e*, 36*f*, 36*g*, 36*h* is located on the base panel 17 adjacent each end of the base front edge 101, and adjacent each end of the base door edge 102, in accordance with the international standards.

As shown in FIG. 17, a hollow, rectangular base right beam 672 extends along the base right edge 99 of the base panel 17 from the corner fitting 36*e* on the base front edge 101 adjacent the base right edge 99 of the base panel 17 to the corner fitting 36*f* on the door edge 102 adjacent the right edge 99 of the base panel 17. Each end 673, 674 of the base right beam 672 is rigidly attached to the adjacent corner fitting 36*e*, 36*f*, preferably by welding. The base right beam 672 comprises base right beam lower portions 675, 676 which extend upwardly from the base right edge 99 a distance of about eight inches, and a base right beam upper portion 677 that extends further up from the base right edge 99 to a height of about twelve inches. Referring again to FIG. 16, a plurality of cable anchors 679, the purpose of which is described in greater detail below, are secured to base right beam 672 in spaced relation to each other adjacent the upper edge 680 of the base right beam upper portion 677. Sloped right transition portions 103*a*, 103*b*, extend between each end 681, 682 of the base right beam upper portion 677 to the base right beam lower portions 675, 676 adjacent thereto. The top edge 683, 684 of each of the base right beam lower portions 675, 676, is capped with a guide rail 401, 402, preferably made of stainless steel. The purpose of the guide rails 401, 402, and the purpose of the base right beam lower portions 675, 676 of the base right beam 672, are discussed below.

As shown in FIG. 16, a hollow, rectangular base left beam 685 extends along the base left edge 100 of the base panel 17 from the corner fitting 36*g* on the base front edge 101 adjacent the base left edge 100 of the base panel 17 to the corner fitting 36*h* on the door edge 102 adjacent the left edge 100 of the base panel 17. Each end 686, 687 of the base left beam 685 is rigidly attached to the adjacent corner fitting 36*g*, 36*h*, preferably by welding. The base left beam 685 comprises base left beam lower portions 688, 689 which extend upwardly from the base left edge 100 a distance of about eight inches, and a base left beam upper portion 690 that extends further up from the base left edge 100 to a height of about twelve inches. Referring again to FIG. 17, a plurality of cable anchors 691, the purpose of which is described in greater detail below, are secured to base left beam 685 in spaced relation to each other adjacent the upper edge 692 of the base right beam upper portion 690. Sloped left transition portions 104*a*, 104*b*, extend between each end 693, 694 of the base left beam upper portion 690 to the base left beam lower portions 688, 689 adjacent thereto. The top edge 695, 696 of each of the base left beam lower portions 688, 689, is capped with a guide rail 403, 404, preferably made of stainless steel. The purposes of the guide rails 403, 404, and the purpose of the base left beam lower portions 688, 689 of the base left beam 685, are discussed below.

Figure 18:
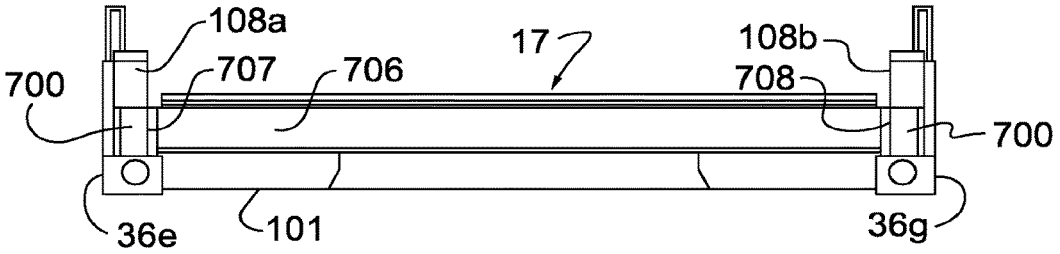
FIG. 18 is a plan view of the front end of the base panel.
Figure 19:
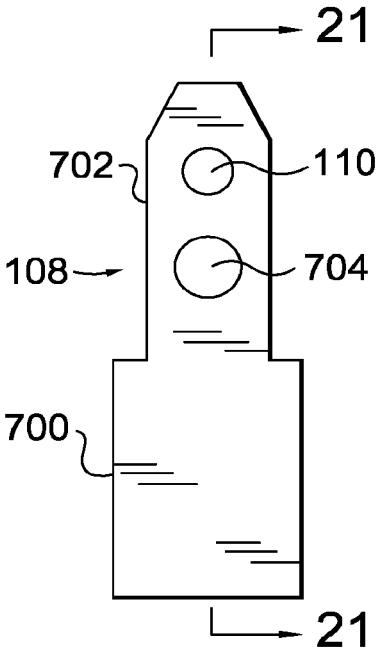
FIGS. 19, 20 and 21 are views of base front tangs.
Figure 20:
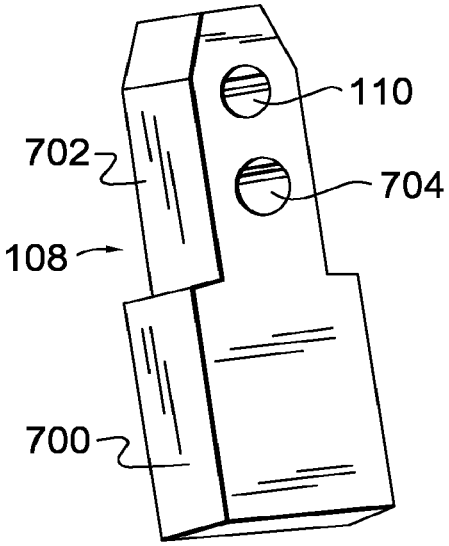
Figure 21:
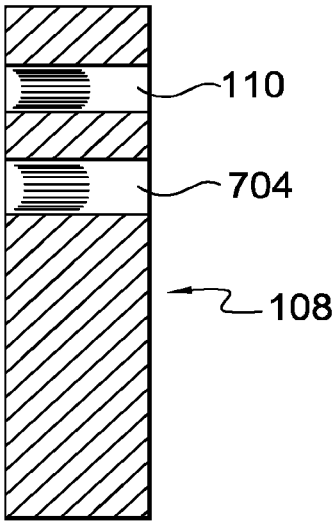

As shown in FIG. 18, extending upward from each corner fitting 36*e*, 36*g* on the base panel 17 adjacent the front edge 101 is a base front tang 108*a*, 108*b*. A representative base front tang 108 is shown in FIGS. 19-21. Each of the base front tang 108 has a rectangular base portion 700, and a locking portion 702 extending therefrom. The locking portion 702 of each base front tang 108 includes an upper tapered locking hole 110 and a lower tapered locking hole 704, each of which is substantially parallel to the front edge 101 of the base panel 17, and each of which is sized and located so as to be able to receive therein one of the hammer locking bolts of the front panel 12, as discussed below.

Referring back to FIG. 18, the base portion 700 of each base front tang 108*a*, 108*b* is fixedly secured to the corner fitting 36*e*, 36*g* it extends from, preferably by welding. The base panel 17 includes a hollow, rectangular base front beam 706 that extends between the base portions 700 of the base front tangs 108*a*, 108*b*. Each end 707, 708 of the base front beam 706 is rigidly attached to the base portion 700 of the base front tang 108*a*, 108*b* immediately adjacent thereto, preferably by welding.

Figure 22:
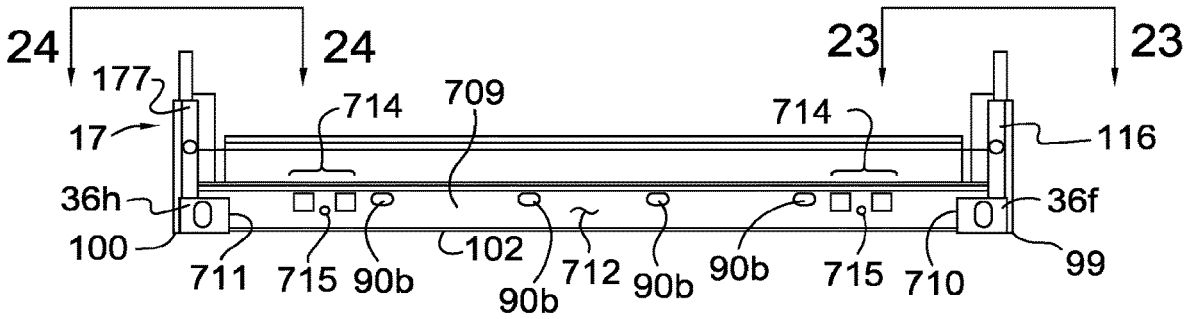
FIG. 22 is a plan view of the door end of the base panel.

As shown in FIG. 22, the base panel 17 includes a hollow, rectangular base door beam 709 that extends along the door edge 102 of the base panel 17, and extends upwardly therefrom a distance of about four inches. The base door beam 109 extends from the corner fitting 36*f* on the door edge 102 adjacent the right edge 99 of the base panel 17 to the corner fitting 36*h* on the door edge 102 adjacent the left edge 100 of the base panel 17. Each end 710,711 of the base door beam 709 is rigidly attached to the adjacent corner fitting 36*f*, 36*h*, preferably by welding. The exterior vertical face 712 of the base door beam 709 includes a plurality of lock hasps 90*b*, preferably four, rigidly secured thereto for receiving lower end 713 of each of the locking rods 92 of the door latch assembly as described below. The door end of the base panel 17 further includes at least two pairs of lower door stop receivers 714 that are welded to the exterior vertical face 712 of the rectangular base door beam 709 adjacent the lock hasps 90*b* closest to the corner fittings 36*f*, 36*h*, the lower door stop receivers 714 of each such pair being in spaced relation to each other. A lower active strap bolt hole 715 is aligned with each pair of lower door stop receivers 714. As those skilled in the art will readily appreciate, when a locking strap 640 is secured by a strap bolt 647 to one of the lower active strap bolt holes 715, the inverted "T" at one end of the locking strap 640 supports the load placed on it by the pair of door stop receivers 714 within which the locking strap 640 is received. Accordingly, the load carrying ability of the lower door stop receivers 714 which rest on the locking strap 640 must be sufficient to support, at a minimum, a weight equal to that of the entire container 10 when the container 10 is empty, which, in addition to those factors previously stated, depends on the material from which the lower door stop receivers 714 are made, as well as the strength of the welds securing the lower door stop receivers 714 to the base door beam 709.

Figure 23:
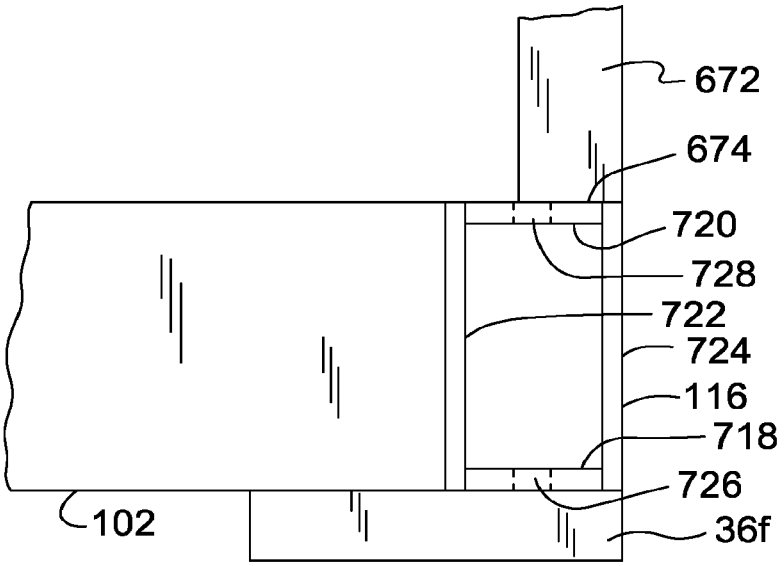
FIG. 23 is a plan view of the right side door interlock.
Figure 24:
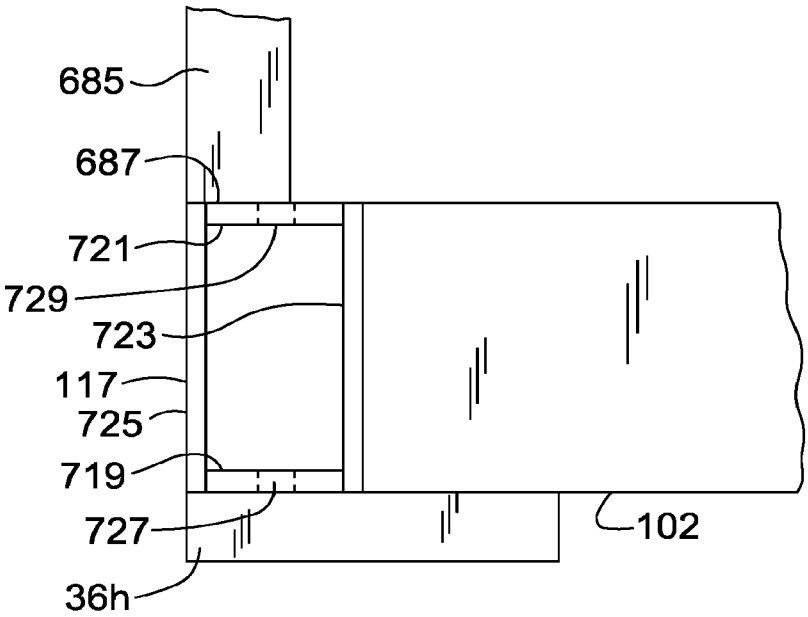
FIG. 24 is a plan view of the left side door interlock.

Extending upwardly from each of the corner fittings 36*f*, 36*h* on the door edge 102 of the base panel 17 is a door interlock 116, 117. As shown in FIGS. 23 & 24, each door interlock 116, 117 has four walls: a door wall 718, 719 which faces the door edge 102 of the base panel 17, a front wall 720, 721 which faces the front edge 101 of the base panel 17 and is parallel to, and in spaced relation with, the door wall 718, 719, an inner wall 722, 723 that is perpendicular to the door wall 718, 719 and the front wall 720, 721 and faces the inner wall 720, 721 of the other door interlock 116, 117, and an outer wall 724, 725 which is parallel to, and in spaced relation with, the inner wall 720, 721. The door interlock 116 extending from the corner fitting 36*f* on the door edge 102 adjacent the base right beam 672 is rigidly attached to that corner fitting 36*f* and the door end 674 of the base right beam 672, preferably by welding. Likewise, the door interlock 117 extending from the corner fitting 36*h* on the door edge 102 adjacent the base left beam 685 is rigidly attached to that corner fitting 36*h* and the door end 687 of the base left beam 685, also preferably by welding.

Each door interlock 116, 117 has a first bolt hole 726, 727 in the door wall 718, 719 thereof, and a second bolt hole 728, 729 in the front wall 720, 721 thereof aligned with the first bolt hole 726, 727 of the same door interlock 116, 117. The diameter of the second bolt holes 728, 729 is preferably slightly larger than the diameter of the first bolt holes 726, 727 for reasons discussed below.

Figure 25:
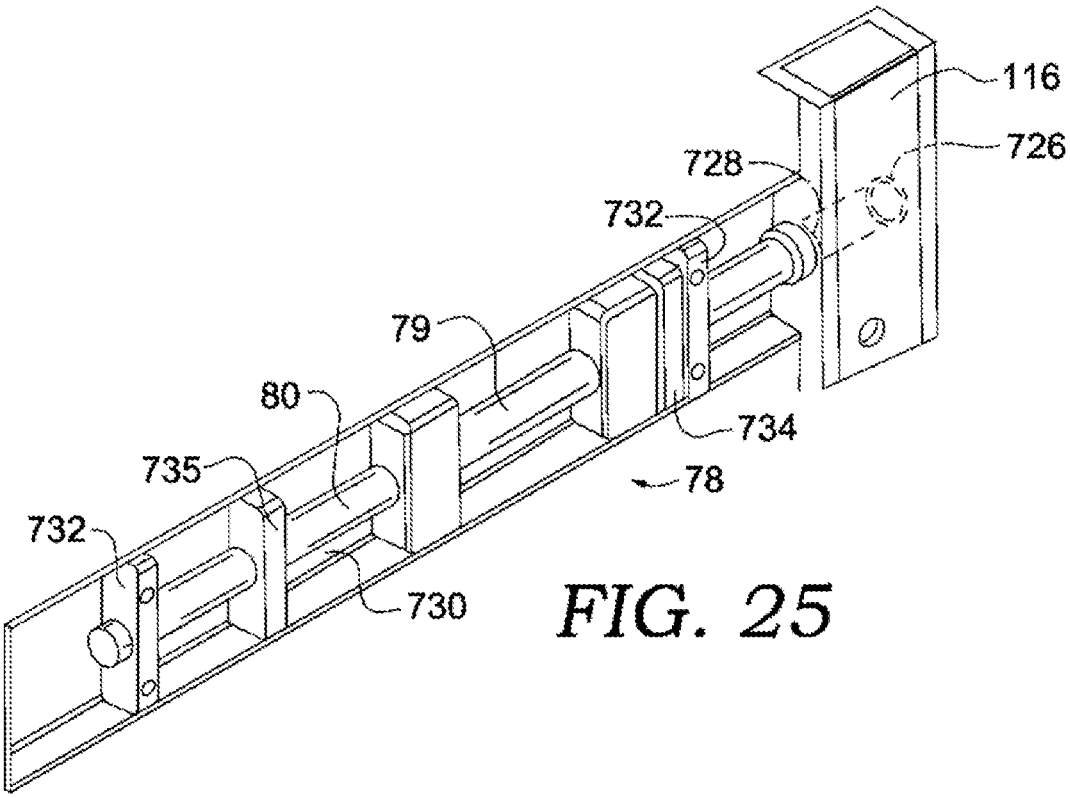
FIG. 25 is a view of the base panel hammer locking mechanism and right door interlock.

As shown in FIGS. 16 & 17, the lower portion 676 of the base right beam 672 and the lower portion 689 of the base left beam 685 each include a recessed portion 730, 731 immediately adjacent the door edge 102 of the base panel 17. As shown in greater detail in FIG. 25, hammer lock retainers 732 are mounted in the recessed portion 730 of the lower portion 676 of the base right beam 672 adjacent the door interlock 116 and aligned with the bolt holes 726, 728 therein. Likewise, as shown in greater detail in FIG. 26, hammer lock retainers 733 are mounted in the recessed portion 731 of the lower portion 689 of the base left beam 685 adjacent the door interlock 117 and aligned with the bolt holes 727, 729 therein. As shown in FIG. 25, a hammer locking mechanism 78 is slideably secured to the hammer lock retainers 732 in the recessed portion 730 of the lower portion of the base right beam 676. The hammer locking mechanism 78 therein includes a slide hammer 80 slideably mounted on a hammer locking bolt 82. As those skilled in the art will readily appreciate, by sliding the slide hammer 80 against one of the hammer stops 734, 735, the hammer locking bolt 82 can be selectively positioned at an unlocked position in which the hammer locking bolt 82 is in a retracted position substantially outside of the interlock 116 immediately adjacent thereto, and a locked position in which the locking bolt 82 extends through the bolt holes 726, 728 of the interlock 116 immediately adjacent thereto.

Figure 26:
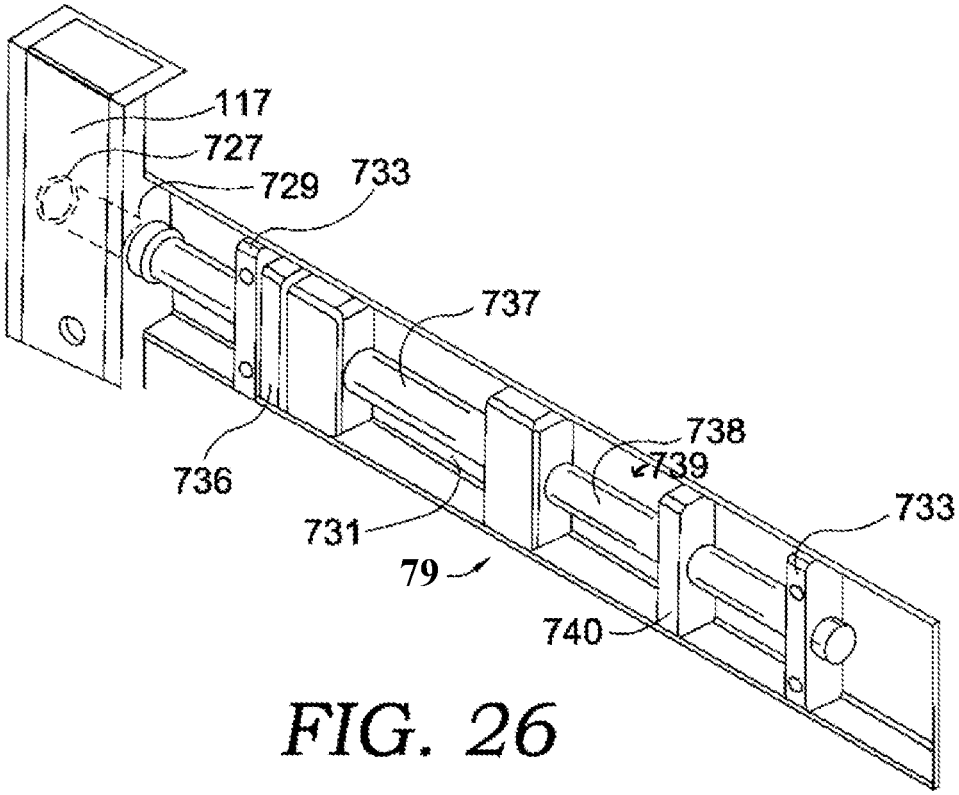
FIG. 26 is a view of the base panel hammer locking mechanism and left door interlock.

Likewise, as shown in FIG. 26, a hammer locking mechanism 736 is slideably secured to the hammer lock retainers 733 in the recessed portion 731 of the lower portion of the base left beam 689. The hammer locking mechanism 736 therein includes a slide hammer 737 slideably mounted on a hammer locking bolt 738. As those skilled in the art will readily appreciate, by sliding the slide hammer 737 against one of the hammer stops 739, 740, the hammer locking bolt 738 can be selectively positioned at an unlocked position in which the hammer locking bolt 738 is in a retracted position substantially outside of the interlock 117 immediately adjacent thereto, and a locked position in which the locking bolt 738 extends through the bolt holes 727, 729 of the interlock 117 immediately adjacent thereto.

Figure 41B:
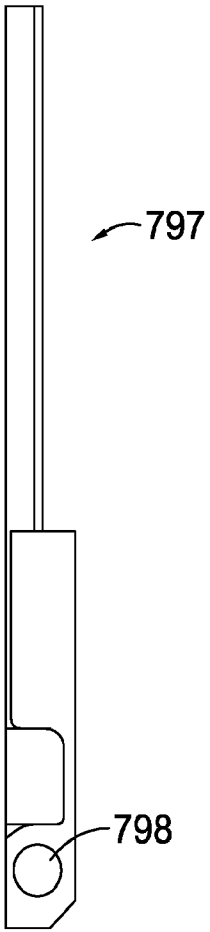
FIGS. 41A and 41B are plan views of the side hinge members.
Figure 41A:
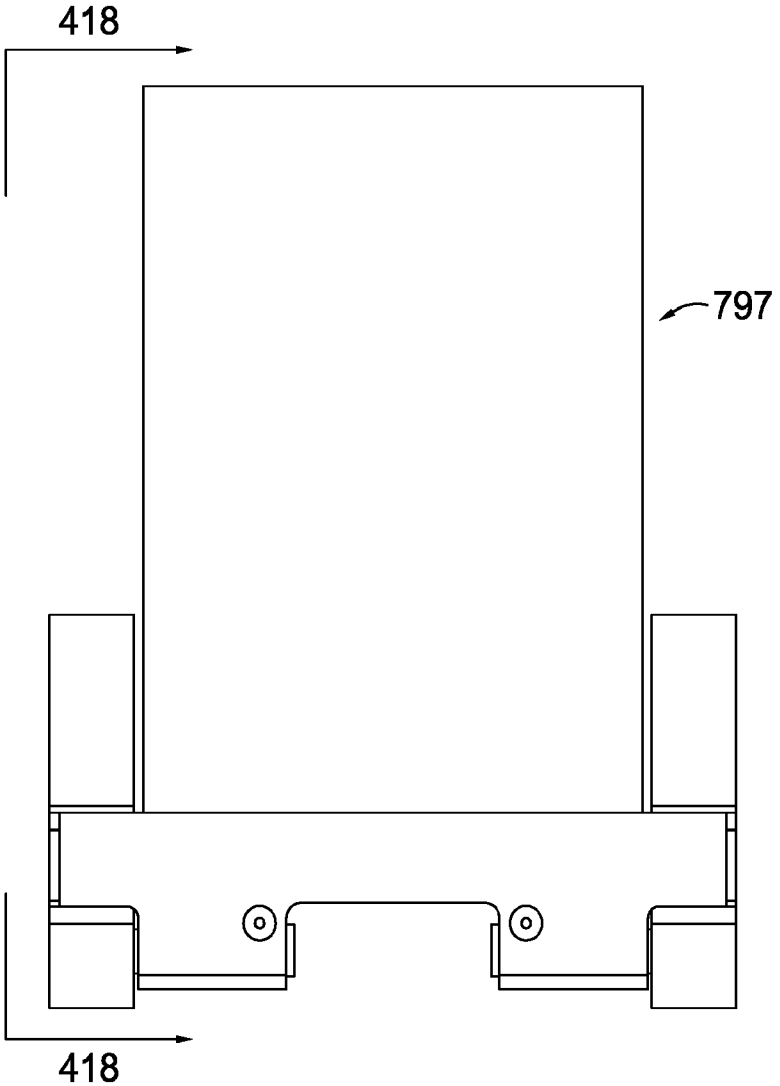

Referring again to FIG. 16, the base right beam 672 includes a plurality of right hinge recesses 741 in spaced relation to each other along the length of the base right beam 672, and a base right hinge member 106 is fixedly secured within each of the right hinge recesses 741. A close-up view exemplary of a base right hinge member 106 is shown in FIG. 41. Additionally, the base right beam 672 preferably includes a plurality of small recesses 742 spaced along the length thereof, within which tie-down bars 743 are rigidly mounted for receiving tie-down straps of the type known in the art for securing the contents of the container 10 during shipping.

As shown in FIG. 17, the base left beam 685 includes a plurality of left hinge recesses 744 in spaced relation to each other along the length of the base left beam 685, and a base left hinge member 745 is fixedly secured within each of the left hinge recesses 744. The base left hinge member 745 is similar in design and function to the base right hinge member 106 shown in FIG. 41. Additionally, the base left beam 685 preferably includes a plurality of small recesses 746 spaced along the length thereof, within which tie-down bars 747 are rigidly mounted for receiving tie-down straps of the type known in the art for securing the contents of the container 10 during shipping.

Figure 27:
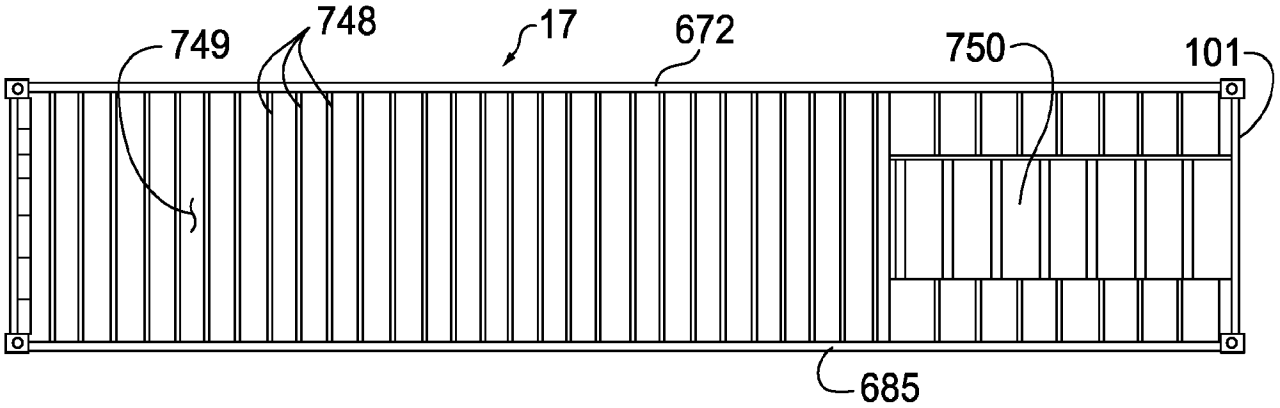
FIG. 27 is a plan view of the underside of the base panel.
Figure 28:
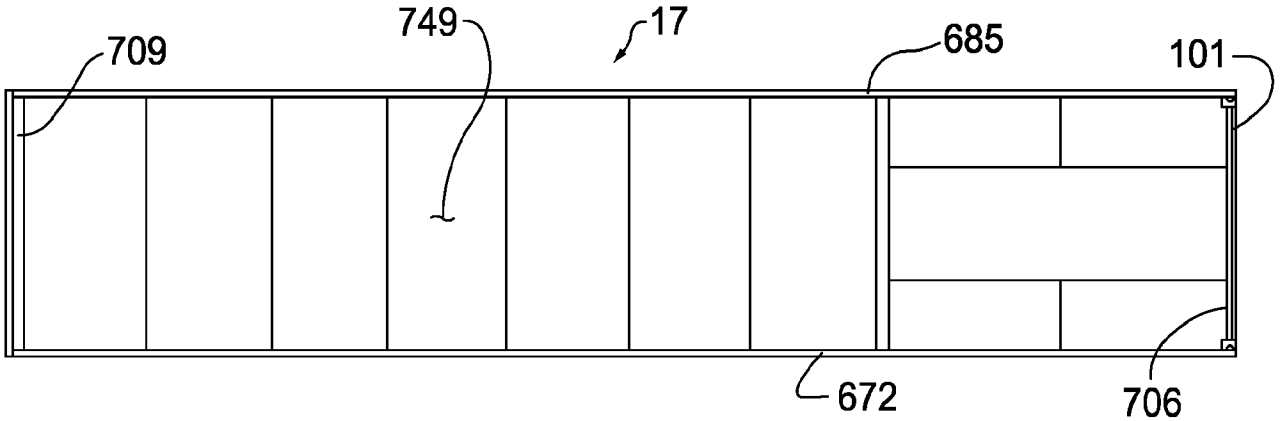
FIG. 28 is a plan view of the upper side of the base panel.

As shown in FIGS. 3, 27 & 28, a plurality of base support beams 748 are secured to the base right beam 672 and the base left beam 685 and span therebetween to add structural rigidity to the floor 749 of the base panel 17. Adjacent the base front edge 101, the base panel 17 includes a "gooseneck tunnel" 750 of the type known in the art. As shown in FIG. 3, a pair of hollow, base lifting beams 751, 752 are secured to the base right beam 672 and the base left beam 685, preferably by welding, and span therebetween to add structural rigidity to the base panel 17 and to provide means for lifting the foldable container 10 by use of a fork lift if desired. The floor 749 of the base panel 17 is preferably made of a sheet of Cor-Ten steel extending from the base right beam 672 to the base left beam 685, and from the base front beam 706 to the base door beam 709. The floor 749 is welded about its entire periphery to the right beam 672, the base left beam 685, the base front beam 706 and the base door beam 709, to make the base panel 17 watertight with respect to the floor 749. The floor 749 is also welded to the base support beams 748 and the base lifting beams 751, 752 for structural purposes. Preferably, the floor 749 is covered with plywood, or a similarly suitable flooring material.

Figure 29:
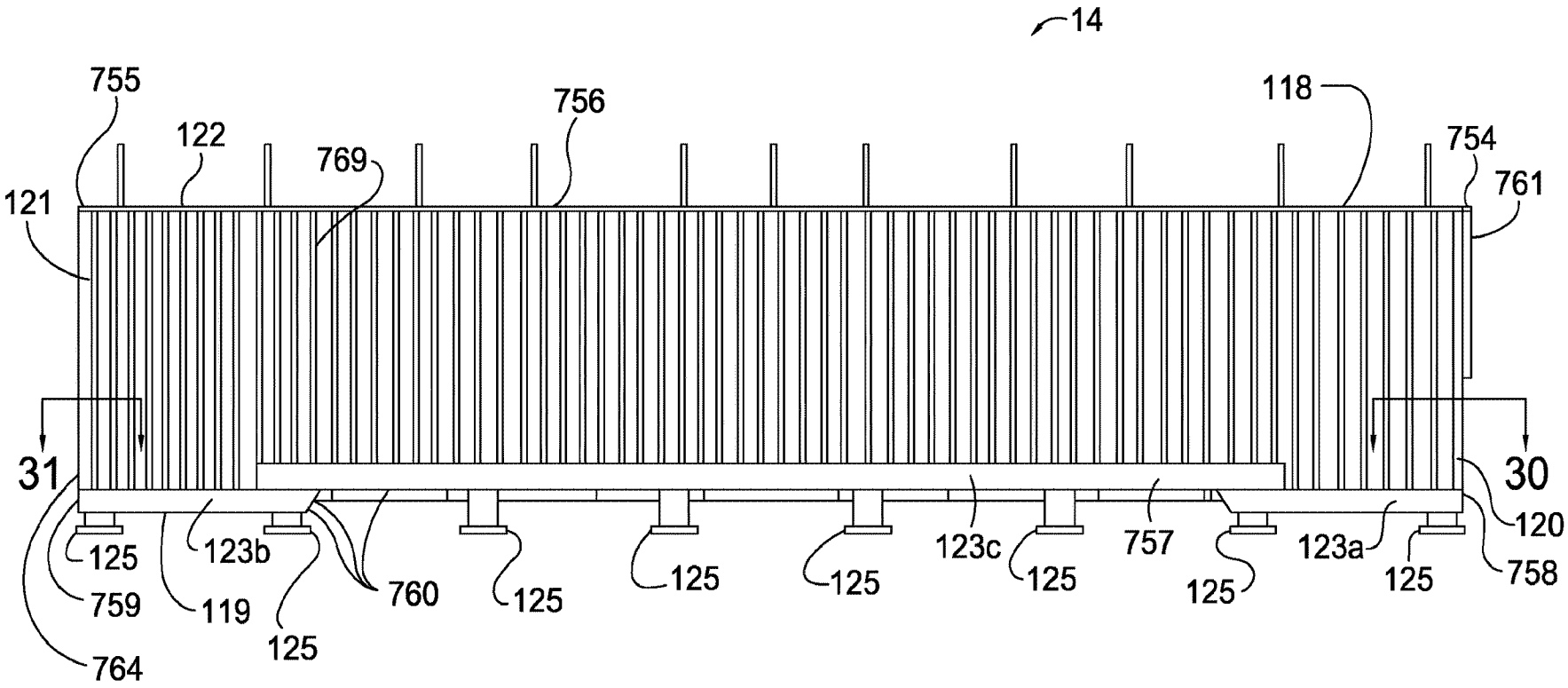
FIG. 29 is a plan view of the external surface of the right side panel.

As shown in FIG. 29, the right side panel 14 includes a top edge 118, a bottom edge 119, a front edge 120 and a door edge 121. Extending along the top edge 118 of the right side panel 14 along the length thereof is a right upper cap plate 122 having a front end 754, a door end 755, and a right roof flange 756 extending from the front end 754 to the door end 755. Extending along the bottom edge 119 of the right side panel 14 along the length thereof is a right compound beam 757 that has a front end 758 and a door end 759. The right compound beam 757 comprises a right upper horizontal beam 123*c* rigidly connected to two right lower horizontal beams 123*a*, 123*b*, preferably by welding. As shown in FIGS. 16 & 29, the lower edge 760 of the right compound beam 757 has a profile that matches the profile formed by the upper edge 680 of the base right beam upper portion 677, the top edges 683, 684 of the base right beam lower portions 675, 676, and the sloped right transition portions 103*a*, 103*b* of the base panel 17, to provide mating sealing surfaces when the container 10 is in its unfolded condition.

Figure 30:
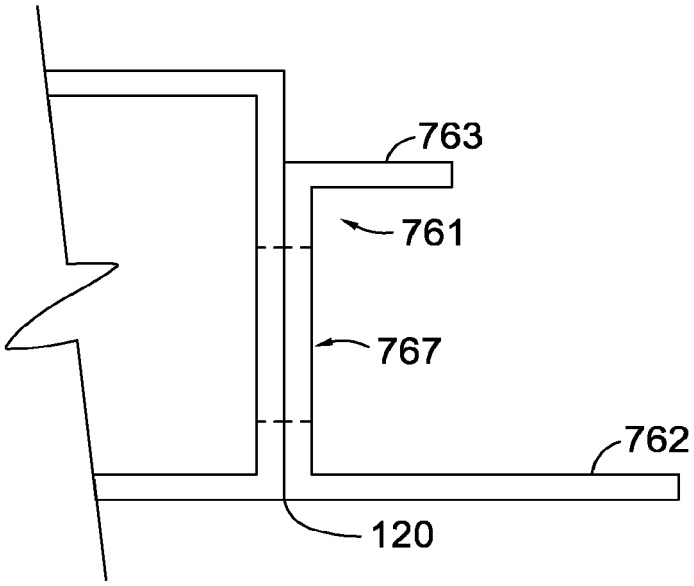
FIG. 30 is a cross sectional view of the flanges at the front edge of the right side panel.
Figure 31:
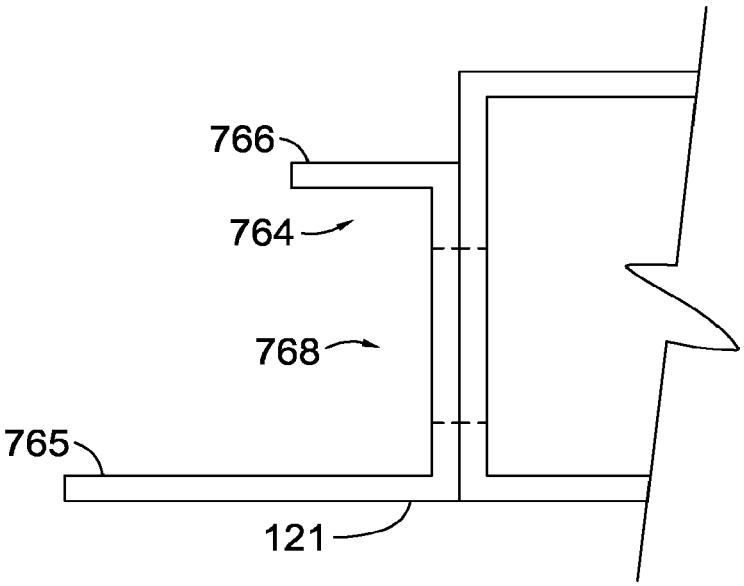
FIG. 31 is a cross sectional view of the flanges at the door edge of the right side panel.

As shown in FIG. 29, a right front member 761 extends from the front end 754 of the right upper cap plate 122 to the front end 758 of the right compound beam 757, and is fixedly secured to the front ends 754, 758, preferably by welding. As shown in FIG. 30, the right front member 761 includes a long flange 762 and a short flange 763, each of which extends along the length of the right front member 761 and towards the front edge 101 of the base panel 17. As shown in FIG. 29, a right door member 764 extends from the door end 755 of the right upper cap plate 122 to the door end 759 of the right compound beam 757, and is fixedly secured to the door ends 755, 759, preferably by welding. The right door member 764 includes a long flange 765 and a short flange 766, each of which extends along the length of the right door member 764 and towards the door edge 102 of the base panel 17, as shown in FIG. 31. The right front member 761 and the right door member 764 each have a plurality, and preferably three, right side bolt holes 767, 768 for receiving locking bolts as described in greater detail below.

Referring again to FIG. 29, corrugated sheet metal 769 extends from the right upper cap plate 122 to the right compound beam 757 along the entire length thereof, and from the right front member 761 to the right door member 764 along the entire length thereof. The corrugated sheet metal 769 is welded along its entire perimeter to the immediately adjacent right upper cap plate 122, right front member 761, right compound beam 757, and right door member 764. As shown in FIG. 1, the corrugated sheet metal 769 is welded to the right front member 761 and the right door member 764 such that the long flanges 762, 765 are visible from the exterior of the container 10 in its unfolded condition.

Figure 32:
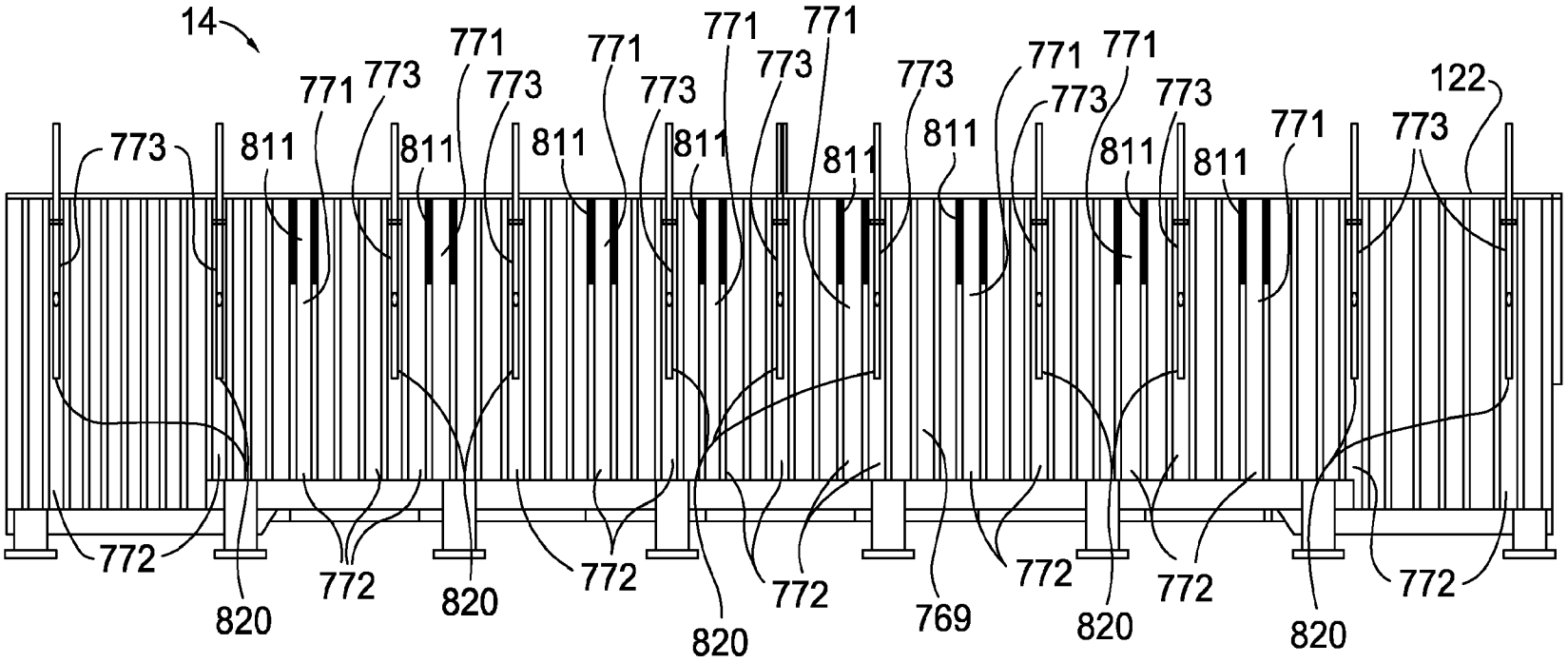
FIG. 32 is a plan view of the internal surface of the right side panel.

As shown in FIG. 29, extending downwardly from the bottom edge 119 of the right side panel 14 are a plurality of right side hinge members 125, each of which is fixedly secured to the right compound beam 757. Each right side hinge member 125 is rotatably connected to one of the base right hinge members 106 of the base panel 17 by one or more hinge pins 770, so as to allow the right side panel 14 to rotate relative to the base panel 17. As shown in FIG. 32, a plurality of linear spring assemblies 771 are mounted to the right side panel 14 within corrugations 772 of the corrugated sheet metal 769, as are a plurality of locking bolt assemblies 773.

Figure 33:
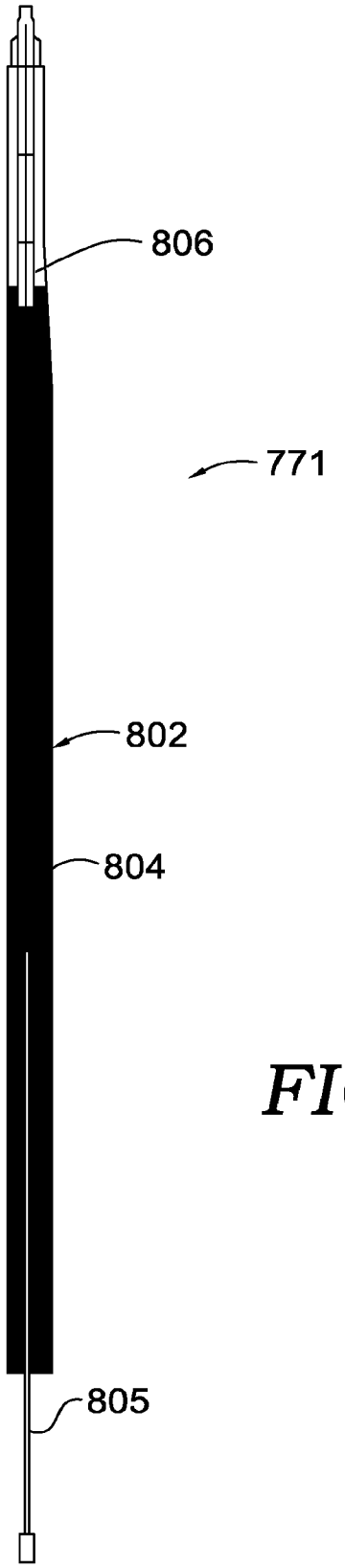
FIG. 33 is a cross sectional view of a linear spring assembly.
Figure 34:
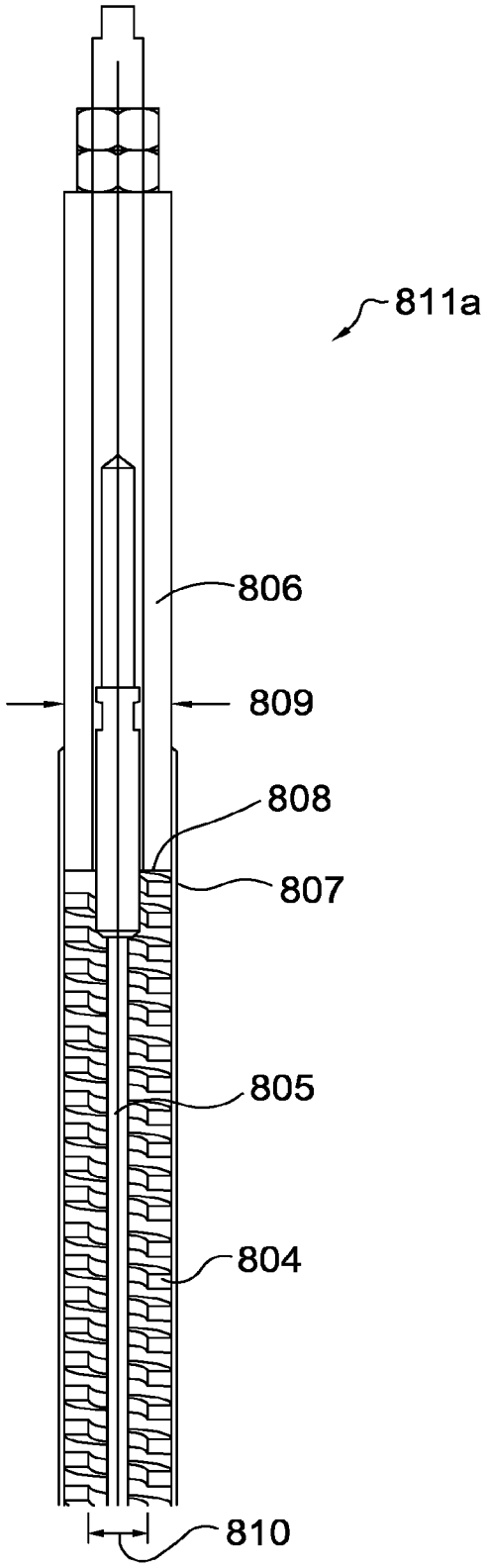
FIG. 34 is a cross sectional view of the upper end of a linear spring assembly.
Figure 35:
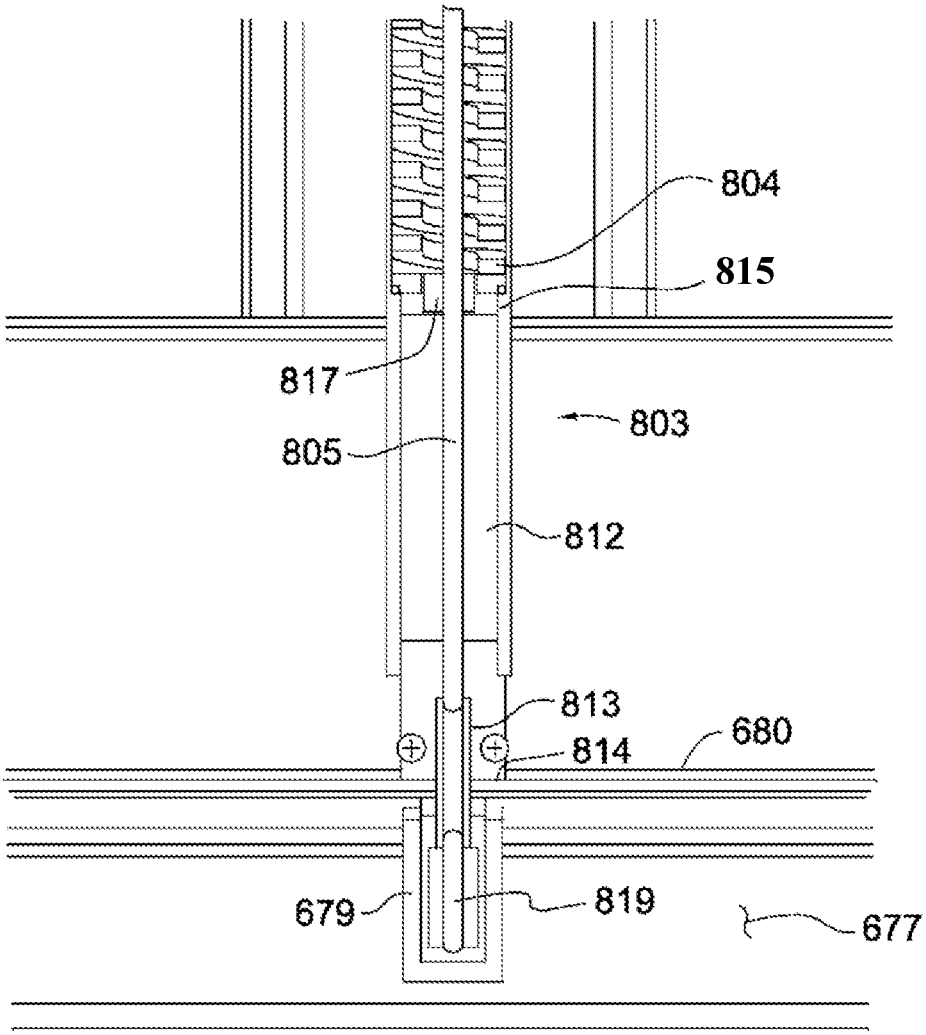
FIG. 35 is a cross sectional view of the lower end of a linear spring assembly.

As shown in FIGS. 33-35, each right side linear spring assembly 771, includes a tube 802 fixedly secured to a tube base 803 mounted within the right upper horizontal beam 123*c*. A compression spring 804, cable 805, and plunger 806 are received within each tube 802. The upper end of the cable 805 is secured to the plunger 806. Each plunger 806 has a plunger foot 808 which is in contact with the upper end 807 of the compression spring 804, and each plunger foot 808 has a diameter 809 that is at least as large as the inner diameter 810 of the compression spring 804 to prevent the plunger 806 from sliding through the compression spring 804. Referring again to FIG. 32, a tube shield 811 secured to the corrugated sheet metal 769 retains and protects the upper end 811*a* of each tube 802, as well as the plunger 806 attached thereto, during use of the container 10.

As shown in FIG. 35, each tube base 803 includes a cable channel 812 within which is rotatably mounted a cable pulley 813 adjacent the lower edge 814 thereof. The upper end 815 of each tube base 803 has a diameter 816 that is at least as large as the inner diameter 810 of the compression spring 804 to support the compression spring 804 against the force applied by the plunger foot 808 at the upper end 807 of the compression spring 804. In addition, the upper end 815 of each tube base 803 has an opening 817 through which the cable 805 passes, and the opening 817 has a diameter 818 that is smaller than the inner diameter 810 of the compression spring 804 to prevent the compression spring 804 from sliding therethrough. The lower end 819 of each cable 805 is attached to one of the cable anchors 679 secured to the base right beam upper portion 677 adjacent the upper edge 680 thereof. It is to be understood that when the container 10 is in the unfolded condition, each cable anchor 679 is vertically aligned with the tube 802 that contains the cable 805 that is attached to such cable anchor 679.

Figure 36:
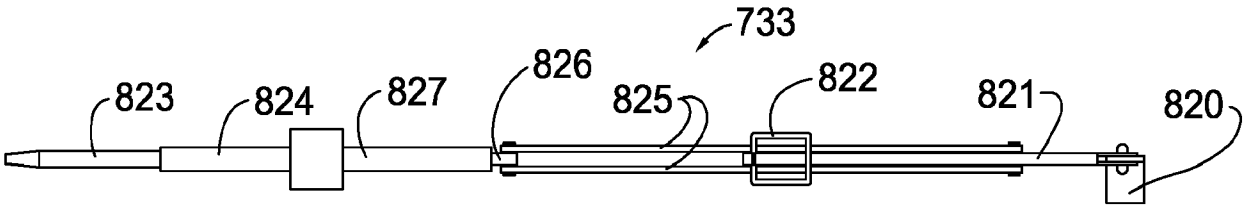
FIG. 36 is a plan view of a locking rod assembly in isolation.

As shown in FIG. 32, the plurality of locking bolt assemblies 773 are mounted to the right side panel 14 within the corrugations 772 of the corrugated sheet metal 769. As shown in FIGS. 32 & 36, each locking bolt assembly 773 includes a pivot anchor 820, a positioning lever 821 with a handle 822 attached thereto, a locking bolt 823, a locking bolt guide 824, and a pair of links 825 pivotably connecting the lower end 826 of the locking bolt 823 to the positioning lever 821. Each of the locking bolt guides 824 includes a guide tube 827 that extends through, and is fixedly secured to the right upper cap plate 122, and one locking bolt 823 is slideably received within each of the guide tubes 827. Each pivot anchor 820 is fixedly secured to the corrugated sheet metal 769, and each positioning lever 821 is pivotably connected to one of the pivot anchors 820.

As those skilled in the art will readily appreciate, each of the locking bolt assemblies 773 so described is selectively positionable between a first position in which the locking bolt 823 is received within one of the locking bolt holes 610 in the lower face 608 of the roof right beam 600, when the container 10 is in the unfolded condition, and a second position in which the locking bolt 823 is fully withdrawn from that locking bolt hole 610.

Figure 37:
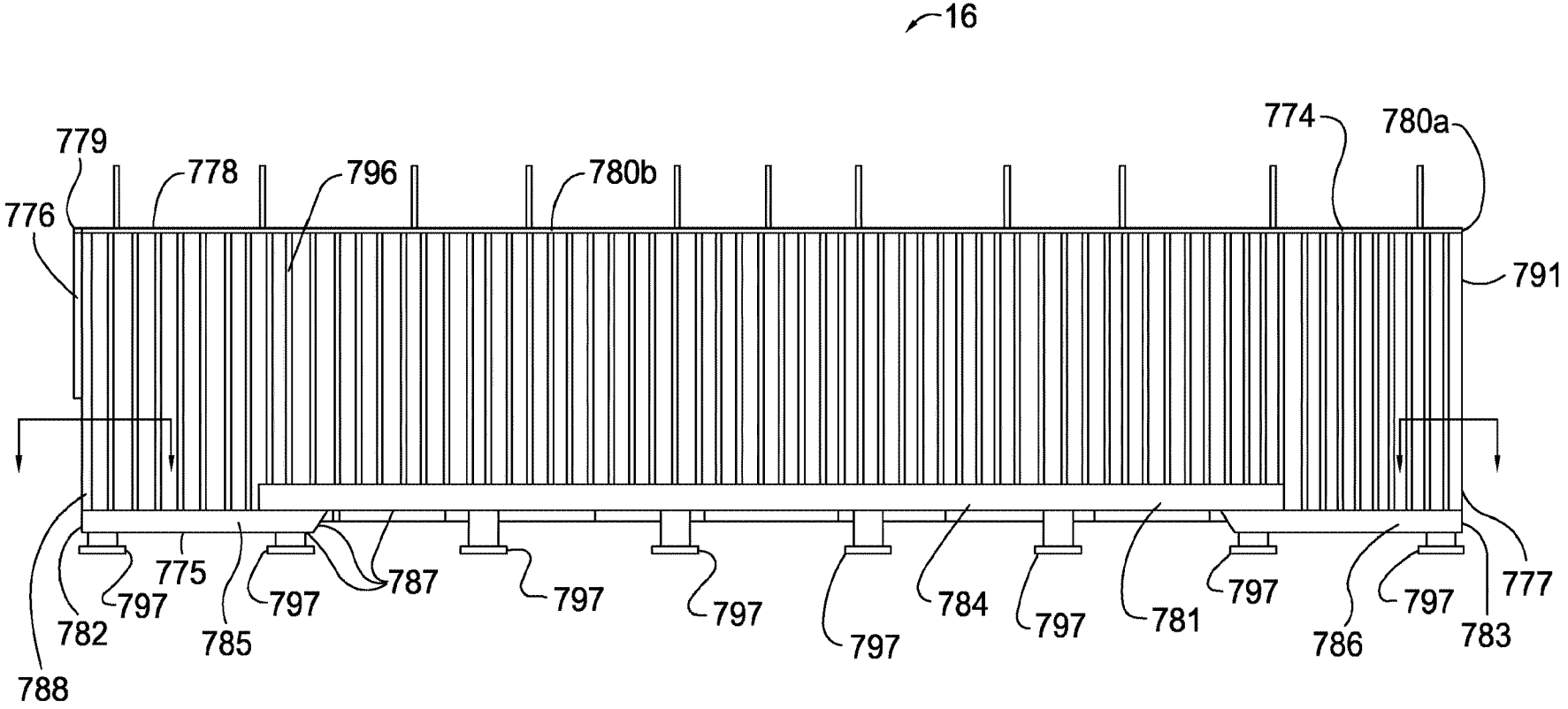
FIG. 37 is a plan view of the external surface of the left side panel.

As shown in FIG. 37, the left side panel 16 includes a top edge 774, a bottom edge 775, a front edge 776 and a door edge 777. Extending along the top edge 774 of the left side panel 16 along the length thereof is a left upper cap plate 778 having a front end 779, a door end 780*a*, and a left roof flange 780*b* extending from the front end 779 to the door end 780. Extending along the bottom edge 775 of the left side panel 16 along the length thereof is a left compound beam 781 that has a front end 782 and a door end 783. The left compound beam 781 comprises a left upper horizontal beam 784 rigidly connected to two left lower horizontal beams 785, 786, preferably by welding. As shown in FIGS. 17 & 37, the lower edge 787 of the left compound beam 781 has a profile that matches the profile formed by the upper edge 692 of the base left beam upper portion 677, the top edges 695, 696 of the base left beam lower portions 688, 689, and the sloped left transition portions 104*a*, 104*b* of the base panel 17, to provide mating sealing surfaces when the container 10 is in its unfolded condition.

Figure 38:
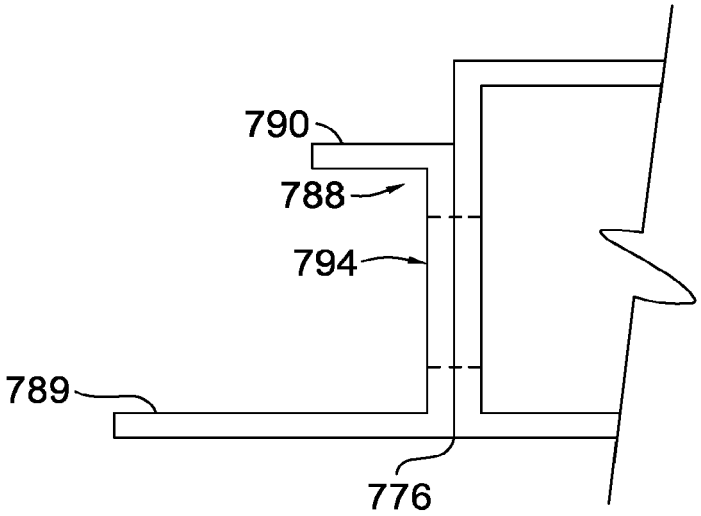
FIG. 38 is a cross sectional view of the flanges at the door edge of the left side panel.
Figure 39:
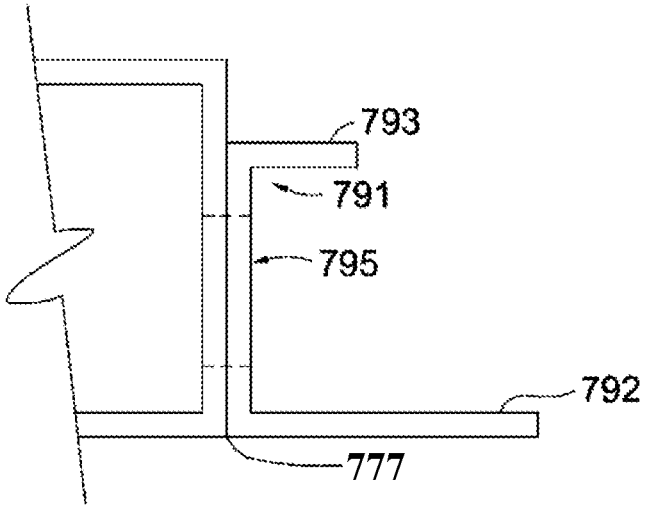
FIG. 39 is a cross sectional view of the flanges at the front.

As shown in FIG. 37, a left front member 788 extends from the front end 779 of the left upper cap plate 778 to the front end 782 of the left compound beam 781, and is fixedly secured to the front ends 779, 782, preferably by welding. As shown in FIG. 38, the left front member 788 includes a long flange 789 and a short flange 790, each of which extends along the length of the left front member 788 and towards the front edge 101 of the base panel 17. Referring again to FIG. 37, a left door member 791 extends from the door end 780*a* of the left upper cap plate 778 to the door end 783 of the left compound beam 781, and is fixedly secured to the door ends 780, 783, preferably by welding. As shown in FIG. 39, the left door member 791 includes a long flange 792 and a short flange 793, each of which extends along the length of the left door member 791 and towards the door edge 102 of the base panel 17. The left front member 788 and the left door member 791 each have a plurality, and preferably three, left side bolt holes 794, 795 for receiving locking bolts as described in greater detail below.

Figure 40:
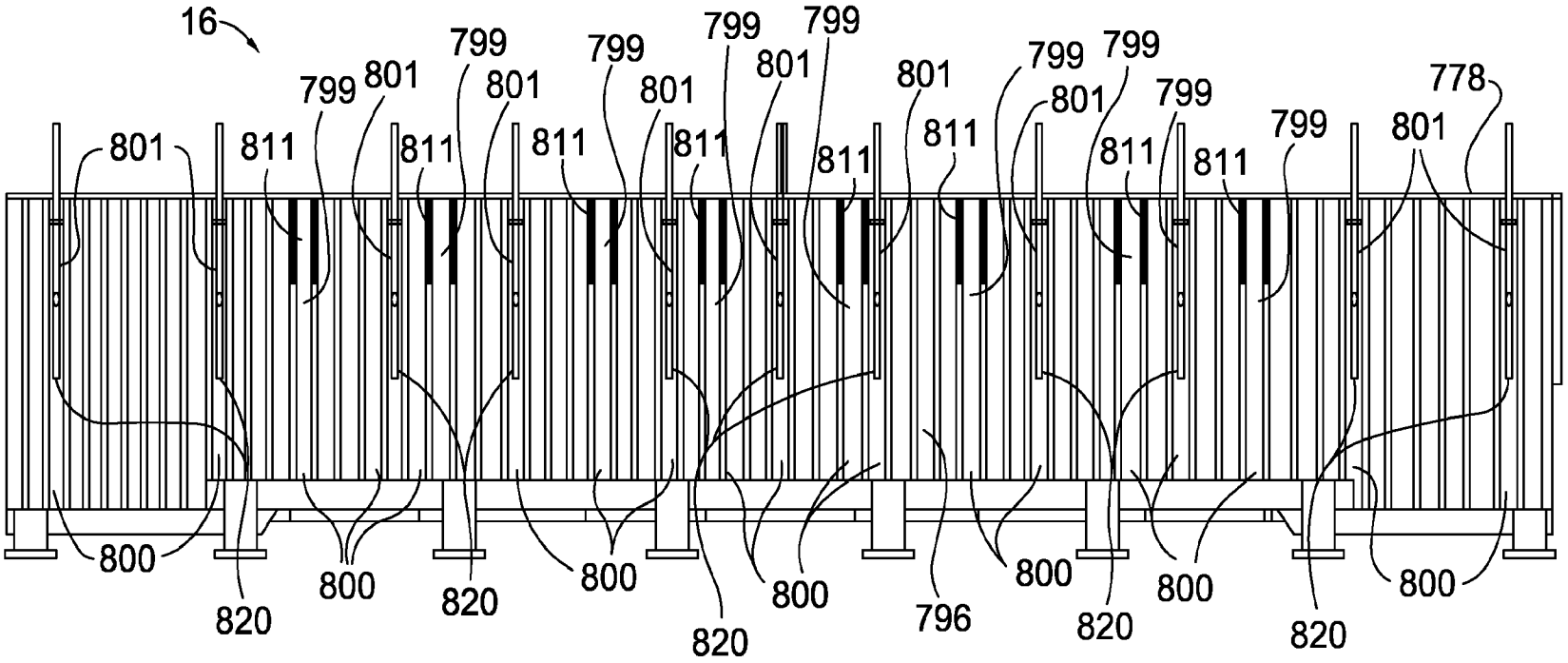
FIG. 40 is a plan view of the internal surface of the left side panel.

As shown in FIG. 40, corrugated sheet metal 796 extends from the left upper cap plate 778 to the left compound beam 781 along the entire length thereof, and from the left front member 788 to the right door member 791 along the entire length thereof. The corrugated sheet metal 796 is welded along its entire perimeter to the immediately adjacent left upper cap plate 778, left front member 788, left compound beam 781, and left door member 791. As shown in FIG. 2, the corrugated sheet metal 796 is welded to the left front member 788 and the left door member 791 such that the long flanges 789, 792 are visible from the exterior of the container 10 in its unfolded condition.

As shown in FIG. 37, extending downwardly from the bottom edge 775 of the left side panel 16 are a plurality of left side hinge members 797, each of which is fixedly secured to the left compound beam 781. Each left side hinge member 797 is rotatably connected to one of the base right hinge members 745 of the base panel 17 by one or more hinge pins 798, so as to allow the left side panel 16 to rotate relative to the base panel 17. The hinge member 797 is shown in isolation, and in greater detail, in FIGS. 41A and 41B. The design and function of hinge member 797 is the same as that of hinge member 125 on right side panel 14.

As shown in FIG. 40, a plurality of linear spring assemblies 799 are mounted to the left side panel 16 within corrugations 800 of the corrugated sheet metal 796, as are a plurality of locking bolt assemblies 801. The construction of the linear spring assemblies 799 is the same as those described with respect to the right side panel 14, except that each tube base 803 is mounted within the left upper horizontal beam 784, each tube shield 811 is secured to the corrugated sheet metal 796 of the left side panel 16, and the lower end 819 of each cable 805 is attached to one of the cable anchors 691 secured to the base left beam upper portion 690 adjacent the upper edge 692 thereof. It is to be understood that when the container 10 is in the unfolded condition, each cable anchor 691 is vertically aligned with the tube 802 that contains the cable 805 that is attached to such cable anchor 691.

Likewise, the construction of the locking bolt assemblies 801 is the same as those described with respect to the right side panel 14, except that each pivot anchor 820 is fixedly secured to the corrugated sheet metal 796 of the left side panel 16, and each guide tube 827 extends through, and is fixedly secured to, the left upper cap plate 778. As those skilled in the art will readily appreciate, each of the locking bolt assemblies 801 so described is selectively positionable between a first position in which the locking bolt 823 is received within one of the locking bolt holes 610 in the lower face 609 of the roof left beam 603, when the container 10 is in the unfolded condition, and a second position in which the locking bolt 823 is fully withdrawn from that locking bolt hole 610.

Figure 42:
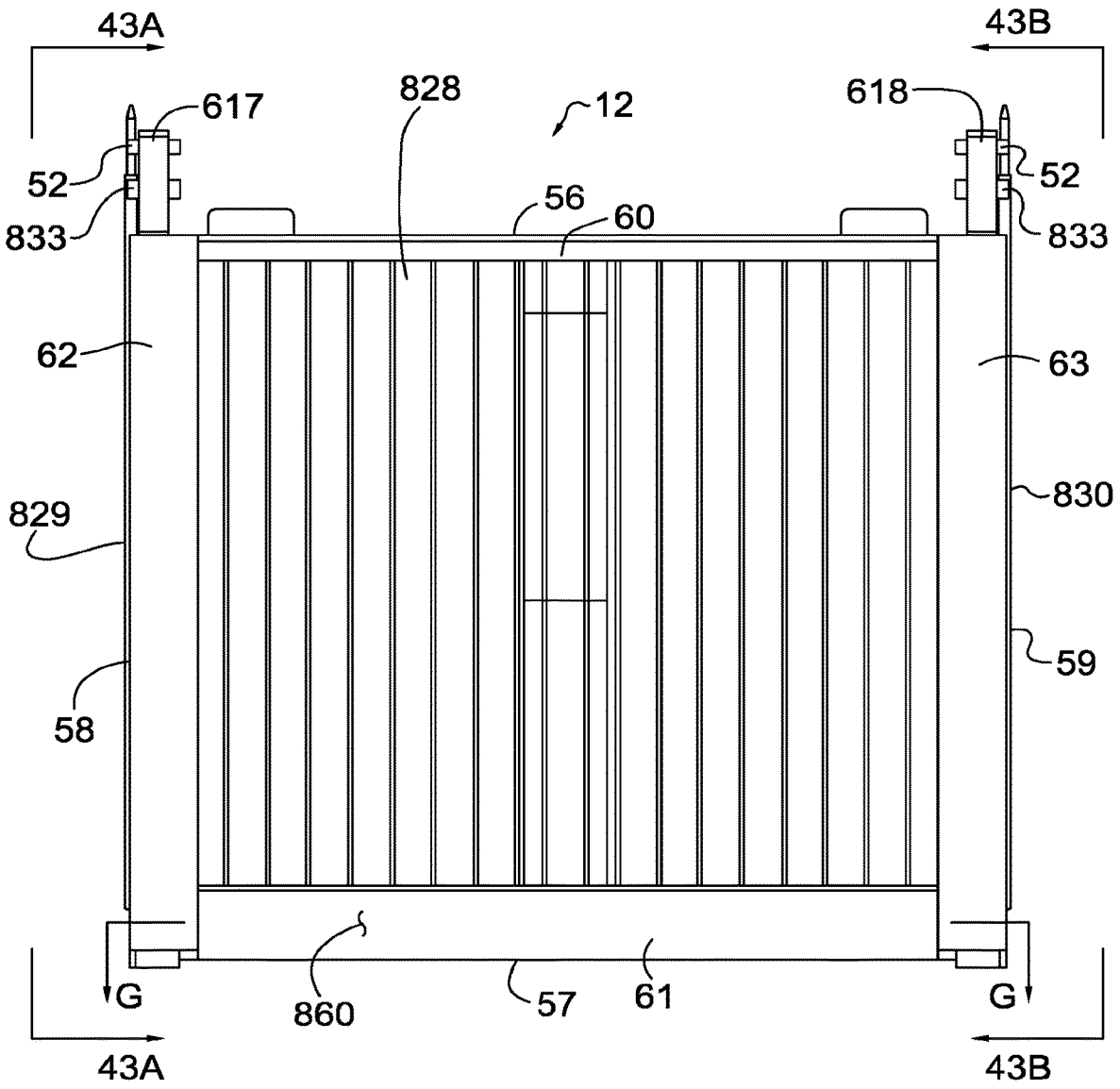
FIG. 42 is a plan view of the external surface of the front panel.
Figure 43B:
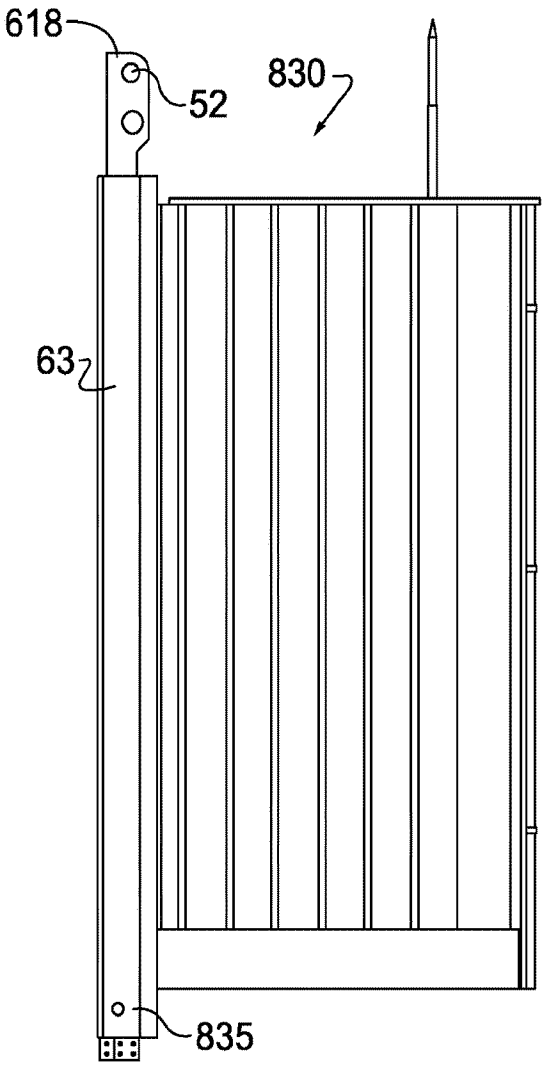
FIGS. 43A and 43B are plan views of the right and left front access panels.
Figure 43A:
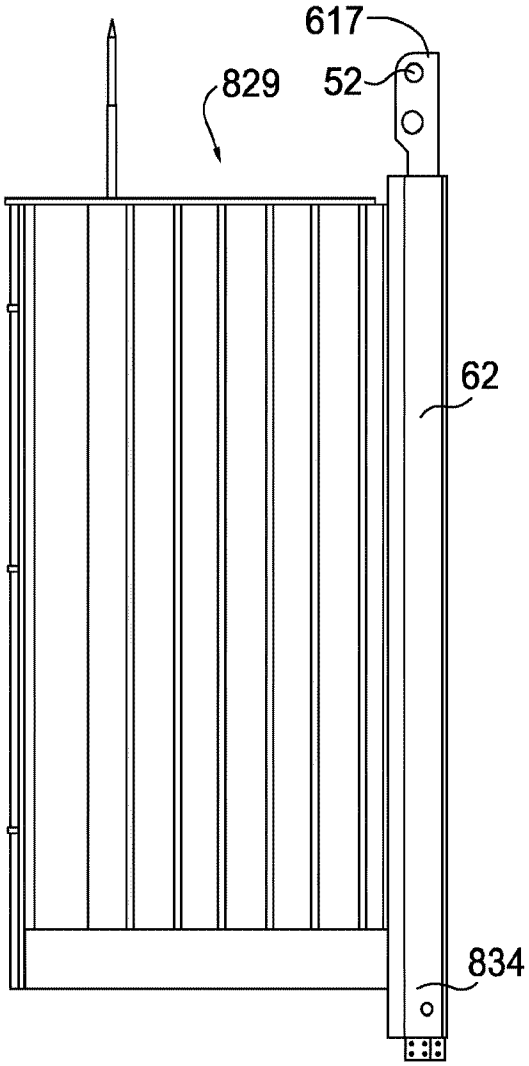

Referring now to FIGS. 42, 43A and 43B, the front panel 12 includes a front main panel 828, a front right access panel 829, and a front left access panel 830. The front main panel 828 includes a top edge 56, a bottom edge 57, a right edge 58, and a left edge 59. Extending along the top edge 56 of the front main panel 828 is a header 60 and along the bottom edge 57 is a sill panel 61, in spaced relation to the header 60. A right front post 62, hollow and rectangular in cross section, extends along the right edge 58 of the front main panel 828, and a left front post 63, also hollow and rectangular in cross section, extends along the left edge 59 of the front main panel 828. Lateral support for the front main panel 828 is provided by corrugated sheet metal which extends between the two front posts 62, 63 along the entire length thereof, and is welded around its periphery to the immediately adjacent sill panel 61, header 60, the right front post 62, and the left front post 63.

As shown in FIGS. 42, 43A, 43B and 44, extending upwardly from each of the front posts 62, 63 adjacent the top edge 56 of the front panel 828 is a front hinge pivot 617, 618. When assembled to the roof panel 11, each front hinge pivot 617, 618 is rotatably connected to one of the sets 613, 614 of front first hinge members 31*a*, 31*b*, 31*c*, 31*d* located adjacent the front edge 22 of the roof panel 11 by means of a hinge pin 52, so as to allow the front panel 12 to rotate relative to the roof panel 11.

Figure 44:
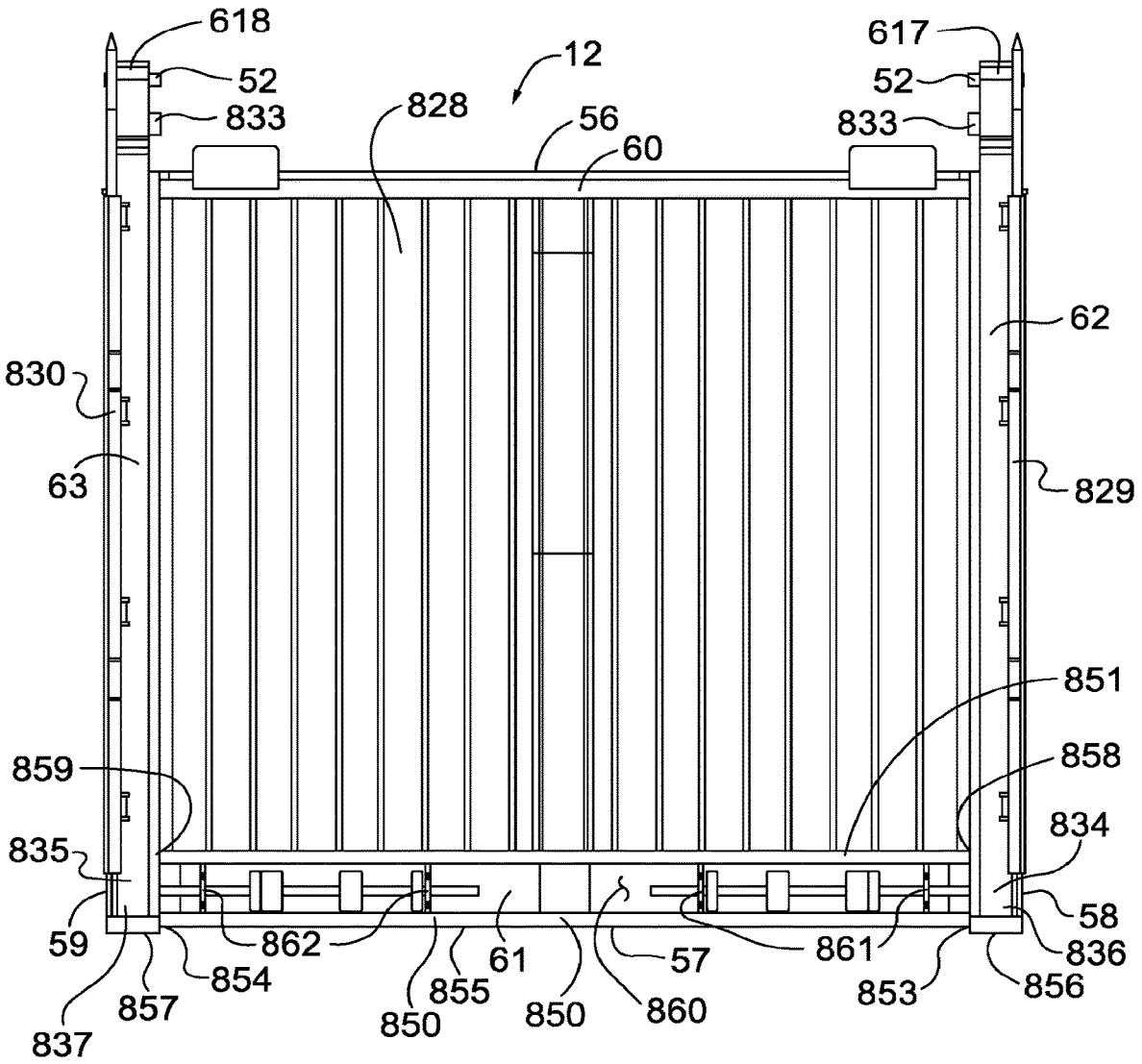
FIG. 44 is a plan view of the internal surface of the front panel.
Figure 45A:
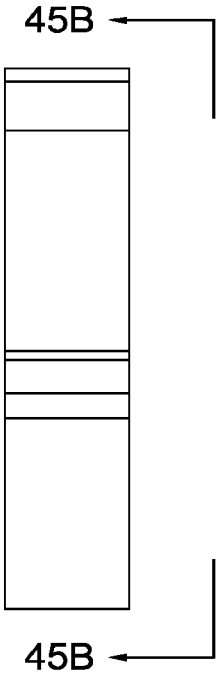
FIGS. 45A. 45B, 45C and 45D are views of the front pivot hinge.
Figure 45B:
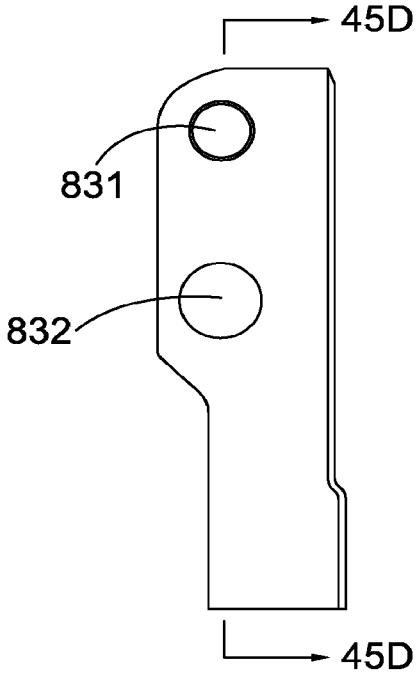
Figure 45C:
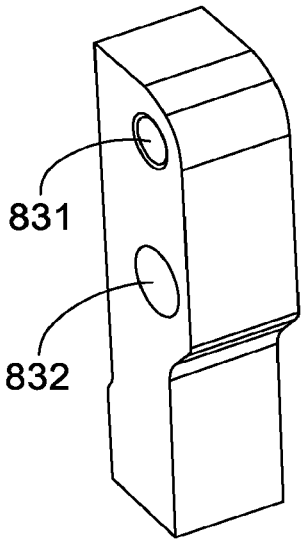
Figure 45D:
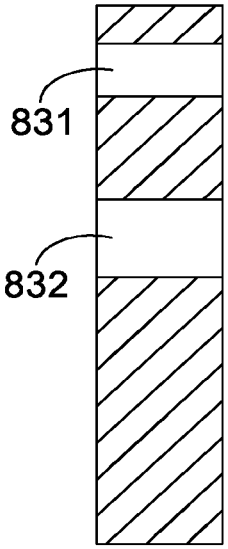
Figure 46:
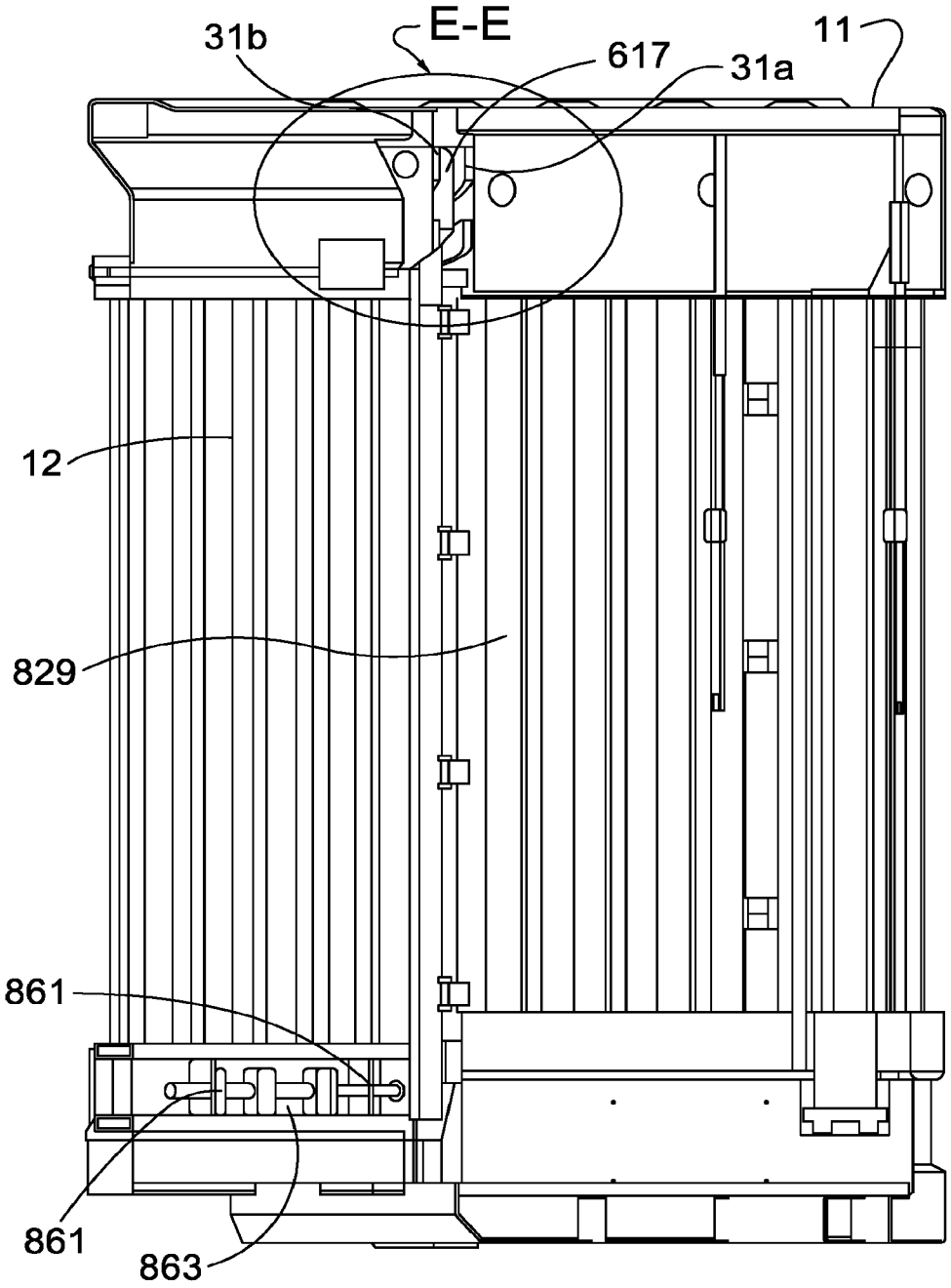
FIG. 46 is an internal view of the front end panel and right access panel.
Figure 47:
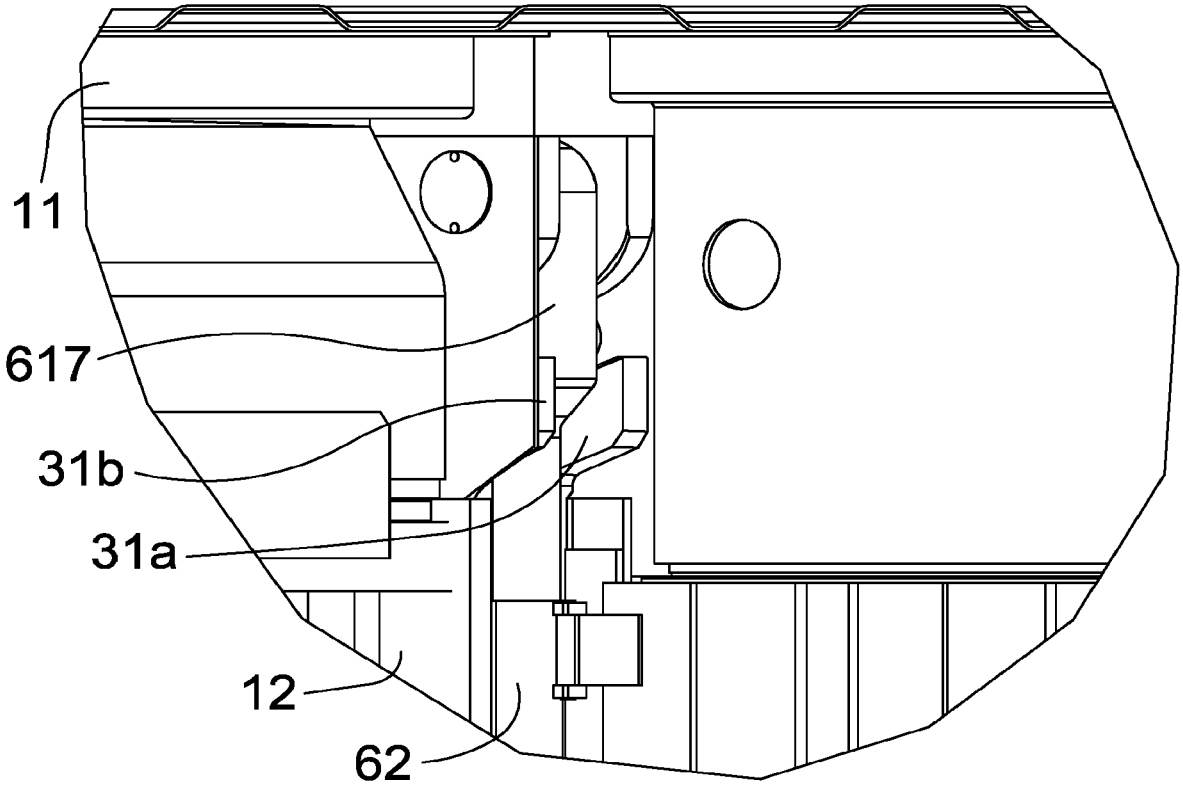
FIG. 47 is an enlarged view of section E-E of FIG. 46.
Figure 48:
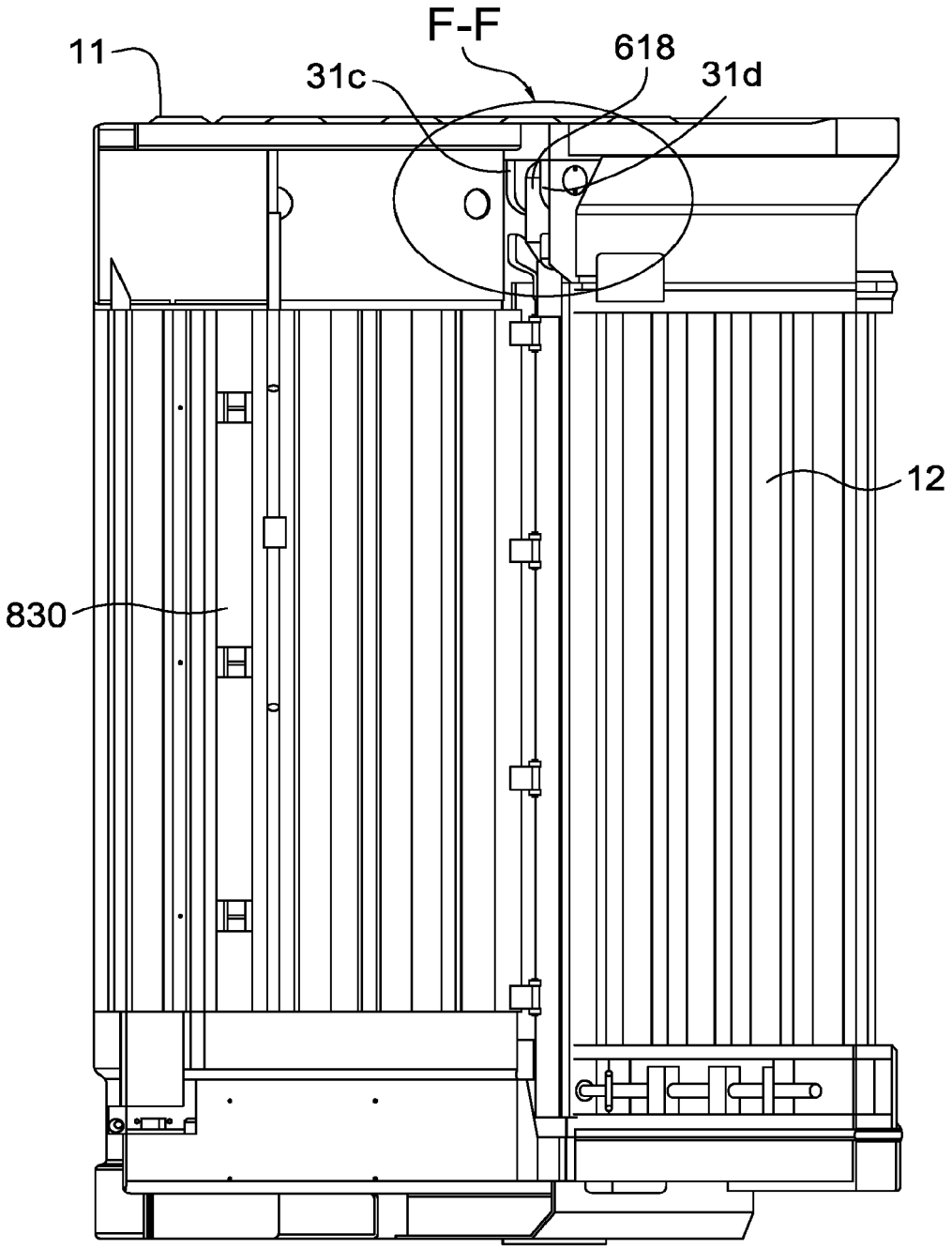
FIG. 48 is an internal view of the front end panel and left access panel.
Figure 49:
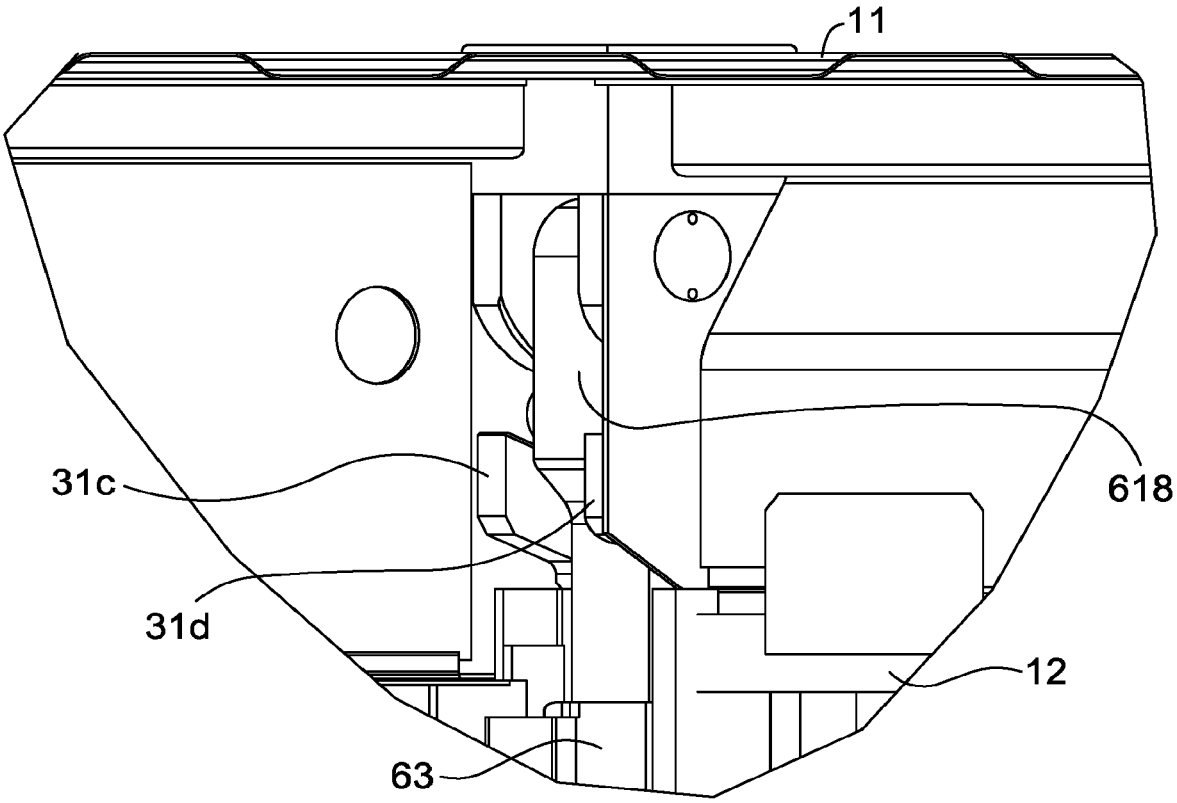
FIG. 49 is an enlarged view of section F-F of FIG. 48.
Figure 50:
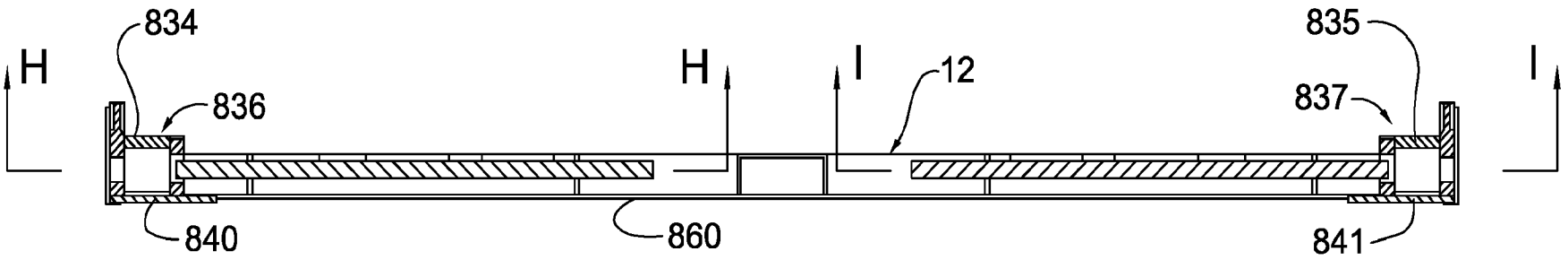
FIGS. 50, 51 and 52 are horizontal cross sectional views of the front panel interlocks.
Figure 52:
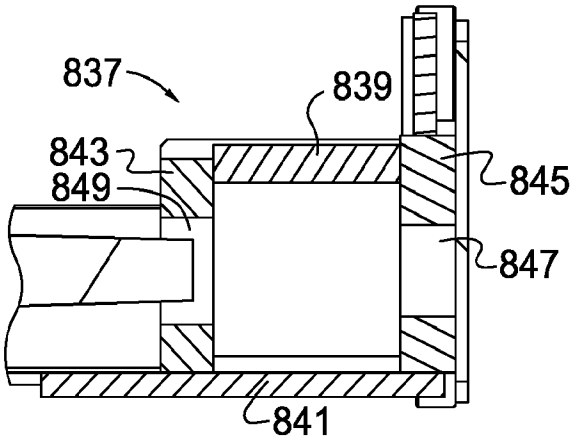
Figure 51:
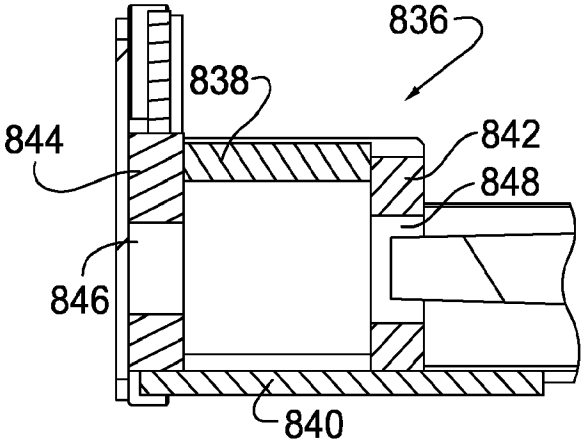
Figure 53:
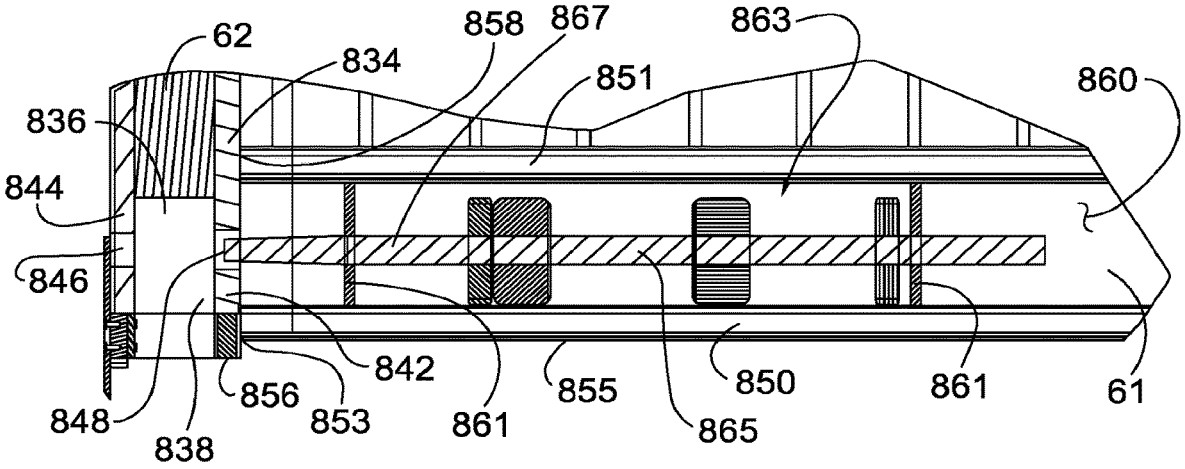
FIG. 53 is a cross sectional view taken along line H-H of FIG. 50.
Figure 54:
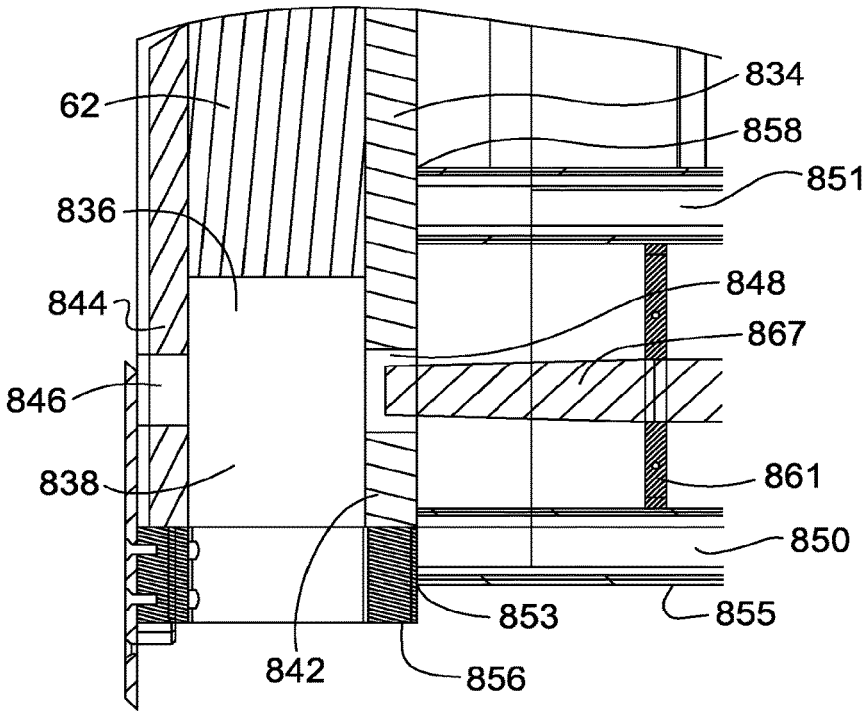
FIG. 54 is a cross sectional view of the right side interlock of the front panel.
Figure 55:
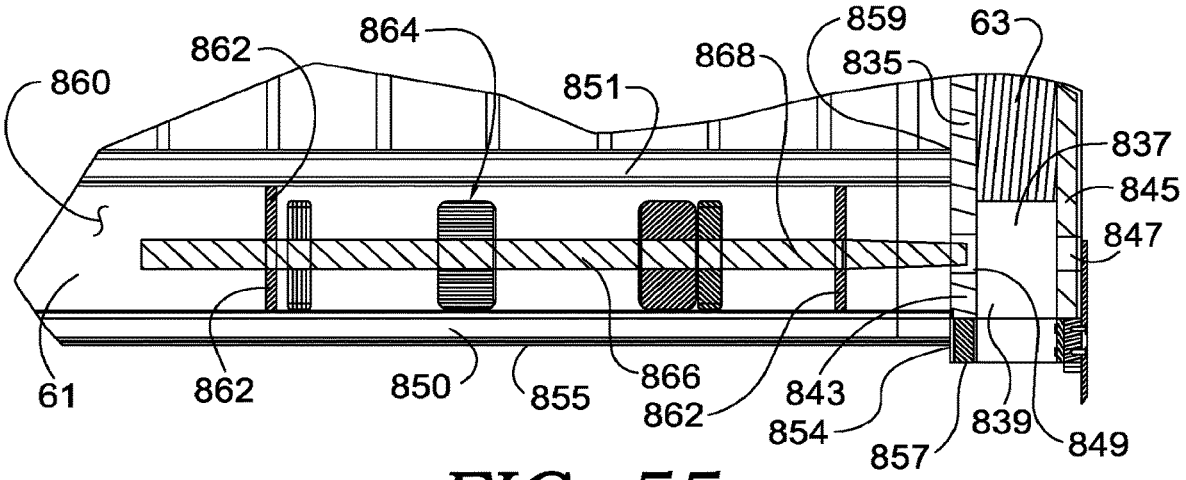
FIG. 55 is a cross sectional view taken along line I-I of FIG. 50.
Figure 56:
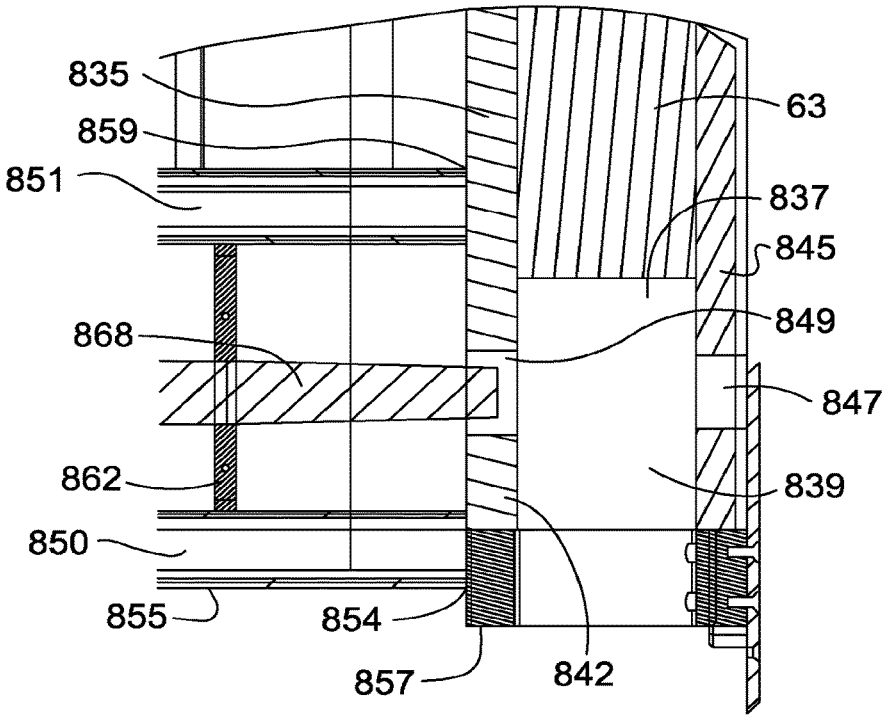
FIG. 56 is a cross sectional view of the left side interlock of the front panel.
Figure 57:
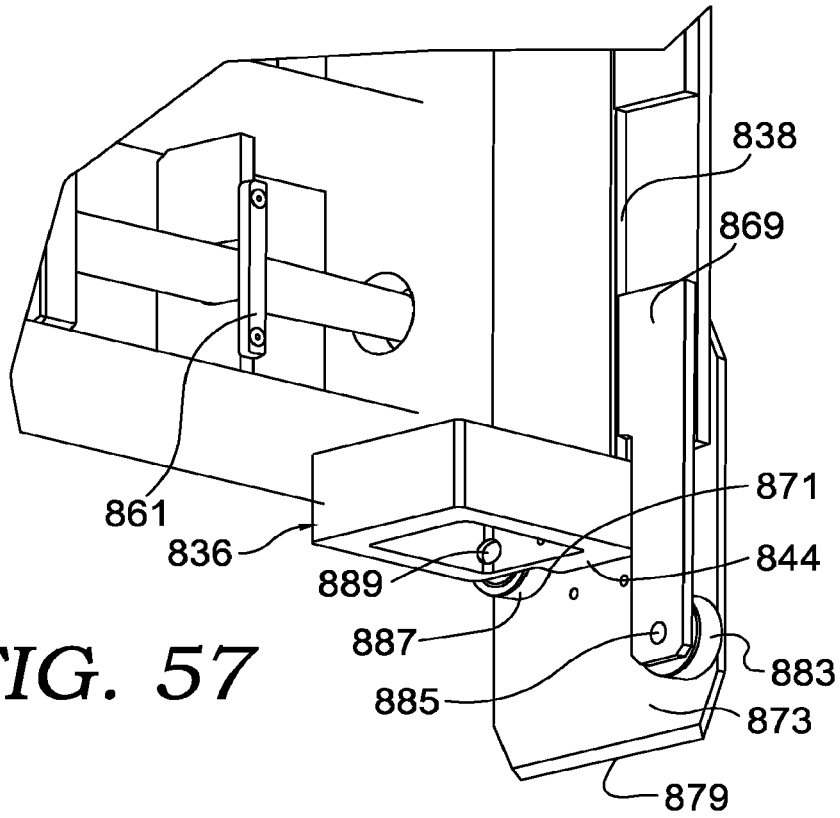
FIG. 57 is a perspective view of the right interlock of the front panel.
Figure 58:
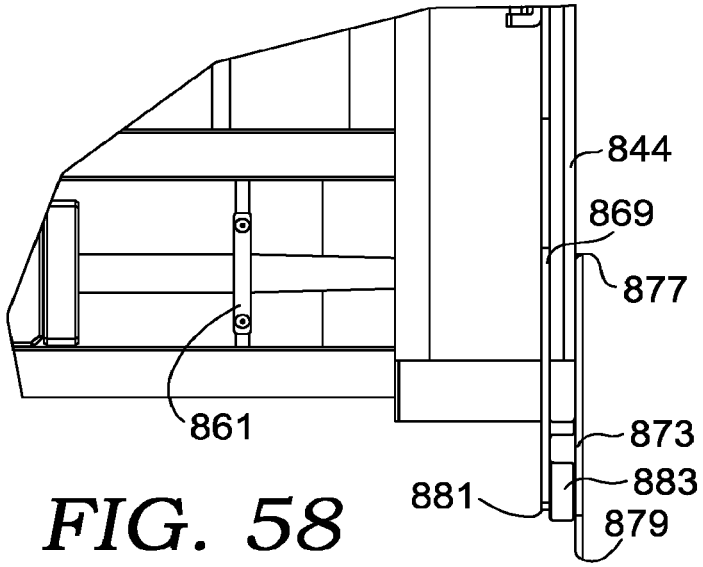
FIG. 58 is an inside view of the right interlock of the front panel.
Figure 61:
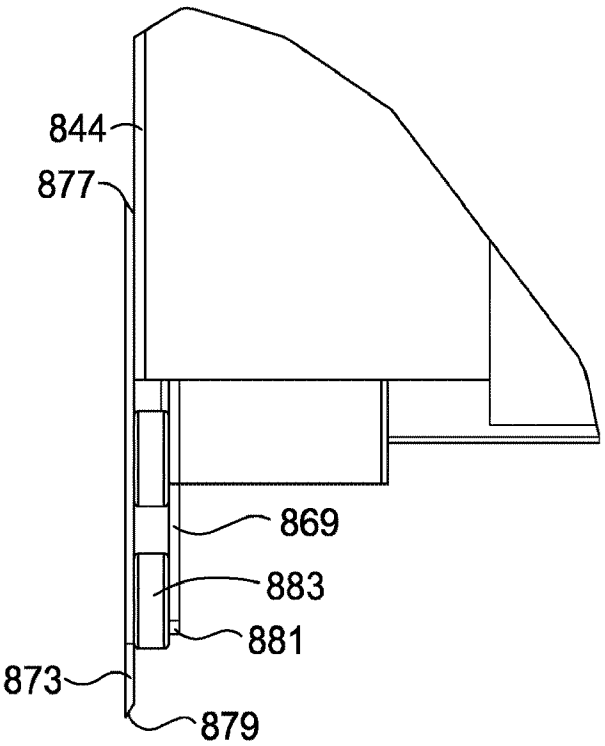
FIG. 61 is an end view of the roller arm cover plate of the front right post.
Figure 60:
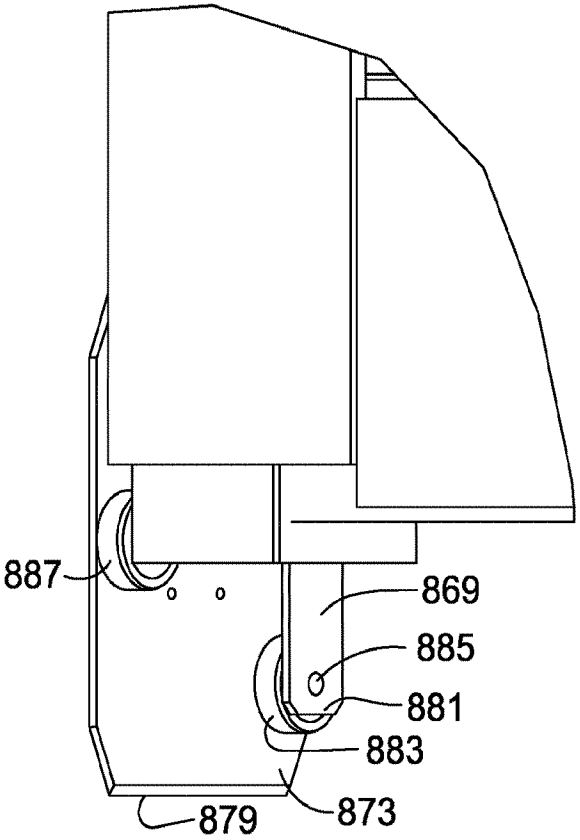
FIG. 60 is a perspective view of the roller arm cover plate of the front right post.
Figure 59:
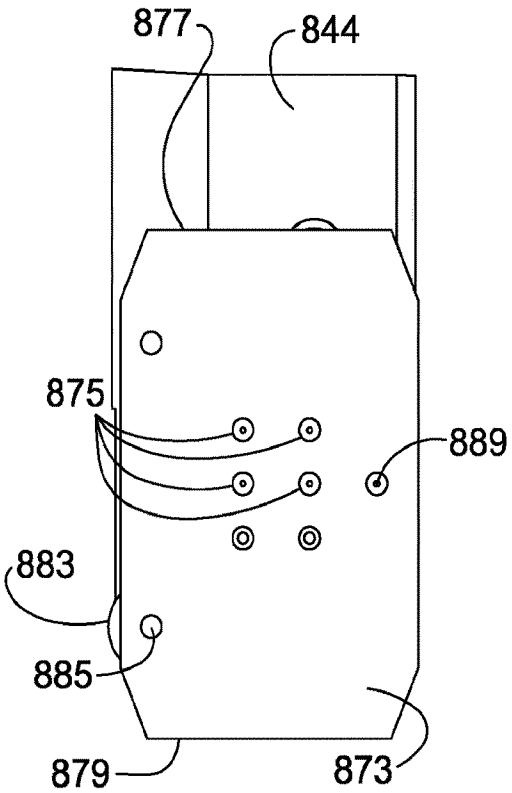
FIG. 59 is an external view of the roller arm cover plate of the front right post.
Figure 62:
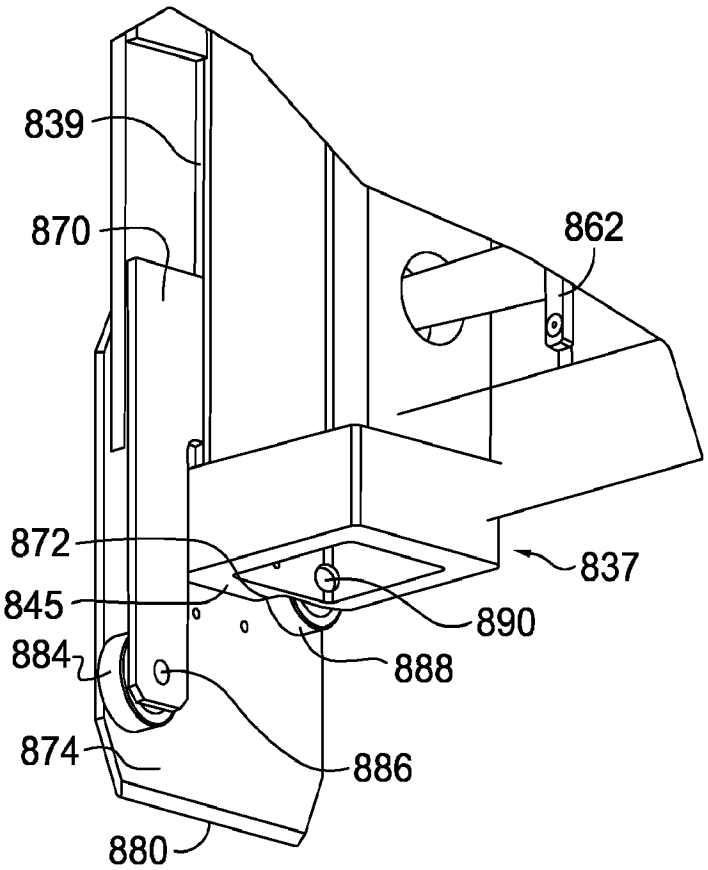
FIG. 62 is a perspective view of the left interlock of the front panel.

The front hinge pivot 617 adjacent the right edge 58 of the front main panel 828, and the front hinge pivot 618 adjacent the left edge 59 of the front main panel 828 are identical, and a representative front hinge pivot 617 is shown in isolation in FIGS. 45A, 45B, 45C, and 45D. As shown in FIGS. 45A, 45B, 45C, and 45D, each front hinge pivot 617 has a pivot hinge pin hole 831 extending therethrough, and a cylindrical lug hole 832 extending therethrough as well. As shown in FIGS. 42 and 44, a cylindrical lug 833 extends through each cylindrical lug hole 832 and protrudes from each side of the front hinge pivots 617. Each cylindrical lug 833 has a diameter that is only slightly less than the height 834*b* of the front lug receiving slot 621 on each of the front first hinge members 31*a*, 31*b*, 31*c* and 31*d* of the roof panel 11. When incorporated into the present disclosure, the hinge pin 52 extends through the front pivot hole 619 of one of the front first hinge members 31*a*, 31*c*, through the pivot hinge pin hole 831 of one of the front hinge pivots 617, and through the front pivot hole 619 of another one of the front first hinge members 31*b*, 31*d* adjacent to the other front first hinge member 31*a*, 31*c* to allow for rotation between the front panel 12 and the roof panel 11. As those skilled in the art will readily appreciate, when the front hinge pivots 617 are rotatably secured between two of the front first hinge members 31*a*, 31*b*, 31*c* and 31*d* by a hinge pin 52, rotation of the cylindrical lugs 833 into the lug receiving slots 621 of the immediately adjacent front first hinge members 31*a*, 31*b*, 31*c* and 31*d*, shifts much of the load carried by the front hinge pivots 617 from the hinge pins 52 to the cylindrical lugs 833, allowing each of the front hinge pivots 617 to support more weight than either could carry on the hinge pin 52 alone. The construction and function of the front hinge pivot 618 adjacent the left edge 59 of the front main panel 828 is the same as that described for the front hinge pivot 617 adjacent the right edge 58, except that the front hinge pivot 618 is received between the front first hinge members 31*c*, 31*d* adjacent the left edge 20 of the roof panel 11. Front hinge pivot 617 is shown assembled to the front first hinge members 31*a*, 31*b* of the roof panel 11 in perspective in FIG. 46, and in greater detail in FIG. 47. Likewise, front hinge pivot 618 is shown assembled to the front first hinge members 31*c*, 31*d* of the roof panel 11 in perspective in FIG. 48, and in greater detail in FIG. 49.

As shown in FIGS. 50-56, incorporated into the lower end portion 834, 835 of each of the front posts 62, 63 on the front panel 12 is a front panel interlock 836, 837. Each front panel interlock 836, 837 has a door wall 838, 839 which faces the door panel 18, a front wall 840, 841 that is parallel to, and in spaced relation with, the door wall 838, 839, an inner wall 842, 843 that is perpendicular to the front wall 840, 841, and the door wall 838, 839 and faces the inner wall 842, 843 of the other front panel interlock, and an outer wall 844, 845 which is parallel to, and in spaced relation with, the inner wall 842, 843.

Each front panel interlock 836, 837 has a first bolt hole 846, 847 in the outer wall 844, 845, and a second bolt hole 848, 849 in the inner wall 842, 843. The diameters of the second bolt holes 848, 849 are slightly larger than the diameters of the first bolt holes 846, 847, and the first bolt holes 846, 847 and the second bolt holes 848, 849 are located on the inner walls 842, 843 and the outer walls 844, 845 of the front panel interlocks 836, 837, such that when one of the base front tangs 108*a*, 108*b* of the base panel 17 is received therein, the upper tapered locking hole 110*a*, 110*b* in the base front tang 108*a*, 108*b* is aligned with the first bolt hole 846, 847 and the second bolt hole 848, 849 of the respective front panel interlock 836, 837, such that the first bolt hole 846, 847 is immediately adjacent the smaller diameter end of the upper tapered locking hole 110*a*, 110*b*, and the second bolt hole 848, 849 is immediately adjacent the larger diameter end of the upper tapered locking hole 110*a*, 110*b*.

Referring now to FIGS. 44, 50, 53 and 55, the sill panel 61 includes a lower sill beam 850 and an upper sill beam 851, each of which extends between the fronts posts 62, 63 adjacent the lower end portions 834, 835 thereof. Each end 853, 854 of the lower sill beam 850 is fixedly secured to the inner wall 842, 843 of the front panel interlock 836, 837 immediately adjacent thereto, preferably by welding, such that the lower edge 855 of the lower sill beam 850 is approximately aligned with the lower ends 856, 857 of the front posts 62, 63. Each end 858, 859 of the upper sill beam 851 is likewise fixedly secured to the inner wall 842, 843 of the front panel interlock 836, 837 immediately adjacent thereto, preferably by welding, such that upper sill beam 851 is parallel, and in spaced relation, to the lower sill beam 850. A sill plate 860, which is substantially aligned with the front walls 840, 841 of the front panel interlocks, extends from the upper sill beam 851 to the lower sill beam 850, and from front left post 63 to the front right post 62, and is welded about its periphery to the upper sill beam 851, the lower sill beam 850, the front left post 63, and the front right post 62.

Adjacent each front panel interlock 836, 837, and aligned with the bolt holes 846, 848, 847, 849 therein, are hammer lock retainers 861, 862 mounted to the sill panel 61. As shown in FIGS. 46, 48, 53 and 55, a hammer locking mechanism 863, 864, including a slide hammer 865, 866, and a hammer locking bolt 867, 868, is slideably secured to each of the hammer lock retainers 861, 862, within the sill panel 61 such that each hammer locking mechanism 863, 864 is positionable by use of one of the slide hammers 865, 866 slideably mounted on one of the hammer locking bolts 867, 868, between an unlocked position in which the respective hammer locking bolt 867, 868, is in a retracted position substantially outside of the front panel interlock 836, 837, and a locked position in which the respective hammer locking bolt 867, 868 extends through the bolt holes 846, 848, 847, 849 of the front panel interlock 836, 837 immediately adjacent thereto.

As shown in FIGS. 57-66, a front roller arm 869, 870 is fixedly secured to the door wall 838, 839 of each of the front interlocks 836, 837, and extends downward therefrom, and the outer wall 844, 845 of each of the front interlocks 836, 837 includes a roller recess 871, 872. A roller cover plate 873, 874 is removably secured to the outer wall 844, 845 of each of the front interlocks 836, 837, preferably with bolts 875, 876. The upper edge 877, 878 of each roller cover plate 873, 874 extends upward along the outer wall 844, 845 to which it is attached so as to cover the roller recess 871, 872 immediately adjacent thereto, and the lower edge 879, 880 of each roller cover plate 873, 874 extends downward along the outer wall 844, 845 to which it is attached about 2 inches below the lower end 881, 882 of the immediately adjacent front roller arm 869, 870. A first front roller 883, 884 is rotatably attached to each of the front roller arms 869, 870 adjacent the lower end thereof, and is secured in place by an axel pin 885, 886 that extends between each roller arm 869, 870 and the roller cover plate 873, 874 immediately adjacent thereto. Likewise, a second front roller 887, 888 is rotatably attached to each of the outer walls 844, 845 of the front interlocks 836, 837 within the roller recess 871, 872 therein, and is secured in place by an axel pin 889, 890 that extends between the outer wall 844, 845 of the respective front interlock 836, 837 and the roller cover plate 873, 874 immediately adjacent thereto. Each of the first front rollers 883, 884 and the second front rollers 887, 888 is aligned with one of the rails 401, 403 of the base panel 17 and rides on such rails 401, 403 during the folding, and unfolding, of the container 10 as described in more detail below.

Figure 67:
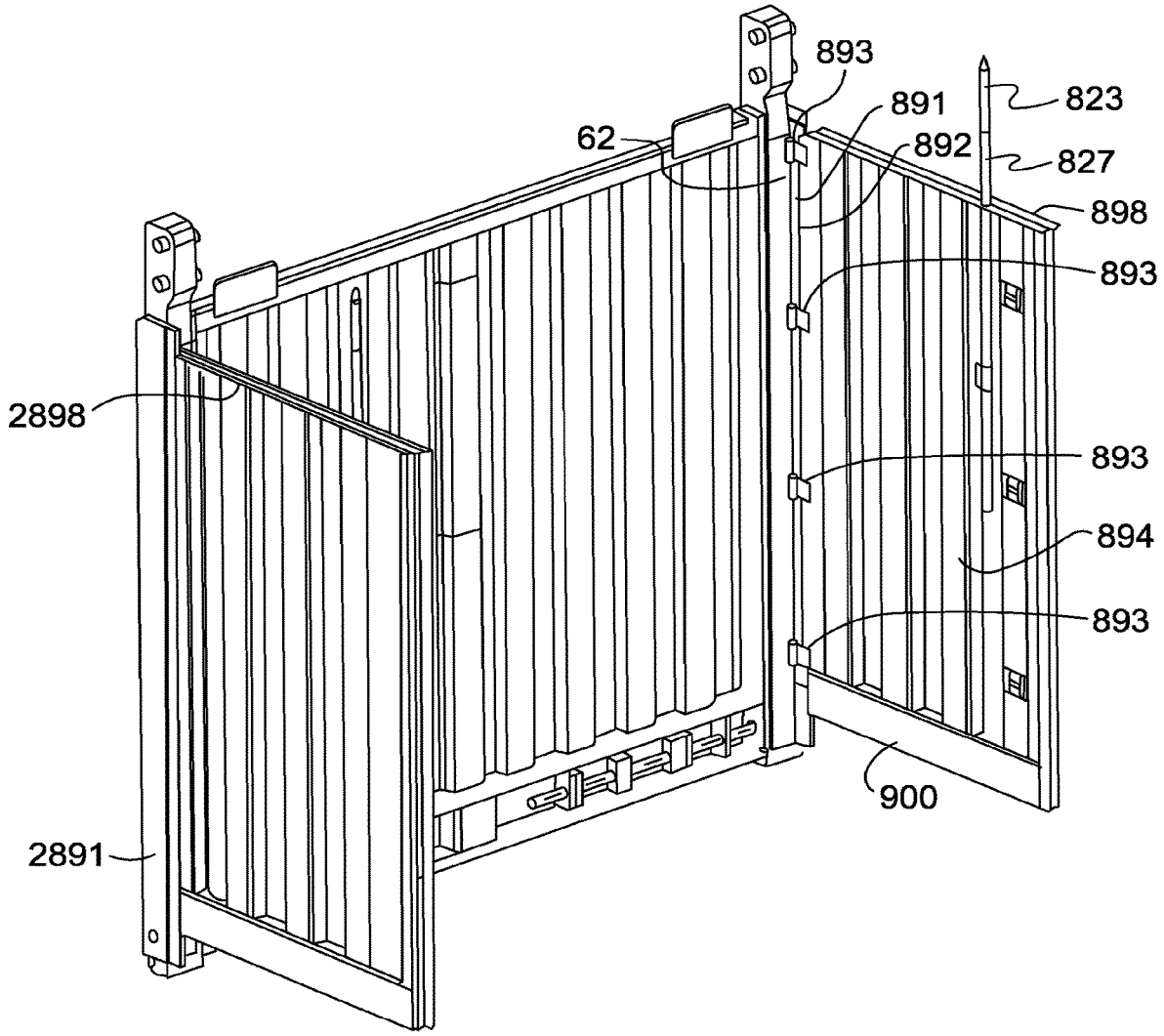
FIG. 67 is a perspective view of the front panel and right and left access panels.
Figure 68:
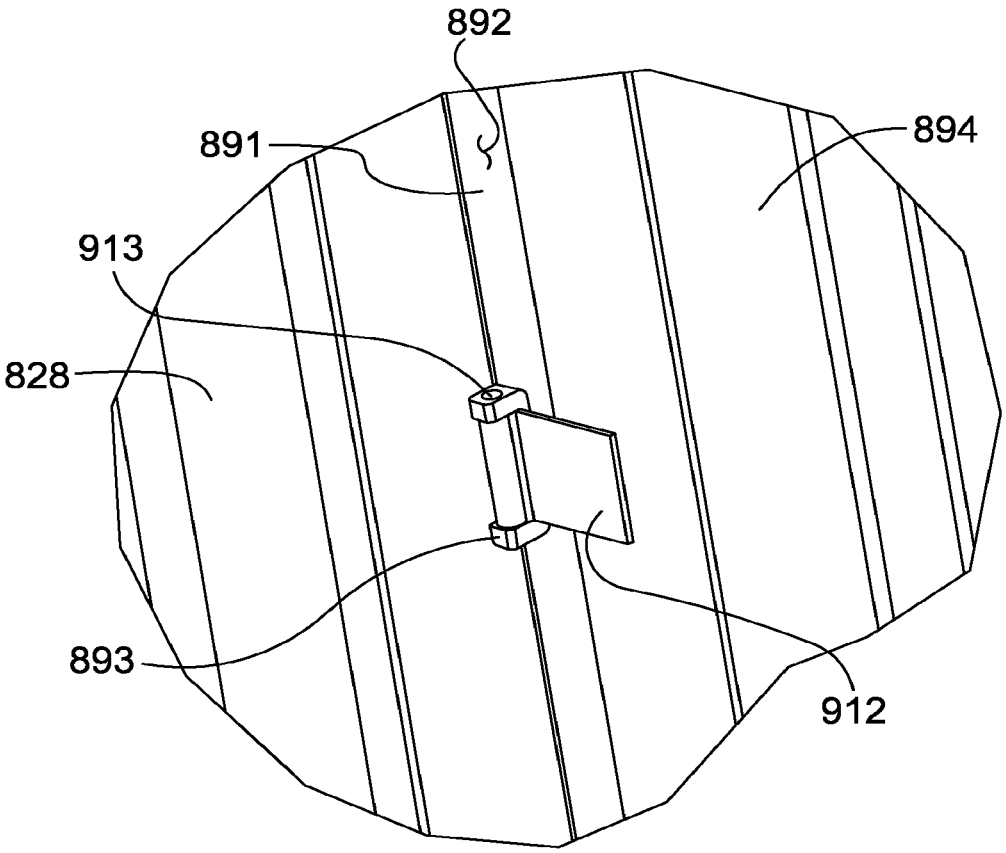
FIG. 68 is a view of a front right access panel hinge.
Figure 74:
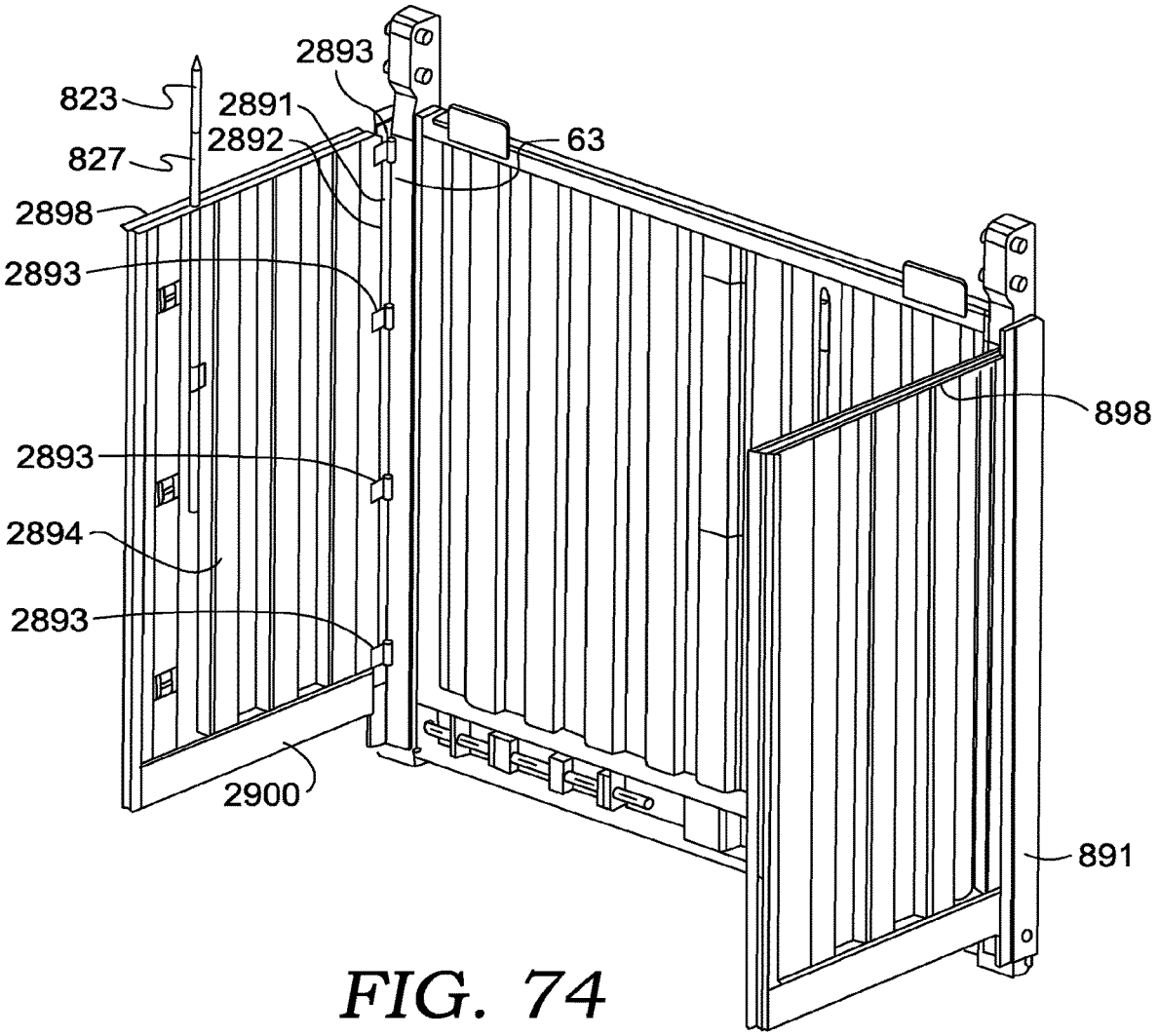
FIG. 74 is a perspective view of the front panel and right and left access panels.

Referring to FIGS. 67, 68 and 74, the front right post 62 includes a front right hinge plate 891 that extends towards the door edge 21 of the roof panel 11 when the container 10 is in the unfolded condition. Attached to the inward surface 892 of the front right hinge plate 891, in spaced relation to each other, are a plurality of, and preferably four, first front right hinge members 893. Each of the first front right hinge members 893 is fixedly secured to the inward surface 892 of the front right hinge plate 891, preferably by welding.

Figure 69:
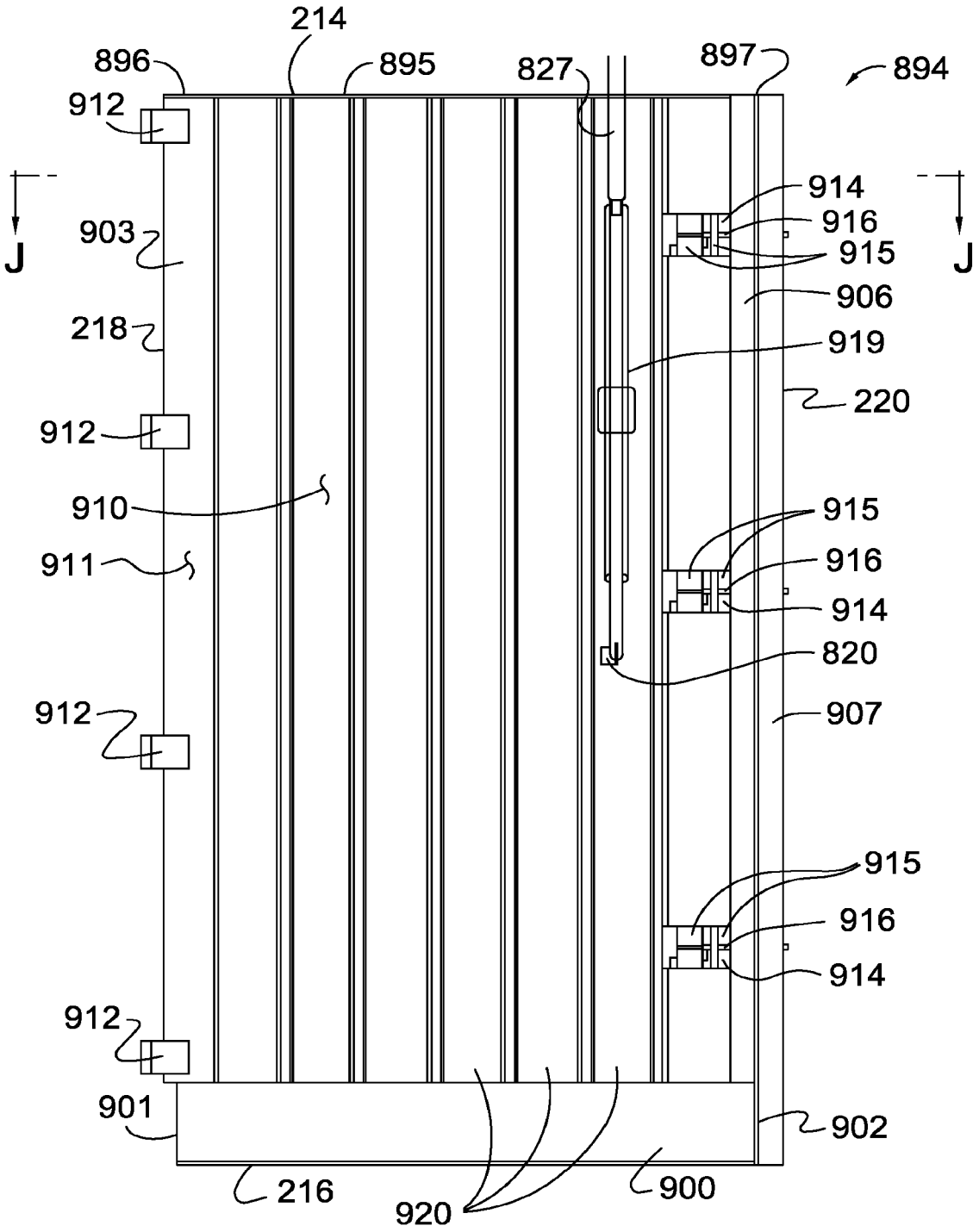
FIG. 69 is a plan view of the inner surface of the front right access panel.

As shown in FIG. 67, a front right access panel 894 is pivotably attached to the front right post 62, and as shown in FIG. 69, the front right access panel 894 includes a top edge 214, a bottom edge 216, a front edge 218, and a door edge 220. Extending along the top edge 214 of the front right access panel 894 along the length thereof is a front right upper cap plate 895 having a front end 896, a door end 897, and preferably, as shown in FIGS. 67 and 74, a front right roof flange 898 extends from the front end 896 to the door end 897. Extending along the bottom edge 216 of the front right access panel 894 along the length thereof is a front right beam 900 that has a front end 901 and a door end 902.

Figure 70:
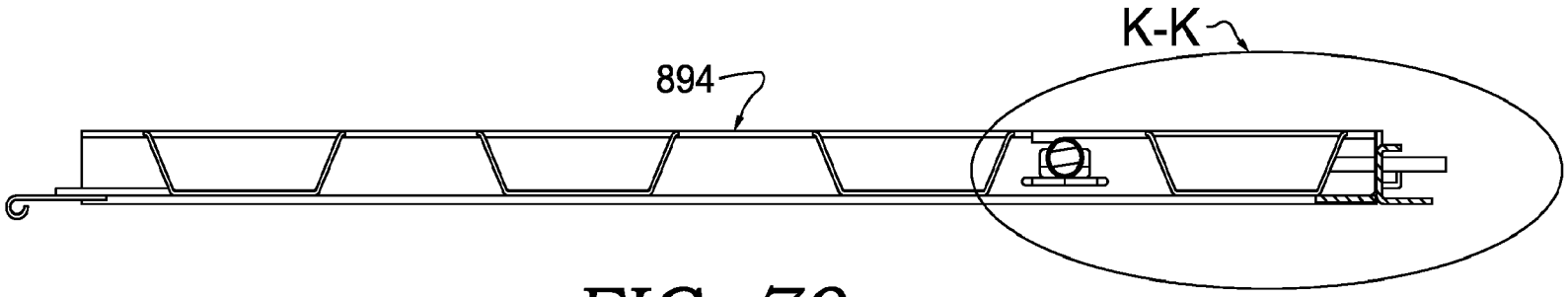
FIG. 70 is a cross sectional view of the front right access panel.
Figure 71:
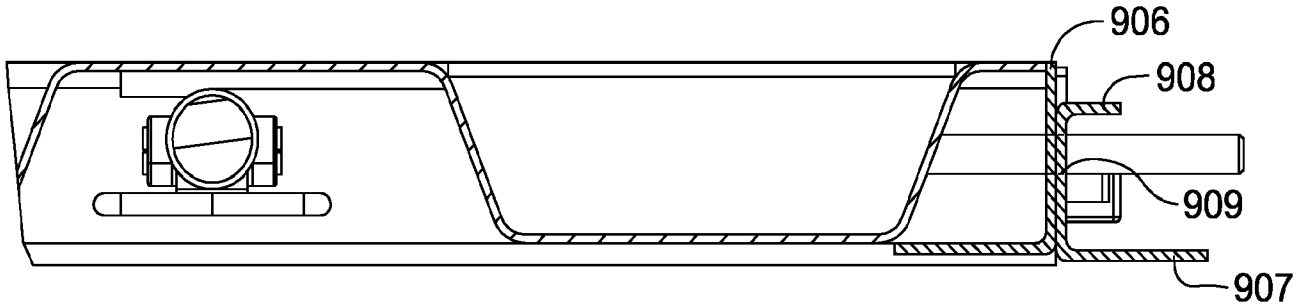
FIG. 71 is an enlarged view of section K-K of FIG. 70.

As shown in FIG. 69, a first front right access member 903 extends from the front end 896 of the front right upper cap plate 895 to the front end 901 of the front right beam 900, and is fixedly secured to the front ends 896, 901, preferably by welding. As shown in FIG. 69, a second front right access member 906 extends from the door end 897 of the front right upper cap plate 895 to the door end 902 of the front right beam 900, and is fixedly secured to the door ends 897, 902, preferably by welding. As shown in FIGS. 69, 70 and 71, the second front right access member 906 includes a long flange 907 and a short flange 908, each of which extends along the length of the second front right access member 906 and towards the door edge 21 of the roof panel 11 when the container 10 is in the unfolded condition. Located between the long flange 907 and the short flange 908 are a plurality of locking bolt holes 909, preferably three, that extend through the second front right access member 906. When the container 10 is in the unfolded condition, the locking bolt holes 909 are aligned with the right side bolt holes 767 of the right side panel 14.

Referring again to FIG. 69, corrugated sheet metal 910 extends from the front right upper cap plate 895 to the front right beam 900 along the entire length thereof, and from the first front right access member 903 to the second front right access member 906 along the entire length thereof. The corrugated sheet metal 910 is welded all along its entire perimeter to the immediately adjacent front right upper cap plate 895, first front right access member 903, front right beam 900, and second front right access member 906. As those skilled in the art will readily appreciate, the second front right access member 906 is welded to the corrugated sheet metal 910 such that the long flange 907 is visible from the interior of the container 10 when the container 10 is in its unfolded condition. As shown in FIGS. 67-69, attached to the inward surface 911 of the first front right access member 903 in spaced relation to each other, are a plurality of second front right hinge members 912. As shown in FIG. 68, each of the second front right hinge members 912 is rotatably secured to one of the first front right hinge members 893 by a hinge pin 913 so as to allow the front right access panel 894 to swing relative to the front main panel 828.

Figure 72:
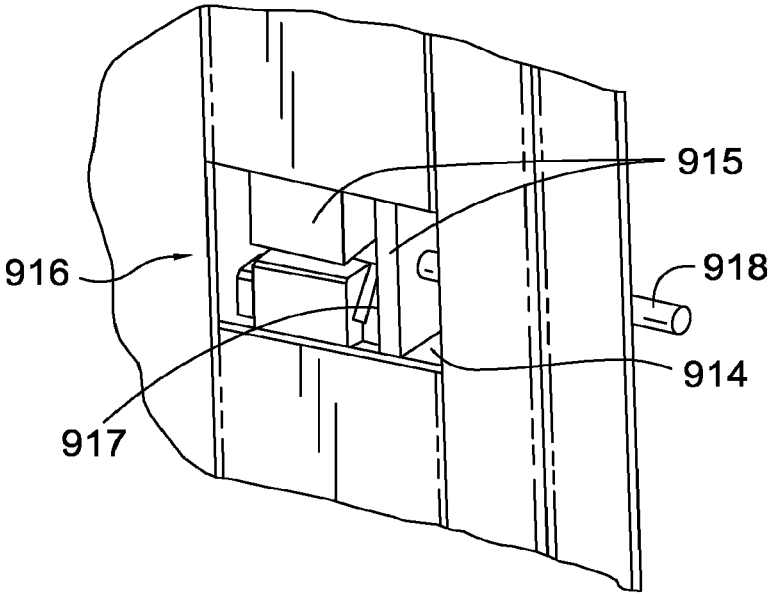
FIG. 72 is a view of the slide locking mechanism of the front right access panel.

Referring again to FIG. 69, immediately adjacent each of the locking bolt holes 909 in the second front right access member 906 is a recess 914 in the corrugated sheet metal 910, and within each recess 914 and aligned with the locking bolt holes 909 in the second front right access member 906 are slide lock retainers 915. As shown in FIGS. 69 and 72, a slide locking mechanism 916, including a slide lock lever 917, and a slide locking bolt 918, is slideably secured to each of the slide lock retainers 915 within the recesses 914 such that each slide locking mechanism 916 is positionable by use of one of the slide lock levers 917 between an unlocked position in which the respective slide locking bolt 918 is in a retracted position outside of the right side bolt holes 767 of the right side panel 14, and a locked position in which the respective slide locking bolt 918 extends through the immediately adjacent locking bolt hole 909 of the second front right access member 906 and one of the right side bolt holes 767 of the right side panel 14.

Figure 73:
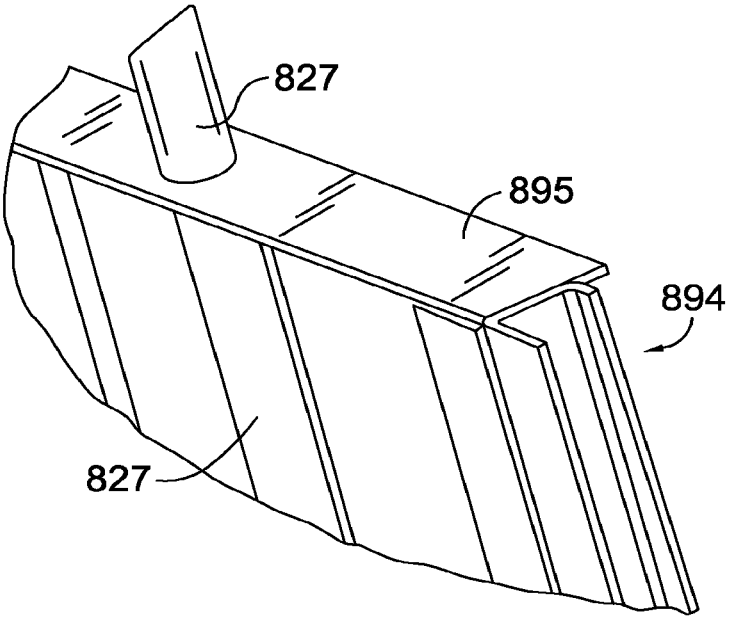
FIG. 73 is a perspective view of the upper cap plate of the front right access panel.

Referring again to FIGS. 67 and 69, at least one locking bolt assembly 919 is mounted to the front right access panel 894 within corrugations 920 of the corrugated sheet metal 910. The construction of the locking bolt assembly 919 is the same as those described with respect to the right side panel 14, except that each pivot anchor 820 is fixedly secured to the corrugated sheet metal 910 of the front right access panel 894, and each guide tube 827 extends through, and is fixedly secured to, the front right upper cap plate 895, as shown in FIG. 73. As those skilled in the art will readily appreciate, each of the locking bolt assemblies 919 so described is selectively positionable between a first position in which the locking bolt 823 is received within one of the locking bolt holes 610 in the lower face 608 of the roof right beam 600 when the container 10 is in the unfolded condition, and a second position in which the locking bolt 823 is fully withdrawn from that locking bolt hole 610.

Figure 75:
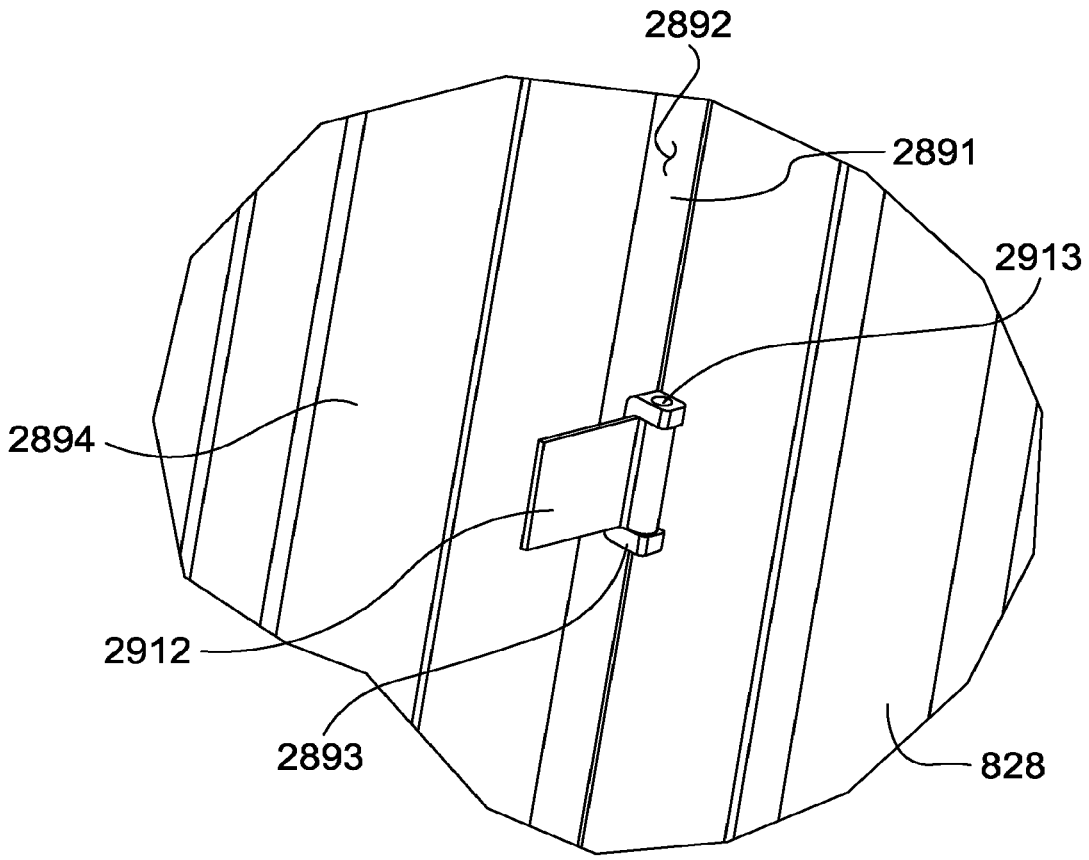
FIG. 75 is a view of a front left access panel hinge.

As shown in FIGS. 67, 74 and 75, the front left post 63 includes a front left hinge plate 2891 that extends towards the door edge 21 of the roof panel 11 when the container 10 is in the unfolded condition. Attached to the inward surface 2892 of the front left hinge plate 2891, in spaced relation to each other, are a plurality of, and preferably four, first front left hinge members 2893. Each of the first front left hinge members 2893 is fixedly secured to the inward surface 2892 of the front left hinge plate 2891, preferably by welding.

Figure 76:
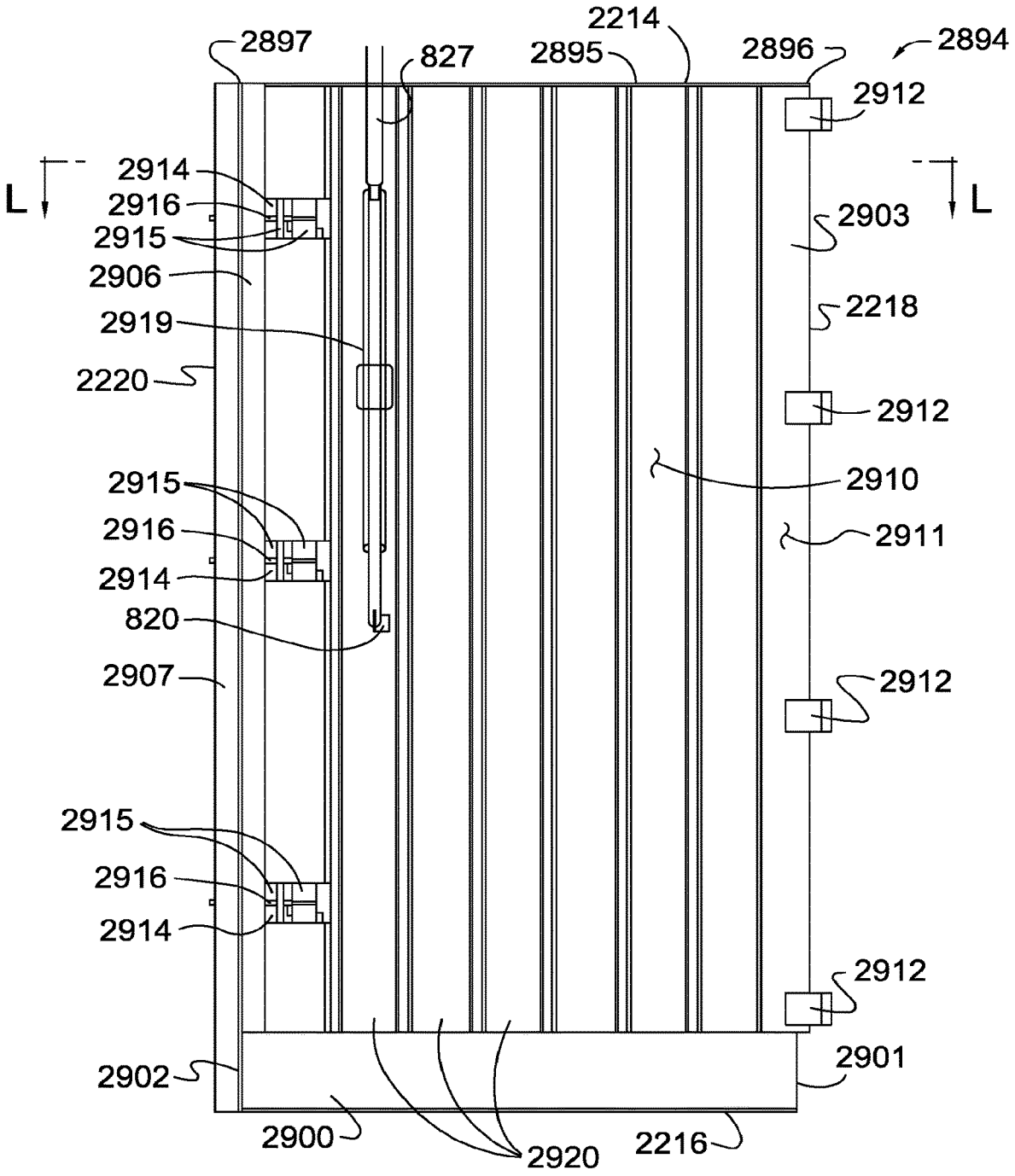
FIG. 76 is a plan view of the inner surface of the front left access panel.

As shown in FIG. 74, a front left access panel 2894 is pivotably attached to the front left post 63, and as shown in FIG. 76, the front left access panel 2894 includes a top edge 2214, a bottom edge 2216, a front edge 2218, and a door edge 2220. Extending along the top edge 2214 of the front left access panel 2894 along the length thereof is a front left upper cap plate 2895 having a front end 2896, a door end 2897, and preferably as shown in FIGS. 67 & 74 a front left roof flange 2898 extends from the front end 2896 to the door end 2897. Extending along the bottom edge 2216 of the front left access panel 2894 along the length thereof is a front left beam 2900 that has a front end 2901 and a door end 2902.

Figure 77:
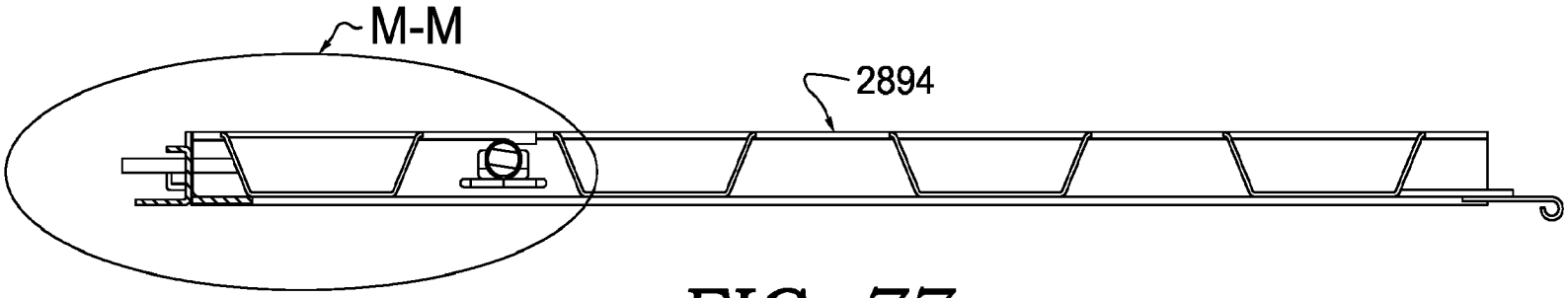
FIG. 77 is a cross sectional view of the front left access panel.
Figure 78:
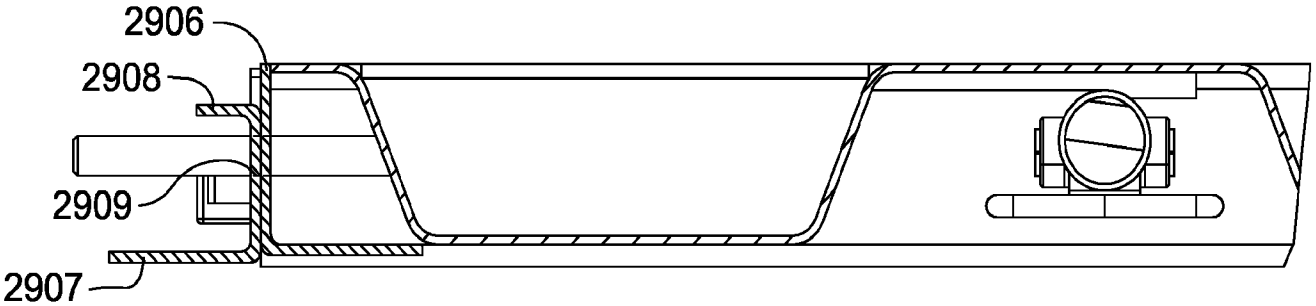
FIG. 78 is an enlarged view of section M-M of FIG. 77.

As shown in FIG. 76, a first front left access member 2903 extends from the front end 2896 of the front left upper cap plate 2895 to the front end 2901 of the front left beam 2900, and is fixedly secured to the front ends 2896, 2901, preferably by welding. As shown in FIG. 76, a second front left access member 2906 extends from the door end 2897 of the front left upper cap plate 2895 to the door end 2902 of the front left beam 2900, and is fixedly secured to the door ends 2897, 2902, preferably by welding. As shown in FIGS. 76, 77 and 78, the second front left access member 2906 includes a long flange 2907 and a short flange 2908, each of which extends along the length of the second front left access member 2906 and towards the door edge 21 of the roof panel 11 when the container 10 is in the unfolded condition. Located between the long flange 2907 and the short flange 2908 are a plurality of locking bolt holes 2909, preferably three, that extend through the second front left access member 2906. When the container 10 is in the unfolded condition, the locking bolt holes 2909 are aligned with the left side bolt holes 794 of the left side panel 16.

Referring again to FIG. 76, corrugated sheet metal 2910 extends from the front left upper cap plate 2895 to the front left beam 2900 along the entire length thereof, and from the first front left access member 2903 to the second front left access member 2906 along the entire length thereof. The corrugated sheet metal 2910 is welded all along its entire perimeter to the immediately adjacent front left upper cap plate 2895, first front left access member 2903, front left beam 2900, and second front left access member 2906. As those skilled in the art will readily appreciate, the second front left access member 2906 is welded to the corrugated sheet metal 2910 such that the long flange 2907 is visible from the interior of the container 10 when the container 10 is in its unfolded condition. As shown in FIGS. 74-76, attached to the inward surface 2911 of the first front left access member 2903 in spaced relation to each other, are a plurality of second front left hinge members 2912. Each of the second front left hinge members 2912 is rotatably secured to one of the first front left hinge members 2893 by a hinge pin 2913 so as to allow the front left access panel 2894 to swing relative to the front main panel 828.

Figure 79:
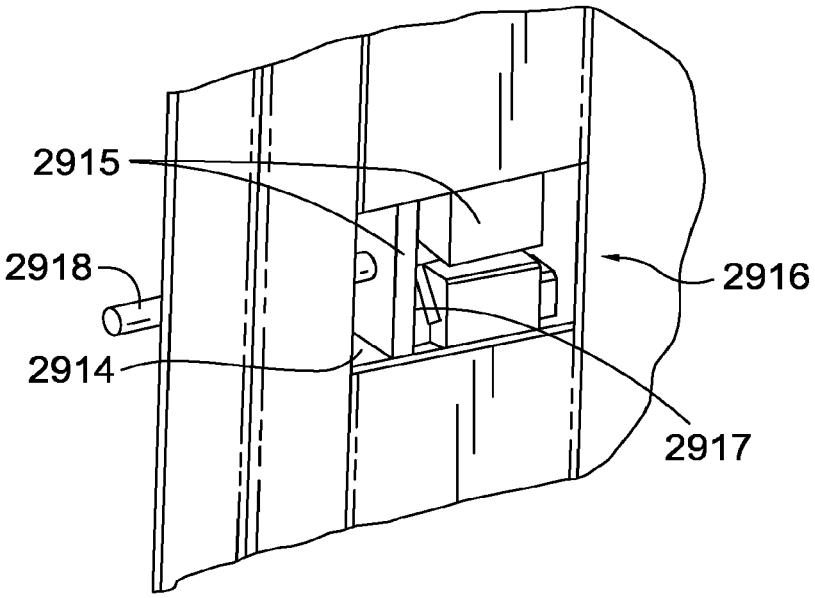
FIG. 79 is a view of the slide locking mechanism of the front left access panel.

Referring again to FIGS. 74 & 76, immediately adjacent each of the locking bolt holes 2909 in the second front left access member 2906 is a recess 2914 in the corrugated sheet metal 2910, and within each recess 2914 and aligned with the locking bolt holes 2909 in the second front left access member 2906 are slide lock retainers 2915. As shown in FIGS. 76 and 79, a slide locking mechanism 2916, including a lock lever 2917, and a slide locking bolt 2918, is slideably secured to each of the slide lock retainers 2915 within the recesses 2914 such that each slide locking mechanism 2916 is positionable by use of one of the slide lock levers 2917 between an unlocked position in which the respective slide locking bolt 2918 is in a retracted position outside of the left side bolt holes 794 of the left side panel 16, and a locked position in which the respective slide locking bolt 2918 extends through the immediately adjacent locking bolt hole 2909 of the second front left access member 2906 and one of the left side bolt holes 794 of the left side panel 16.

Figure 80:
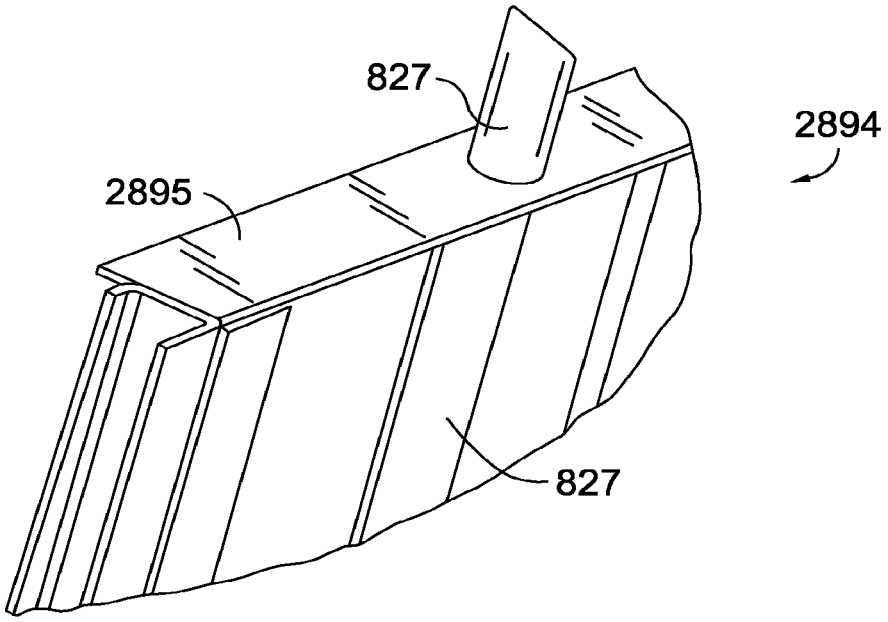
FIG. 80 is a perspective view of the upper cap plate of the front left access panel.

Referring again to FIG. 76, at least one locking bolt assembly 2919 is mounted to the front left access panel 2894 within corrugations 2920 of the corrugated sheet metal 2910. The construction of the locking bolt assembly 2919 is the same as those described with respect to the right side panel 14, except that each pivot anchor 820 is fixedly secured to the corrugated sheet metal 2910 of the front left access panel 2894, and each guide tube 827 extends through, and is fixedly secured to, the front left upper cap plate 2895, as shown in FIG. 80. As those skilled in the art will readily appreciate, each of the locking bolt assemblies 2919 so described is selectively positionable between a first position in which the locking bolt 823 is received within one of the locking bolt holes 610 in the lower face 609 of the roof left beam 603 when the container 10 is in the unfolded condition, and a second position in which the locking bolt 823 is fully withdrawn from that locking bolt hole 610.

Figure 81:
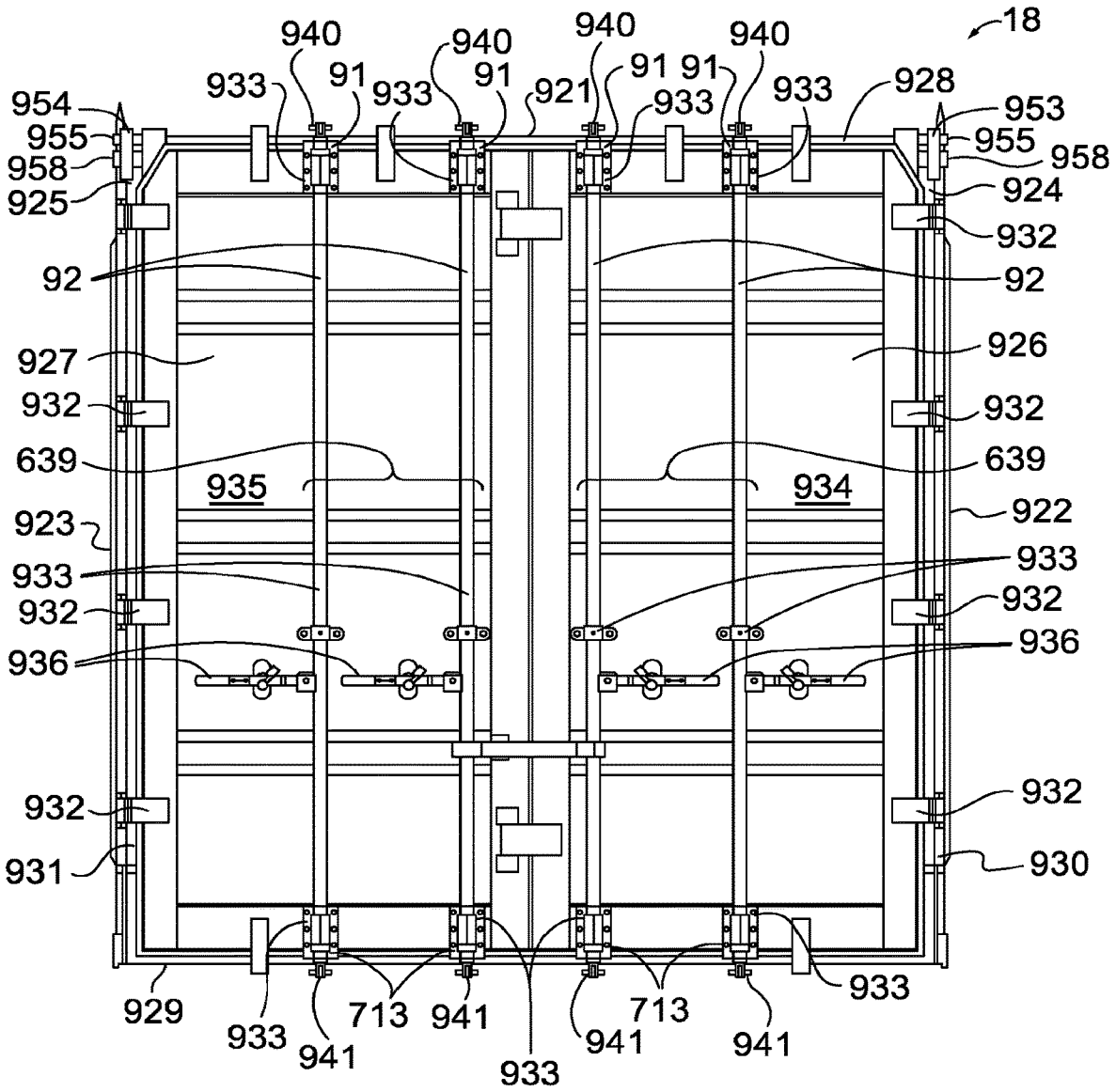
FIG. 81 is a plan view of the external surface of the door panel.
Figure 84:
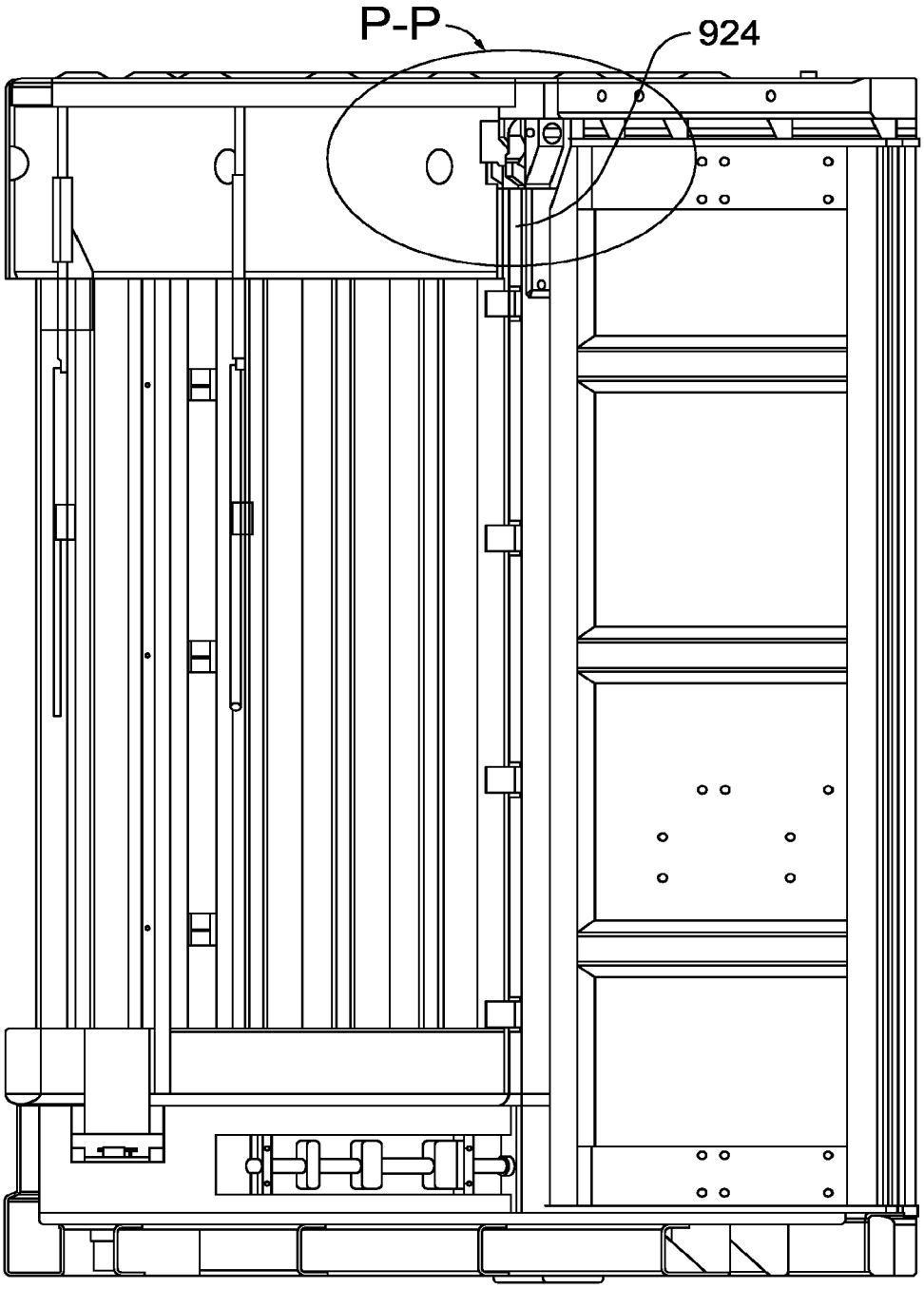
FIG. 84 is an internal view of the door end panel and right access panel.
Figure 85:
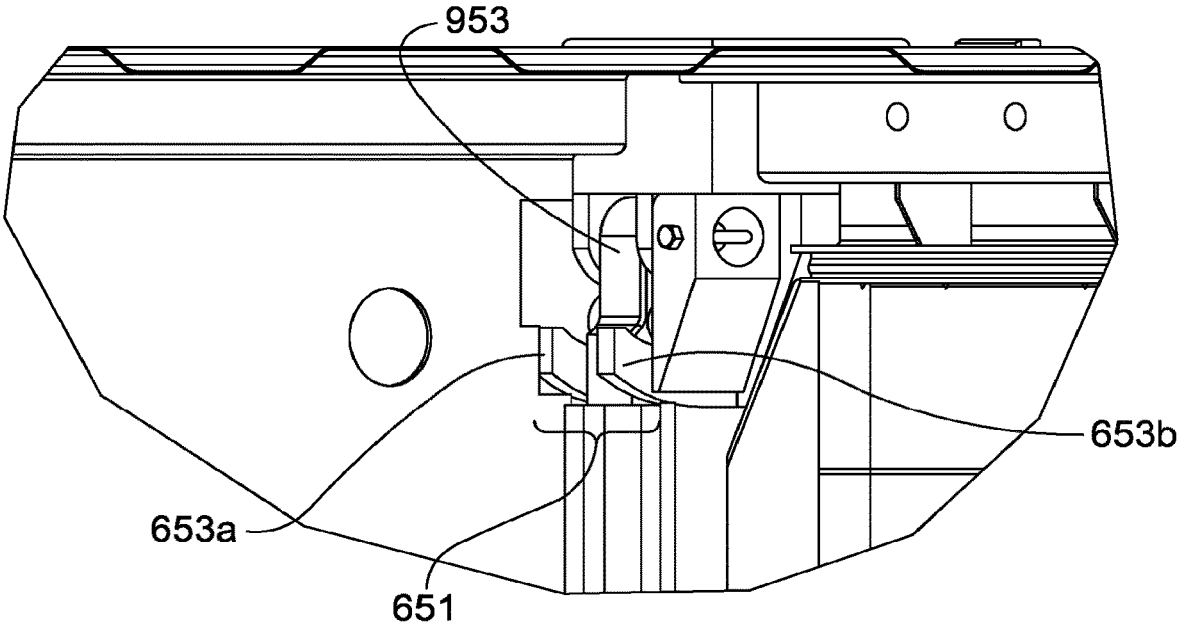
FIG. 85 is an enlarged view of section P-P of FIG. 84.
Figure 86:
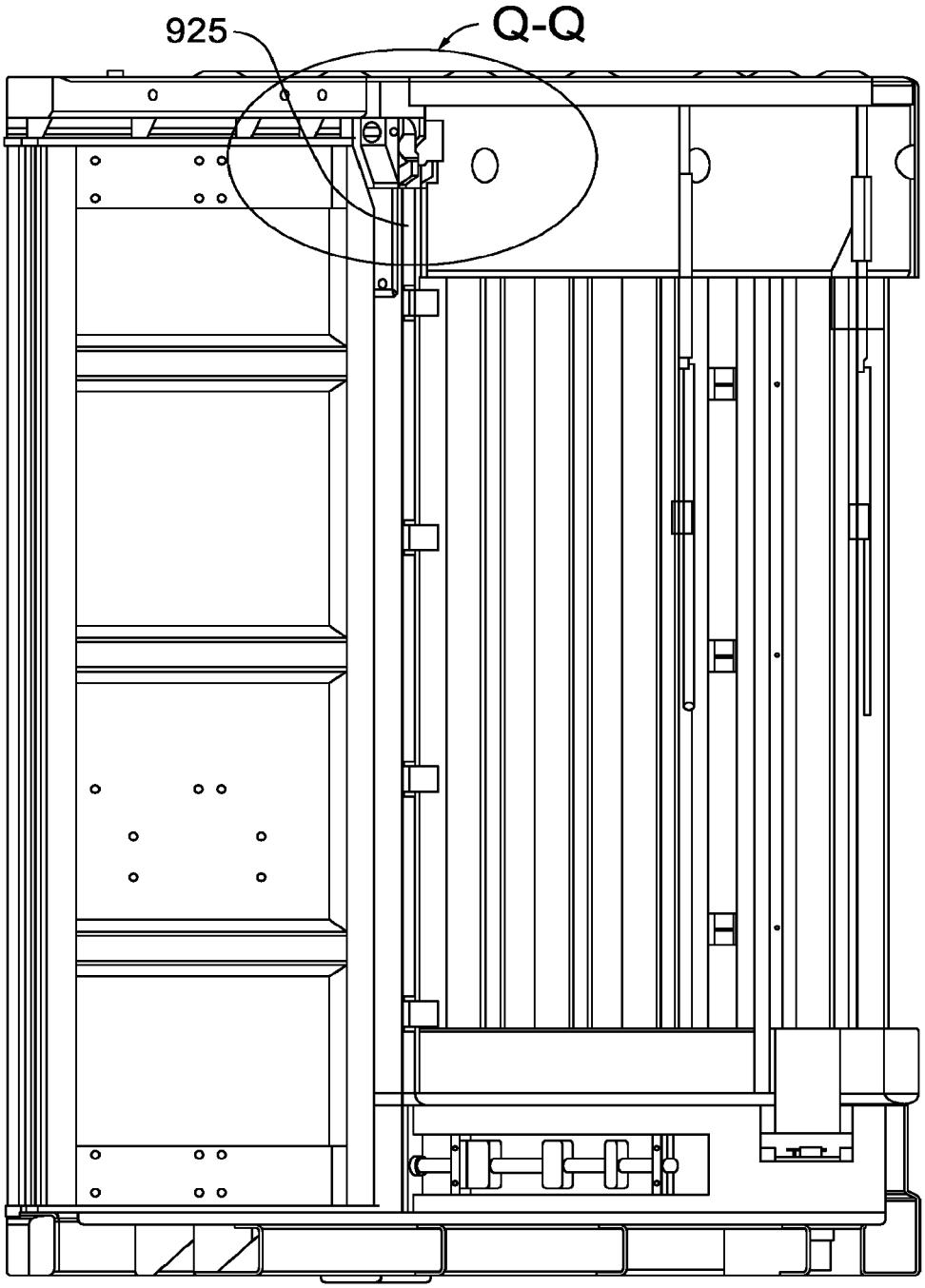
FIG. 86 is an internal view of the door end panel and left access panel.
Figure 87:
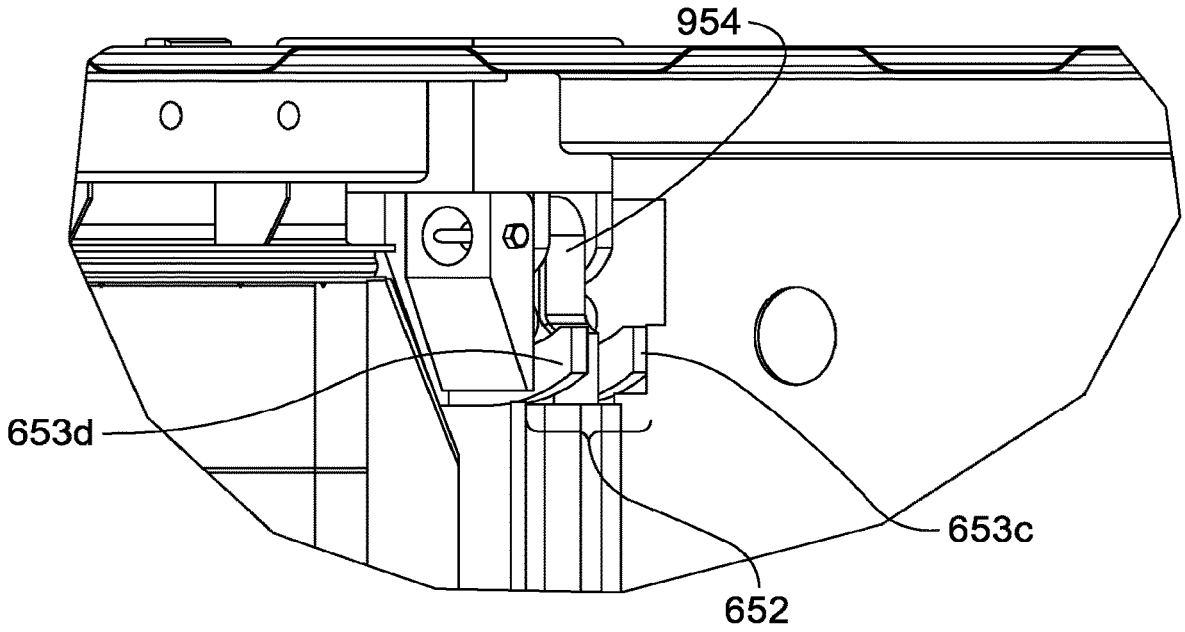
FIG. 87 is an enlarged view of section Q-Q of FIG. 86.

As shown in FIGS. 81, 84 and 86, the door panel 18 includes a door main panel 921, a door right access panel 922, and a door left access panel 923. The door main panel 921 includes a top edge 928, a bottom edge 929, a right edge 930, a left edge 931, two door posts 924, 925, and two doors 926, 927. The right door post 924, hollow and rectangular in cross section, extends along the right edge 930 of the door main panel 921, and a left door post 925, also hollow and rectangular in cross section, extends along the left edge 931 of the door main panel 921.

Referring again to FIG. 81, each door 926, 927 is of the type known in the shipping container art, and is hinged to one of the door posts 924, 925 by a plurality of door hinges 932 so as to be rotatable between a first position in which such door 926, 927 is closed, and a second position in which such door 926, 927 is open. Each door 926, 927 has a door latch assembly 639 attached thereto, and each door latch assembly preferably includes two locking rods 92 rotatably attached to the outer surface 934, 935 of such door 926, 927 by rod guides 933. The locking rods 933 of the present disclosure are of the type known in the art and commonly used on shipping containers. Such locking rods 92 have knuckles 940 at the upper ends 91 thereof, and knuckles 941 at the lower ends 713 thereof, and each locking rod 92 has a handle 936 attached thereto to rotate such locking rod 92 approximately 180 degrees. As those skilled in the art will readily appreciate, when the container 10 is in the unfolded condition and the doors 926, 927 are closed, rotating each of the locking rods 92 by means of the handles 936 attached thereto causes the knuckles 940 at the upper ends 91 of such locking rods 92 to rotate into one of the lock hasps **90*a* on the roof panel 11 while simultaneously causing the knuckles 941 at the lower ends 713 of such locking rods 92 to rotate into one of the lock hasps 90*b* on the base panel 17, thereby securing the doors 926, 927** in the closed position.

Figure 83:
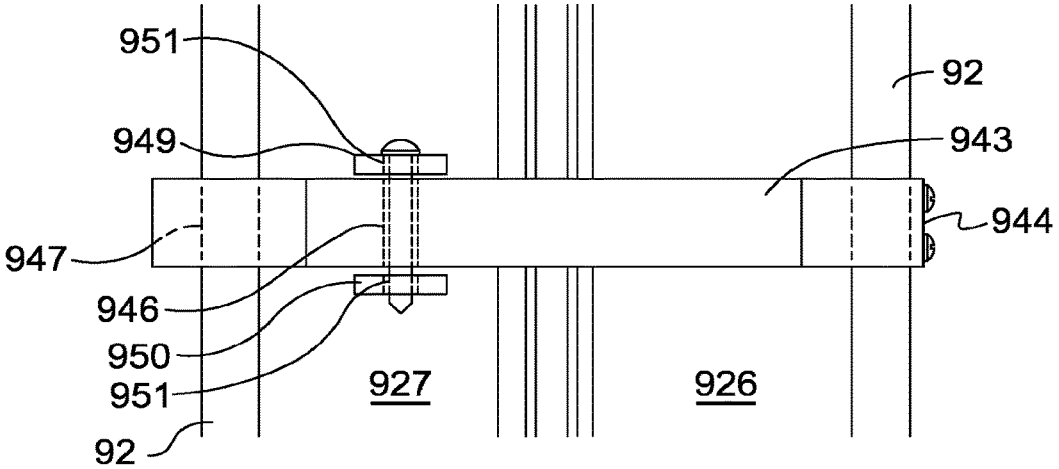
FIG. 83 is a plan view of the locking bar on the door panel.
Figure 82:
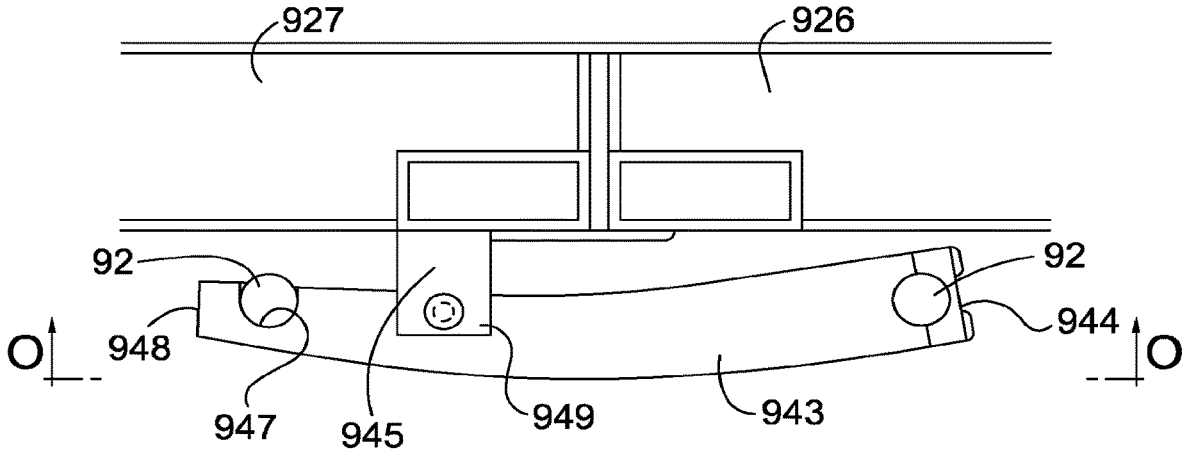
FIG. 82 is a top view of the locking bar on the door panel.

As shown in FIGS. 82 and 83, a locking bar 943 is pivotably connected at one end 944 to one of the locking rods 92 of the right door 926, and a locking block 945 is fixedly secured to the left door 927 at a location that is aligned with the locking bar 943 when both of the doors 926, 927 are closed. The locking bar 943 further includes a lock pin hole 946 that extends vertically through the locking bar 943, and the locking bar 943 has a locking rod recess 947 adjacent the distal end 948 of the locking bar 943. The locking block 945 has an upper flange 949 and a lower flange 950 in spaced relation to each other for receiving the locking bar 943, and a pin receiving hole 951 that is the same diameter as the lock pin hole 946 extends vertically through the upper flange 949 and lower flange 950. The lock pin hole 946 is located on the locking bar 943 such that, when the locking bar 943 is received within the flanges 949, 950 of the locking block 945 and a locking rod 92 on the left door 927 is received within the locking rod recess 947 (the "locked position"), the lock pin hole 946 of the locking bar 943 and pin receiving hole 951 of the locking block 945 are substantially coaxial, so as to allow a locking pin 952 to be inserted through the pin receiving hole 951 of the upper flange 949, through the lock pin hole 946 of the locking bar 945, and into the pin receiving hole 951 of the lower flange 950.

As shown in FIG. 81, extending upwardly from each of the door posts 924, 925 adjacent the top edge 928 of the door main panel 921 is a door hinge pivot 953, 954, and as shown in FIGS. 84-87, each door hinge pivot 953, 954 is rotatably connected to one of the sets 651, 652 of door first hinge members 653*a*, 653*b*, 653*c*, 653*d* located adjacent the door edge 21 of the roof panel 11. Each door hinge pivot 953, 954 has a hinge pin 955, as shown in FIG. 81, that extends through one of the door hinge pivots 953, 954 and the door pivot holes 668 of the immediately adjacent door first hinge members 653*a*, 653*b*, 653*c* and 653*d* so as to allow the door panel 18 to rotate relative to the roof panel 11.

Figure 88B:
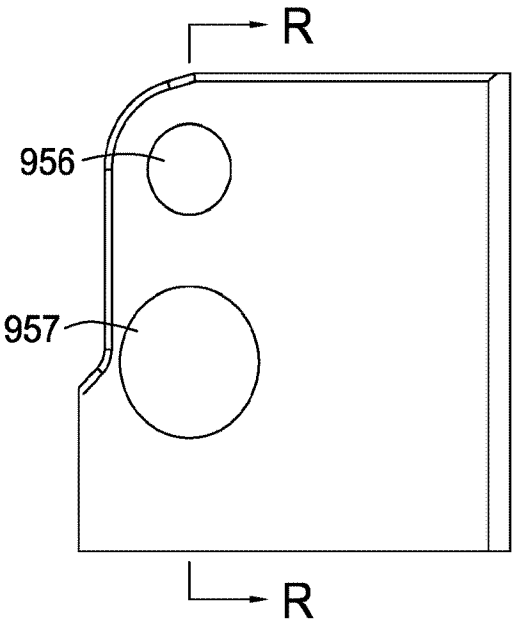
FIGS. 88A, 88B and 88C are views of the door pivot hinge.
Figure 88C:
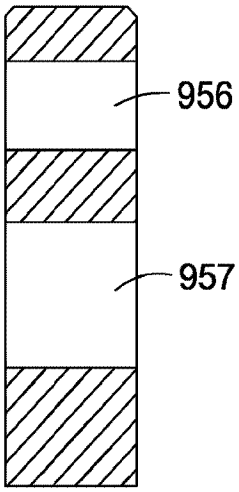
Figure 88A:
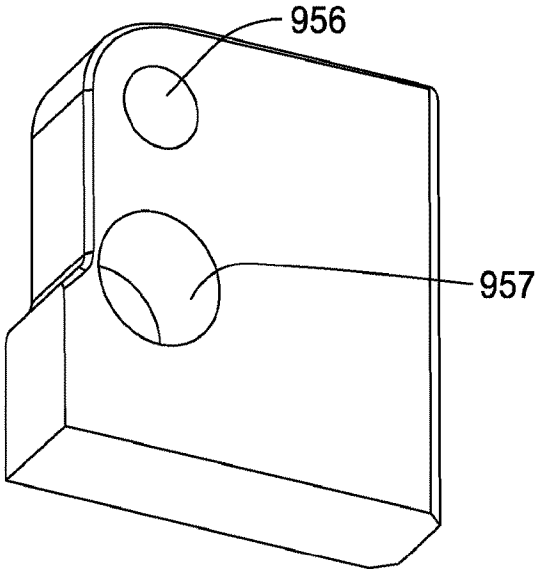

The door hinge pivot 953 adjacent the right edge 930 of the door main panel 921 and the door hinge pivot 954 adjacent the left edge 931 of the door main panel 921 are identical, and a representative door hinge pivot is shown in isolation in FIGS. 88A-88C. Each door hinge pivot 953, 954 has a pivot hinge pin hole 956 extending therethrough, and a cylindrical lug hole 957 extending therethrough as well. As shown in FIG. 81, a cylindrical lug 958 extends through each cylindrical lug hole 957 and protrudes from each side of the door hinge pivots 953, 954. Each cylindrical lug 958 has a diameter that is only slightly less than the height 959 of the door lug receiving slot 669 on each of the door first hinge members 653*a*, 653*b*, 653*c*, 653*d* of the roof panel 11. When incorporated into the present disclosure, the hinge pin 955 extends through the door pivot hole 668 of one of the door first hinge members 653*a*, 653*c* through the pivot hinge pin hole 956 of the door hinge pivot 953, and through the door pivot hole 668 of another one of the door first hinge members 653*b*, 653*d* adjacent to the other door first hinge member 653*a*, 653*c* to allow for rotation between the door panel 18 and the roof panel 11. As those skilled in the art will readily appreciate, when the door hinge pivots 953, 954 are rotatably secured between two of the door first hinge members 653*a*, 653*b*, 653*c*, 653*d* by a hinge pin 955, rotation of the cylindrical lugs 958 into the lug receiving slots 669 of the immediately adjacent door first hinge members 653*a*, 653*b*, 653*c*, 653*d*, shifts much of the load carried by the door hinge pivots 953, 954 from the hinge pins 955 to the cylindrical lugs 958, allowing the door hinge pivots 953, 954 to support more weight than either could carry on the hinge pins 955 alone. The construction and function of the door hinge pivot 954 adjacent the left edge 931 of the door main panel 921 is the same as that described for the door hinge pivot 953 adjacent the right edge 930, except that the door hinge pivot 954 is received between the door first hinge members 653*c*, 653*d* adjacent the left edge 20 of the roof panel 11.

Figure 93:
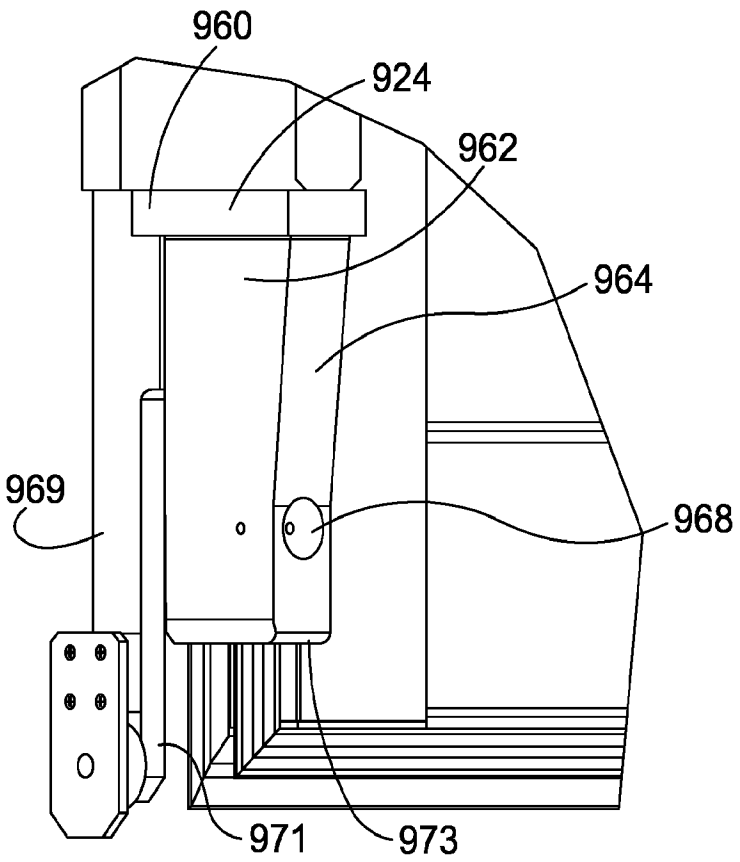
FIG. 93 is a view of the front face of the door right post locking tang.
Figure 94:
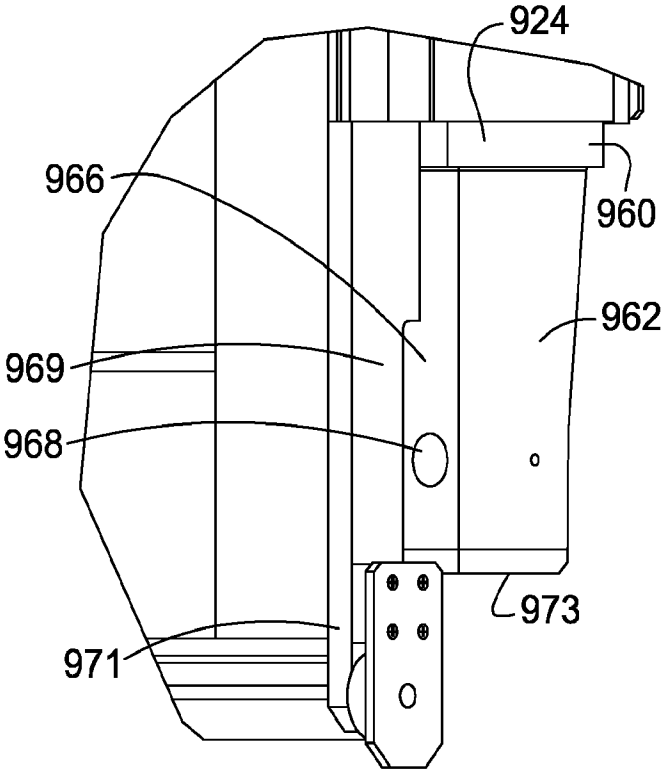
FIG. 94 is a view of the door face of the door right post locking tang.
Figure 96:
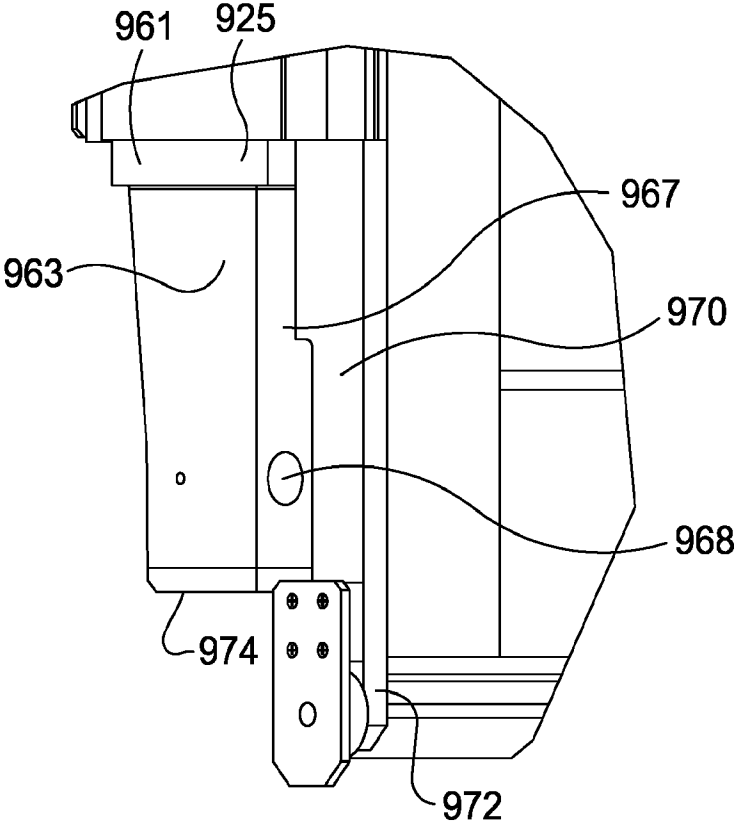
FIG. 96 is a view of the door face of the door left post locking tang.
Figure 95:
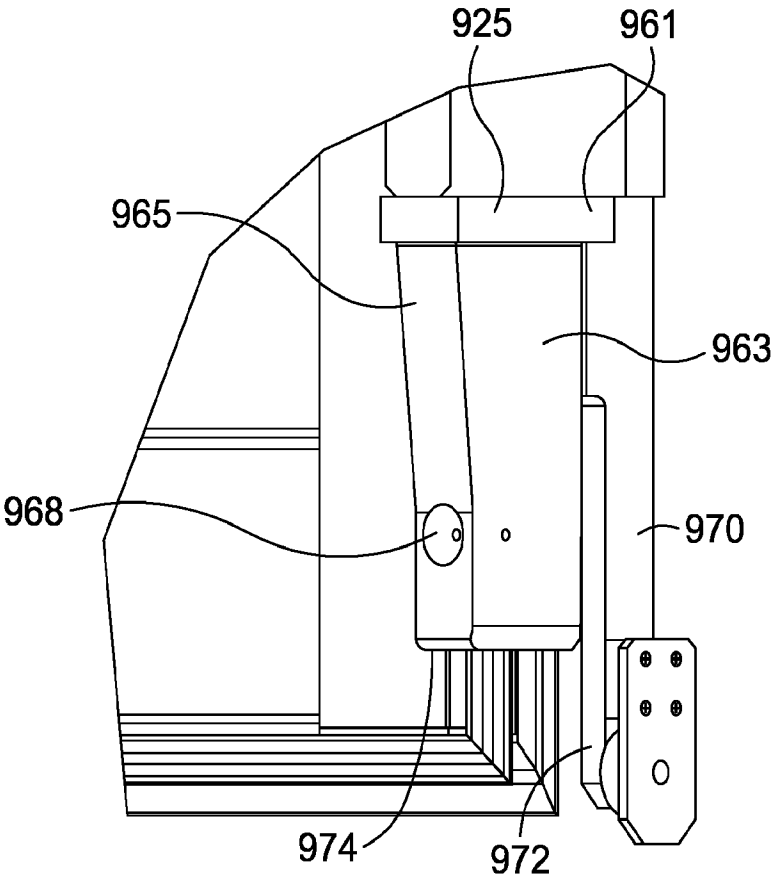
FIG. 95 is a view of the front face of the door left post locking tang.
Figure 97:
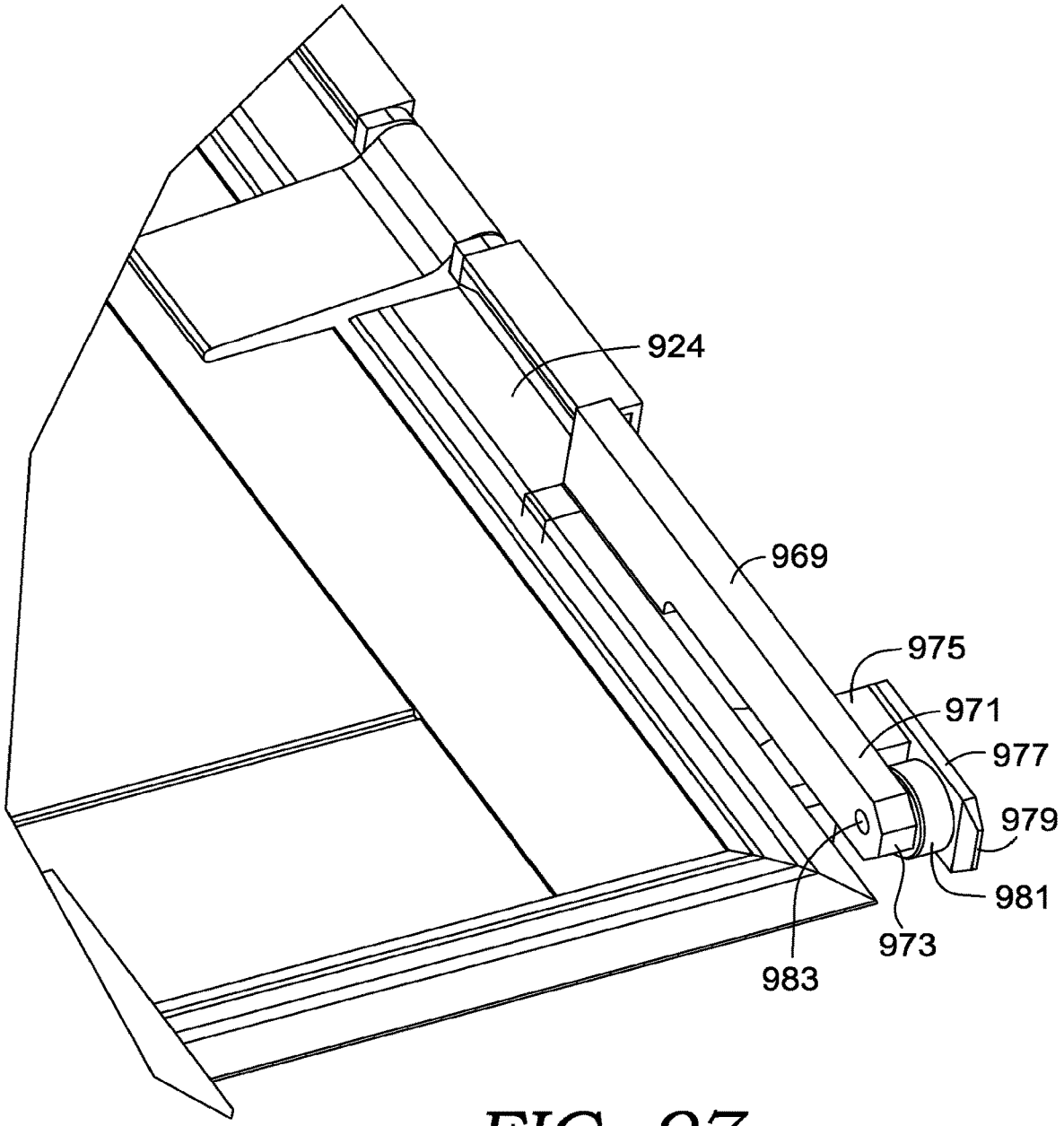
FIG. 97 is a view of the door right post roller arm.
Figure 98:
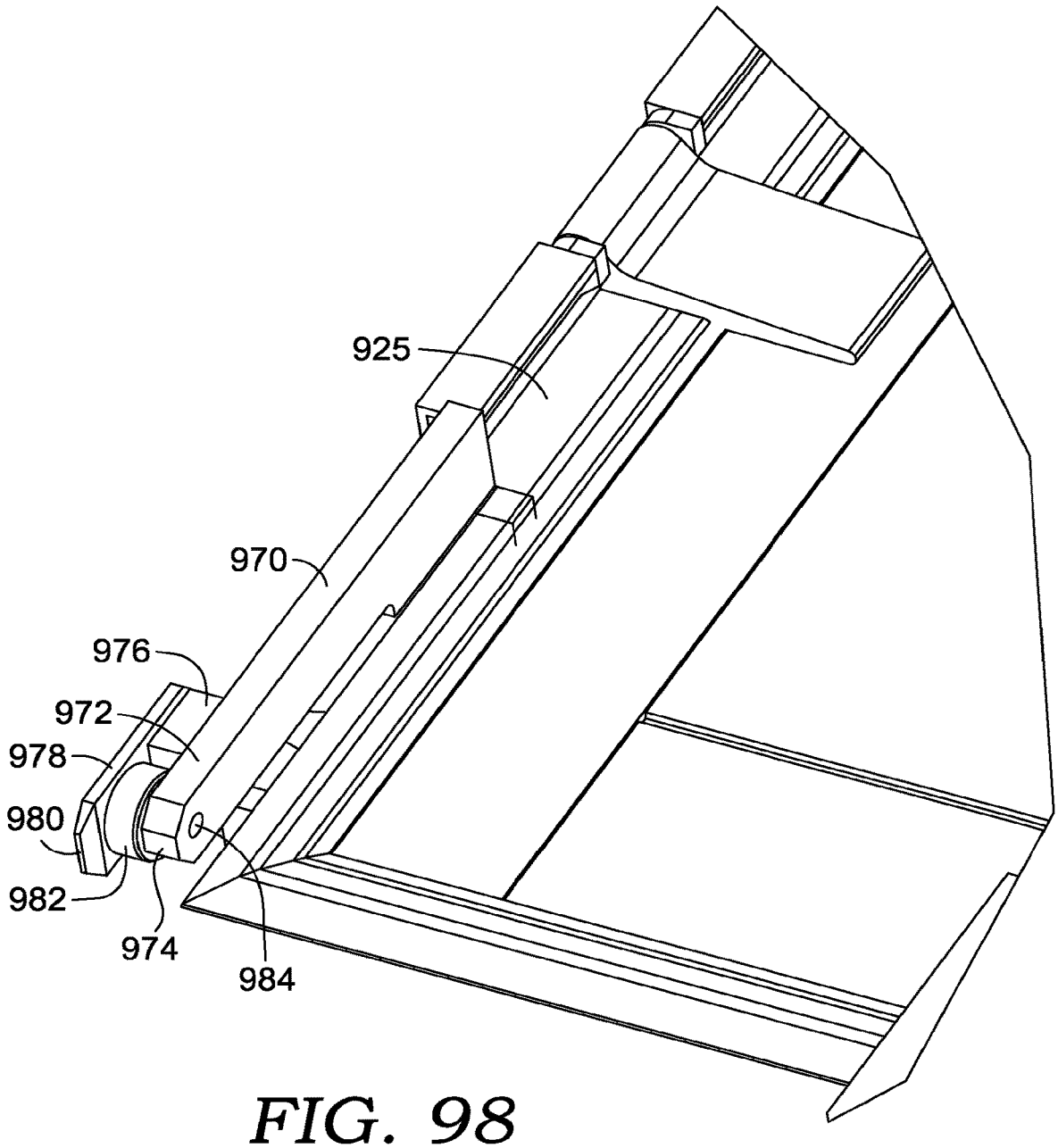
FIG. 98 is a view of the door left post roller arm.

As shown in FIGS. 89-92, at the lower end 960, 961 of each of the door posts 924, 925 of the door panel 18 is a tang 962, 963. Each door tang 962, 963 has a front face 964, 965 which faces the front panel 12, and a door face 966, 967 which faces away from the front panel 12. As shown in greater detail in FIGS. 93 and 94, the door tang 962 attached to the door right post 924 includes a hole 968, which extends from the front face 964 to the door face 966 of the door tang 962, and the hole 968 tapers from a first diameter at the front face 964 to a slightly smaller diameter at the door face 966. As shown in FIGS. 95 and 96, the construction of the door tang 963 attached to the door left post 925 is the same as that for the tang 962 attached to the door right post 924, except that the hole 968 extends from the front face 965 of the door tang 963 attached to the door left post 925 to the door face 967 of the door tang 963 attached to the door left post 925.

As shown in FIGS. 93-96, each of the door posts 924, 925 has a door roller arm 969, 970 fixedly secured thereto adjacent the lower end thereof 960, 961, and each door roller arm 969, 970 extends downward along the immediately adjacent tang 962, 963, but in spaced relation thereto. The lower end 971, 972 of each door roller arm 969, 970 extends about two inches below the lower end 973, 974 of the immediately adjacent door tang.

As shown in FIGS. 93-98, a spacer 975, 976 is secured to each door roller arm 969, 970 adjacent the lower end 971, 972 thereof, and each spacer 975, 976 has a roller cover plate 977, 978 removably secured thereto in spaced relation to the immediately adjacent door roller arm 969, 970. The lower edge 979, 980 of each roller cover plate 977, 978 extends downward along the immediately adjacent door roller arm 969, 970 and then about half an inch to an inch below the lower end 973, 974 thereof. A door roller 981, 982 is rotatably attached to each of the roller arms 969, 970 adjacent the lower end 973, 974 thereof, and is secured in place by an axel pin 983, 984 that extends between the door roller arm 969, 970 and the roller cover plate 977, 978 immediately adjacent thereto. Each of the door rollers 981, 982 is aligned with one of the rails 402, 404 of the base panel 17 and rides on such rails 402, 404 during the folding, and unfolding, of the container 10 as described in more detail below.

Referring back to FIGS. 89 and 90, the door right post 924 includes a door right hinge plate 3891 that extends towards the front edge 22 of the roof panel 11 when the container 10 is in the unfolded condition. Attached to the inward surface 3892 of the door right hinge plate 3891, in spaced relation to each other, are a plurality of, and preferably four, first door right hinge members 3893. Each of the first door right hinge members 3893 is fixedly secured to the inward surface 3892 of the door right hinge plate 3891, preferably by welding.

Figure 90:
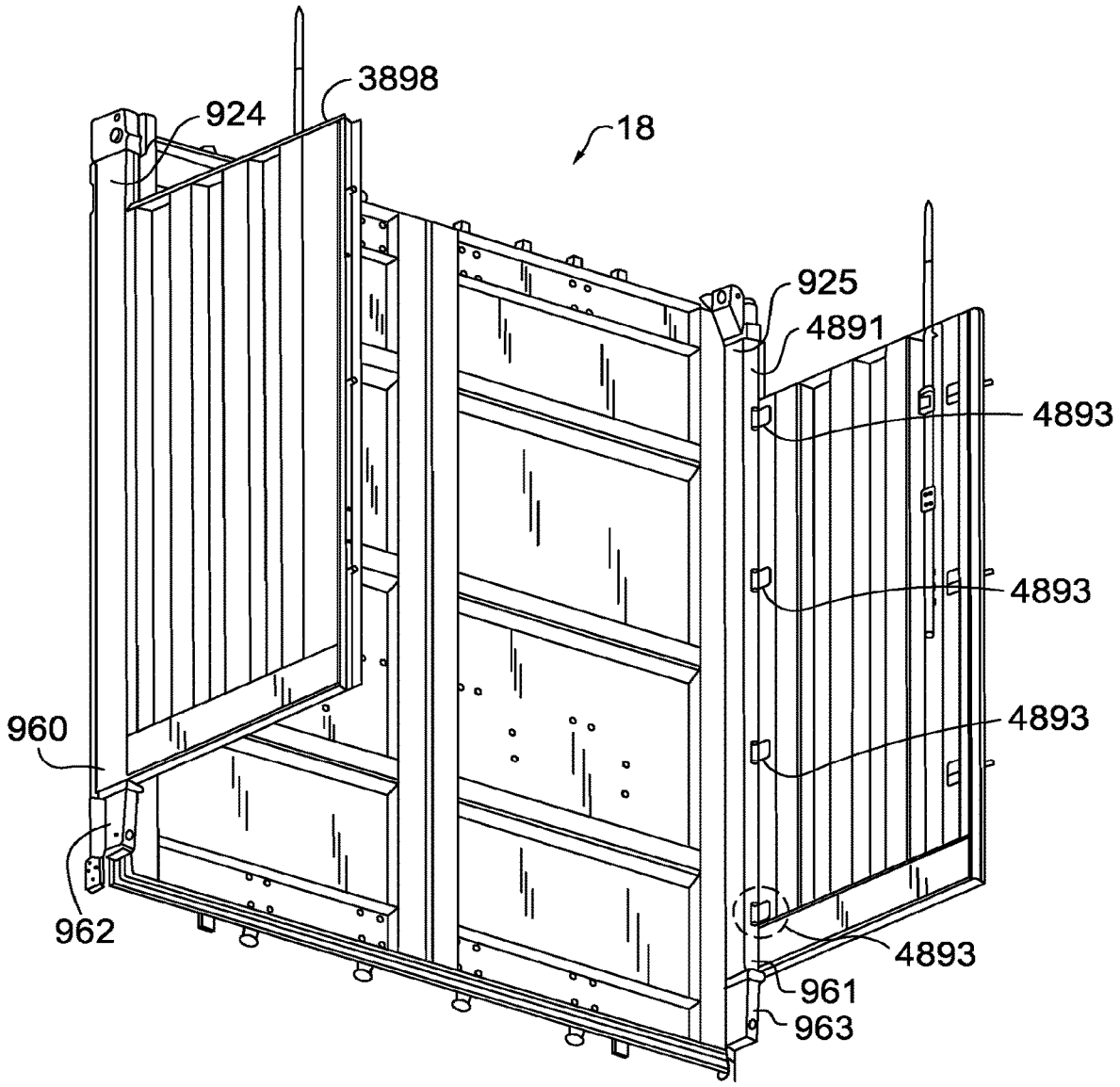
FIG. 90 is a perspective view of the door panel and right and left access panels.
Figure 99:
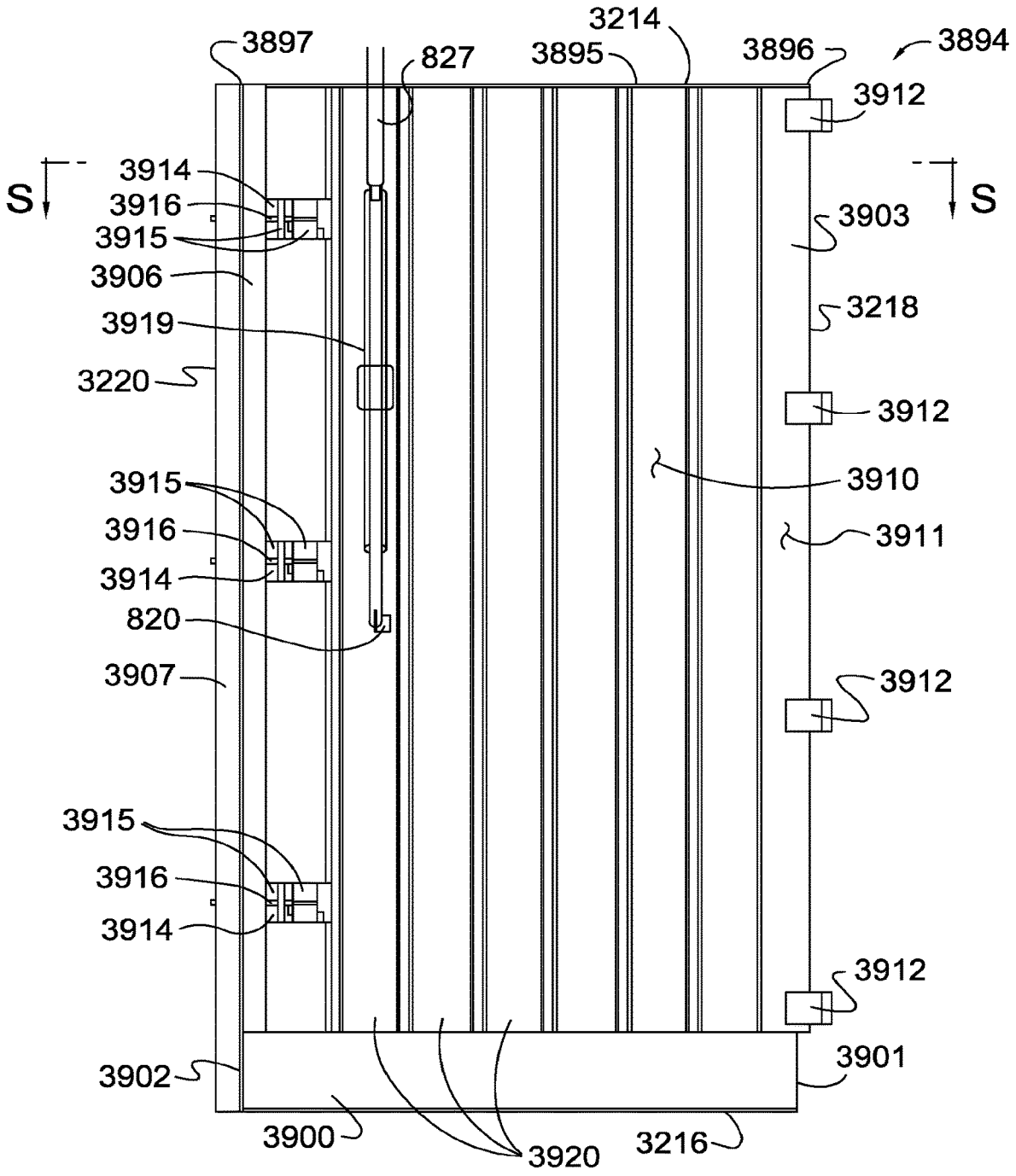
FIG. 99 is a plan view of the inner surface of the door right access panel.
Figure 105:
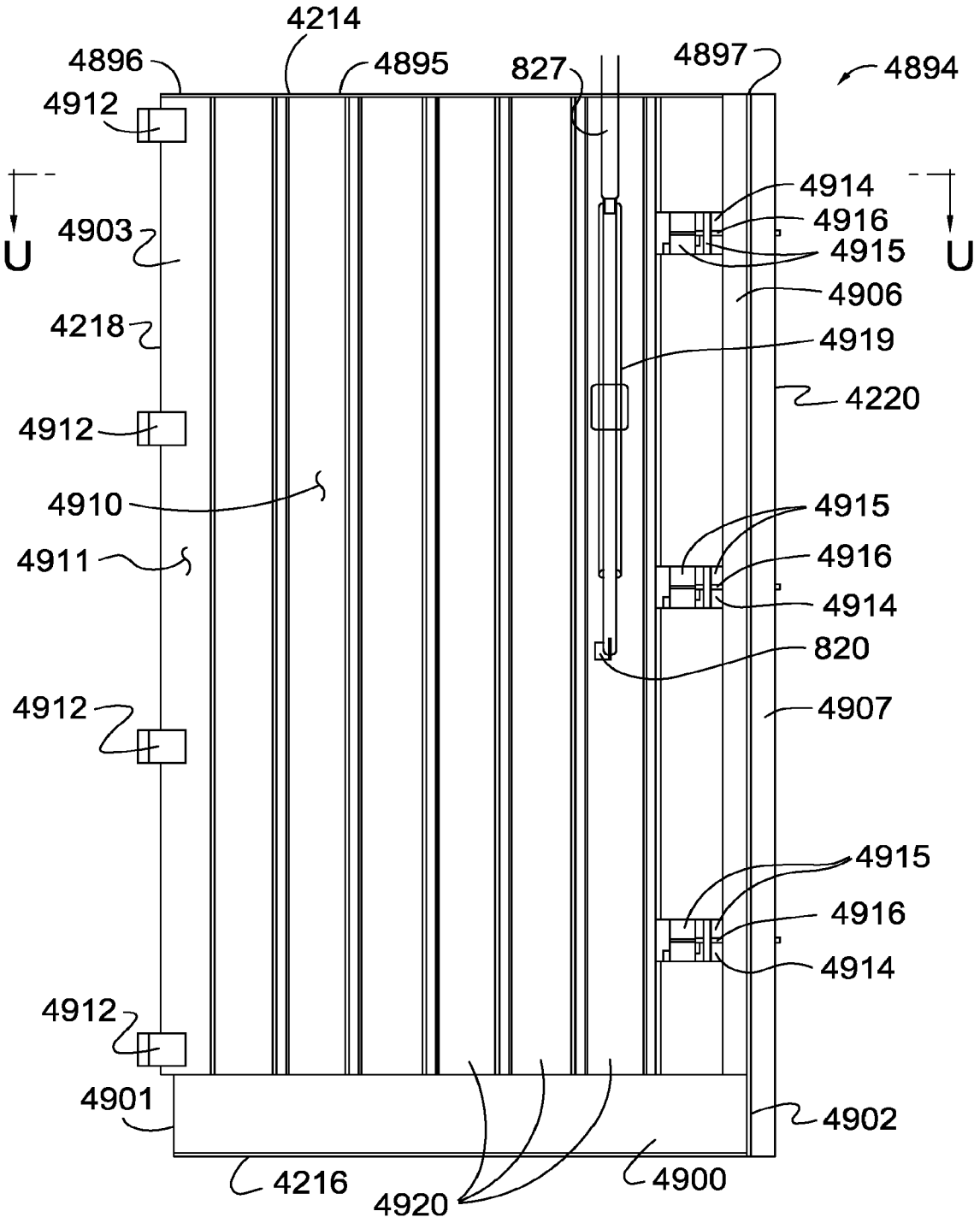
FIG. 105 is a plan view of the inner surface of the door left access panel.

A door right access panel 3894 is pivotably attached to the door right post 924, and as shown in FIGS. 99 and 105, the door right access panel 3894 includes a top edge 3214, a bottom edge 3216, a front edge 3218, and a door edge 3220. Extending along the top edge 3214 of the door right access panel 3894 along the length thereof is a door right upper cap plate 3895 having a front end 3896, a door end 3897, and preferably as shown in FIG. 90, a door right roof flange 3898 extends from the front end 3896 to the door end 3897. Extending along the bottom edge 3216 of the door right access panel 3894 along the length thereof is a front right beam 3900 that has a front end 3901 and a door end 3902.

Figure 91:
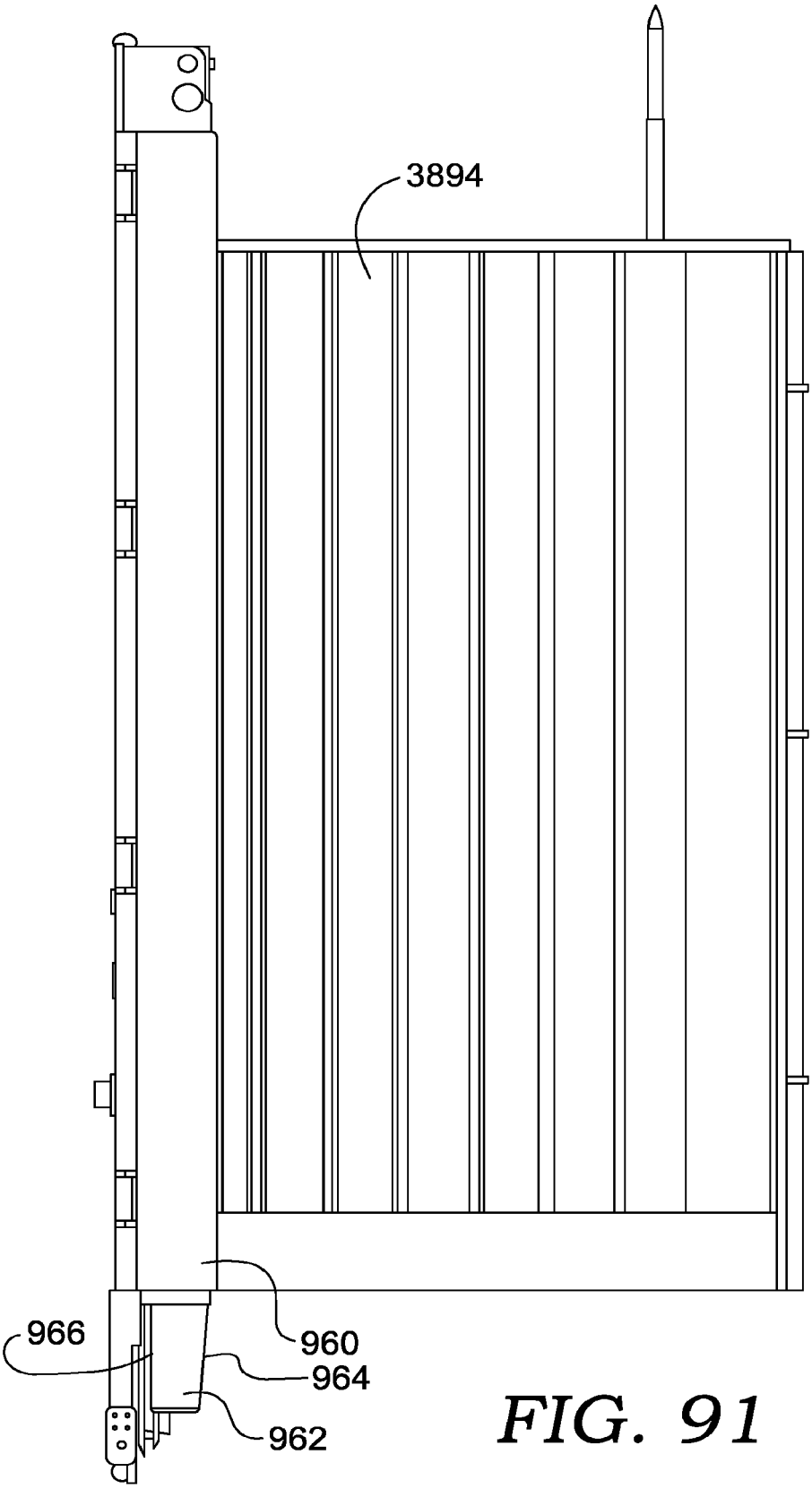
FIG. 91 is a plan view of the external surface of the door right access panel.
Figure 100:
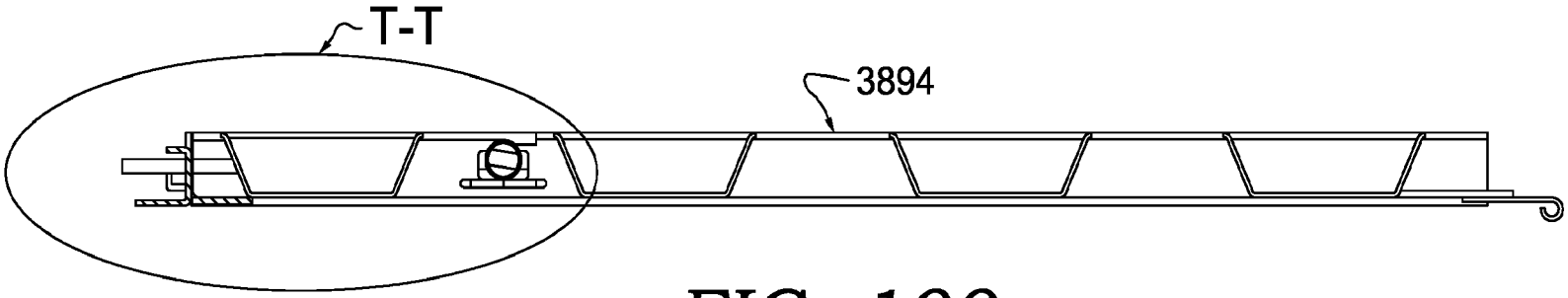
FIG. 100 is a cross sectional view of the door right access panel.
Figure 101:
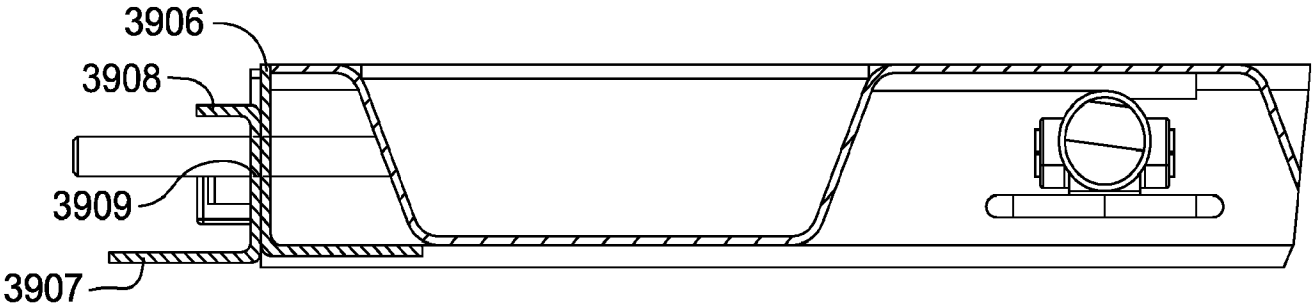
FIG. 101 is an enlarged view of section T-T of FIG. 100.

As shown in FIG. 99, a first door right access member 3903 extends from the door end 3897 of the door right upper cap plate 3895 to the door end 3902 of the door right beam 3900, and is fixedly secured to the door ends 3897, 3902, preferably by welding. As shown in FIGS. 91 and 99, a second door right access member 3906 extends from the front end 3896 of the door right upper cap plate 3895 to the front end 3901 of the door right beam 3900, and is fixedly secured to the front ends 3896, 3901, preferably by welding. As shown in FIGS. 99-101, the second door right access member 3906 includes a long flange 3907 and a short flange 3908, each of which extends along the length of the second door right access member 3906 and towards the door edge 21 of the roof panel 11 when the container 10 is in the unfolded condition. Located between the long flange 3907 and the short flange 3908 are a plurality of locking bolt holes 3909, preferably three, that extend through the second door right access member 3906. When the container 10 is in the unfolded condition, the locking bolt holes 3909 are aligned with the right side bolt holes 768 of the right side panel 14.

Figure 89:
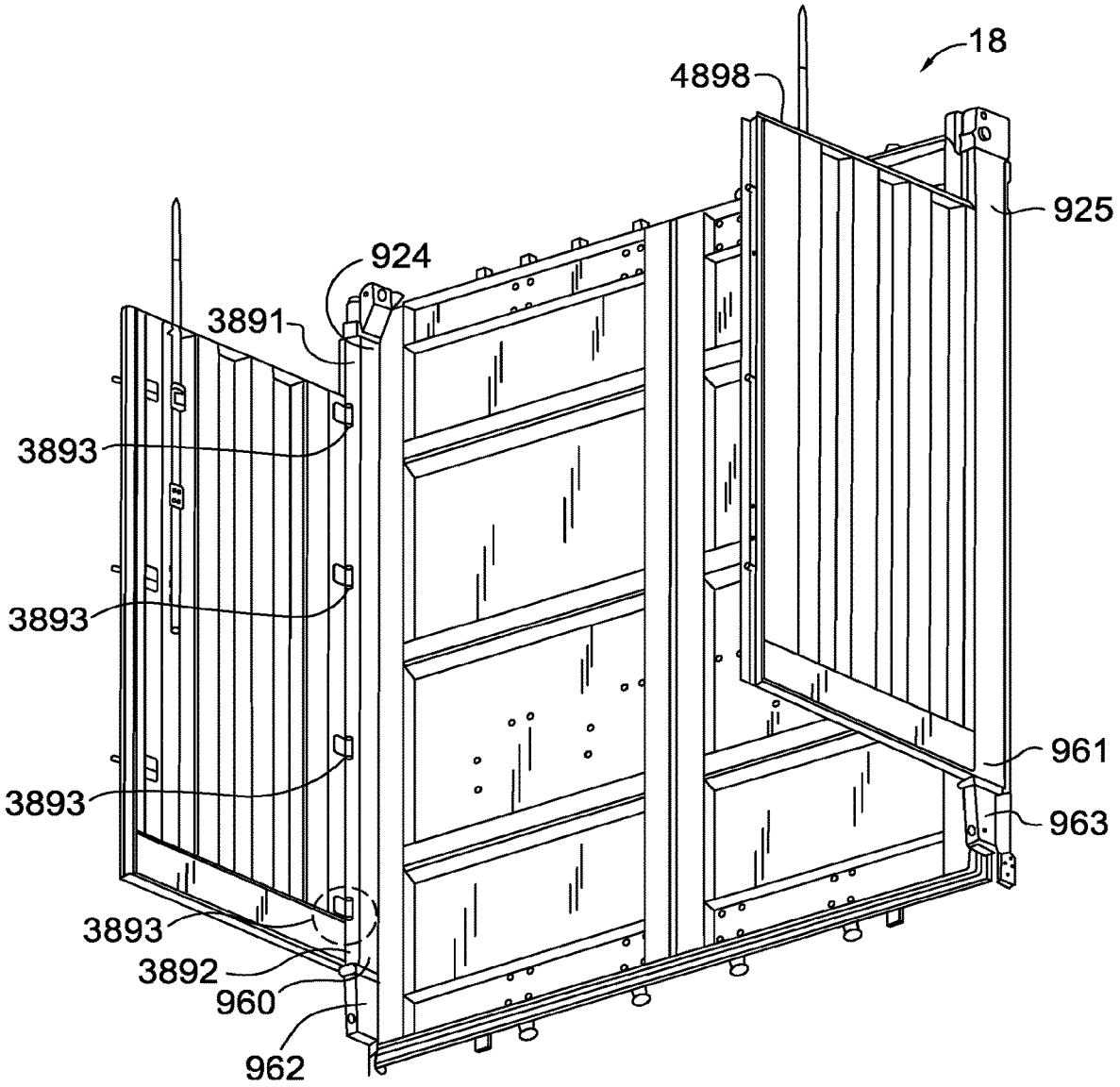
FIG. 89 is a perspective view of the door panel and right and left access panels.
Figure 102:
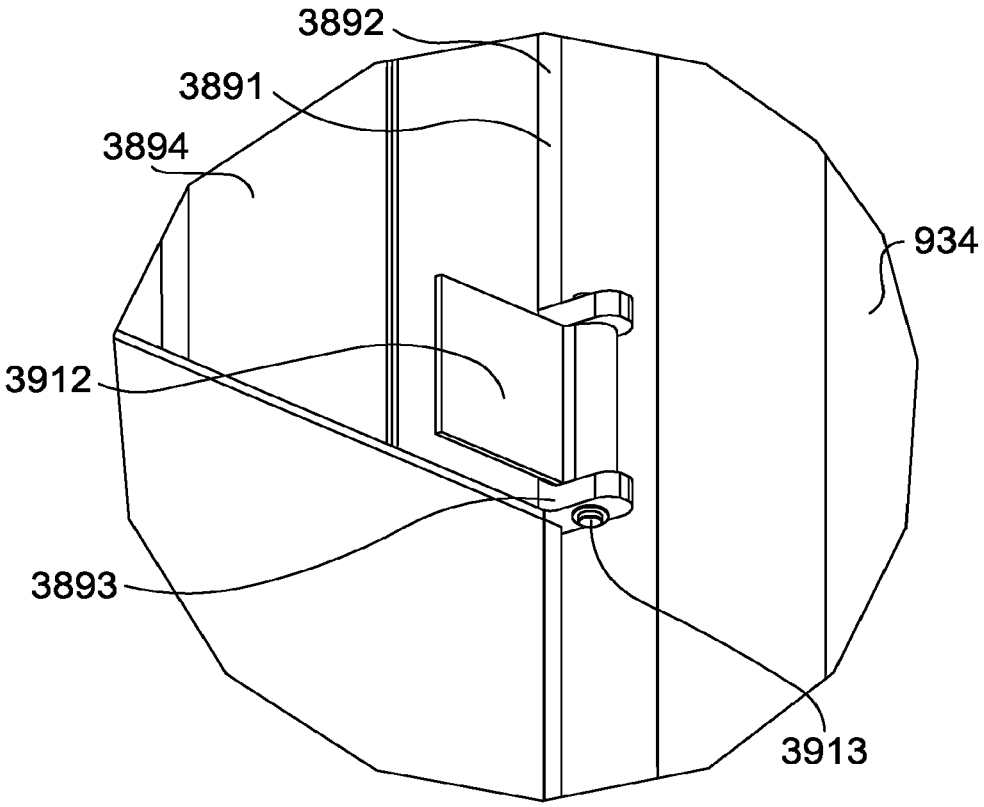
FIG. 102 is a view of a door right access panel hinge.

Referring again to FIG. 99, corrugated sheet metal 3910 extends from the door right upper cap plate 3895 to the door right beam 3900 along the entire length thereof, and from the first door right access member 3903 to the second door right access member 3906 along the entire length thereof. The corrugated sheet metal 3910 is welded all along its entire perimeter to the immediately adjacent door right upper cap plate 3895, first door right access member 3903, door right beam 3900, and second door right access member 3906. As those skilled in the art will readily appreciate, the second door right access member 3906 is welded to the corrugated sheet metal 3910 such that the long flange 3907 is visible from the interior of the container 10 when the container 10 is in its unfolded condition. As shown in FIGS. 89, 99 and 102, attached to the inward surface 3911 of the door right access panel 3894 and the first door right access member 3903 in spaced relation to each other, are a plurality of second door right hinge members 3912. Each of the second door right hinge members 3912 is rotatably secured to one of the first door right hinge members 3893 by a hinge pin 3913 so as to allow the door right access panel 3894 to swing relative to the door main panel 921.

Figure 103:
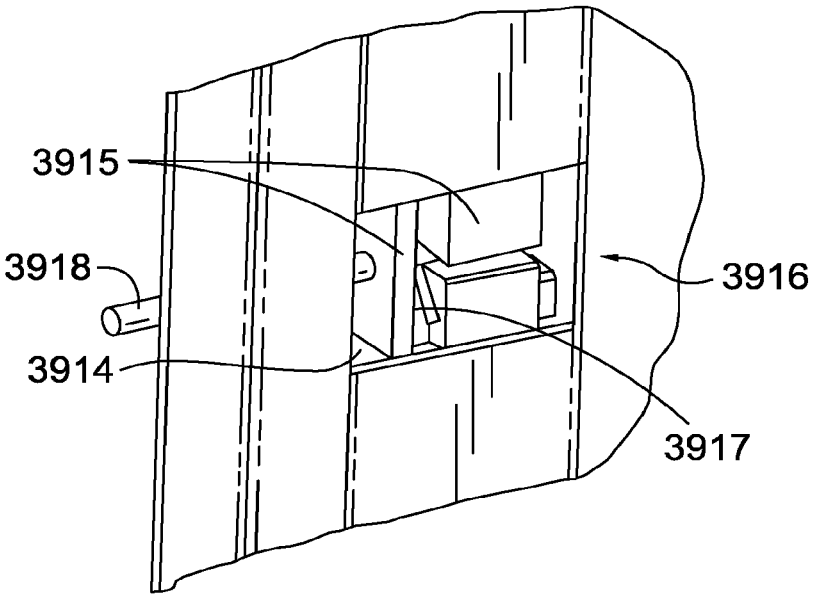
FIG. 103 is a view of the slide locking mechanism of the door right access panel.

Immediately adjacent each of the locking bolt holes 3909 in the second door right access member 3906 is a recess 3914 in the corrugated sheet metal 3910, and within each recess 3914 and aligned with the locking bolt holes 3909 in the second door right access member 3906 are slide lock retainers 3915. As shown in FIGS. 99 and 103, a slide locking mechanism 3916, including a lock lever 3917, and a slide locking bolt 3918, is slideably secured to each of the slide lock retainers 3915 within the recesses 3914 such that each slide locking mechanism 3916 is positionable by use of one of the slide lock levers 3917 between an unlocked position in which the respective slide locking bolt 3918 is in a retracted position outside of the right side bolt holes 768 of the right side panel 14, and a locked position in which the respective slide locking bolt 3918 extends through the immediately adjacent locking bolt hole 3909 of the second door right access member 3906 and one of the right side bolt holes 768 of the right side panel 14.

Figure 104:
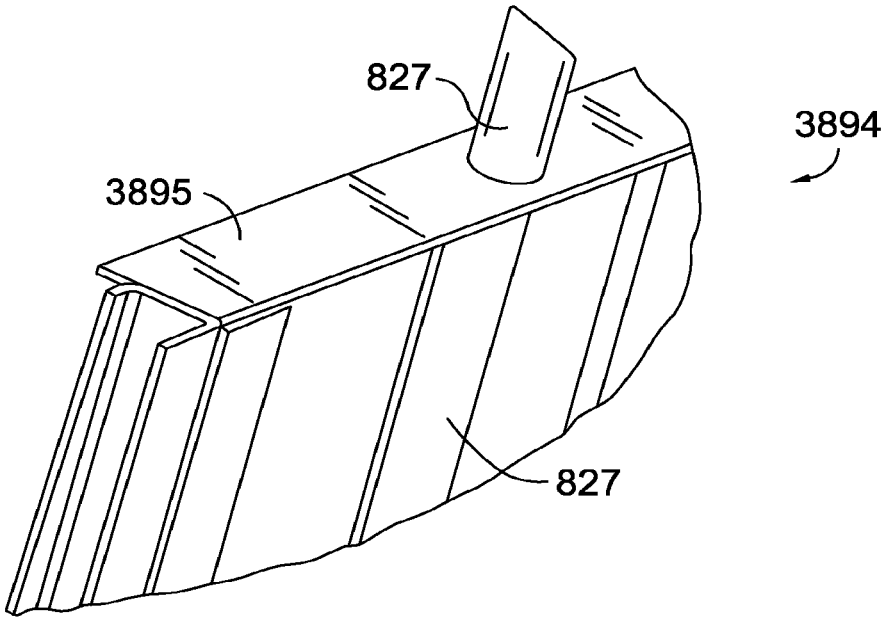
FIG. 104 is a perspective view of the upper cap plate of the door right access panel.

Referring again to FIG. 99, at least one locking bolt assembly 3919 is mounted to the door right access panel 3894 within corrugations 3920 of the corrugated sheet metal 3910. The construction of the locking bolt assembly 3919 is the same as those described with respect to the right side panel 14, except that each pivot anchor 820 is fixedly secured to the corrugated sheet metal 3910 of the door right access panel 3894, and each guide tube 827 extends through, and is fixedly secured to, the front right upper cap plate 3895, as shown in FIG. 104. As those skilled in the art will readily appreciate, each of the locking bolt assemblies 3919 so described is selectively positionable between a first position in which the locking bolt 823 is received within one of the locking bolt holes 610 in the lower face 608 of the roof right beam 600 when the container 10 is in the unfolded condition, and a second position in which the locking bolt 823 is fully withdrawn from that locking bolt hole 610.

Referring back to FIGS. 89 and 90, the door left post 925 includes a door left hinge plate 4891 that extends towards the front edge 22 of the roof panel 11 when the container 10 is in the unfolded condition. Attached to the inward surface 4892 of the door left hinge plate 4891, in spaced relation to each other, are a plurality of, and preferably four, first door left hinge members 4893. Each of the first door left hinge members 4893 is fixedly secured to the inward surface 4892 of the door left hinge plate 4891, preferably by welding.

A door left access panel 4894 is pivotably attached to the door left post 925, and as shown in FIG. 105, the door left access panel 4894 includes a top edge 4214, a bottom edge 4216, a front edge 4218, and a door edge 4220. Extending along the top edge 4214 of the door left access panel 4894 along the length thereof is a door left upper cap plate 4895 having a front end 4896, a door end 4897, and preferably as shown in FIG. 89, a door left roof flange 4898 extends from the front end 4896 to the door end 4897. Extending along the bottom edge 4216 of the front left access panel 4894 along the length thereof is a door left beam 4900 that has a front end 4901 and a door end 4902.

Figure 92:
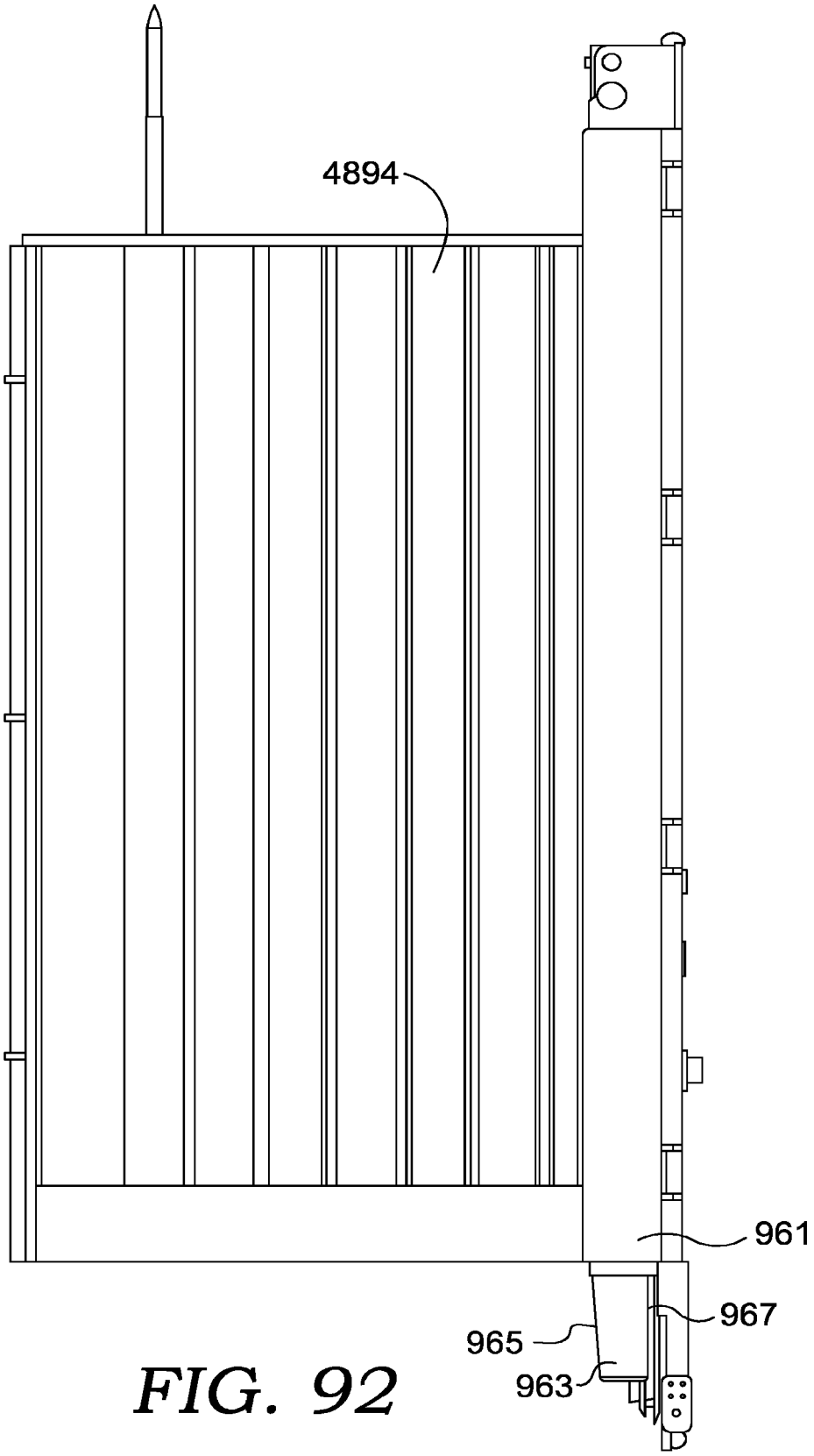
FIG. 92 is a plan view of the external surface of the door left access panel.
Figure 106:
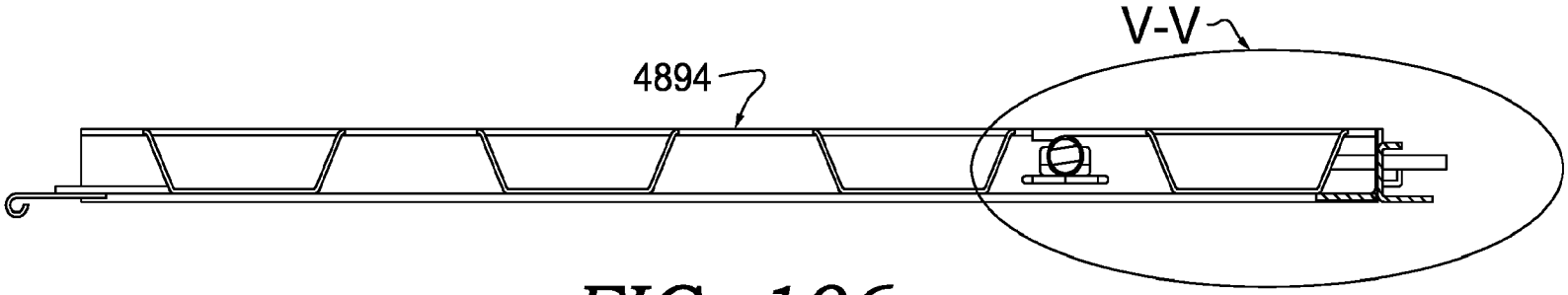
FIG. 106 is a cross sectional view of the door left access panel.
Figure 107:
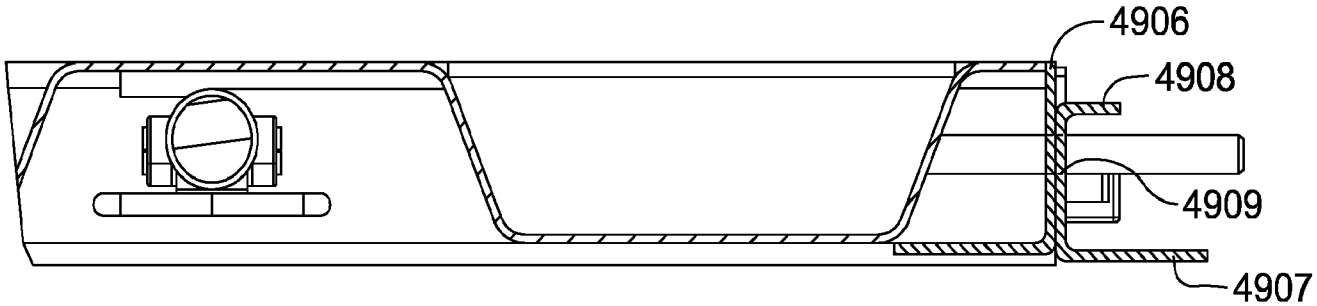
FIG. 107 is an enlarged view of section V-V of FIG. 106.

As shown in FIG. 105, a first door left access member 4903 extends from the door end 4897 of the door left upper cap plate 4895 to the door end 4902 of the door left beam 4900, and is fixedly secured to the door ends 4897, 4902, preferably by welding. As shown in FIGS. 92 and 105, a second door left access member 4906 extends from the front end 4896 of the door left upper cap plate 4895 to the front end 4901 of the door left beam 4900, and is fixedly secured to the front ends 4896, 4901, preferably by welding. As shown in FIGS. 105-107, the second door left access member 4906 includes a long flange 4907 and a short flange 4908, each of which extends along the length of the second front left access member 4906 and towards the front edge 22 of the roof panel 11 when the container 10 is in the unfolded condition. Located between the long flange 4907 and the short flange 4908 are a plurality of locking bolt holes 4909, preferably three, that extend through the second front left access member 4906. When the container 10 is in the unfolded condition, the locking bolt holes 4909 are aligned with the left side bolt holes 795 of the left side panel 16.

Figure 108:
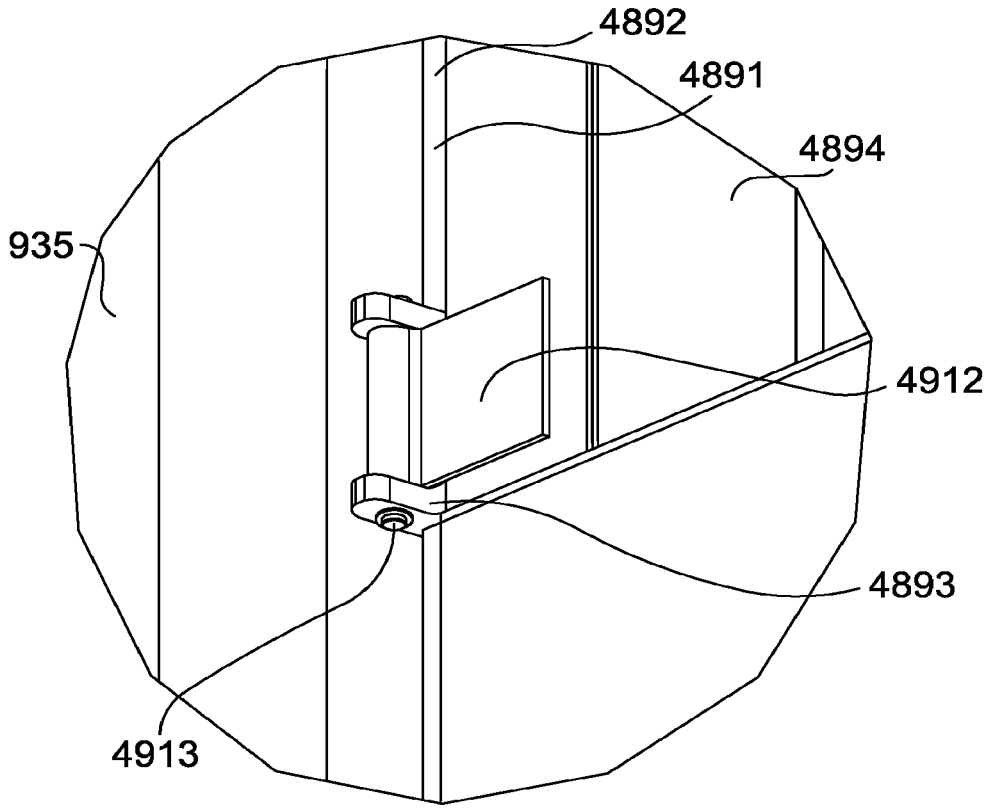
FIG. 108 is a view of a door left access panel hinge.

Referring again to FIG. 105, corrugated sheet metal 4910 extends from the door left upper cap plate 4895 to the door left beam 4900 along the entire length thereof, and from the first door left access member 4903 to the second door left access member 4906 along the entire length thereof. The corrugated sheet metal 4910 is welded all along its entire perimeter to the immediately adjacent door left upper cap plate 4895, first door left access member 4903, door left beam 4900, and second door left access member 4906. As those skilled in the art will readily appreciate, the second door left access member 4906 is welded to the corrugated sheet metal 4910 such that the long flange 4907 is visible from the interior of the container 10 when the container 10 is in its unfolded condition. As shown in FIGS. 90, 105 and 108, attached to the inward surface 4911 of the door left access panel 4894 and the first door left access member 4903 in spaced relation to each other, are a plurality of second door left hinge members 4912. Each of the second door left hinge members 4912 is rotatably secured to one of the first door left hinge members 4893 by a hinge pin 4913 so as to allow the door left access panel 4894 to swing relative to the door main panel 921.

Figure 109:
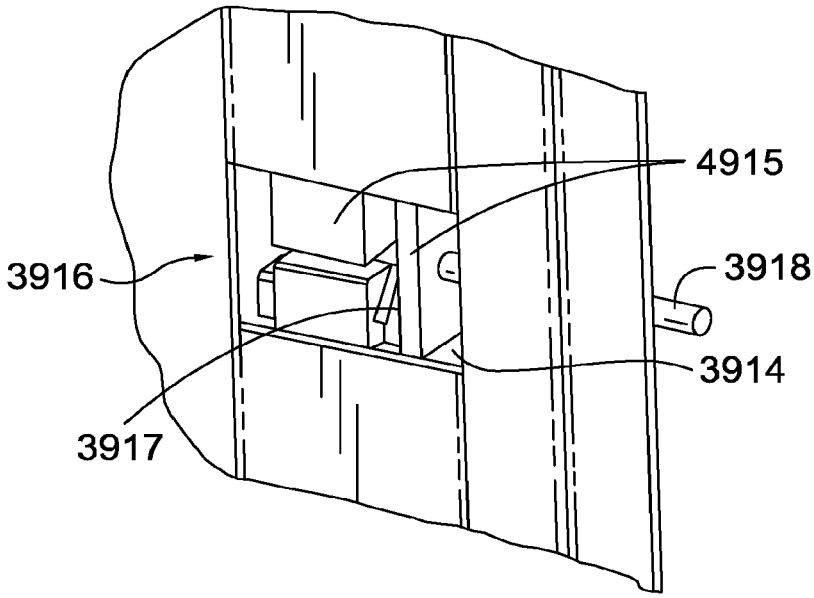
FIG. 109 is a view of the slide locking mechanism of the door left access panel.

Immediately adjacent each of the locking bolt holes 3909 in the second door left access member 4906 is a recess 4914 in the corrugated sheet metal 4910, and within each recess 4914 and aligned with the locking bolt holes 4909 in the second front left access member 4906 are slide lock retainers 4915. As shown in FIGS. 105 and 109, a slide locking mechanism 4916, including a slide lock lever 4917, and a slide locking bolt 4918, is slideably secured to each of the slide lock retainers 4915 within the recesses 4914 such that each slide locking mechanism 4916 is positionable by use of one of the slide lock levers 4917 between an unlocked position in which the respective slide locking bolt 4918 is in a retracted position outside of the left side bolt holes 795 of the left side panel 16, and a locked position in which the respective slide locking bolt 4918 extends through the immediately adjacent locking bolt hole 4909 of the second door left access member 4906 and one of the left side bolt holes 795 of the left side panel 16.

Figure 110:
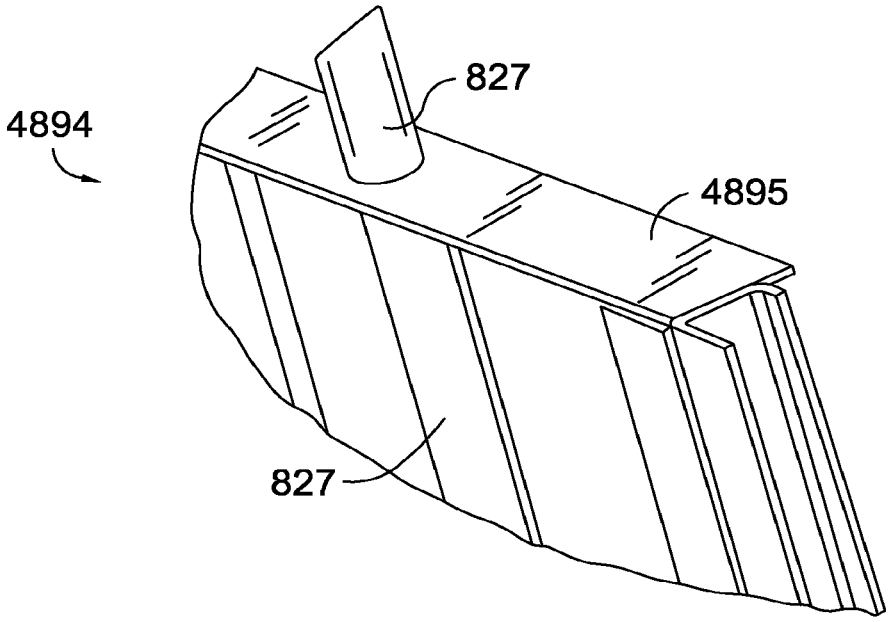
FIG. 110 is a perspective view of the upper cap plate of the door left access panel.

As shown in FIG. 105, at least one locking bolt assembly 4919 is mounted to the door left access panel 4894 within corrugations 4920 of the corrugated sheet metal 4910. The construction of the locking bolt assembly 4919 is the same as those described with respect to the right side panel 14, except that each pivot anchor 820 is fixedly secured to the corrugated sheet metal 4910 of the door left access panel 4894, and each guide tube 827 extends through, and is fixedly secured to, the door left upper cap plate 4895, as shown in FIG. 110. As those skilled in the art will readily appreciate, each of the locking bolt assemblies 4919 so described is selectively positionable between a first position in which the locking bolt 823 is received within one of the locking bolt holes 610 in the lower face 609 of the roof left beam 603 when the container 10 is in the unfolded condition, and a second position in which the locking bolt 823 is fully withdrawn from that locking bolt hole 610.

As those skilled in the art will readily appreciate, further embodiments can be incorporated to reduce cost and weight. One of these embodiments includes elimination of the access panels, replacing the side hinge members and linear spring assemblies with a torsion pin hinge, and increasing the height of the side panels to provide more strength to the base panel and reduction of weight from the top panel.

Figure 113:
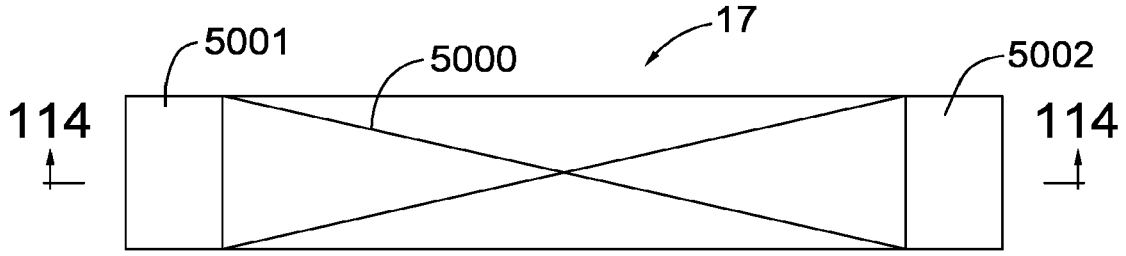
FIG. 113 is a schematic plan view showing the base panel with the side panels folded down and laying on top of it.
Figure 114:
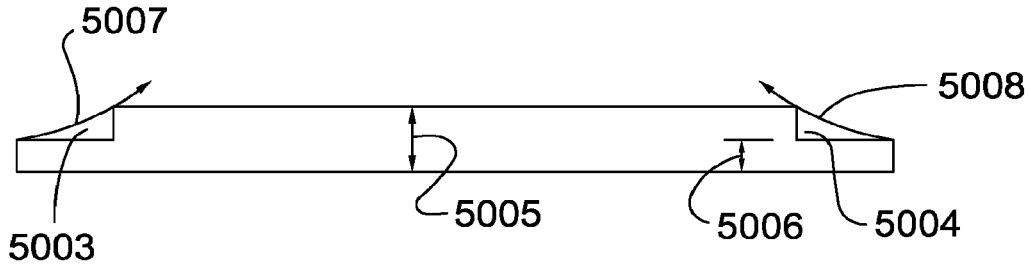
FIG. 114 is schematic cross sectional view taken along line 114-114 of FIG. 113.

The primary function of the access panels is to minimize the side panel section height near the door panel and the front panel to give access thereto. FIG. 113 is a schematic view plan view looking down on the base 17, showing the side panels folded down on the base 17. The area marked by the "X" 5000, shows the area occupied by the side panels when they are folded down. The two areas 5001, 5002, immediately adjacent the side panels are areas that are not occupied by the side panels because in this view the access panels are folded into the front panel or the door panel. A side view of the base 17 shown in FIG. 113 is shown in FIG. 114, which shows that since the side panels do not extend the entire length of the base, notched areas 5003, 5004 are formed at the ends of each side panel, because the stacked-up height 5005 of the base 17 and the side panels is substantially greater than the height 5006 of the base panel 17 at the two areas 5001, 5002, immediately adjacent the side panels. As shown by the curved arrows 5007, 5008, these notched areas 5003, 5004 allow the door panel and the front panel to clear the folded-down side panels as they swing along the paths shown by the curved arrows 5007, 5008 during the folding process. Unfortunately, inherent in this notched design are surfaces that may be difficult to seal effectively, and structural issues require additional weight in to achieve desirable rigidity of the container. This further embodiment eliminates the access panels all together by extending the side panels the entire length of the base. This eliminates the sealing requirements between the access panels and the side panels, reduces cost, and also significantly improves the structural aspects of the container.

Figure 115:
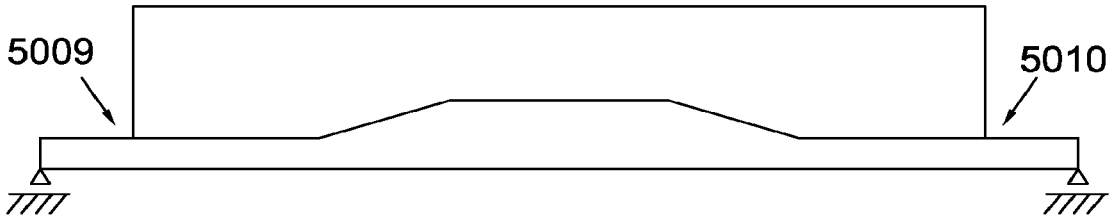
FIG. 115 shows a schematic side view of the base panel with the side panels in an unfolded position.

FIG. 115 shows a schematic side view of the base 17 with the side panels erect. As previously described, the side panels are structurally tied to the base panel 17 by side hinge members that provide both a hinge function for the side panels, and shear load capability for the container in its unfolded condition. While this design may perform satisfactorily, it incorporates structural features that may not be desirable in certain applications. Unfortunately, the side panels, which provide 80% of the load carrying capability of the base panel 17 (by effectively increasing the beam-height from a structural point of view), do not extend all the way to the ends of the base panel 17 where the right and left side door interlocks, and the right and left side front interlocks take all of the vertical loading. Consequently, stress is concentrated at the points 5009, 5010, where the ends of the side panels meet the base panel 17. By extending the side panels the full length of the base panel 17, to the end of the beam, this stress concentration can be eliminated.

Figure 116:
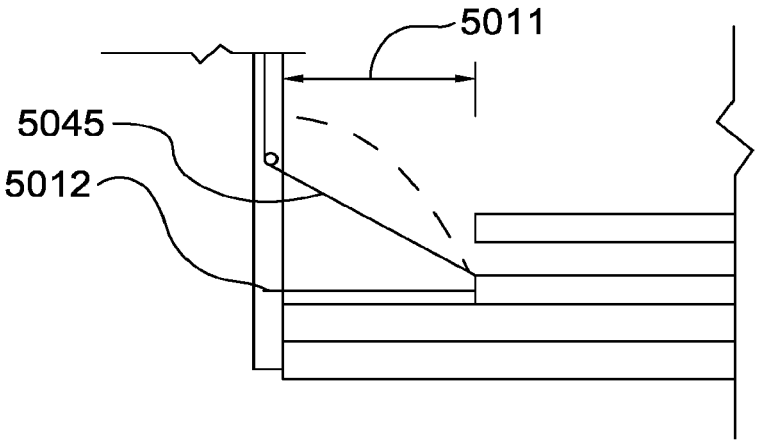
FIG. 116 is a schematic transverse cross-sectional view through the base panel and the side panels adjacent one of the side hinge members and linear spring assemblies.

FIG. 116 shows schematically a transverse cross-sectional view through the base panel 17 and the side panels adjacent one of the side hinge members and linear spring assemblies. As the left side panel is rotated down from its vertical position (as shown by the dashed lines) the spring mechanism in the linear spring assembly (not shown) is compressed, developing a tensile force in the cable 5045 which is preferably adjusted to provide the appropriate force to counter-balance the weight of the left side panel as it is folded down. Unfortunately, this design requires that the right side panel be shortened by a distance "D" 5011. As a result, the right side skirt, which extends down from the top panel, must be longer to compensate for the shortened height of the right side panel, as compared to if the right side panel height did not have to be shortened by a distance "D" 5011 to accommodate the cable 5045. As those skilled in the art will readily appreciate, since the right and left side skirts are less rigid than the rest of the top panel from which they extend, the distance which the side skirts extend down from the top panel should preferably be as short as possible, and the side panels should be as tall as possible, to maximize the structural rigidity of the container.

Figure 117:
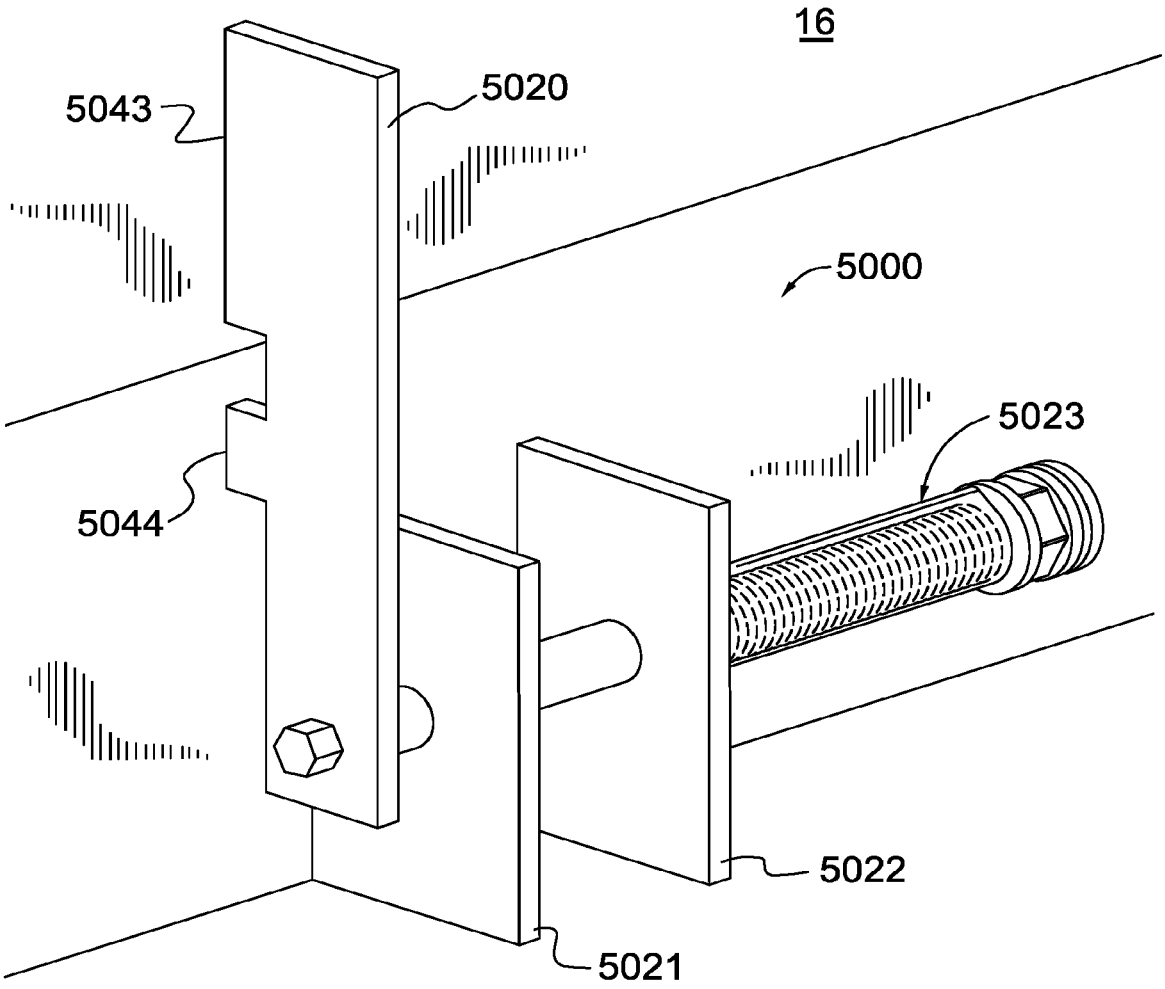
FIG. 117 is a view of one of the hinge pin torsion spring assemblies secured to the base panel and a side panel.

A further embodiment significant improvement to this arrangement is the use of hinge pin torsion spring assemblies, an example of which is shown in FIG. 117, instead of the linear spring assemblies and side hinge members attached to the right and left side panels described in the preferred embodiment. The hinge pin torsion spring replaces the "pin" in FIG. 116 torsion feature interior to the bottom beam. Preferably, each hinge pin torsion spring assembly 5000 includes a side panel hinge member 5020, base hinge members 5021, 5022, and a hinge pin torsion spring 5023. Although the hinge pin torsion spring assembly shown in FIG. 117 is shown and described attached to the to the left side panel, it is to be understood that the hinge pin torsion spring assemblies used on the right side panel are similar.

Figure 118:
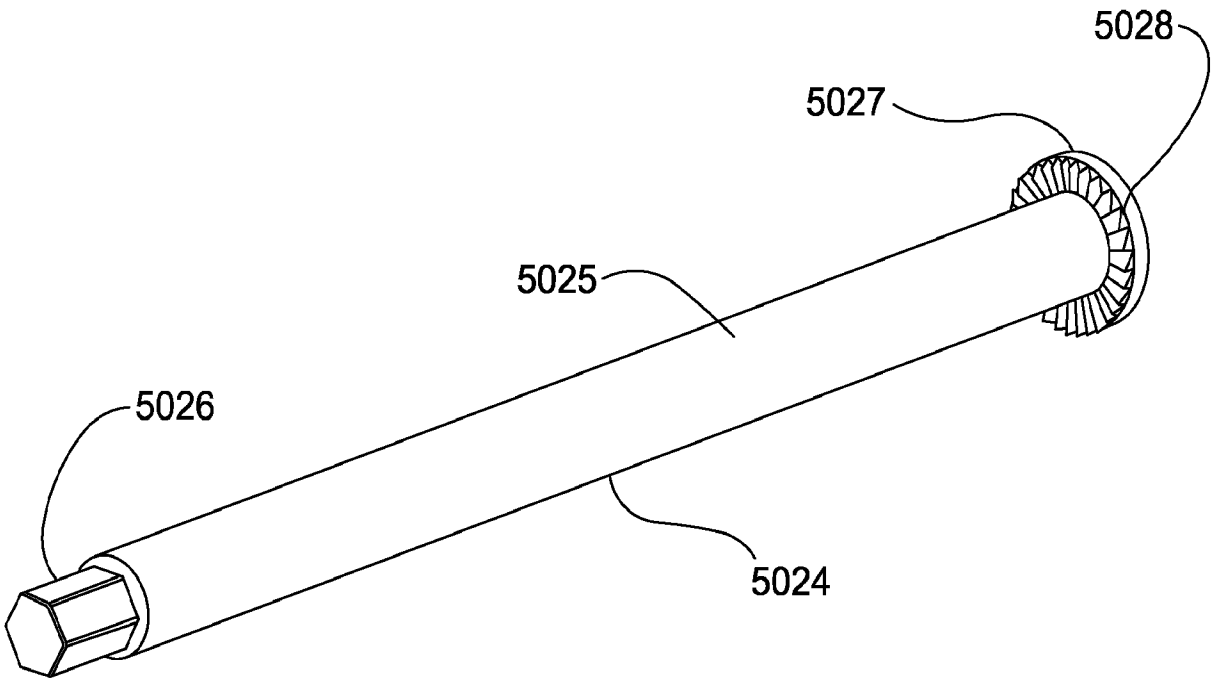
FIG. 118 is a view of a the hinge pin of one of the hinge pin torsion spring assemblies.

The hinge pin torsion spring 5023, as shown in FIG. 118, includes a hinge pin 5024 having a cylindrical main section 5025, a non-cylindrical section 5026, preferably hexagonal in cross-section, at one end of the hinge pin, and a pin ratcheting feature 5027 at the end opposite the non-cylindrical section 5026. The pin ratcheting feature 5027, which is preferably a cylindrical disk, includes a plurality of gear teeth 5028 which face the non-cylindrical section 5026 and which are all canted in the same circumferential direction. The non-cylindrical section 5026 and the pin ratcheting feature 5027 are integral with the cylindrical main section 5025, so that rotation of the non-cylindrical section 5026 necessarily causes the pin ratcheting feature 5027 to rotate in the same direction.

Figure 119:
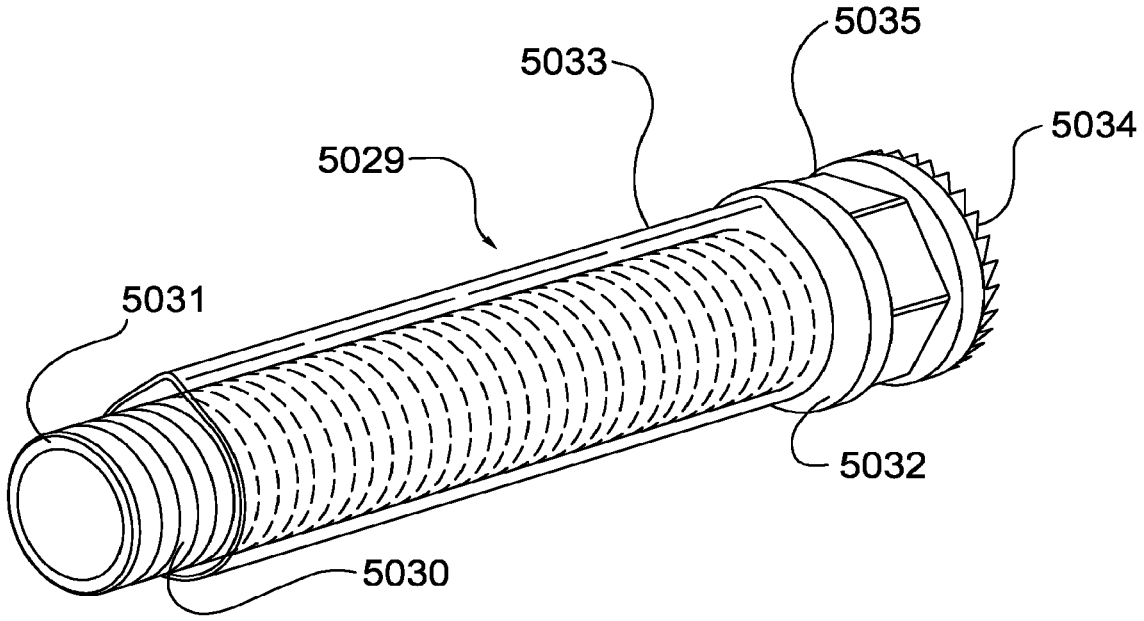
FIG. 119 is a view of a Torsion spring of one of the hinge pin torsion spring assemblies.

As shown in FIG. 119, the torsion spring 5029 of the hinge pin torsion spring 5023 includes a coil spring 5030, an attachment ring 5031, a spring ratcheting feature 5032, and a spring shield 5033. The attachment ring 5031 and the spring ratcheting feature 5032 each have an inner bore having a diameter that is greater than the outer diameter of the cylindrical main section 5025 of the hinge pin 5024 to allow the cylindrical main section 5025 of the hinge pin 5024 to slide therethrough without binding. Likewise, the inner diameter of the coil spring 5030 is greater than the outer diameter of the cylindrical main section 5025 of the hinge pin 5024 to avoid binding between the cylindrical main section 5025 of the hinge pin 5024 and the coil spring 5030 at all operating positions of the hinge pin torsion spring 5023. The attachment ring 5031 is fixedly attached, preferably by welding, to one end of the coil spring 5030, and the spring ratcheting feature 5032 is fixedly attached, preferably by welding, to the opposite end of the of the coil spring 5030. The spring ratcheting feature 5030, which is preferably generally cylindrical, includes a plurality of gear teeth 5034 which face away from the attachment ring 5031 and which are all canted in the same circumferential direction, which is opposite the direction in which the gear teeth 5028 of the pin ratcheting feature are canted. The spring ratcheting feature 5032 includes a non-cylindrical portion 5035, which is preferably hexagonal in cross section, the purpose of which is described below. The spring shield 5033 which is tubular and may be cylindrical or non-cylindrical, fits loosely around, and protects, the coil spring 5030.

Figure 120:
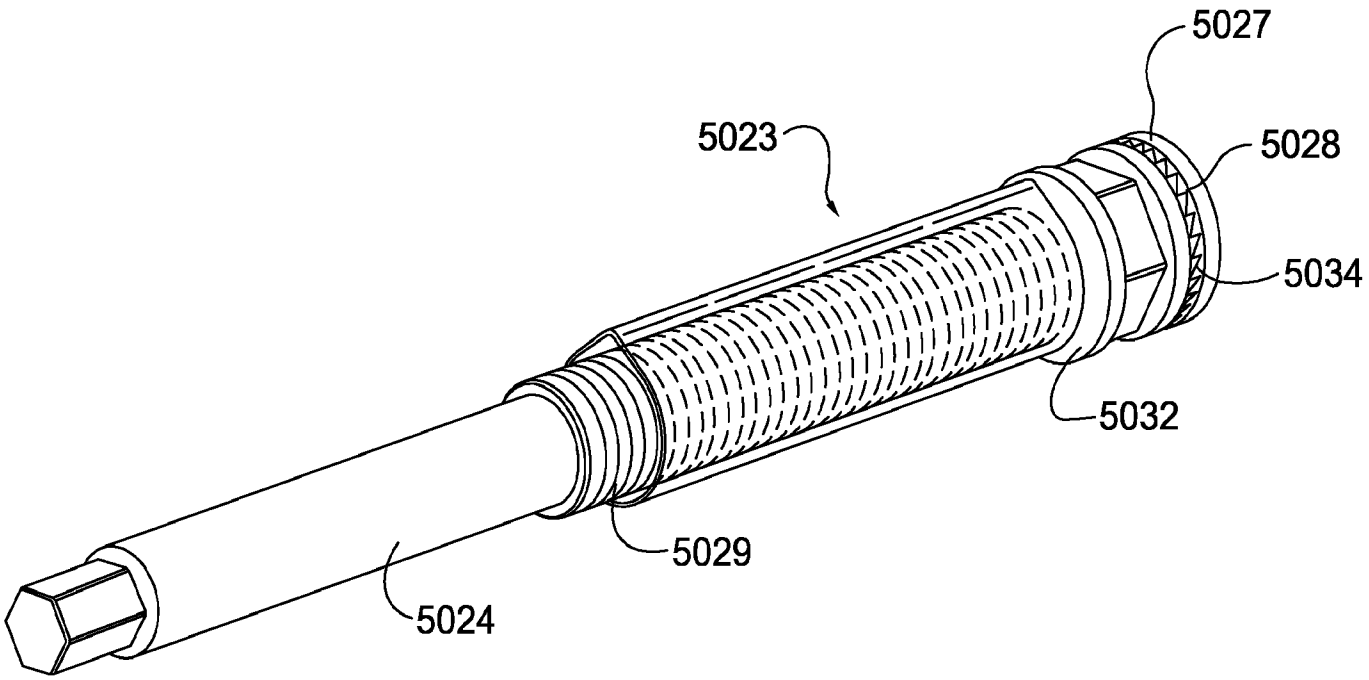
FIG. 120 is a view of a hinge pin torsion spring fully assembled.

The hinge pin torsion spring 5023 is shown in FIG. 120 fully assembled, with the hinge pin 5024 inserted into the torsion spring 5029. As those skilled in the art will readily appreciate, in this assembled condition, the gear teeth 5028 of the pin ratcheting feature 5027 are interlocked with the gear teeth 5034 of the spring ratcheting feature 5032, and due to the canted nature of the gear teeth 5028, 5034, can only be rotated in one direction, and the gear teeth 5028, 5034 will lock together if rotation in the opposite direction is attempted.

Figure 121:
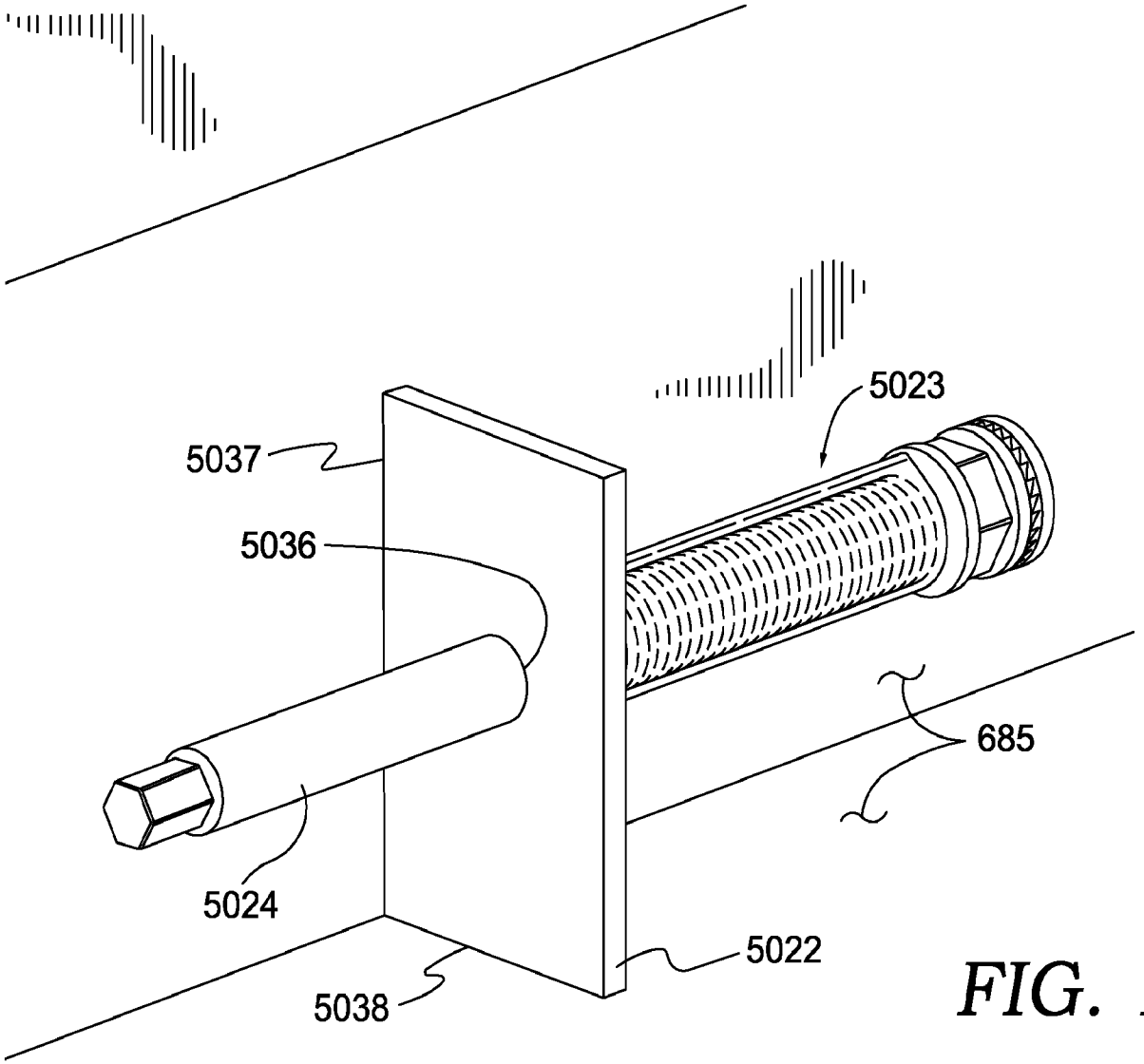
FIG. 121 is a view showing a hinge pin of a hinge pin torsion spring received within a hole in a base hinge member.

As shown in FIG. 121 the hinge pin 5024 of the hinge pin torsion spring 5023 is received within a hole 5036 in base hinge member 5022. The hole 5036 is slightly larger than the outer diameter of the cylindrical main portion 5025 of the hinge pin 5024 so as to allow the hinge pin to rotate freely therein. In addition, the attachment ring 5031, is fixedly attached to the base hinge member 5022, either by welding or by some other attachment method that prevents rotation between the attachment ring 5031 and base hinge member 5022. Base hinge member 5022 is welded to the base left beam 685 along the vertical edge 5037 immediately adjacent thereto, and to the base left beam 685 along the horizontal edge 5038 immediately adjacent thereto.

Figure 122:
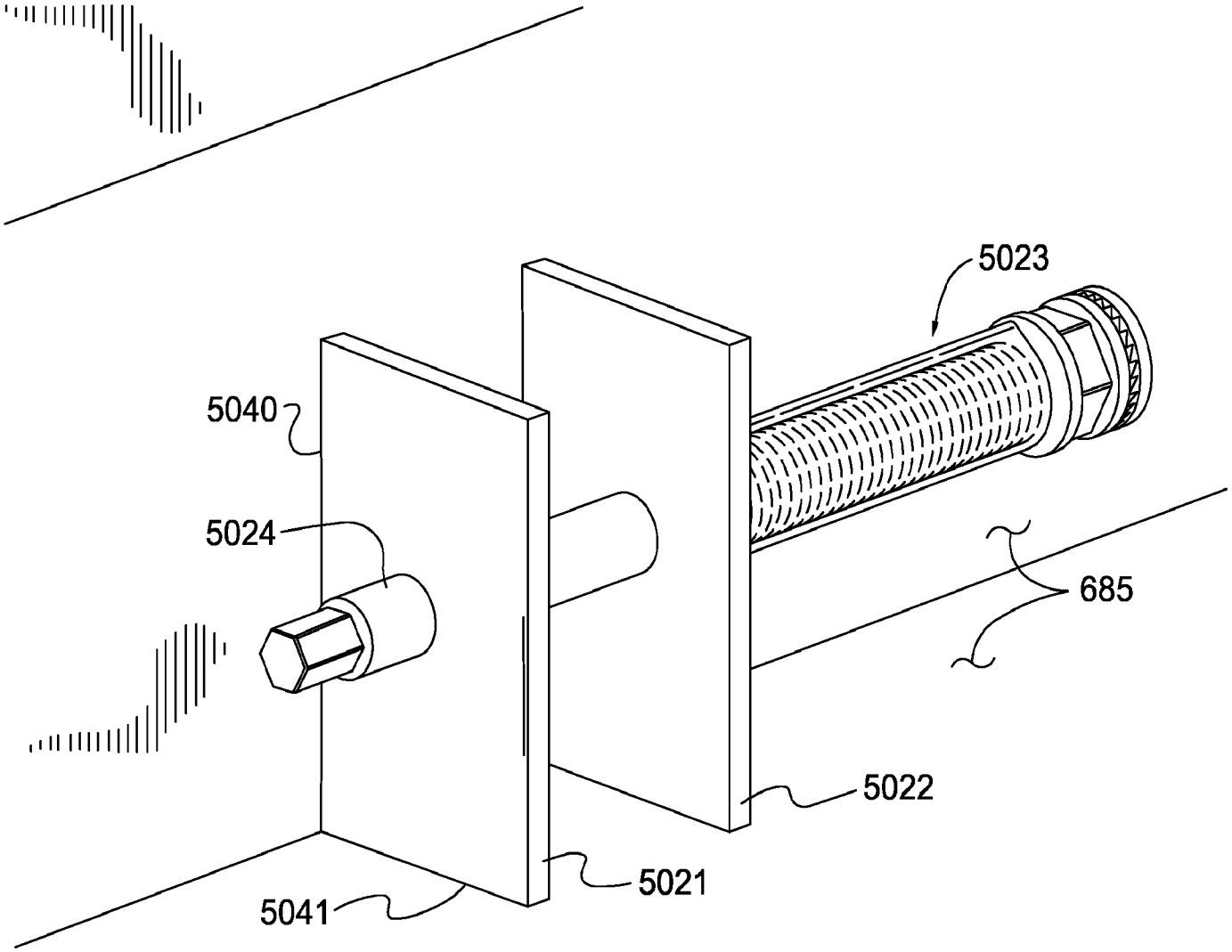
FIG. 122 is a view showing a hinge pin of a hinge pin torsion spring received within a hole in another base hinge member.
Figure 123:
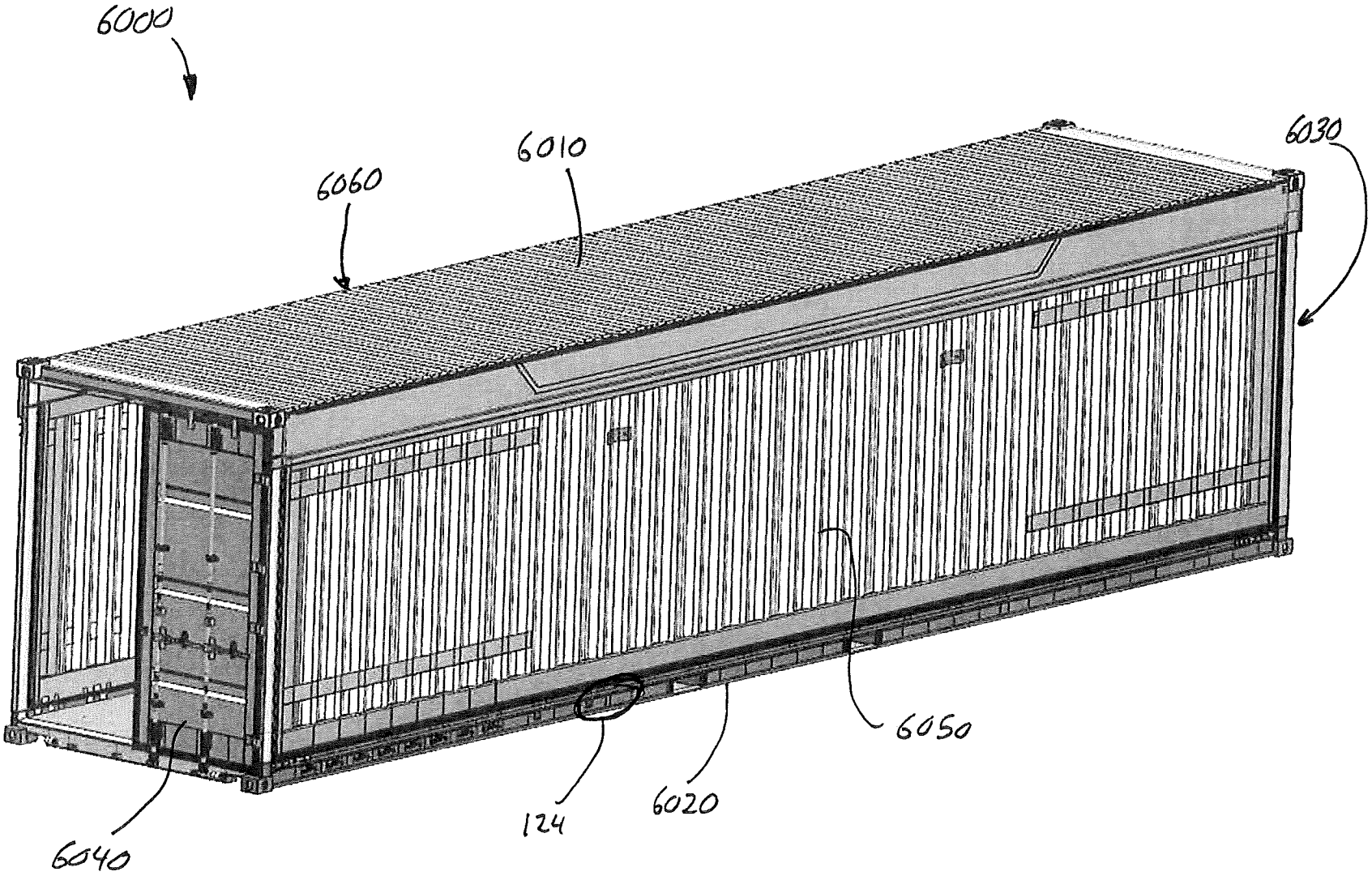

As shown in FIG. 122 the hinge pin 5024 of the hinge pin torsion spring 5023 is received within a hole 5039 in base hinge member 5021. The hole 5039 is slightly larger than the outer diameter of the cylindrical main portion 5025 of the hinge pin 5024 so as to allow the hinge pin to rotate freely therein. Base hinge member 5021 is welded to the base left beam 685 along the vertical edge 5040 immediately adjacent thereto, and to the base left beam 685 along the horizontal edge 5041 immediately adjacent thereto.

Referring again to FIG. 117, the hexagonal portion 5026 of the hinge pin 5024 is received within a hexagonal hole 5042 in side panel hinge member 5020. The hexagonal portion 5026 of the hinge pin 5024 welded, or otherwise fixedly secured to side panel hinge member 5020 to prevent the hinge pin 5024 from inadvertently sliding out of the torsion spring 5029. Side panel hinge member 5020 is welded to the left side panel 16 along the vertical edge 5043 immediately adjacent thereto, and if desired, may include a stop 5044 to insure that the side panel 16 stops rotating once the side panel 16 is vertical to prevent it from rotating past the vertical position.

As those skilled in the art will readily appreciate, in the fully assembled condition shown in FIG. 117, an open-end wrench can be used on the hexagonal portion 5035 of the spring ratcheting feature 5032 to rotate the spring ratcheting feature 5032, thereby increasing the torque on the hinge pin 5024 and increasing the counterbalancing effect of the coil spring 5030 on the side panel 16. Once the torque has been so set, the hinge pin torsion springs provide torque to the side panels as they are rotated down, thereby counterbalancing the weight of the side panels.

The hinge pin torsion spring assembly 5000 eliminates the need for the step up in height from height 5006 to height 5005 in FIG. 114, eliminates the requirement that either side panel 14, 16 be shortened to provide clearance for the cable 5045 from the linear spring assembly. Each hinge pin torsion spring assembly 5000 replaces a pin, cable and linear spring, among others. With no need to shorten the side panels to accommodate the cables, the height of the side panels can be increased to minimize the distance that the right and left skirts 23, 24 extend down from the roof panel, simplifying sealing in this area. With the elimination of the cable 5045, the risk that this cable, which is exposed and always under tension, may get caught on something and break, or injure someone, is eliminated as well. Likewise, elimination of the access panels allows each side panel to span the full length of the container, and the use of the hinge pin torsion springs allows height of each side panel to be maximized, resulting in a container that is lighter in weight and more rigid than a container incorporating access panels and linear spring assemblies with cables.

To fold the container of the present disclosure, the locking bolts on the access panels are retracted from their respective bolt holes in the roof panel, and the slide locking mechanisms in each of the access panels are used to retract the slide locking bolts from the bolt holes in the right and left side panels. One of the access panels on the front panel and one of the access panels on the at the door panel is then swung toward the interior of the folding container until they lie substantially flat against the respective front, or door, main panel. The remaining access panels are then swung toward the interior of the folding container until they lie substantially flat against the other access panel. (Of course, if the embodiment of the present disclosure is the one which eliminates the access panels by extending the length of each side panel to the full length of the container, the foregoing folding steps related to the access panels do not occur in the folding process.)

The doors are then swung closed, but the locking rods are left in the unlocked position. The locking bar is swung into the locking block so that it is received between the flanges of the locking block, and a locking rod on the adjacent door is received within the locking rod recess of the locking bar. Then a locking pin is inserted through the pin receiving hole of the upper flange of the locking block and into the lock pin hole of the locking bar, thus securing the doors together to prevent the doors from opening during the folding process.

Next, the locking bolts on the left and right side panels are retracted from their respective bolt holes in the roof panel, thereby freeing the side panels to be rotated inwardly. One of the side panels is then swung from its vertical position to a position in which the side panel is resting on the floor of the base panel, after which the other side panel is then swung from its vertical position to a position in which it is resting on the other side. As each of the right and left side panels is rotated inward, the weight of that side panel is substantially counter balanced by the spring force provided by the springs in the linear spring assemblies, or the hinge pin torsion spring assemblies, depending on which is used, thereby allowing one or two people to safely fold the left and right side panels from a vertical position to a horizontal position without additional equipment. At this point, a spreader attaches to the roof panel at each of the four corner fittings in the manner similar to lifting typical shipping containers, so that the roof panel of the container is thus supported by both the spreader and the posts of the front panel and the door panel.

Then the hammer locking mechanisms in the recessed portions of the base right beam and base left beams adjacent the door main panel are used to retract the hammer locking bolts from the base door interlocks, and in doing so the holes in the door tangs at the lower ends of the right and left door posts, thus freeing the door panel from the base panel. Then and the hammer locking mechanisms in the recessed portions of the base right beam and base left beams adjacent the door main panel are used to retract the hammer locking bolts from the base door interlocks, and in doing so the holes in the door tangs at the lower ends of the right and left door posts, thus unlocking the door panel from the base panel. Likewise, the hammer locking mechanisms in the sill panel of the front panel are used to retract the hammer locking bolts from the base front interlocks, and in doing so the hammer locking bolts retract from the holes in the base front tangs in the lower ends of the right and left door posts, thus unlocking the front panel from the base panel.

The spreader then lifts the roof panel along with the attached front panel and door panel until the rollers at the lower ends of the door posts and front posts are just a little higher than the guide rails on the base panel immediately adjacent thereto, at which point the door tangs and base front tangs are in a position such that they are fully withdrawn from the interlocks of the door panel and front panel. At this point, the roof panel has been lifted to the highest point necessary in the folding process. Then workers push inwardly on the door panel to swing the bottom edge thereof to be positioned above the base panel well inward of the door edge of the base panel, while workers simultaneously push inwardly on the front panel to force the bottom edge thereof to be positioned above the base panel well inward of the front edge of the base panel. As the workers are so positioning the door panel and front panel, the spreader begins to slowly lower the roof panel until each of the rollers mounted on the lower ends of the door posts and front posts are resting on the immediately adjacent guide rails of the base panel.

Lowering of the roof panel then continues, causing the rollers of the door panel to roll along the guide rails of the base panel towards the front panel, guided by the cover plates which slide along, but outward of, the guide rails to keep the rollers from sliding off such guide rails. At the same time, lowering of the roof panel causes the rollers of the front panel to roll along the guide rails of the base panel towards the door panel, guided by the cover plates which slide along, but outward of, the guide rails to keep the rollers from sliding off such guide rails. Further lowering of the roof panel continues until the front panel and door panel are substantially parallel to the base panel, the roof panel is resting on the base panel, and each of the base tangs extending from the base panel is received within one of the interlocks of the roof panel. The container is then ready to be locked in its folded position.

Figure 111:
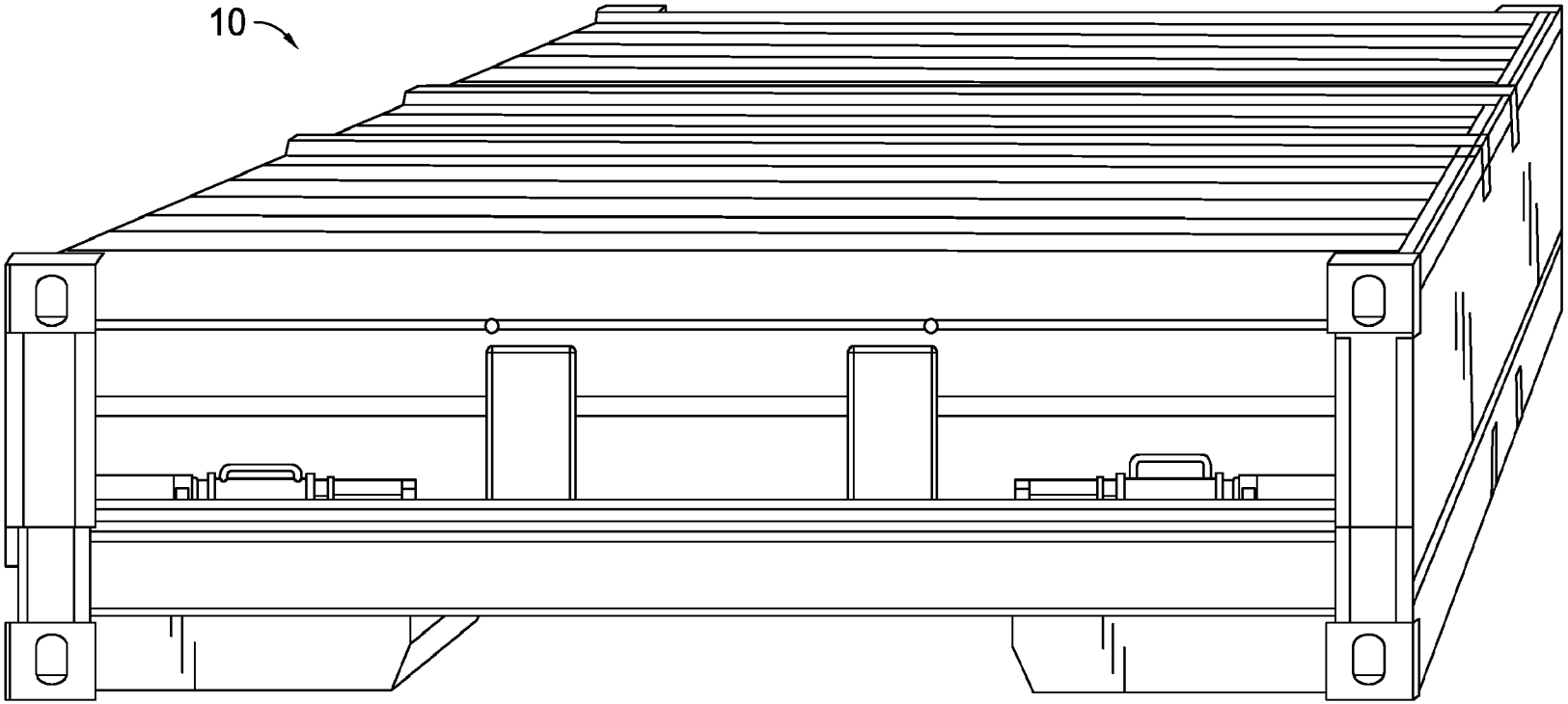
FIG. 111 is a perspective view of the front end of the folded container.
Figure 112:
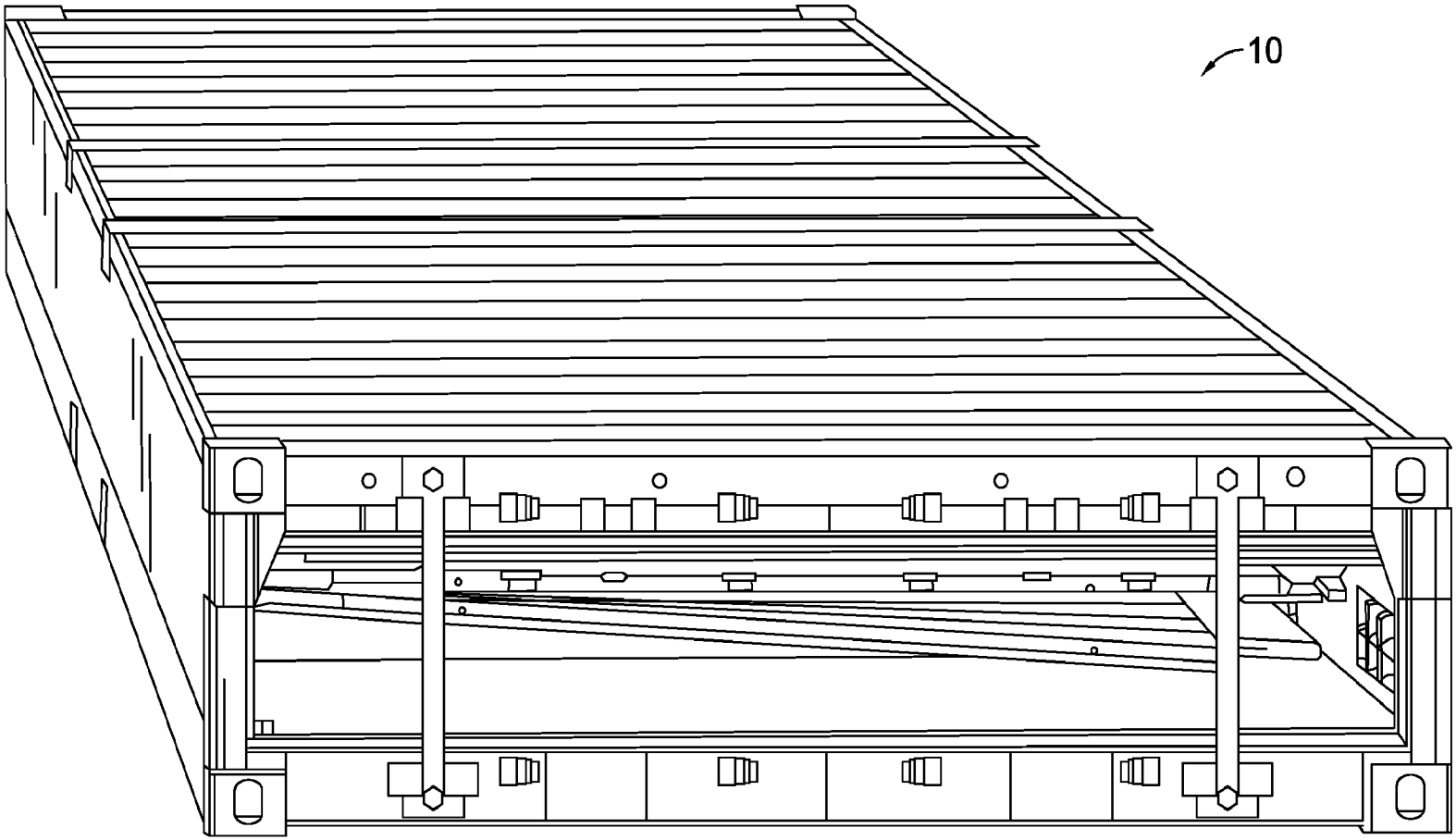
FIG. 112 is a perspective view of the door end of the folded container.

The hammer locks located on the roof panel adjacent the front edge thereof are engaged by hammering the locking bolts into the holes of the interlocks and the holes of the base tangs received therein, as shown in FIG. 111. This locks the roof panel to the base panel at the front edges thereof. Then, the pair of locking straps are removed from their stored position, and then re-attached to the folded container such that each locking strap is located between a pair of upper door stop receivers in the roof panel, and a pair of lower door stop receivers in the base panel. Each locking strap is secured to the folded container by bolting the upper end of each locking strap to the roof panel with a bolt that is threaded into one of the upper active strap bolt holes and tightened, and by bolting the lower end of each locking strap to the roof panel with a bolt that is threaded into one of the lower active strap bolt holes and tightened. In this position, as shown in FIG. 112, each "T" end of each locking strap is resting against the upper or lower door stop receivers immediately adjacent thereto, so that the load carried by the locking straps during lifting of the folded container is carried by such door stop receivers rather than the bolts that secure the locking straps to the roof panel and base panel. At this point, locking of the roof panel to the base panel has been completed, and the folded container is ready to be moved, stacked, shipped or stored. At this point the spreader can lift the folded container to be stacked onto other folded containers for shipment to the intended destination.

Unfolding of the preferred embodiment of the present disclosure is essentially the reverse of the folding process, however when the roof panel has been raised to what was the highest point in the folding process, workers pull the door panel and front panel outwardly to properly position the tangs on the door panel above the interlocks in the base at the door end of the base panel, while workers position the interlocks at the bottom of the front posts over the base front tangs. The workers then hold these positions until the roof panel is lowered and the door tangs and base front tangs are received within the adjacent interlocks. The hammer locks located on the base panel adjacent the door end are then secured by driving each locking bolt through the hole in the adjacent interlock and into the hole in the door tang received therein, and the hammer locks located in the sill panel of the front panel are secured by driving each locking bolt through the hole in the adjacent interlock and into the hole in the base front tang received therein. Then the left and right side panels are lifted to their vertical, unfolded positions (assisted by the counterbalance provided by the springs in the spring tubes), and the locking bolts on the side panels are extended into the bolt holes on the roof panel to lock the left and right side panels to the roof panel. Then, the access panels are unfolded from the door panel and front panel so as to be parallel with the side panels, the slide locking mechanisms in the access panels are used to drive the slide locking bolts into the bolt holes in the right and left side panels, and the locking bolts on the access panels are extended into the bolt holes on the roof panel to lock the access panels to the roof panel. At this point the container is ready for use in shipping cargo.

As those skilled in the art will readily appreciate, the access panels allow workers to easily enter and exit the container to assist with the folding and unfolding of the side panels. If this flexibility is not desired, the side panels could be extended to span the entire length between the front panel and the door panel, and locking features could be added to the side panels to lock the side panels to the front panel and the door panel, thus eliminating the access panels altogether.

Referring now to FIGS. 123-129, alternate embodiments of the present disclosure are disclosed. In a first alternate embodiment shown in FIG. 123, the container 6000 includes a roof panel 6010 and an opposing base panel 6020. A front panel 6030 is positioned opposite a door panel 6040 where the front panel 6030 and the door panel are hingedly connected to only the roof panel. The container 6000 also comprises a right side panel 6050 and an opposing left side panel 6060, where the right side panel 6050 and the left side panel 6060 each comprise a single, unitary, one-piece wall extending between the roof panel 6010 and the base panel 6020, and the left and right side panels 6060 and 6050 are hingedly connected to the base panel 6020.

This alternate embodiment also includes a system for helping to control the folding of the side panels 6050 and 6060 in towards the base panel 6020. Due to the size and weight of the side panels, it is necessary to provide a means for assisting in the lowering and raising of the side panels.

Figure 124:
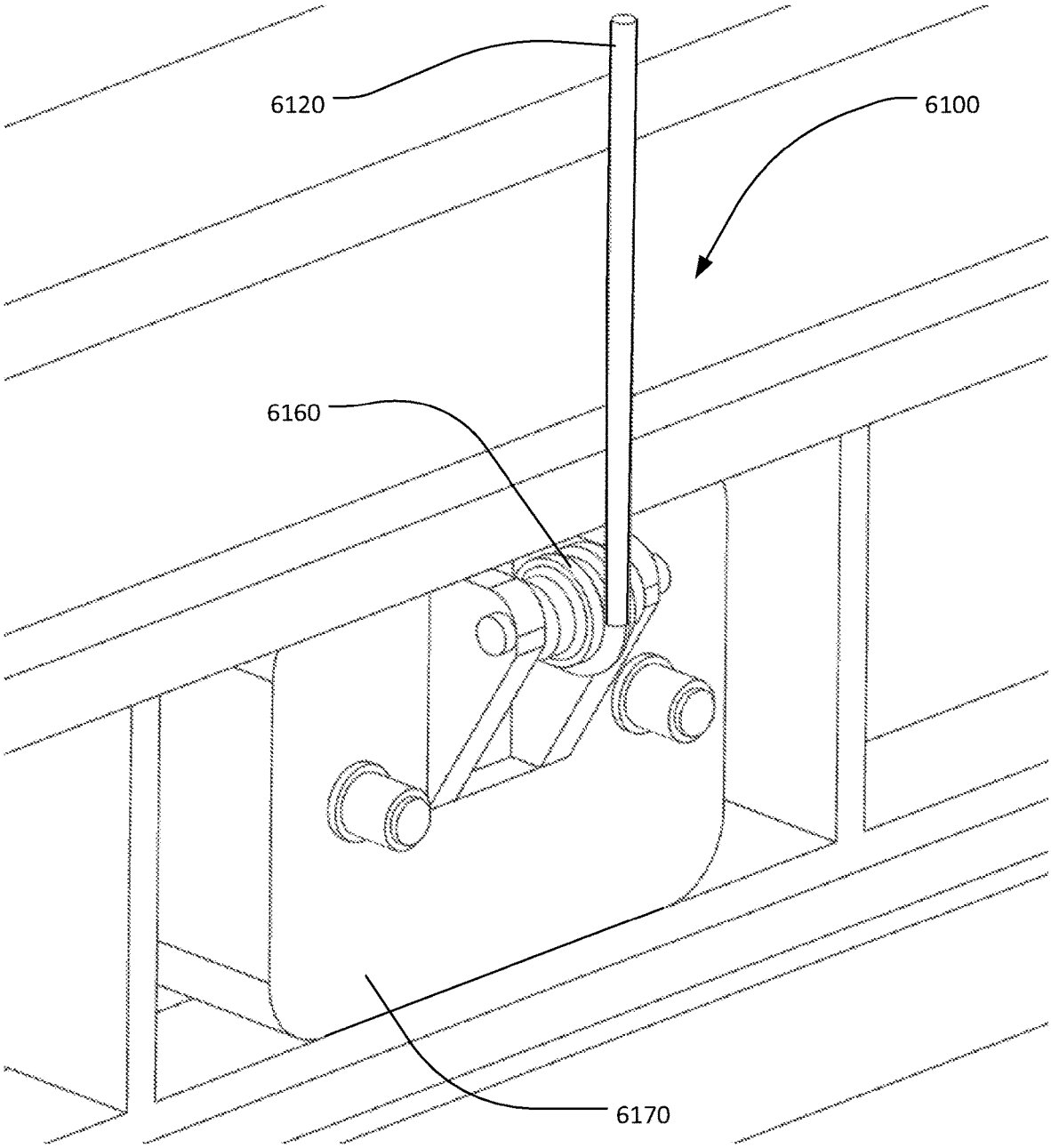
Figure 125:
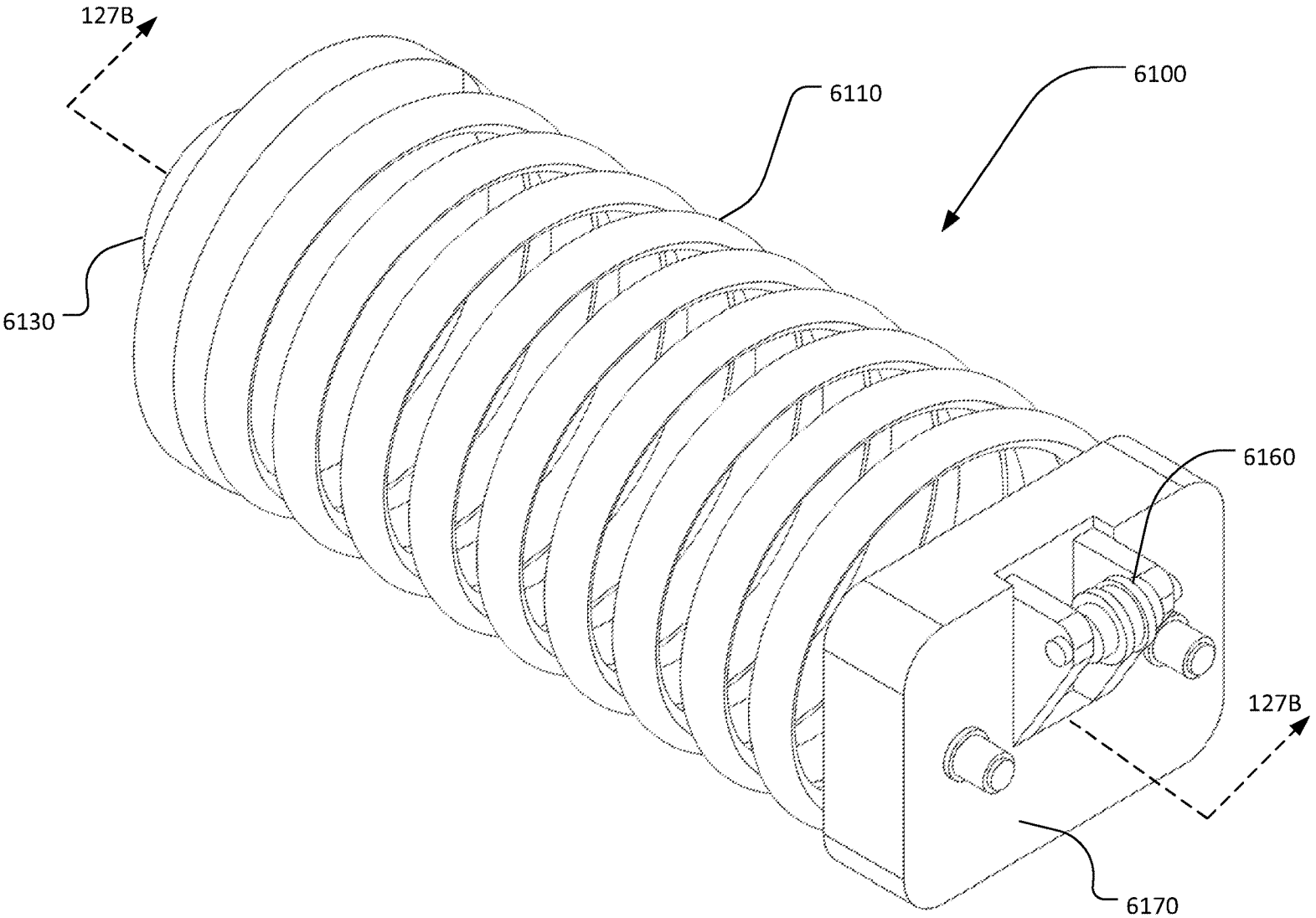
Figure 126:
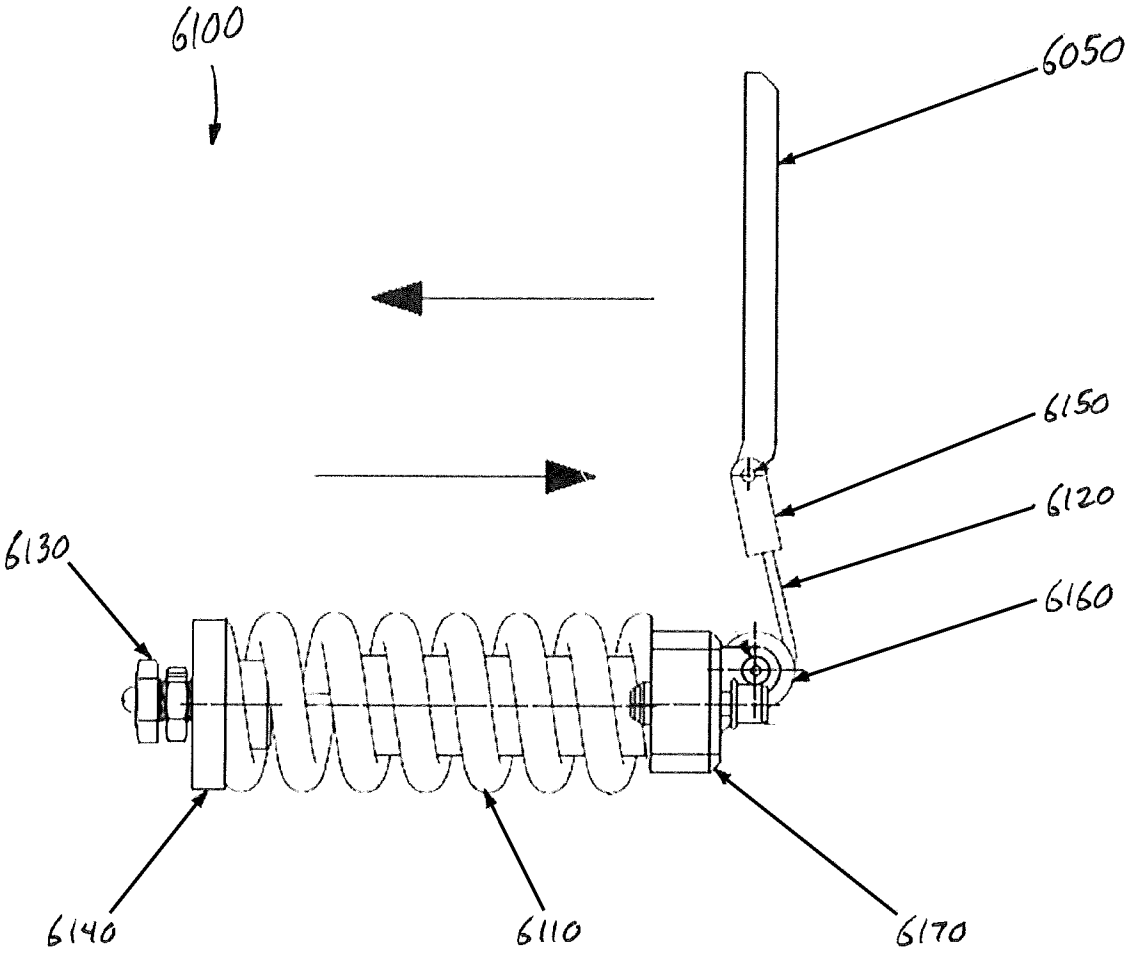

In one embodiment, a spring mechanism 6100 is utilized. Referring now to FIG. 124, the spring mechanism 6100 is secured to a beam under the base panel 6020 of the folding container. The spring mechanism 6100, which is depicted in FIGS. 124-127B, is also connected to both the right side panel 6050 and the left side panel 6060 and comprises a compression spring 6110 positioned under the base panel 6020. A cable 6120 extends from the side panel and passes through the compression spring 6110. The cable 6120 is secured to a cap 6130 at one end and the other end of the cable 6120 terminates proximate to the side panel 6050 or 6060. The spring mechanism 6100 also comprises a compression tube 6140 that extends through a portion of the compression spring 6110 and is in contact with the cap 6130 and the compression spring 6110. The spring mechanism 6100 can also include a spring plate 6150 that is coupled to the side panel 6050 and/or 6060. The cable 6120, which is secured to the cap 6130 at one end, can then be secured to the spring plate 6150 at the opposing end. In order to facilitate easy movement of the cable 6120 as the side panel 6050 or 6060 folds, the spring mechanism 6100 also includes at least one pulley 6160 for purposes of directing the cable 6120. The spring mechanism 6100 also comprises a mounting flange 6170 for securing the spring mechanism 6100 to the base panel 6020, where the compression tube 6140 is in telescoping relationship with the mounting flange 6170 and the mounting flange 6170 is secured to the base panel 6020.

Figure 127A:
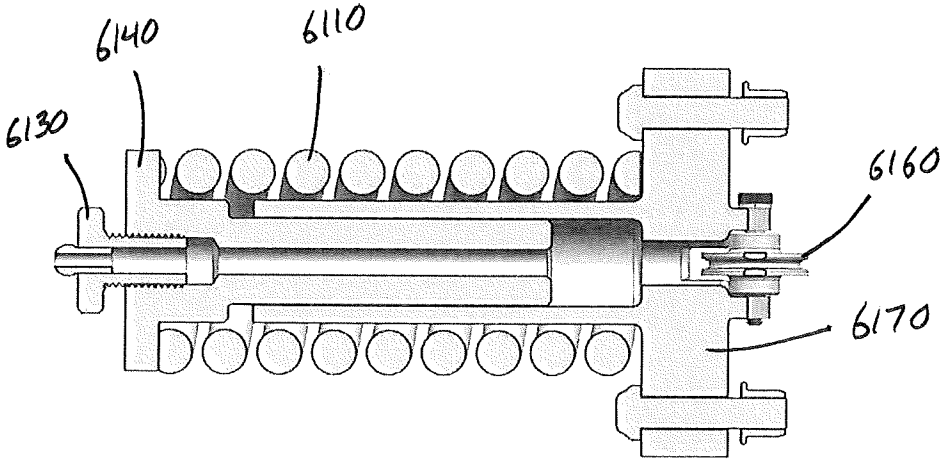
Figure 127B:
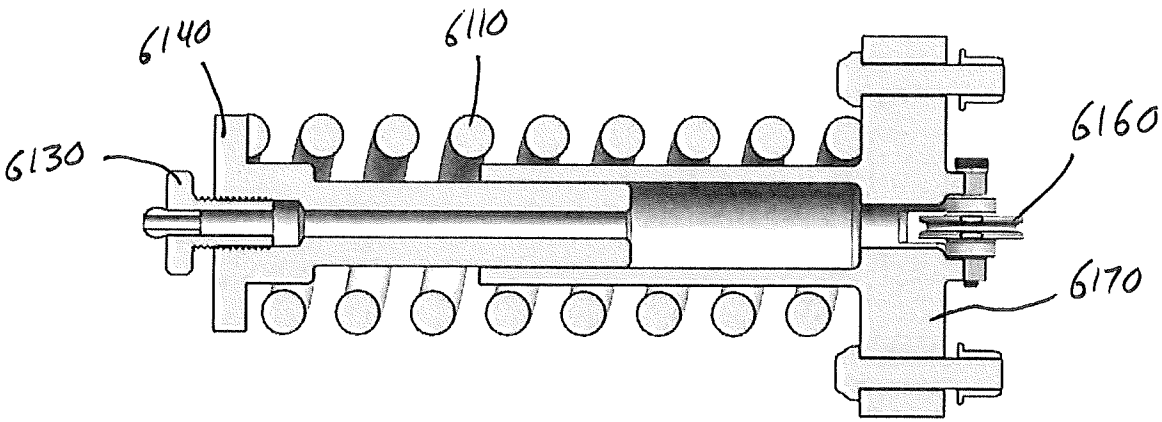

In operation, the spring mechanism 6100 helps to control the rate at which the side panels 6050 and 6060 are lowered towards the base panel 6020 of the folding container 6000. That is, to fold the container, the side panels 6050 and 6060 are released from the roof panel 6010 and permitted to collapse inward and towards the base panel 6020. In operation, as the side panel (6050 or 6060) is lowered towards the base panel 6020, the end of the cable 6120 at the side panel 6050 or 6060 is pulled upwards in a vertical direction, relative to the base panel 6020. In doing so, the cable 6120 pulls the cap 6130, causing the cap 6130 to contact the compression tube 6140. As the force is applied, the compression tube 6140 transmits the force to the compression spring 6110 causing the compression spring 6110 to compress to a shorter length. As a result, the force applied by the wall collapsing is stored as potential energy in the compression spring 6110. This force can then be used to help elevate the side panel from the collapsed state. In the embodiment depicted in FIG. 123, the folding container 6000 utilizes a number of compression springs spread generally equidistant along the length of side panels 6050 and 6060, with each of the compression spring 6110 collapsing from a decompressed length when the container is in its unfolded condition to a smaller compressed length, as shown in FIGS. 127A and 127B.

In an alternate embodiment of the present disclosure, a foldable shipping container is provided having a roof panel 6010 and an opposing base panel 6020. A right side panel 6050 and opposing left side panel 6060 are each connected to the roof panel 6010. Each of the side panels 6050 and 6060 are a single, one-piece wall. The container 6000 also includes a front panel 6030 and opposing door panel 6040, where the front panel 6030 and opposing door panel 6040 are connected to the base panel 6020. The container also includes at least one spring mechanism 6100, as disclosed above. However, in this alternate embodiment, the at least one spring mechanism 6100 operates to control the folding of the front panel 6030 and door panel 6040 towards the base panel 6020. The at least one spring mechanism 6100 operates as previously discussed above, however in this configuration, the compression spring 6110 compresses in length as the front panel 6030 or door panel 6040 collapse inward towards the base panel 6020. Due to the shorter length of the front panel 6030 and door panel 6040 compared to the side panels 6050 and 6060, the front panel 6030 and door panel 6040 are lighter in weight, and therefore require fewer spring mechanisms 6100 to control their folding rate.

Figure 128:
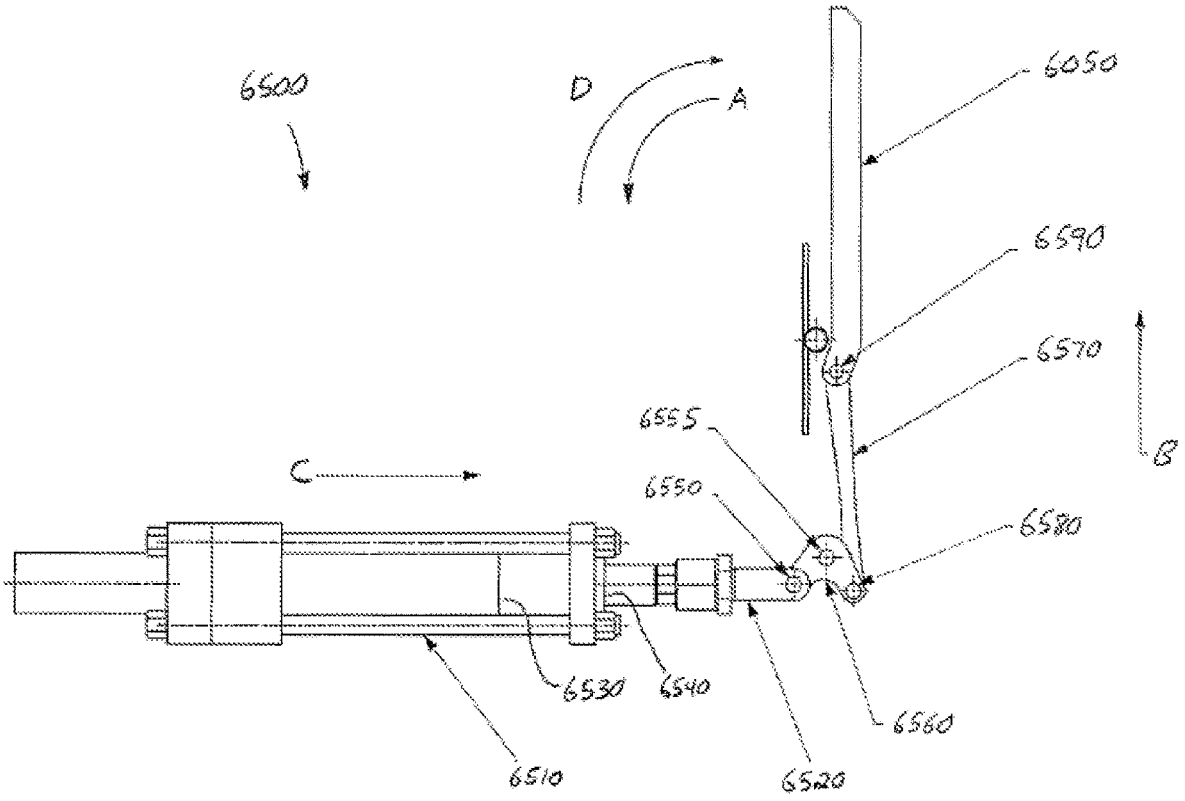
Figure 129:
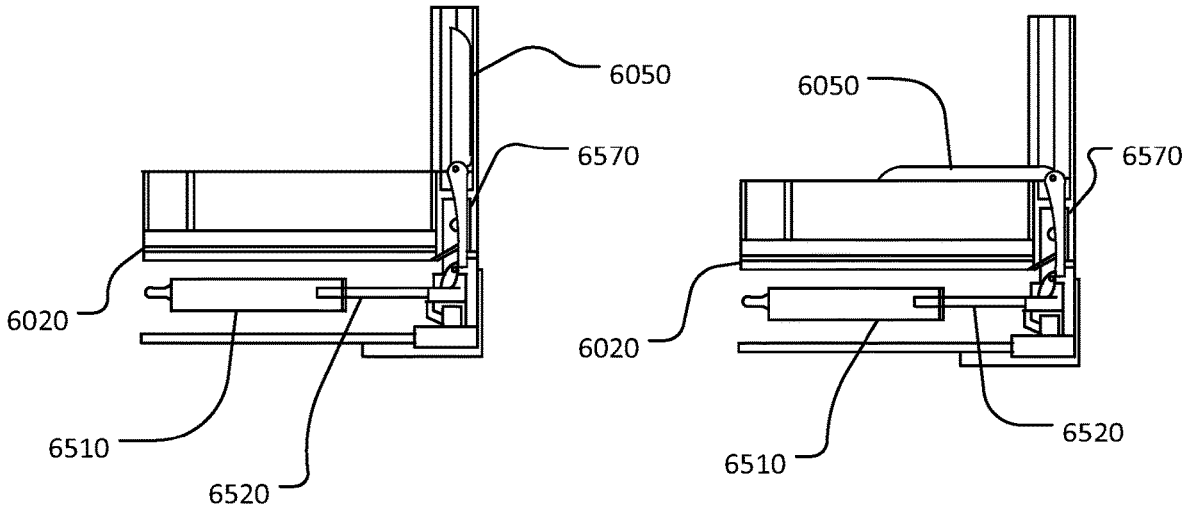

Another embodiment of the present disclosure is depicted in FIGS. 128 and 129. The embodiment depicted in FIGS. 128 and 129 provides an alternate way of regulating the folding of side panels and/or the front panel and door panel. Referring initially to FIG. 128, a panel support system 6500 is depicted. The panel support system 6500 comprises a cylinder 6510 having fluid, such as oil contained in the cylinder. A shaft 6520 has a piston 6530 coupled to a first shaft end 6540 where the shaft 6520 extends through at least a portion of the cylinder 6510 and the piston 6530 is located within the cylinder. The shaft 6520 has a second end 6550 that is coupled to an elbow bracket 6560. Connected to an opposing end of the elbow bracket 6560 is a connecting rod 6570. The connecting rod has a first rod end 6580 coupled to the elbow bracket 6560 and a second rod end 6590 that is coupled to the side panel 6050 or 6060, depending on whether the panel support system is coupled to the left side or right side of the container. The operation of the panel support system is depicted in FIGS. 128 and 129, where the side panel moves from an upright to a folded position.

In operation, as the side panel 6050 or 6060 is lowered towards the base panel 6020, as indicated by arrow A, the connecting rod 6570 travels in a vertical direction indicated by arrow B. This movement causes the elbow bracket 6560 to rotate about hinge point 6555, thus moving the piston 6530 in the direction of arrow C. The rate of descent of the side panels 6050 and 6060 are controlled within the panel support system by means of an oil cylinder valve and piston arrangement, providing a resistance as the side panels 6050 or 6060 fold towards the base panel 6020. The piston may also include a plurality of flow restriction devices (not depicted) for regulating the flow of fluid through the piston.

When the side panels 6050 and 6060 are to be raised from their folded condition, such as depicted by arrow D, the valves and piston arrangement allow the shaft 6520 to return freely to its normal position. Although a variety of shapes and configurations may be utilized, one such acceptable shape for the connecting rod 6570 is a solid bracket and the elbow bracket 6560 may be L-shaped. Furthermore, the connecting rod 6570 is coupled to a side panel 6050 or 6060 while the cylinder 6510, shaft 6520, and piston 6530 are positioned under the base panel 6020.

In yet another embodiment of the present disclosure, the folding container may fold in a slightly different arrangement where side panels 6050 and 6060 are hinged to the roof panel 6010 and the front panel 6030 and door panel 6040 are hinged to the base panel 6020. In this configuration, the same panel support system 6500 can be connected to the front panel 6030 and door panel 6040 for controlling the rate at which the front panel 6030 and door panel 6040 fold towards the base panel 6020. The panel support system 6500 would operate as discussed above, but since the front panel 6030 and door panel 6040 are smaller, fewer panel support systems would be necessary than when supporting the side panels.

FIGS. 130 through 148 show an embodiment 8000 of the container 10. The embodiment 8000 may be substantially similar to the container 10, except as expressly noted and/or shown, or as would be inherent (e.g., the embodiment 8000 may have a base panel 17' substantially similar to the base panel 17 of container 10, a right side panel 14' substantially similar to the right side panel 14 of container 10, a roof panel 11' substantially similar to the roof panel 11 of container 10, etc.). Further, those skilled in the art will appreciate that the container 10 (and thus the container 8000) may be modified in various ways, such as through incorporating all or part of any of the various described embodiments.

In embodiment 8000, the posts (e.g., corner posts 6002' (FIG. 138), etc.) may have a solid steel construction, and may be of narrower dimensions (e.g., height, width, and/or depth) than previous embodiments. Additionally, anti-racking features 7250 (FIG. 143) may be added to the container 8000 (e.g., at the rear frame, rear doors, front frame, etc.). Racking forces are often undesirable forces that push or pull a structure laterally, where the structure may be more vulnerable to failure. Anti-racking features 7250 of the container 8000 may include anti-racking plates. For instance, anti-racking plates 7255 (FIG. 143) may be placed at one or more end walls 12', 18' and/or side walls 14', 16', e.g., at the container interior where the walls 12', 14', 16', and/or 18' meet the base 17'. The anti-racking plates 7255 may also be provided at the skirts 23', 24', and/or the roof panel 11', as shown in FIGS. 143 and 144.

Anti-racking features 7250 of the container 8000 may alternately or additionally include corrugations, e.g., corrugations 7256 (FIG. 130) of the front panel 12' that run horizontally instead of vertically. Other anti-racking features 7250 may comprise door hinges 932' (e.g., five total door hinges 932') attached to a hinge bar 7750 for the doors (e.g., door 927' as shown in FIG. 144, etc.), such as those seen in FIGS. 145A and 145B.

One difference between the container 8000 and the container 10 may be that the length of one side wall of the container 8000 (e.g., side wall 14') may be disparate from the length of the other side wall (e.g., side wall 16'). That is, the side walls 14' and 16' may be asymmetrical. For example, as seen in FIG. 137, right side wall 14' may be longer than (or, in other embodiments, shorter than) the left side wall 16'. Asymmetry between the side walls 14' and 16' may preclude undue conflict between the walls 14' and 16' when the container 8000 is placed in a folded/collapsed position as discussed herein. In one embodiment, the longer side wall (e.g., side wall 14') may have a length of 460.2 inches and the shorter side wall (e.g., side wall 16') may have a length of 458.6 inches.

In embodiments, the side wall 14' may have extender 14" and the side wall 16' may have extender 16". The extenders 14" and 16" may ensure that the combined length of one side wall (e.g., side wall 14') and its extender (e.g., extender 14") is equal to the combined length of the other side wall (e.g., side wall 16') and its extender (e.g., extender 16"). Thus, the length of the sides of the container 8000 may be generally equal.

In an embodiment, the extender 14" may be welded or otherwise secured to the side wall 14'. The extender 14", in an embodiment, may be generally L-shaped and have two perpendicular walls 14A" and 14B" (FIG. 137). The wall 14B" may extend generally parallel to the side wall 14'.

The extender 16" may likewise be welded or otherwise secured to the side wall 16'. The extender 16", in an embodiment, may generally correspond to the extender 14". For example, in an embodiment, the extender 16" may be generally L-shaped and have two perpendicular walls 16A" and 16B" (FIG. 137). The wall 16B" may extend generally parallel to the side wall 16' and may have a length that is greater than the length of the extender wall 14B". The extender walls 14B" and 16B", when the side walls 14' and 16' are folded and/or unfolded, may terminate in the same vertical plane. This functionality may ensure there are no gaps in the container 8000 notwithstanding the disparate length of the side walls 14' and 16'. As can be seen in FIG. 137, the side walls 14' and 16', when in a folded configuration, may be nested.

One optional difference between the embodiment 8000 and the container 10 may be the inclusion of a plurality of damper assemblies 7000, 7100 (FIGS. 131-135) in place of the hinge pin torsion spring assembly 5000 or the linear spring assemblies 771, 799 of the collapsible container 10. In operation, the damper assemblies 7000, 7100 may counter-balance the weight of the side walls 14', 16' when folding and/or unfolding the container 8000. For example, when the right side panel 14' is being lowered into a collapsed position, right side damper chains 7010 may be pulled, transferring the motion of the right side panel 14' to the plurality of right side damper assemblies 7000. The right side damper assemblies 7000 may then dampen or otherwise slow down the overall motion of the right side panel 14'. The damper assemblies 7000 and/or 7100 may, in embodiments, be omitted.

Figure 132:
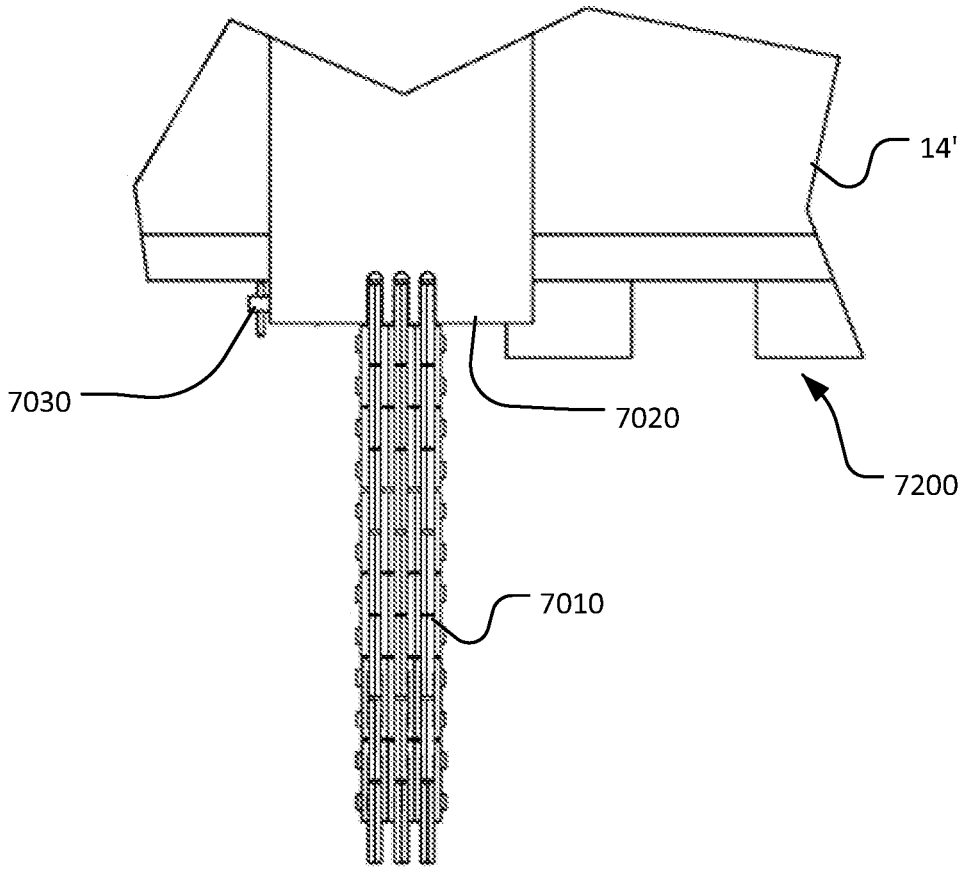

As seen in FIGS. 131 through 135, one embodiment of the damper assemblies 7000, 7100 may optionally include one or more right side damper assemblies 7000 which may be coupled to the underside of the base panel 17'. Each right side damper assembly 7000 may include or be coupled to a right side damper chain 7010. As shown in FIG. 132, the right side damper chains 7010 of each right side damper assembly 7000 may be attached to a right side clevis block 7020 using a cotter pin 7030 or other suitable means. The right side clevis block 7020 may be attached to, or be formed as part of, the right side panel 14'. The right side damper assemblies 7000 may each include a damper adjusting means 7005 (e.g., an adjustable hexagonal or other nut placed at the end of a damping spring within the right side damper assembly 7000) for calibration of the right side damper assembly 7000. As can be seen in FIGS. 130 and 135, the damper assemblies 7000, 7100 may be situated underneath and/or within the base panel 17', and damper chains 7010, 7110 may extend therefrom to their respective side panels 14', 16'.

Referring now to FIGS. 133 and 134, the container 8000 may also optionally include one or more left side damper assemblies 7100, similar in function and structure to the plurality of right side damper assemblies 7000, barring the following exceptions: each left side damper assembly 7100 may be attached to a left side damper chain 7110; the left side damper chain 7110 may be attached to a left side clevis block 7120 using a cotter pin 7130 or other suitable means;

the left side clevis block 7120 may be attached to, or be formed as part of, the left side panel 16'; and, the left side damper assemblies 7100 may each include a damper adjusting means 7105 (e.g., an adjustable hexagonal nut placed at the end of a damping spring within the left side damper assembly 7100) for calibration of the left side damper assembly 7100. In some embodiments, one or more damper assemblies 7000, 7100 may be coupled to each other. In some embodiments, one or more of the damper assemblies 7000, 7100 may be configured to dampen the motion of both side wall panels 14', 16'. As noted, in embodiments, one or more right side and/or one or more left side damper assemblies may be provided, or alternately, the container 8000 may be devoid of the damper assemblies.

In embodiments, as shown in FIG. 130, there may be one or more fold assist members 7050 attached to the side panels 14', 16'. In some embodiments, the fold assist members may comprise link attachment portions 7055. The link attachment portions 7055 may be configured to be coupled to a link (e.g., rope, chain, cable, etc.). The link may be used to assist in the folding/unfolding of the side panels 14', 16', such as by being attached to both a vehicle and the link attachment portion 7055. In operation, the link attachment portions 7055 may assist in hauling, or otherwise moving, the side panels 14', 16' when folding/unfolding and/or transporting the container 8000.

Another difference between the embodiment 8000 and the container 10 may be that the container 8000 may include one or more sets of guides 7150 (FIG. 136). The guides 7150 may be operably coupled to the side wall 14', the side wall 16', or both. In an embodiment, guides 7150 may be provided only on one side wall (e.g., side wall 14').

In operation, the side panel without the guides (e.g., side panel 16') may first be lowered into a collapsed position and thereafter the side panel with the guides 7150 (e.g., side panel 14') may be collapsed such that it is upwardly adjacent the panel without the guides. The end panels 12' and 18', as discussed above, may each have wheels and the end panels 12' and 18', via their respective wheels, may be guided along the guides 7150 to a collapsed position.

In more detail, the guides may, in an embodiment, be tracks 7155. The tracks 7155 may be spaced along the exterior side panels 14', 16' in a manner configured to receive the rollers 981, 982 of the end panels 12' and 18' when the container 8000 is undergoing a folding/unfolding operation. There may be a set of tracks 7155 for each of the end panels 12', 18' (e.g., two sets of tracks 7155 situated at the opposite ends of the side wall 14'). As noted, in embodiments, the tracks 7155 may be attached to the exterior of only one of the side panels 14', 16' (e.g., just the right side panel 14'), so that the tracks 7155 may not conflict with other parts of the container 8000 when folding the container 8000 into a collapsed condition.

Another difference between the container 8000 and the container 10 may be that the roof beams 600', 603' of the container 8000 may be situated differently (e.g., above) relative to their respective upper cap plates (e.g., roof beam 603' may be above cap plate 778') (FIG. 143). When in an unfolded or uncollapsed condition, the skirts 23', 24' may be configured to overlap both their respective roof beams 600', 603' and upper cap plates (e.g., the left skirt 24' may overlap the roof left beam 603' and the upper left cap plate 778').

In embodiments, when in a collapsed or folded condition, the skirts 23', 24' may be configured to overlap at least part of the base 17'. For example, as shown in FIGS. 138 and 139, container 8000 may include securing means 7058 to allow for the securement of the container 8000 in a folded condition. In one embodiment, the securing means 7058 may include vertical skirt plates 7060 that may be attached to, or formed as part of, the exterior of each of the four corners of the skirts 23', 24'. The vertical skirt plates 7060 may each have a respective aperture 7061, with each aperture 7061 being configured to receive a locking mechanism 7070 (e.g., pin, bar, bolt, lock, etc.) as discussed herein.

Similarly, in some embodiments, and as seen in FIG. 139, the securing means 7058 may include vertical base plates 7160 attached to, or formed as part of, each of the base corner fittings **36*e*', 36*f*', 36*g*', 36*h*'. Each of the vertical base plates 7160 may include an aperture 7161 configured to receive the locking mechanism 7070 (e.g., pin, bar, bolt, lock, etc.). In operation, the skirts 23', 24' may at least partially overlap the base 17' when the container 8000 is in a collapsed position, and each aperture 7061 of the vertical skirt plates 7060 may align with one of the apertures 7161 of the vertical base plates 7160 for reception of the locking mechanism 7070 therethrough, for locking the skirts 23', 24' to the base 17'**.

In some embodiments, as seen in FIG. 139, the locking mechanism 7070 may be rotating ratchet locks 7080. The rotating ratchet locks may, in embodiments, be attached at one or more of each of the base corner fittings **36*e*', 36*f*', 36*g*', 36*h*' (see also FIG. 135). The rotating ratchet locks 7080 may include a base 7182, a socket 7184, a corner pin 7181, and a hex nut 7183. The base 7182 may be attached to a base corner fitting 36*e*', 36*f*', 36*g*', 36*h*', and may include or have associated therewith the socket 7184 for retaining the corner pin 7181. The corner pin 7181 may be configured to pass through the apertures 7161 of the vertical base plates 7160. In embodiments, each of the corner pins 7181 may be configured to pass through both the apertures 7161 of the vertical base plates 7160 and the apertures 7061 of the vertical skirt plates 7060 when the apertures 7061, 7161 align upon the folding of the container 8000. The hex nut 7183 may be used to ratchet, or otherwise adjust, the ratchet lock 7080** into a desired position.

In some embodiments, as seen in FIG. 140, the vertical base plates 7160 may include one or more alignment assist portions 7170. In embodiments, the alignment assist portions 7170 each include a groove 7175 on an interior face of the vertical base plates 7160, with each of the grooves 7175 being configured to individually receive a key 7180 that is attached to, or formed as part of, each respective corner post 6002' (see also FIG. 138). In operation, the grooves 7175 may assist in the alignment of the corner posts 6002' when undergoing a folding/unfolding operation of the container 8000, by using the keys 7180 to guide each corner post 6002' into its proper place. It is to be understood that many various shapes and configurations of each groove 7175 and corresponding key 7180 are available to those skilled in the art, and that any suitable variation of such components is contemplated and within the scope of the present disclosure.

Another difference between the container 8000 and the container 10 may be that the side walls 14', 16' may be coupled to the base 17' through a multi butt hinge system 7200 instead of hinge members 125, 797 (see FIGS. 141 and 142). More specifically, there may be a plurality of base left hinge members 7210 attached to the left side of the base 17', corresponding to a plurality of left hinge members 7220 attached to the left side panel 16'. Each of these pluralities of hinge members 7210, 7220 may be rotatably coupled via a left hinge pin 7215 to allow for rotation of the left side panel 16' relative to the base 17'.

Similar in design and function to the left side, and as seen in FIG. 142, the multi butt hinge system 7200 may also include a plurality of base right hinge members 7230 attached to the right side of the base 17', corresponding to a plurality of right hinge members 7240 attached to the right side panel 14'. Each of these pluralities of hinge members 7230, 7240 may be rotatably coupled via a right hinge pin 7235, to allow for rotation of the right side panel 14' relative to the base 17'.

As seen in FIGS. 141 and 142, embodiments of the compound beams 757', 781' may comprise an "H" beam 7300 and an "L" beam 7350, or any other suitable structural beam with one or more channels. The "L" beam 7350 may be attached to the top of the "H" beam 7300. In embodiments, the "H" beam 7300 may be an "I" beam. In further embodiments, the compound beams 757', 781' may include a positive prestressed 25 mm camber, which may improve structural performance of the compound beams 757', 781' and/or the base 17'.

In embodiments, as shown in FIG. 146, the sill panel 61' may include an inverted channel 7400. The inverted channel 7400 may be configured to fit over the base front beam 706 of the base front edge 101. In some embodiments, the end panel hinges (e.g., first hinge set 651 (FIG. 14), etc.) may be mounted more inboard of the side panels 14', 16' relative to other embodiments described herein, which may provide better clearance for other components such as the locking rods 92. In further embodiments, one or more mating surfaces may have watertight seals, which may maintain the watertight integrity of the container 8000.

In embodiments, the door latch assembly 639 may have an alternate configuration, as shown in FIG. 147. For example, rather than orienting the door handles 936 on each exterior door panel 934, 935 in the same direction, as seen in FIG. 81, the door handles 936' on each exterior door panel 934', 935' may be oriented to face each other. The door latch assembly 639' may comply with international and/or industry standards.

In embodiments, as shown in FIG. 148, one or more of the locking bolt assemblies 773, 801 may have alternate configurations (e.g., locking bolt assemblies 7500), alternatively or in addition to the previously described embodiments (e.g., in FIG. 32). For example, there may be a plurality of locking bolt assemblies 7500 situated along the interior of each of the side walls 14', 16'. The interior locking bolt assemblies 7500 may be similar in design and function to the locking bolt assemblies 773, 801, except that they may be mounted within interior corrugations 7475 of the side panels 14', 16'. As those skilled in the art will readily appreciate, each of the locking bolt assemblies 7500 so described is selectively positionable between a first position in which a locking bolt 823' is received within one of the locking bolt holes 7470 of the roof beams 600', 603' when the container 8000 is in the unfolded condition, and a second position in which the locking bolt 823' is fully withdrawn from that locking bolt hole 7470.

In an embodiment, there may be: four interior locking bolt assemblies 7500 situated along the interior of the right side panel 14', four interior locking bolt assemblies 7500 situated along the interior of the left side panel 16', two locking bolt assemblies 773 situated along the exterior of the right side panel 14', and two locking bolt assemblies 801 situated along the exterior of the left side panel 16'. In operation, the locking bolt assemblies 773, 801 and interior locking bolt assemblies 7500 may help maintain the container 8000 in an unfolded, or uncollapsed, condition. When assembling the container 8000 into an unfolded condition, the locking assemblies 773, 801 may first be engaged in a locked position as a safety measure, before a user moves inside to engage the interior locking assemblies 7500 in a locked position.

FIG. 149 illustrates a method 9000 for folding the container 8000. First, at step 9010, each of the locking bolt assemblies 773, 801, 7500 and the ratchet locks 7080 may be moved to an unengaged position in a given order. For example, the given order may be that the interior locking bolt assemblies 7500 are unengaged before the exterior locking bolt assemblies 773, 801 are unengaged, and then the ratchet locks 7080 may be unengaged. In embodiments, the given order may include unengaging locks after other steps of the method 9000 are performed (e.g., the ratchet locks 7080 are unengaged after the side walls 14', 16' are lowered at step 9020). Next, at step 9020, the side walls 14', 16' may be lowered into a folded condition upon the base panel 17', as described above (e.g., using the fold assist members 7050). In some embodiments, the side walls 14', 16' may be lowered in an order that allows a side panel 14', 16' with the guides 7150 to be situated on top of the other side panel (e.g., the right side panel 14' with the guides 7150 may be folded after the left side wall 16' is folded). Then, at step 9030, the roof panel 11' may be lifted from the rest of the container 8000 (e.g., by a crane).

Next, in step 9040, the end panels 12', 18' may be swung inward towards the roof panel 11' as described earlier (e.g., using the guides 7150). Then, at step 9050, the roof panel 11' may be lowered towards the base panel 17' of the container 8000. Care may be taken to ensure that certain components align themselves properly (e.g., care may be taken to ensure each of the apertures 7061 align with corresponding apertures 7161). Then, at step 9060, securing means 7058 may be used to removably secure the folded container 8000 to itself in a folded condition, as described above. Finally, at step 9070, the folded container 8000 may be stacked upon other folded containers 8000, and the stacked folded containers may be removably secured together using any suitable securing means known to those skilled in the art. It is to be understood that stacking any number of containers 8000 is contemplated and within the scope of the present disclosure. It is also to be understood that the steps of the method 9000 may be carried out in a different order than as described herein, and that the method 9000 may omit and/or include additional steps not expressly set forth in FIG. 149. The artisan will understand that unfolding the container 8000 will essentially involve effectuating the steps of the method 9000 in reverse.

FIGS. 150 through 161 show an embodiment 10000 of the container 10. The embodiment 10000 may be substantially similar to the container 10, except as expressly noted and/or shown, or as would be inherent (e.g., the embodiment 10000 may have a base panel 17" substantially similar to the base panel 17 of container 10, a right side panel 14'" substantially similar to the right side panel 14 of container 10, a roof panel 11" substantially similar to the roof panel 11 of container 10, etc., as seen in FIGS. 150 and 151). Further, those skilled in the art will appreciate that the container 10 (and thus the container 10000) may be modified in various ways, such as through incorporating all or part of any of the various described embodiments. Like previously described collapsible container embodiments, the container 10000 is selectively changeable between a "collapsed" or "folded" condition, and an "uncollapsed" or "unfolded" condition. Certain features of the container 10000 are not represented in FIGS. 150 and 151 for clarity, but are shown in greater detail in FIGS. 152-161.

As discussed above, some container embodiments include a set of disparate side wall lengths to preclude the side walls from interfering with each other during a folding/unfolding operation. However, the container 10000 may alternately or additionally include a set of side walls 14''' and 16''' having disparate total heights to accomplish a similar goal. In some embodiments, only one of these sets of disparate features may be employed. Disparate side wall 14" and 16" heights may mean that the total height of one sidewall of the container 10000 (e.g., the height of the side wall 14''' plus the height of the compound beam 757") may be disparate from the total height of the other side wall (e.g., the height of the side wall 16''' plus the height of the compound beam 781"). For example, looking at the container 10000 in the unfolded condition as depicted in FIG. 152A, the side wall 16''' begins (and terminates) in a different horizontal plane than the side wall 14'''. In other words, one or more ends of the side walls 14''' and 16''' may be offset from each other.

A disparity between total side wall 14''' and 16''' heights may preclude undue conflict between the walls 14''' and 16''' when the container 10000 is placed into the folded/collapsed position, as discussed herein. For example, as seen in FIG. 152B, the sidewalls 14''' and 16''' are placed in the folded/collapsed condition where the side wall 16''' is laid over the side wall 14'''. With this configuration, the side wall 16''' may lay both against the side wall 14''' and generally parallel with the base panel 17". While FIG. 152A depicts an embodiment where the side walls 14''' and 16''' have equivalent heights, embodiments where the side walls 14''' and 16''' have disparate heights are contemplated herein. For example, the side walls 14''' and 16''' may have disparate heights in addition to or in lieu of having disparate lengths (as discussed previously). In the folded condition, the front panel and the door panel may in embodiments lay between the folded side wall 16" and the roof panel 11".

To accommodate the disparate heights of the side walls 14''' and 16''', the container 10000 may have skirts 23" and 24" of disparate heights such that the combined height of one side wall and its associated skirt (e.g., compound beam 781", side wall 16''', and skirt 24") is the same as the combined height of the other side wall and its associated skirt (e.g., compound beam 757", side wall 14''', and skirt 23"). The disparate heights of the skirts 23", 24" may correspond to the terminal ends of the side walls 14''', 16''' so that the roof panel 11" lays flat when in the unfolded condition (i.e., the skirts 23", 24" may terminate in the same horizontal plane). Alternately or additionally the right compound beam 757" may have a height disparate from the left compound beam 781", and the compound beam 757" and 781" heights may correspond with the heights of the skirts 23" and 24". For example, the combined height of the right compound beam 757" and the right skirt 23" may be substantially equal to the combined height of the left compound beam 781" and the left skirt 24" (i.e., the side wall 14''' and 16''' may be asymmetrical not necessarily because they have disparate heights but because they are vertically offset from each other). This configuration may allow the roof panel 11" to lay flat when the container 10000 is in the folded condition, as seen in FIG. 152B. In embodiments, any suitable combination of side wall 14''', 16''' offsets, side wall 14''', 16''' heights, compound beam 757", 781" heights, and skirt 23", 24" heights may be used in the container 10000.

To further illustrate a particular embodiment, various heights of the components depicted in FIG. 152A have been labeled. Viewed from the door end facing the front, LH1 corresponds to the height of the left compound beam 781", LH2 corresponds to the height of the left side wall 16''', LH3 corresponds to the height of the left skirt 24", RH1 corresponds to the height of the right compound beam 757", RH2 corresponds to the height of the right side wall 14", RH3 corresponds to the height of the right skirt 23". In this embodiment, the compound beam 757", 781" heights RH1 and LH2 are not equivalent, and the skirt 23", 24" heights RH3 and LH3 are not equivalent. Meanwhile, the side walls 14''' and 16''' heights RH2 and LH2 are equal. For the roof panel 11" to lie horizontal (i.e., flat), each of the total heights of the unfolded wall 14''', 16''' panel must be equal (i.e., LH1+LH2+LH3=RH1+RH2+RH3). Thus, the combined height of the left skirt 24" and the left compound beam 781" may be equivalent to the combined height of the right skirt 23" and the right compound beam 757" (i.e., LH1+LH3=RH1+RH3).

To facilitate the folding and unfolding of the container 10000, the side walls 14''' and 16''' may be coupled to the base 17" through a hinge system 7200" (also referred to as one or more "hinge points") (FIGS. 152A and 152B). More specifically, there may be a plurality of base left hinge members 7210" attached to the left side of the base 17" (e.g., attached to the compound beam 781"), corresponding to a plurality of left hinge members 7220" attached to the left side panel 16'''. Each of these pluralities of hinge members 7210", 7220" may be rotatably coupled via a left hinge pin 7215" to allow for rotation of the left side panel 16''' relative to the base 17". In some embodiments, the left hinge pin 7215" is removable. The removable left hinge pin 7215" may allow for separation of the left side wall 16''' from the base panel 17".

Similar in design and function to the left side, the hinge system 7200" may also include a plurality of base right hinge members 7230" attached to the right side of the base 17" (e.g., attached to the compound beam 757"), corresponding to a plurality of right hinge members 7240" attached to the right side panel 14'''. Each of these pluralities of hinge members 7230" and 7240" may be rotatably coupled via a right hinge pin 7235", to allow for rotation of the right side panel 14''' relative to the base 17". In some embodiments, the right hinge pin 7235" is removable. The removable right hinge pin 7235" may allow for separation of the right side wall 14''' from the base panel 17". As illustrated in FIG. 152A, the locations of the left and right side hinge systems 7200" may correspond to the heights of the compound beams 757" and 781". That is, the left and right side hinge systems 7200" may lay in different horizontal planes. For example, in an embodiment, the left side hinge system (e.g., parts 7210", 7215", and 7220") may be vertically higher than the right side hinge system (e.g., parts 7230", 7235", and 7240").

To assist with securing the container 10000 in the folded and/or the unfolded condition, the container 10000 may include locking mechanisms. For example, the locking mechanisms may be one or more hammer locking mechanisms 10025, as seen in FIG. 153. The hammer locking mechanisms 10025 may be arranged on the base panel 17", and each hammer locking mechanism 10025 may selectively engage with an end panel 12" or 18" (e.g., a corner post 6002" thereof). By engaging with the end panels 12", 18", the hammer locking mechanisms 10025 may removably couple the base panel 17" to the end panels 12", 18", securing (or otherwise retaining) the container 10000 in the unfolded position. Alternately or additionally, the hammer locking mechanisms 10025 may each selectively engage with a roof skirts 23" or 24" when the container 10000 is in the folded condition. By engaging with the roof skirts 23" and 24", the hammer locking mechanisms 10025 may removably couple the base panel to the roof skirts 23", 24", securing (or otherwise retaining) the container 10000 in the folded position.

The hammer locking mechanism 10025 may operate by first engaging a portion of the hammer locking mechanism 10025 with the skirt 23", 24" and/or end panel 12", 18", such as by engaging with an aperture formed therein. Then, a locking body 10027 may be rotated (e.g., via a locking body bar 10029) to prevent the hammer locking mechanism 10025 from disengaging from the skirt 23", 24" or end panel 12", 18". To inhibit the hammer locking mechanism 10025 from unintentionally rotating and unengaging from the panels 12", 18" and/or the roof skirts 23", 24", the hammer locking mechanism 10025 may include a hammer locking mechanism catch 10030. When engaged with the hammer locking mechanism 10025 (e.g., the locking body bar 10029 thereof), the catch 10030 may prevent the locking body 10029 from rotating, and thus preclude the hammer locking mechanism 10025 from disengaging from the end panels 12", 18" and/or the roof skirts 23", 24".

Turning now to FIG. 154, another difference between the container 10000 and the other container embodiments described herein may be that the container 10000 may have one or more base receivers 10040 for fitting the end panels 12", 18" with the base panel 17". The base receivers 10040 may be used instead of the previously described groove 7175 and key 7180, for example. Each base receiver 10040 may be an angled and/or lipped portion extending (e.g., extending upwards) from the base panel 17", and in some embodiments, may have a generally triangular profile. The base receivers 10040 may each be located at or near a corner of the base panel 17" for mating with a corner post 6002" (e.g., by being seated within a pocket 10041). Accordingly, the corner posts 6002" may each have a corresponding tapered portion 10042 configured to slot with the base receiver 10040. In embodiments, the tapered portion 10042 may have an extruded lip that substantially covers the base receiver 10040 (e.g., a side thereof) when the container 10000 is in the unfolded condition. In use, the base receiver 10040 and the corner post tapered portion 10042 may assist in guiding the placement of the end panels 12" and/or 18" when moving the container 10000 into the unfolded condition. For instance, the tapered portion 10042 may mate with and slide against the base receiver 10040 to bias the end walls 12", 18" into the correct position when unfolding the container 10000. Additionally, the base receiver 10040 and tapered portion 10042 may mate in such a manner as to provide other benefits, such as by providing a seal (and/or a location for seals) against environmental conditions (e.g., moisture), reinforcement against racking forces, et cetera.

Alternately or additionally to the base receivers 10040, the base panel 17" may include a slotting portion 10045 (FIG. 155) located at each corner (e.g., a corner fitting 36") of the base panel 17", for slotting with the corner posts 6002" of the end walls 12", 18". The slotting portion 10045 may protrude from the base panel 17", and may have an angled (e.g., chamfered) shape to guide a mating corner post 6002". In embodiments, each corner post 6002" may have a corresponding void formed within the corner post 6002" for receiving the slotting portion 10045. In operation, the slotting portion 10045 may assist in assembling the container 10000 into the unfolded condition by biasing and/or retaining each of the end walls 12", 18" in the correct position at the ends of the base panel 17".

Turning now to FIG. 156, anti-racking features 7250" may be included in the container 10000, alternately or in addition to other anti-racking features described herein (e.g., anti-racking plates 7255, as seen in FIG. 144). The anti-racking features 7250" may include, for example, one or more anti-racking angles (or angled extenders) 10050 arranged along the side walls 14'" and 16'" for engaging with corresponding anti-racking plates 10055 located on the skirts 23" and 24". The anti-racking angles 10050 and plates 10055 may help mitigate undesirable container 10000 motion (e.g., bending, twisting, etc.) in one or more planes (e.g., the vertical and horizontal plane), such as when the container 10000 is experiencing a tensile load. Another example of anti-racking features 7250" may be one or more side wall latches 10105 arranged along the side walls 14'" and 16'" for engaging with the roof skirts 23" and 24" (e.g., a latching portion 10107 thereof), as will be discussed in further detail below.

Embodiments of anti-racking features 7250" may include bracing, such as vertical and/or diagonal bracing 10060. The vertical/diagonal bracing 10060 may be arranged along the interior of the roof skirts 23" and 24", as depicted in FIG. 156. The bracing 10060 may reinforce the container 10000, such as by mitigating impacts to the container 10000 caused from contact with adjacent containers, among other things.

The side wall latches 10105 may be rotatable, and may selectively engage with the skirts 23", 24" via one or more side wall latch systems 10100 (FIGS. 157A and 157B). The side wall latch system 10100 may include a latch bar 10110, a latch handle 10115, and a plurality of retainers 10120. Like previously described embodiments, the side wall 14'" and 16'" may have a corrugated construction with alternating recessed and protruding portions, and the side wall latch systems 10100 may be located within these side walls 14'", 16'" recesses (e.g., within an interior of the container 10000). In embodiments, the side walls 14'", 16'" may alternately or additionally have a cut-out portion 10125 for the placement of the side wall latch system 10100. For instance, the cut-out portion 10125 may be a portion of the side wall 14'", 16'" that is flattened to accommodate one or more side wall latch system 10100.

The latch bar 10110 may extend (e.g., downwardly) from the side wall latch 10105, and may couple (e.g., rotatably, hingedly, etc.) with the latch handle 10115. The latch handle 10115 may be changeable from a first position (e.g., generally vertical, as seen in FIG. 157A) where the side wall latch 10105 is not engaged with the skirt 23", 24", and a second position (e.g., generally horizontal, as seen in FIG. 157B) where the side wall latch is 10105 is engaged with the roof skirts 23", 24". The retainers 10120 may be used to hold the latch handle 10115 in these first and second positions, and may thus include one or more latches (e.g., gravity style latches, holders, et cetera). The retainers 10120 may be arranged such that the latch handle 10115 may be selectively secured in both the first position and the second position.

To operate the side wall latch system 10100, the latch handle 10115 may be released from its retainer 10120. The latch handle 10115 may then be manipulated (e.g., rotated) into another position, such as by being moved from the first position to the second position. In doing so, the attached side wall latch 10105 is selectively engaged or disengaged with the skirts 23", 24". Once the latch handle 10115 has been moved into the new position, the latch handle 10115 may be retained there with another retainer 10120. The side wall latch 10105 may thus be selectively locked in an engaged or disengaged position with the skirts 23" or 24".

An advantage of the side wall latch system 10100 may be that the latch system 10100 may removably secure the side walls 14'" and 16'" to the roof panel 11" via the skirts 23" and 24". The retainers 10120 may prevent the side wall latches 10105 from undesirably disengaging, such as by preventing side wall latch 10105 disengagement when there is cargo inside the container 10000. Additionally, overlapping surfaces of the skirts 23", 24" and the side walls 14"', 16"' may be pressed together when the side wall latches 10105 are engaged. In operation, these mating surfaces, along with any seals 10150 (e.g., tubing, channel seals, clip seals, etc.) (FIG. 156) placed between them, may prevent environmental elements (e.g., humidity and other moisture) from infiltrating the container 10000 at the seams between the side walls 14"', 16"' and the skirts 23", 24". For example, channel seals 10150 located at strategic points along the base panel 17" may receive the panels 12", 14"', 16"', and/or 18" to provide a seal therebetween.

While a single side wall latch system 10100 is depicted in the figures, the artisan will understand that the container 10000 may include any suitable number of side wall latch systems 10100 arranged (e.g., internally and/or externally) along the side wall 14"', the side wall 16"', or both. For example, in an embodiment, the side walls 14"' and 16"' may each have two or more external side wall latch systems 10100 in addition to any internal side wall latch systems 10100. These external side wall latch systems 10100 may be used as a safety measure to prevent the premature collapse of the side walls 14"', 16"' whilst personnel are inside the container 10000, such as when personnel are releasing the internal side wall latches 10100.

Another difference between the container 10000 and the other container embodiments described herein may be that the embodiment 10000 may include additional reinforcements to its construction. For example, post (e.g., corner posts 6002", etc.) walls may have an approximate thickness of about 20 mm, and may have a single piece construction. As another example, the roof panel 11" may have a camber (i.e., a slight curve) to resist sagging that may occur, such as sagging caused by the container 10000's own weight.

One or more components of the container 10000 may have a reduced weight relative to a typical version of such component. For example, as seen in FIG. 158, the base panel 17" may include members 10200 which include castellations 10202 (i.e., by having apertures formed therein), having material etched away, et cetera. In use, castellations 10202 may reduce the overall weight of the container 10000 while sacrificing little to no container 10000 structural integrity. In embodiments, the castellations 10202 may have a different shape from that depicted in FIG. 158. For example, the castellations 10202 may instead have a circular profile.

In embodiments, seals 10150 (e.g., tubing, strings, strips, etc.) (FIG. 156) may be located at any of the various seams and/or joints of the container 10000. For instance, seals 10150 may be located at any portion where two surfaces meet (e.g., between the roof skirts 23", 24" and their respective side walls 14"', 16"' as depicted in FIG. 156, between the base panel 17" and each of the side panels 14"', 16"' and the end panels 12", 18", along the corners of the skirts 23", 24", along a perimeter of side walls 14"', 16"', along a perimeter of the base panel 17", along a perimeter of the end panels 12", 18", et cetera). The seals 10150 may provide protection against environmental conditions that, such as rain, dust, moisture, humidity, insects, rodents, et cetera. In embodiments, one or more seals 10150 may have retainer strips located on and/or around the seals 10150. The retainer strips may be configured to assist in holding mating components together, such as by having a textured surface, a gripping material (e.g., rubber, latex, etc.), a specific shape for retaining a component, et cetera.

In an embodiment, the seals 10150 may include drip rails that may span one or more corners (e.g., the corner where the skirts 23", 24" meet the side walls 14"', 16"'). The drip rails may be an angled section configured to prevent environmental conditions from permeating the container 10000. To reinforce the drip rails, gussets (e.g., ribs) may be located between the drip rails and a surface of the container 10000.

Yet another difference between the container 10000 and the other container embodiments described herein may be that the container 10000 may have doors (e.g., doors 926" and 927" shown in FIG. 151) that are capable of folding back up to 270 degrees. To accomplish this, the doors 926", 927" may each have offset hinges. In other words, the ends of each door hinge may be spaced apart from each other such that the doors 926", 927" may have a greater degree of rotation than a standard door.

Turning now to FIGS. 159A and 159B, the end panels 12", 18" may have one or more wheels 10205 hingedly coupled thereto. The wheels 10205 may assist the movement of the end panels 12", 18" during the folding/unfolding of the container 10000. Each of the wheels 10205 may be selectively positionable between a first position where the wheel 10205 is lowered to make contact with a surface (e.g., the side walls 14"', 16"' in their folded condition) (FIG. 159A), and a second position where the wheel 10205 is raised to preclude contact of the wheel 10205 with the surface (FIG. 159B). To retain the wheels 10205 in the first and second positions, a plurality of latches 10207 (e.g., gravity style latches) may be located adjacent the wheels 10205. The latches 10207 may be selectively engaged with the wheels 10205 to prevent the wheels 10205 from undesirably changing from the first position to the second position, or vice versa.

The container 10000 may include one or more sets of tracks 7150". The tracks 7150" may be operably coupled to the side wall 14"', the side wall 16"', or both. In embodiments, there may be tracks 7150" (e.g., channeled tracks, tracks similar to the tracks 7155, etc.) corresponding to each of the wheels 10205 of the end panels 12", 18", as seen in FIG. 151. In other embodiments, there may be tracks 7150A" that may span the distance between two or more peaks of the corrugations of the side walls 14"', 16"' (FIG. 160). The tracks 7150A" may have supports extending downwards and contacting the trough of the corrugations. Such tracks 7150A" may lie (e.g., lie flush) between the peaks of the corrugations of the side wall 14"', 16"' in order to provide a surface for the wheels 10205 of the end panels 12", 18" to roll across (e.g., when moving the end panels 12", 18" from the folded condition to the unfolded condition, or vice versa). By lying flush with the corrugation peaks of the side walls 14"', 16"' (as opposed to extending beyond the corrugation peaks), the tracks 7150A" may not preclude the side walls 14"', 16"' from properly collapsing into the container 10000 folded condition.

In embodiments, the container 10000 may include ergonomic features. For example, the container 10000 panels (e.g., end panel 12") may include handles 10210 (FIG. 150) to facilitate handling of the container 10000, such as during the folding/unfolding of the container 10000. The handles 10210 may be located, for example, between (e.g., spanning the distance between) the corrugations of the panels of the container 10000.

In embodiments, as shown in FIGS. 150 and 151, there may be one or more fold assist members 7050" attached to one or more of the side panels 14"', 16"'. The fold assist members may comprise link attachment portions 7055". The link attachment portions 7055" may be configured to be coupled to a link (e.g., a rope, chain, cable, et cetera). The link may be used to assist in the folding/unfolding of the side panels 14''', 16''', such as by being attached to both a vehicle (e.g., a fork lift truck) and the link attachment portion 7055". In operation, the link attachment portions 7055" may assist in hauling, or otherwise moving, the side panels 14''', 16''' when folding/unfolding and/or transporting the container 10000. In embodiments, the unfolding/folding of the container 10000 may be accomplished without the use of a spring assisted system such as those described previously (e.g., the linear spring assemblies 771, 199, the damper assemblies 7000, 7100, etc.), and may instead be facilitated by using the link attachment portions 7055".

In embodiments, the container 10000 may include tethered twist locks 10250 (e.g., center-mounted rectangular plate twist locks) located at each of the corners of the roof panel 11", as shown in FIG. 161. The tethered twist locks 10250 may be selectively positionable between a first position where the twist lock 10250 extends upward from the roof panel 11", and a second position where the twist lock 10250 is arranged within a twist lock receptacle 10275. To accomplish this, the twist locks 10250 may be coupled to the roof panel 11" by, for example, a bracket, a lanyard, a chain, et cetera. The roof panel 11" may include an aperture at each of its corners for the twist locks 10250 to reside within when in the first position. In use, the twist locks 10250 may facilitate the stacking of multiple containers 10000 when in the first position. Accordingly, the base panel 17" may have apertures 10280 (FIG. 155) (e.g., along a bottom surface of the corner fitting 36") configured to receive the twist locks 10250 of another container 10000. When not in use, the twist locks 10250 may be stored within the twist lock receptacle 10275 (i.e., stored in the second position) so that the twist locks 10250 may not impede the unfolded operation of the container 10000.

FIGS. 162 through 169 show an embodiment 20000 of the container 10. The embodiment 20000 may be substantially similar to the container 10000 (and thus, substantially similar to the container 10), except as expressly noted and/or shown, or as would be inherent. Parts labeled 20001-29999 may be substantially similar to their corresponding parts as originally labeled without the prefix "2", "20", or "200" (e.g., the embodiment 20000 may have a base panel 20017" substantially similar to the base panel 17" of container 10000, a right side panel 20014''' substantially similar to the right side panel 14''' of container 10000, a roof panel 20011" substantially similar to the roof panel 11" of container 10000, a door 20926" substantially similar to the door 926" of container 10000, fold assist members 27050" substantially similar to the fold assist members 7050" of the container 10000, etc., as seen in FIGS. 162 and 163). Further, those skilled in the art will appreciate that the container 10000 (and thus the container 20000) may be modified in various ways, such as through incorporating all or part of any of the various described embodiments. Like previously described collapsible container embodiments, the container 20000 is selectively changeable between a "collapsed" or "folded" condition, and an "uncollapsed" or "unfolded" condition.

As discussed above, some container embodiments include a set of disparate side wall lengths to preclude the side walls from interfering with each other during a folding/unfolding operation. However, the container 20000 may alternately or additionally include a set of side walls 20014''' and 20016''' having disparate total heights to accomplish a similar goal. In some embodiments, only one of these sets of disparate features may be employed. Disparate side wall 20014''' and 20016''' heights may mean that the total height of one sidewall of the container 20000 (e.g., the height of the side wall 20014''' plus the height of the compound beam 20757") may be disparate from the total height of the other side wall (e.g., the height of the side wall 20016''' plus the height of the compound beam 20781"). For example, looking at the container 20000 in the unfolded condition as depicted in FIG. 164A, the side wall 20016''' begins (and terminates) in a different horizontal plane than the side wall 20014'''. In other words, one or more ends of the side walls 20014''' and 20016''' may be offset from each other. One difference between the embodiment 20000 and the embodiment 10000 may be that the embodiment 20000 may achieve these disparate side wall total heights by incorporating hinge-beam structures 20781''' and 20757'''. The hinge-beam structures 20781''', 20757''' may extend between their respective base beams 20781", 20757" and walls 20016''', 20014''', and may comprise any suitable beam structure now known or subsequently developed. In embodiments, the hinge-beam structures 20781''', 20757''' may have a similar construction to the compound beams 20781", 20757".

A disparity between total side wall 20014''' and 20016''' heights may preclude undue conflict between the walls 20014''' and 20016''' when the container 20000 is placed into the folded/collapsed position, as discussed herein. For example, as seen in FIG. 164B, the sidewalls 20014''' and 20016''' are placed in the folded/collapsed condition where the side wall 20016''' is laid over the side wall 20014'''. With this configuration, the side wall 20016''' may lay both against the side wall 20014''' and generally parallel with the base panel 20017". While FIG. 164A depicts an embodiment where the side walls 20014''' and 20016''' have disparate heights, embodiments where the side walls 20014''' and 20016''' have equivalent heights are contemplated herein. For example, the side walls 20014''' and 20016''' may have disparate heights in addition to or in lieu of having disparate lengths (as discussed previously). In the folded condition, the front panel 20012" and the door panel 20018" may in embodiments lay between the folded side wall 20016" and the roof panel 20011".

To accommodate the disparate heights of the side walls 20014''' and 20016''', the container 20000 may have skirts 20023" and 20024" of disparate heights such that the combined height of one side wall and its associated skirt (e.g., compound beam 20781", hinge-beam structure 20781''', side wall 20016''', and skirt 20024") is the same as the combined height of the other side wall and its associated skirt (e.g., compound beam 20757", hinge-beam structure 20757''', side wall 20014''', and skirt 20023"). The disparate heights of the skirts 20023", 20024" may correspond to the terminal ends of the side walls 20014''', 20016''' so that the roof panel 20011" lays flat when in the unfolded condition (i.e., the skirts 20023", 20024" may terminate in different horizontal planes). Alternately or additionally the right compound beam 20757" and the right hinge-beam structure 20757''' may have a combined height that is disparate from the combined height of the left compound beam 20781" and the left hinge-beam structure 20757'''. The above discussed combined heights may correspond with the heights of their respective skirts 20023" and 20024". For example, the combined height of the right compound beam 20757", right hinge-beam structure 20757''', and the right skirt 20023" may be substantially equal to the combined height of the left compound beam 20781", left hinge-beam structure 20757''', and the left skirt 20024" (i.e., the side walls 20014''' and 20016''' may be asymmetrical not necessarily because they have disparate heights but because they are vertically offset from each other). This configuration may allow the roof panel 20011" to lay flat when the container 20000 is in the folded condition, as seen in FIG. 164B. In embodiments, any suitable combination of side wall 20014'", 20016'" offsets, side wall 20014'", 20016'" heights, compound beam 20757", 20781" heights, hinge-beam structure 20757'", 20781'" heights, and skirt 20023", 20024" heights may be used in the container 20000.

To further illustrate a particular embodiment, various heights of the components depicted in FIG. 164A have been labeled. Viewed from the door end facing the front, LH1' corresponds to the height of the left compound beam 20781", LH2' corresponds to the height of the left side wall 20016'", LH3' corresponds to the height of the left skirt 20024", LH4' corresponds to the height of the left hinge-beam structure 20781'", RH1' corresponds to the height of the right compound beam 20757", RH2' corresponds to the height of the right side wall 20014", RH3' corresponds to the height of the right skirt 20023", and RH4' corresponds to the height of the right hinge-beam structure 20757'". In this embodiment, the compound beam 20757", 20781" heights RH1' and LH1" are equivalent, the hinge-beam structure 20757'", 20781'" heights RH4' and LH4' are disparate, and the skirt 20023", 20024" heights RH3' and LH3' are disparate. Meanwhile, the side walls 20014'" and 20016'" heights RH2' and LH2' are equal. For the roof panel 20011" to lie horizontal (i.e., flat) in the unfolded condition, each of the total heights of the unfolded wall panels 20014'", 20016'" must be equal (i.e., LH1'+LH2'+LH3'+LH4'=RH1'+RH2'+RH3'+RH4'). For the roof panel 20011" to lie horizontal (i.e., flat) in the folded condition, each of the total heights of the side walls minus the heights of the right side panel 20014'" and the left side panel 20016'" must be equal (i.e., LH1'+LH3'+LH4'=RH1'+RH3'+RH4'). That is, since in the folded configuration the side panels 20014'" and 20016'" do not contribute to the height of the folded container (see FIG. 164B), LH1'+LH3'+LH4' must equal RH1'+RH3'+RH4' for the roof panel 20011" to lay flat. Thus, the combined height of the left skirt 20024", the left hinge-beam structure 20781'", and the left compound beam 20781" may be equivalent to the combined height of the right skirt 20023", the right hinge-beam structure 20757'", and the right compound beam 20757".

To facilitate the folding and unfolding of the container 20000, the side walls 20014'" and 20016'" may be coupled to the base 20017" through a hinge system 27200" (also referred to as one or more "hinge points") (FIGS. 164A and 164B). More specifically, there may be a plurality of base left hinge members 27210" attached to the left side of the base 20017" (e.g., attached to the hinge-beam structure 20781'"), which may correspond to a plurality of left hinge members 27220" attached to the left side panel 20016'". Each of these pluralities of hinge members 27210", 27220" may be rotatably coupled via a left hinge pin 27215" to allow for rotation of the left side panel 20016'" relative to the base 20017". In some embodiments, the left hinge pin 27215" is removable. The removable left hinge pin 27215" may allow for separation of the left side wall 20016'" from the base panel 20017".

Similar in design and function to the left side, the hinge system 27200" may also include a plurality of base right hinge members 27230" attached to the right side of the base 20017" (e.g., attached to the hinge-beam structure 20757'"), which may correspond to a plurality of right hinge members 27240" attached to the right side panel 20014'". Each of these pluralities of hinge members 27230" and 27240" may be rotatably coupled via a right hinge pin 27235", to allow for rotation of the right side panel 20014'" relative to the base 20017". In some embodiments, the right hinge pin 27235" is removable. The removable right hinge pin 27235" may allow for separation of the right side wall 20014'" from the base panel 20017".

As illustrated in FIG. 164A, the locations of the left and right side hinge systems 27200" may correspond to the combined heights of the compound beams 20757", 20781" and the hinge-beam structures 20757'", 20781'". That is, the left and right side hinge systems 27200" may lay in different horizontal planes. For example, in an embodiment, the left side hinge system (e.g., parts 27210", 27215", and 27220") may be vertically higher than the right side hinge system (e.g., parts 27230", 27235", and 27240").

While the embodiment depicted in FIGS. 164A and 164B have the side panels 20014'", 20016'" rotating about their respective edges, other points of rotation are contemplated herein. For example, the hinge systems 27200" may be incorporated within the structure of the panels 20014'", 20016'" and the hinge-beam structures 20757'", 20781'" such that each of the panels 20014'", 20016" rotate about a midway point along their width, as seen in FIG. 165. That is, the left side hinge pin 27215" lies within a midline of the left side panel 20016'" and/or the left-side hinge beam structure 20781'", and the right side hinge pin 27230" lies within a midline of the right side panel 20014'" and/or the right-side hinge beam structure 27057'". In such cases, the hinge-beam structures 20781'" and 20757'" may include retaining portions 20781'"" and 20757'"", respectively. These retaining portions 20781'"", 20757'"" may receive the skirts 20024", 20023" when the container 20000 is in the folded condition. To seal and protect the container 20000 from the elements, the container 20000 may include seals 20150 that may be the same or similar to the seals 10150 of the container 10000. In embodiments, the seals 20150 may alternately or additionally comprise seals such as those manufactured by Trim-Lok, Inc. of Buena Park, California, which may require the use of seal attachment bars.

To assist with securing the container 20000 in the folded and/or the unfolded condition, the container 20000 may include locking mechanisms. For example, the locking mechanisms may be one or more hammer locking mechanisms 20025, as seen in FIG. 166. The hammer locking mechanisms 20025 may operate in a substantially similar matter as the hammer locking mechanisms 10025 of the container 10000 (e.g., each of the hammer locking mechanisms 20025 may selectively engage with an end panel 20012" or 20018", e.g., a corner post 26002" thereof, and may include a locking body 20027, a locking body bar 20029, and a hammer locking mechanism catch 20030). In this manner, the hammer locking mechanisms 20025 may secure (or otherwise retain) the container 20000 in the unfolded position (e.g., by removably securing the base panel 20017" to one or more of the side panels 20016'", 20014'"). Alternately or additionally, each of the hammer locking mechanisms 20025 may each selectively engage with a roof skirt 20023" or 20024" when the container 20000 is in the folded condition. By engaging with the roof skirts 20023" and 20024", the hammer locking mechanisms 20025 may removably couple the base panel 20017" to the roof skirts 20023", 20024", securing (or otherwise retaining) the container 20000 in the folded position.

Turning now to FIG. 167, anti-racking features 27250" may be included in the container 20000, alternately or in addition to other anti-racking features described herein (e.g., anti-racking plates 7255 as seen in FIG. 144, or the anti-racking features 7250" as seen in FIG. 156). The anti-racking features 27250" may include, for example, one or more anti-racking plates (or angled extenders) 20050 arranged along the side walls 20014''' and 20016''' for engaging with one or more corresponding anti-racking receivers 20055 located on the skirts 20023" and 20024". The anti-racking plates 20050 and receivers 20055 may help mitigate undesirable container 20000 motion (e.g., bending, twisting, etc.) in one or more planes (e.g., the vertical and horizontal plane), such as when the container 20000 is experiencing a tensile load. To improve the anti-racking capabilities of the plate 20050, the plate 20050 may include one or more tapered edges 20060 that may slot with the receivers 20055. Furthermore, a top plate 20145 may be situated above the plate 20050 (e.g., on top of the receivers 20055). The top plate 20145 may preclude the plate 20050 from moving too much in a vertical direction, such as when the container 20000 shifts from external forces.

Embodiments of the anti-racking features 27250" may alternately or additionally include plates and/or angles located along one or more frames of the end panels 20012", 20018" to mitigate undesirable forces acting on the container 20000, such as those that would originate from an internal pressure of the container 20000. For example, the panels 20012" and/or 20018" may include one or more anti-racking plates and/or angles along a bottom edge thereof to withstand interior pressure of the container 20000.

Like embodiment 10000, the container 20000 may use a plurality of side wall latches 20105 in a side wall latch system 20100 (FIGS. 168A and 168B) to secure the side walls 20014''', 20016''' to the roof panel 20011" (e.g., to the side skirts 20023", 20024" thereof). However, unlike the side wall latches 10105, the side wall latches 20105 may operate by rotating a latch handle 20115, shown in FIG. 168A in a locked position, in a vertical plane to cause a displacing portion 20130 to move. When the displacement portion 20130 moves, it displaces a latch bar 20110 in turn (i.e., in a direction opposite the motion of the latch handle 20115). This may cause the latch bar 20100 to engage or disengage a skirt-bar retention portion 20140 (FIG. 168B). In some embodiments, the latch handle 20115 may include a curved portion 20117, which may allow the latch handle 20115 to abut the latch bar 20110 when the latch bar 20110 is rotated up into an unlocked position.

Each of the latch bars 20110 may selectively engage with the roof skirts 20023", 20024" via a skirt-bar retention portion 20140. The skirt-bar retention portions 20140 may be part of the skirts 20023", 20024", and may receive and/or retain the latch bar 20110 when the latch bar 20110 is moved into the locked position, as shown in FIG. 168B. In doing so, the latch system 20100 may secure the side walls 20014''', 20016''' to the roof panel 20011" when the container 20000 is in the unfolded condition. To mitigate misalignment of the latch bars 20110 with the skirt-bar retention portions 20140, the latch bars 20110 may include tapered ends 20112. If a misalignment were to occur when the latch bar is transitioning from the unlocked state to the locked state, the latch bar tapered end 20112 may bias the latch bar 20110 into the proper position. Latch bar 20110 misalignment may also be precluded through the use of latch bar guides 20114. The latch bar guide 20114 may be any suitable tube, partition, surface, edge, etc. now known or subsequently developed to retain the latch bar 20110 in the correct position.

To operate the side wall latch system 20100, the latch handle 20115 may be manipulated (e.g., rotated) into another position. In doing so, the latch bar 20110 is selectively engaged or disengaged with the skirts 20023", 20024". Once the latch handle 20115 has been moved into the new position, the latch handle 20115 may retain itself there. The side wall latch 20105 may thus be selectively locked in an engaged or disengaged position with the skirts 23" or 24". For example, the latch handle 20115 may be rotated downwards to push the latch bar 20110 upwards to engage the skirts 20023", 20024".

An advantage of the side wall latch system 20100 may be that the latch system 20100 may removably secure the side walls 20014''' and 20016''' to the roof panel 20011" via the skirts 20023" and 20024". The latch handle 20115 itself may prevent the latch bar 20110 from undesirably disengaging, such as by preventing latch bar 20110 disengagement when there is cargo inside the container 20000. The latch handle 20115 may advantageously act as a lever arm to magnify the force applied by an operator, assisting with operator engagement and disengagement of the side walls 20014''', 20016''' from the skirts 20023", 20024". Furthermore, the tapered ends 20112 and the skirt-bar retention portions 20140 may work together to preclude misalignment of the side wall latch systems 20100. The skirt-bar retention portion 20140 may also serve to mitigate (e.g., with one or more anti-racking plates) some or all of the undesirable compressive, tensile, and/or lateral forces experienced by the side wall latch systems 20100.

Additionally, overlapping surfaces of the skirts 20023", 20024" and the side walls 20014''', 20016''' may be pressed together when the side wall latch system 20100 is engaged. In operation, these mating surfaces, along with any seals 20150 (e.g., tubing, channel seals, clip seals, etc.) placed between them, may prevent environmental elements (e.g., humidity and other moisture) from infiltrating the container 20000 at the seams between the side walls 20014''', 20016''' and the skirts 20023", 20024". Further, unlike the latch system 10100, the latch system 20100 may not require "cut outs" or any other kind of modification to the container walls, besides the mounting of the latches 20100 themselves. Therefore, the cost of manufacturing and/or retrofitting the latch system 20100 may be relatively low.

While a single side wall latch system 20100 is depicted in the figures, the artisan will understand that the container 20000 may include any suitable number of side wall latch systems 20100 arranged (e.g., internally and/or externally) along the side wall 20014''', the side wall 20016''', or both. For example, in an embodiment, the side walls 20014''' and 20016''' may each have eight side wall latch systems 20100.

Another difference between the container 20000 and the other container embodiments described herein may be that the embodiment 20000 may include additional reinforcements to its construction. For example, post (e.g., corner posts 6002", etc.) walls may have an approximate thickness of about 40 mm, and may have a unitary construction.

Turning now to FIG. 169, an alignment tab system 20500 is shown. The alignment tab system 20500 may comprise one or more tabs 20525 and corresponding slots 20550 in each of the side panels 20014'''', 20016''', the roof panel 20011", the base panel 20017", the front panel 20012", and/or the door panel 20018". In operation, the tabs 20525 and corresponding slots 20550 in the container 20000 panels may facilitate alignment of the panels during assembly of the container 20000 in the unfolded condition. Any suitable combination and number of tabs 20525 and slots 20550 arranged on the panels of the container 20000 is contemplated herein (e.g., a panel with all tabs 20525 and no slots 20550, a panel with no tabs 20525 and all slots 20550, a panel with both tabs 20525 and slots 20550, some panels of the container 20000 having tabs 20525 and/or slots 20550 while other panels of the container 20000 have neither, et cetera).

Figure 63:
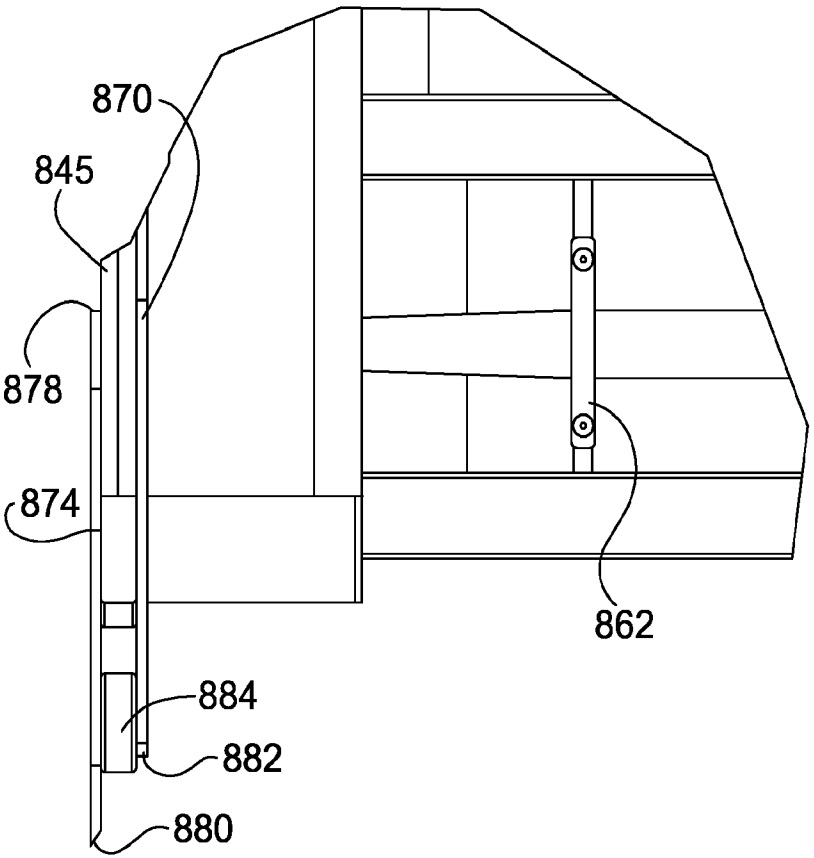
FIG. 63 is an inside view of the left interlock of the front panel.
Figure 66:
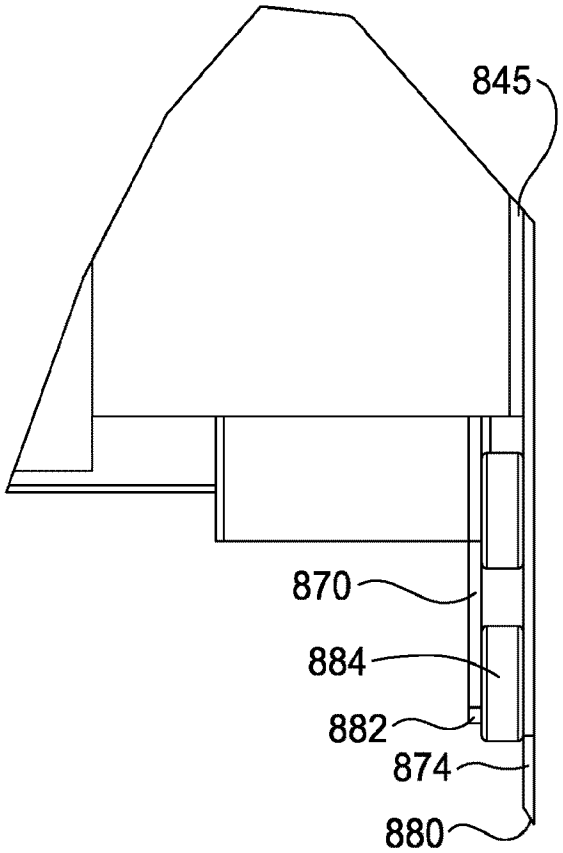
FIG. 66 is an end view of the roller arm cover plate of the front left post.
Figure 65:
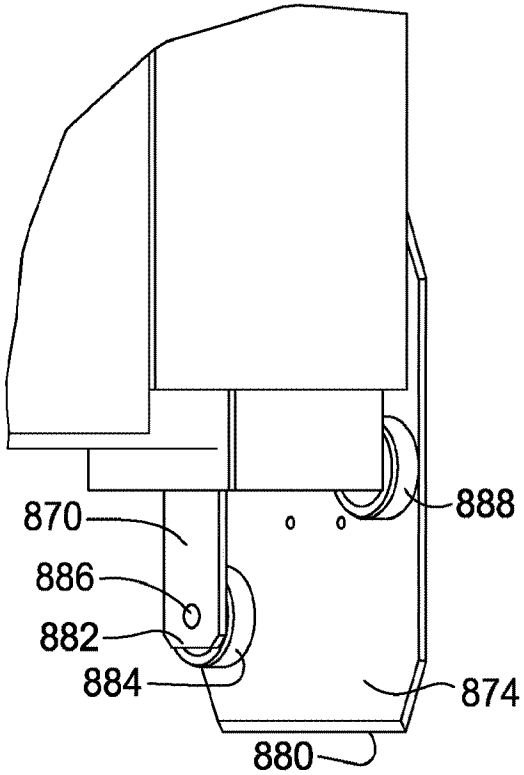
FIG. 65 is a perspective view of the roller arm cover plate of the front left post.
Figure 64:
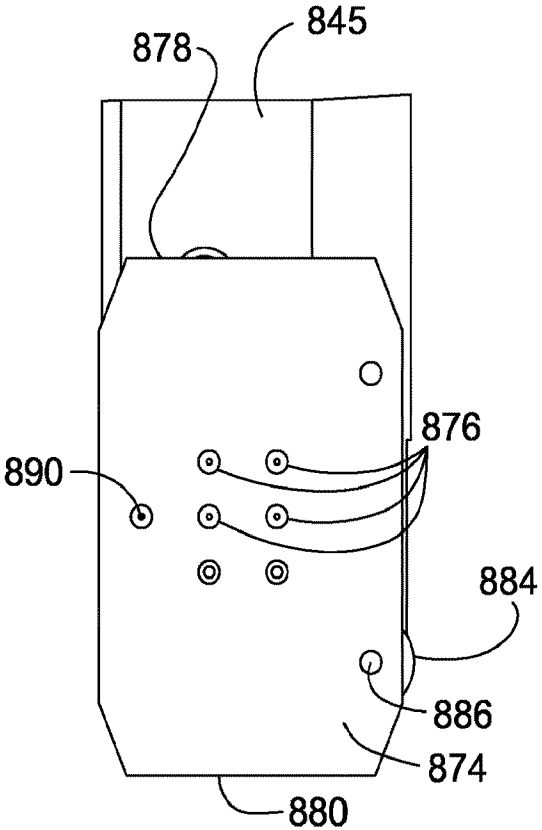
FIG. 64 is an external view of the roller arm cover plate of the front left post.

The container 20000 may include one or more sets of tracks 27150" (FIG. 63). The tracks 27150" may be operably coupled to the side wall 20014'", the side wall 20016'", or both. In embodiments, there may be tracks 27150" (e.g., channeled tracks, tracks similar to the tracks 7155, etc.) corresponding to each of the wheels 10205 of the end panels 20012", 20018". The tracks 27150" may provide a surface for the wheels 10205 of the end panels 20012", 20018" to roll across (e.g., when moving the end panels 20012", 20018" from the folded condition to the unfolded condition, or vice versa).

The above description clearly establishes the advantages provided by the present disclosure which need not be explained in greater detail to those skilled in the art, who will also recognize that various design modifications and differing components can be introduced within the scope of the present disclosure as set forth below.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims. Not all steps listed in the various figures need be carried out in the specific order described.

The invention claimed is:

1. A foldable container adjustable between an unfolded condition and a folded condition, comprising:

a roof panel and an opposing base panel;

a front panel and an opposing door panel, each of said front panel and said door panel hingedly connected to solely said roof panel;

a left side compound beam and a right side compound beam, each of said left side compound beam and said right side compound beam extending from said base panel;

a left side hinge-beam structure extending from said left side compound beam, said left side hinge-beam structure having a left side hinge point and a first skirt retaining portion;

a right side hinge-beam structure extending from said right side compound beam, said right side hinge-beam structure having a right side hinge point and a second skirt retaining portion;

a right side panel and an opposing left side panel, said right side panel being hingedly coupled to said right side hinge-beam structure at said right side hinge point, and said left side panel being hingedly coupled to said left side hinge-beam structure at said left side hinge point; and a right side roof skirt associated with said right side panel and an opposing left side roof skirt associated with said left side panel, a height of said right side roof skirt being disparate from a height of said left side roof skirt;

wherein:

said right side hinge point and said left side hinge point lie in different horizontal planes;

said right side hinge point lies within a midline of said right side panel; and said left side hinge point lies within a midline of said left side panel.

2. The foldable container of claim 1, further comprising a plurality of side wall latch systems arranged on at least one of said right side panel and said left side panel, each of said plurality of side wall latch systems being selectively engageable for coupling said roof panel with the at least one of said right side panel and said left side panel, each of said plurality of side wall latch systems having a latch bar with a tapered end, said tapered end configured to facilitate locking of the at least one of said right side panel and said left side panel to said roof panel when said foldable container is in said unfolded condition.

3. The foldable container of claim 2, wherein each of said plurality of side wall latch systems further comprises a latch handle configured to provide a lever force on said latch bar when operated.

4. The foldable container of claim 3, wherein said latch handle is configured to displace said latch bar in a first direction when said latch handle is moved in a second direction opposing the first direction.

5. The foldable container of claim 1, further comprising tracks on at least one of said left side panel and said right side panel, said tracks corresponding to wheels on one of said front panel and said door panel.

6. The foldable container of claim 1, further comprising a plurality of sets of tracks on said right side panel, one of said plurality of sets of tracks configured to guide wheels associated with said front panel and another of said plurality of sets of tracks configured to guide wheels associated with said door panel when said container is being placed in the folded condition.

7. The foldable container of claim 1, wherein each of said right side panel and said left side panel comprises a link attachment portion configured to allow for the attachment of a link for folding said foldable container.

8. The foldable container of claim 1, wherein each of said left side panel and said right side panel is corrugated.

9. The foldable container of claim 1, wherein:

at least one of said right side panel and said left side panel further comprise a tapered anti-racking angle extending from a top part; and at least one of said right side roof skirt and said left side roof skirt comprise an anti-racking receiver configured to receive said tapered anti-racking angle; and said tapered anti-racking angle is received within said anti-racking receiver when said foldable container is in said unfolded condition.

10. The foldable container of claim 1, further comprising an alignment tab associated with one of said right side panel and said left side panel, and an alignment slot associated with said roof panel, said alignment slot being configured to receive said alignment tab when the foldable container is in the unfolded condition.

11. The foldable container of claim 1, further comprising securing means configured to secure said skirts to said base panel when said foldable container is in said folded condition.

12. The foldable container of claim 11, wherein an aperture associated with one of said skirts aligns with an aperture associated with said base panel when said foldable container is in said folded condition to allow for the passage of a lock therethrough.

13. The foldable container of claim 12, wherein said lock is a hammer locking mechanism.

14. The foldable container of claim 13, wherein an aperture associated with one of said front panel and said door panel aligns with said hammer locking mechanism to allow for the passage of said hammer locking mechanism therethrough when said foldable container is in said unfolded condition.

15. A foldable container adjustable between an unfolded condition and a folded condition, comprising:

a roof panel and an opposing base panel;

a front panel and an opposing door panel, each of said front panel and said door panel hingedly connected to solely said roof panel;

a first side panel and an opposing second side panel, said first side panel being offset from said second side panel by a vertical distance;

a first skirt retaining portion situated outwardly adjacent said first side panel;

a second skirt retaining portion situated outwardly adjacent said second side panel;

a first roof skirt associated with a top of said first side panel and an opposing second roof skirt associated with a top of said second side panel, said first roof skirt and said second roof skirt having a height difference; and a set of tracks situated on said first side panel;

wherein:

in said folded condition, said second side panel is upwardly adjacent said base panel, said first side panel is upwardly adjacent said second side panel, a group comprising said front panel and said door panel is upwardly adjacent said first panel, said roof panel is upwardly adjacent said group, said first roof skirt is received within said first skirt retaining portion, and said second roof skirt is received within said second skirt retaining portion; and said vertical distance equals said height difference.

16. The foldable container of claim 15, further comprising a seal located at a seam, said seam being located between said one of said first side panel and said second side panel and one of said first roof skirt and said second roof skirt.

17. The foldable container of claim 15, further comprising a plurality of interior locking bolt assemblies for securing each of said first side panel and said second side panel to said roof panel when said container is in said unfolded condition.

18. The foldable container of claim 15, wherein:

at least one of said right side panel and said left side panel further comprise a tapered anti-racking angle extending from a top part; and at least one of said right side roof skirt and said left side roof skirt comprise an anti-racking receiver configured to receive said tapered anti-racking angle;

wherein said tapered anti-racking angle is received within said anti-racking receiver when said foldable container is in said unfolded condition.

19. The foldable container of claim 15, further comprising a plurality of hinges for removably coupling said base panel to said first side panel and said second side panel.

* * * * *